US009963770B2

(12) United States Patent
Rios et al.

(10) Patent No.: US 9,963,770 B2
(45) Date of Patent: May 8, 2018

(54) CASTABLE HIGH-TEMPERATURE CE-MODIFIED AL ALLOYS

(71) Applicants: UT-Battelle, LLC, Oak Ridge, TN (US); Eck Industries, Inc., Manitowoc, WI (US); Lawrence Livermore National Laboratory, Industrial Partnership Office, Livermore, CA (US); Iowa State University Research Foundation, Inc., Ames, IA (US)

(72) Inventors: Orlando Rios, Knoxville, TN (US); Alexander H. King, Ames, IA (US); Scott K. McCall, Livermore, CA (US); Michael A. McGuire, Knoxville, TN (US); Zachary C. Sims, Knoxville, TN (US); Cori Thorne, Manitowoc, WI (US); David Weiss, Manitowoc, WI (US); Gerard M. Ludtka, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 72 days.

(21) Appl. No.: 15/204,169

(22) Filed: Jul. 7, 2016

(65) Prior Publication Data

US 2017/0096730 A1 Apr. 6, 2017

Related U.S. Application Data

(60) Provisional application No. 62/190,301, filed on Jul. 9, 2015.

(51) Int. Cl.
*B22D 21/04* (2006.01)
*C22C 1/02* (2006.01)
(Continued)

(52) U.S. Cl.
CPC ..... *C22F 1/047* (2013.01); *B22D 21/007* (2013.01); *C22C 1/026* (2013.01); *C22C 21/06* (2013.01)

(58) Field of Classification Search
CPC ..... B22D 21/007; C22C 1/026; C22C 21/00–21/18
See application file for complete search history.

(56) References Cited

U.S. PATENT DOCUMENTS 2,272,779 A 2/1942 Sarbey
2,656,270 A 10/1953 Russell
(Continued)

FOREIGN PATENT DOCUMENTS

CN 1171453 1/1998
GB 1211467 11/1970
(Continued)

OTHER PUBLICATIONS

Faruk Mert, et al., "Influence of Cerium Additions on the Corrosion Behaviour of High Pressure Die Cast AM50 Alloy," Corrosion Science, 2012, pp. 145-151, vol. 65.
(Continued)

*Primary Examiner* — George Wyszomierski
*Assistant Examiner* — Janelle Morillo
(74) *Attorney, Agent, or Firm* — Edna I. Gergel; Joseph A. Marasco

(57) ABSTRACT

A cast alloy includes aluminum and from about 5 to about 30 weight percent of at least one material selected from the group consisting of cerium, lanthanum, and mischmetal. The cast alloy has a strengthening $Al_{11}X_3$ intermetallic phase in an amount in the range of from about 5 to about 30 weight percent, wherein X is at least one of cerium, lanthanum, and mischmetal. The $Al_{11}X_3$ intermetallic phase has a microstructure that includes at least one of lath features and rod
(Continued)

morphological features. The morphological features have an average thickness of no more than 700 um and an average spacing of no more than 10 um, the microstructure further comprising an eutectic microconstituent that comprises more than about 10 volume percent of the microstructure.

49 Claims, 135 Drawing Sheets

(51) Int. Cl.

| | |
|---|---|
| ***C22C 21/00*** | (2006.01) |
| ***C22F 1/047*** | (2006.01) |
| ***C22C 21/06*** | (2006.01) |
| ***B22D 21/00*** | (2006.01) |

(56) References Cited

U.S. PATENT DOCUMENTS

| | | | |
|---|---|---|---|
| 3,964,935 | A | 6/1976 | Wilks |
| 4,464,199 | A | 8/1984 | Hildeman et al. |
| 4,743,317 | A | 5/1988 | Skinner et al. |
| 4,805,686 | A | 2/1989 | Skinner et al. |
| 4,832,737 | A | 5/1989 | Mathy et al. |
| 4,948,558 | A | 8/1990 | Skinner et al. |
| 5,037,608 | A | 8/1991 | Tarcy |
| 5,074,935 | A | 12/1991 | Masumoto et al. |
| 5,284,532 | A | 2/1994 | Skinner |
| 5,320,688 | A | 6/1994 | Masumoto et al. |
| 5,368,658 | A | 11/1994 | Masumoto et al. |
| 7,875,131 | B2 | 1/2011 | Pandey |
| 2003/0183306 | A1 | 10/2003 | Hehmann et al. |
| 2004/0238150 | A1 | 12/2004 | Adachi et al. |
| 2005/0167011 | A1 | 8/2005 | Saha et al. |
| 2009/0288796 | A1 | 11/2009 | Song et al. |
| 2010/0221141 | A1 | 9/2010 | Tonn et al. |
| 2012/0152414 | A1 | 6/2012 | Che et al. |

FOREIGN PATENT DOCUMENTS

| | | |
|---|---|---|
| JP | 2003293108 | 10/2003 |
| JP | 3726258 | 12/2005 |

OTHER PUBLICATIONS

Michael C. Gao, et al., "Reassessment of Al—Ce and Al—Nd Binary Systems Supported by Critical Experiments and First-Principles Energy Calculations," Metallurgical and Materials Transactions A, 2005, pp. 3269-3279, vol. 36A.

Zhang, "Effect of Substituting Cerium-Rich Mischmetal with Lanthanum on Microstructure and Mechanical Properties of Die-Cast Mg-Al-Re Allows," Materials and Design, 2009. pp. 2372-2378, vol. 30, Issue 7.

PCT International application No. PCT/US2016/041293, International Search Report, dated Nov. 17, 2016.

PCT International application No. PCT/US2016/041293, Written Opinion of the International Searching Authority, dated Nov. 17, 2016.

3
27
19
5
DC
5
V
19
27
3
DC
5
V
19
27
3
DC
5
V
19
27
3

REPLACEMENT SHEET

CASTABLE HIGH-TEMPERATURE CE-MODIFIED AL ALLOYS

STATEMENT REGARDING FEDERALLY SPONSORED RESEARCH

This invention was made with Government support under DE-AC05-00OR22725 and DE-AC02-07CH11358, and DE-AC52-07NA27344 awarded by the United States Department of Energy. The Government has certain rights in the invention.

NAMES OF PARTIES TO A JOINT RESEARCH AGREEMENT

The invention arose under an agreement between UT-Battelle, LLC (Oak Ridge National Laboratory), Lawrence Livermore National Security, LLC, Iowa State University of Science and Technology (Ames Laboratory), and Eck Industries, Inc., funded by the Critical Materials Institute of the United States Department of Energy.

BACKGROUND OF THE INVENTION

Aluminum alloys have been developed to increase the operating temperature thereof, but are at present limited to applications below 230° C. due to rapid loss of mechanical characteristics. There is a need for aluminum alloys that have good castability and maintain mechanical characteristics above that temperature.

BRIEF SUMMARY OF THE INVENTION

In accordance with one aspect of the present invention, the foregoing and other objects are achieved by a cast alloy that includes aluminum and from about from about 5 to about 30 weight percent of at least one of cerium, lanthanum, and mischmetal. The cast alloy has a strengthening $Al_{11}X_3$ intermetallic phase in an amount in the range of from about 5 to about 30 weight percent, wherein X is at least one of cerium, lanthanum, and mischmetal. The $Al_{11}X_3$ intermetallic phase has a microstructure that includes at least one of lath features and rod morphological features. The morphological features have an average thickness of no more than 700 um and an average spacing of no more than 10 um, the microstructure further comprising an eutectic microconstituent that comprises more than about 10 volume percent of the microstructure.

Moreover, a method of making a cast alloy includes the steps of:

a. heating preselected amounts of aluminum and at least one additional alloying element selected from the group consisting of silicon, zinc, iron, titanium, zirconium, vanadium, magnesium, copper, and nickel to a molten state to form a melt;
b. degassing the melt with a reactive gas in order to purge the melt of undesirable dissolved materials and bring the melt to greater than 90% theoretical density;
c. further degassing the melt with a nonreactive gas to remove the reactive gas;
d. fluxing the melt with an alkaline based flux to remove dissolved gases and undesirable solids;
e. testing theoretical density of the melt, and if the theoretical density:
   i. does not exceed 70% theoretical density, repeat steps b, c, d, and e;
   ii. exceeds 70% theoretical density, but does not exceed 90% theoretical density, repeat steps c, d, and e;
   iii. exceeds 90% theoretical density, go to step f;
f. adding to the melt a preselected amount of at least one material selected from the group consisting of cerium, lanthanum, and mischmetal;
g. degassing the melt with a nonreactive gas;
h. fluxing the melt with an alkaline based flux to remove dissolved gases and undesirable solids;
j. testing theoretical density of the melt, and if the theoretical density:
   i. does not exceed 90% theoretical density, repeat steps g, h, and j;
   ii. exceeds 90% theoretical density, go to step k; and
k. transferring the melt into a casting mold to form a cast alloy including: aluminum and from about 5 to about 30 weight percent of at least one material selected from the group consisting of cerium, lanthanum, and mischmetal, the cast alloy having a strengthening $Al_{11}X_3$ intermetallic phase in an amount in the range of from about 5 to about 30 weight percent, wherein X is at least one material selected from the group consisting of cerium, lanthanum, and mischmetal, the $Al_{11}X_3$ intermetallic phase having a microstructure including at least one morphological feature selected from the group consisting of lath features and rod features, the features having an average thickness of no more than 700 um and an average lath spacing of no more than 10 um, the microstructure further comprising an eutectic microconstituent that comprises more than about 10 volume percent of the microstructure.

Moreover, a method of making a cast alloy includes the steps of:

a. heating a predetermined amount of aluminum;
b. degassing the melt with a reactive gas in order to purge the melt of undesirable dissolved materials;
c. further degassing the melt with a nonreactive gas to remove the reactive gas;
d. testing theoretical density of the melt, and if the theoretical density:
   i. does not exceed 70% theoretical density, repeat steps c and d;
   ii. exceeds 70% theoretical density, but does not exceed 90% theoretical density, repeat steps b, c, and d;
   iii. exceeds 90% theoretical density, go to step f;
e. adding to the melt a predetermined amount of at least one material selected from the group consisting of cerium, lanthanum, and mischmetal;
f. degassing the melt with a nonreactive gas;
g. fluxing the melt with an alkaline based flux to remove dissolved gases and undesirable solids;
h. testing theoretical density of the melt, and if the theoretical density:
   i. does not exceed 90% theoretical density, repeat steps f, g, and h;
   ii. exceeds 90% theoretical density, go to step j;
j. adding a predetermined amount of at least one additional alloying element selected from the group consisting of silicon, zinc, iron, titanium, zirconium, vanadium, magnesium, copper, and nickel to the melt;
k. degassing the melt with a nonreactive gas;
l. fluxing the melt with an alkaline based flux to remove dissolved gases and undesirable solids;
m. testing theoretical density of the melt, and if the theoretical density:
   i. does not exceed 90% theoretical density, repeat steps k, l and m;
   ii. exceeds 90% theoretical density, go to step n; and n. transferring the melt into a casting mold to form a cast alloy including: aluminum and from about 5 to about 30 weight percent of at least one material selected from the group consisting of cerium, lanthanum, and mischmetal, the cast alloy having a strengthening $Al_{11}X_3$ intermetallic phase in an amount in the range of from about 5 to about 30 weight percent, wherein X is at least one material selected from the group consisting of cerium, lanthanum, and mischmetal, the $Al_{11}X_3$ intermetallic phase having a microstructure including at least one morphological feature selected from the group consisting of lath features and rod features, the features having an average thickness of no more than 700 um and an average lath spacing of no more than 10 um, the microstructure further comprising an eutectic microconstituent that comprises more than about 10 volume percent of the microstructure.

Moreover, a method of making a cast alloy includes the steps of:

a. heating predetermined amounts of aluminum and at least one additional alloying element selected from the group consisting of silicon, iron, titanium, zirconium, vanadium, copper, and nickel to a molten state to form a melt;
b. degassing the melt with a reactive gas in order to purge the melt of undesirable dissolved materials;
c. fluxing the melt with an alkaline based flux to remove dissolved gases and undesirable solids;
d. testing theoretical density of the melt, and if the theoretical density:
   i. does not exceed 90% theoretical density, repeat steps b, c, and d;
   ii. exceeds 90% theoretical density, go to step e;
e. adding to the melt a predetermined amount of at least one material selected from the group consisting of magnesium and zinc;
f. degassing the melt with a reactive gas in order to purge the melt of undesirable dissolved materials;
g. further degassing the melt with a nonreactive gas to remove the reactive gas;
h. fluxing the melt with an alkaline based flux to remove dissolved gases and undesirable solids;
j. testing theoretical density of the melt, and if the theoretical density:
   i. does not exceed 70% theoretical density, repeat steps f, g, h, and j;
   ii. exceeds 70% theoretical density, but does not exceed 90% theoretical density, repeat steps g, h, and j;
   iii. exceeds 90% theoretical density, go to step k;
k. adding to the melt a predetermined amount of at least one material selected from the group consisting of cerium, lanthanum, and mischmetal;
l. degassing the melt with a nonreactive gas;
m. fluxing the melt with an alkaline based flux to remove dissolved gases and undesirable solids;
n. testing theoretical density of the melt, and if the theoretical density:
   i. does not exceed 90% theoretical density, repeat steps l, m and n;
   ii. exceeds 90% theoretical density, go to step o; and
o. transferring the melt into a casting mold to form a cast alloy including: aluminum, up to 12 weight percent magnesium, up to 7 weight percent zinc, and from about 5 to about 30 weight percent of at least one material selected from the group consisting of cerium, lanthanum, and mischmetal, the cast alloy having a strengthening $Al_{11}X_3$ intermetallic phase in an amount in the range of from about 5 to about 30 weight percent, wherein X is at least one material selected from the group consisting of cerium, lanthanum, and mischmetal, the $Al_{11}X_3$ intermetallic phase having a microstructure including at least one morphological feature selected from the group consisting of lath features and rod features, the features having an average thickness of no more than 700 um and an average lath spacing of no more than 10 urn, the microstructure further comprising an eutectic microconstituent that comprises more than about 10 volume percent of the microstructure.

Moreover, a method of making a cast alloy includes the steps of:

a. heating predetermined amounts of aluminum and at least one additional alloying element selected from the group consisting of silicon, iron, titanium, zirconium, vanadium, copper, and nickel to a molten state to form a melt;
b. degassing the melt with a reactive gas in order to purge the melt of undesirable dissolved materials;
c. fluxing the melt with an alkaline based flux to remove dissolved gases and undesirable solids;
d. testing theoretical density of the melt, and if the theoretical density:
   i. does not exceed 90% theoretical density, repeat steps b, c, and d;
   ii. exceeds 90% theoretical density, go to step e;
e. adding to the melt a predetermined amount of at least one material selected from the group consisting of cerium, lanthanum, and mischmetal;
f. degassing the melt with a nonreactive gas;
g. fluxing the melt with an alkaline based flux to remove dissolved gases and undesirable solids;
h. testing theoretical density of the melt, and if the theoretical density:
   i. does not exceed 90% theoretical density, repeat steps f, g, and h;
   ii. exceeds 90% theoretical density, go to step j;
j. adding to the melt a predetermined amount of at least one material selected from the group consisting of magnesium and zinc;
k. degassing the melt with a nonreactive gas;
l. fluxing the melt with an alkaline based flux to remove dissolved gases and undesirable solids;
m. testing theoretical density of the melt, and if the theoretical density:
   i. does not exceed 90% theoretical density, repeat steps k, l and m;
   ii. exceeds 90% theoretical density, go to step n; and
n. transferring the melt into a casting mold to form a cast alloy including: aluminum, up to 12 weight percent magnesium, up to 7 weight percent zinc, and from about 5 to about 30 weight percent of at least one material selected from the group consisting of cerium, lanthanum, and mischmetal, the cast alloy having a strengthening $Al_{11}X_3$ intermetallic phase in an amount in the range of from about 5 to about 30 weight percent, wherein X is at least one material selected from the group consisting of cerium, lanthanum, and mischmetal, the $Al_{11}X_3$ intermetallic phase having a microstructure including at least one morphological feature selected from the group consisting of lath features and rod features, the features having an average thickness of no more than 700 um and an average lath spacing of no more than 10 um, the microstructure further comprising an eutectic microconstituent that comprises more than about 10 volume percent of the microstructure.

Amounts of various constituents in the alloys described herein are expressed in weight percent unless otherwise noted.

BRIEF DESCRIPTION OF THE DRAWINGS

FIG. 120 is a plot showing yield vs tensile maintenance of various alloys at 200° C.

FIG. 121 is an SEM image of Al-12Ce in the as-cast condition.

FIG. 122 is an SEM image of fracture surface of as-cast Al-12Ce.

FIG. 123 is an SEM image of Al-16Ce in the as-cast condition.

FIG. 124 is an SEM image of fracture surface of as-cast Al-16Ce.

FIG. 125 is a graph showing DSC and thermogravimetric (TG) curves for Al-8Ce.

FIG. 126 is a graph showing DSC and TG curves for Al-8Ce-7Mg.

FIG. 127 is a graph showing DSC and TG curves for Al-8Ce-10Mg-2.5Zn.

FIG. 128 is a graph showing cooling curves for cast Al-8Ce-10Mg.

FIG. 129 is a graph comparing magnetic behavior of as-cast samples.

FIG. 130 is a graph showing effect of annealing on the magnetic behavior of Al-8Ce-7Mg.

FIG. 131 is a graph showing effect of annealing on the magnetic behavior of Al-8Ce-10Mg.

Figure 132:
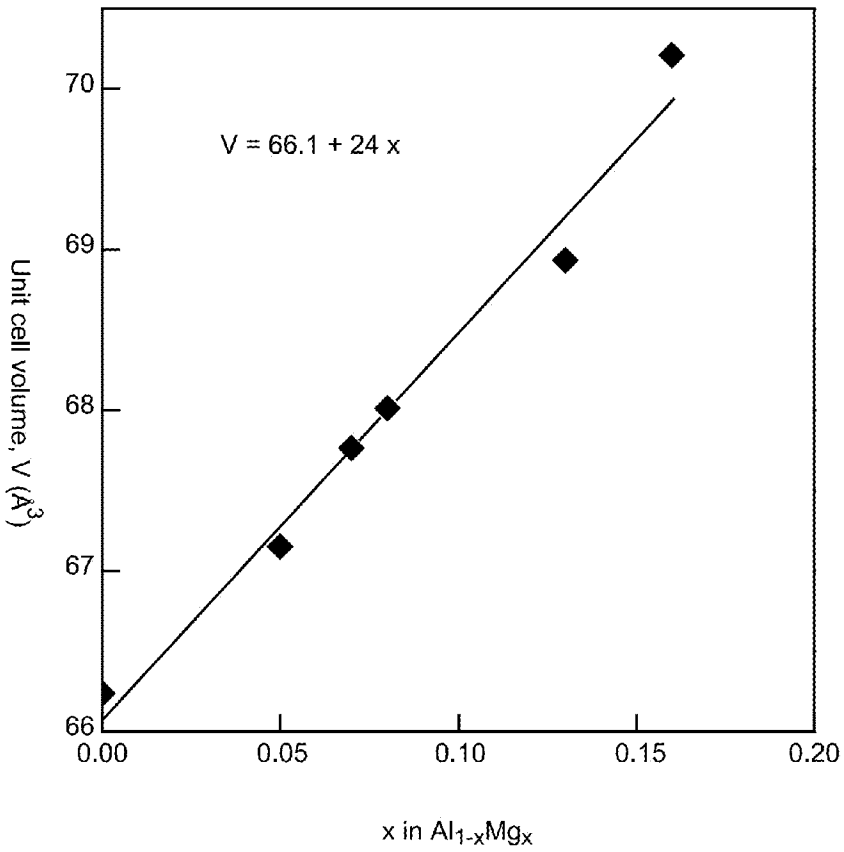

FIG. 132 is a plot of unit cell volume V of Al1-xMgx determined from a Pearson database with a linear fit.

Figure 133:
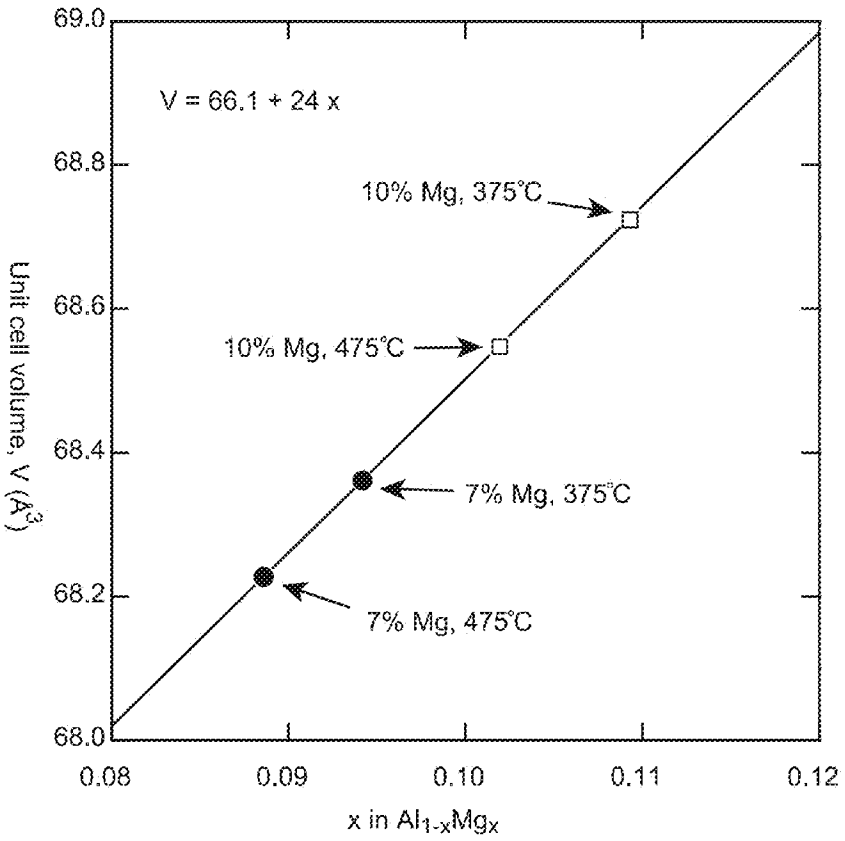

FIG. 133 is a plot of unit cell volume of Al-8Ce-7Mg and Al-8Ce-10Mg as-cast and heat with corresponding Mg concentration x determined using the trend line from FIG. 132.

Figure 134A:
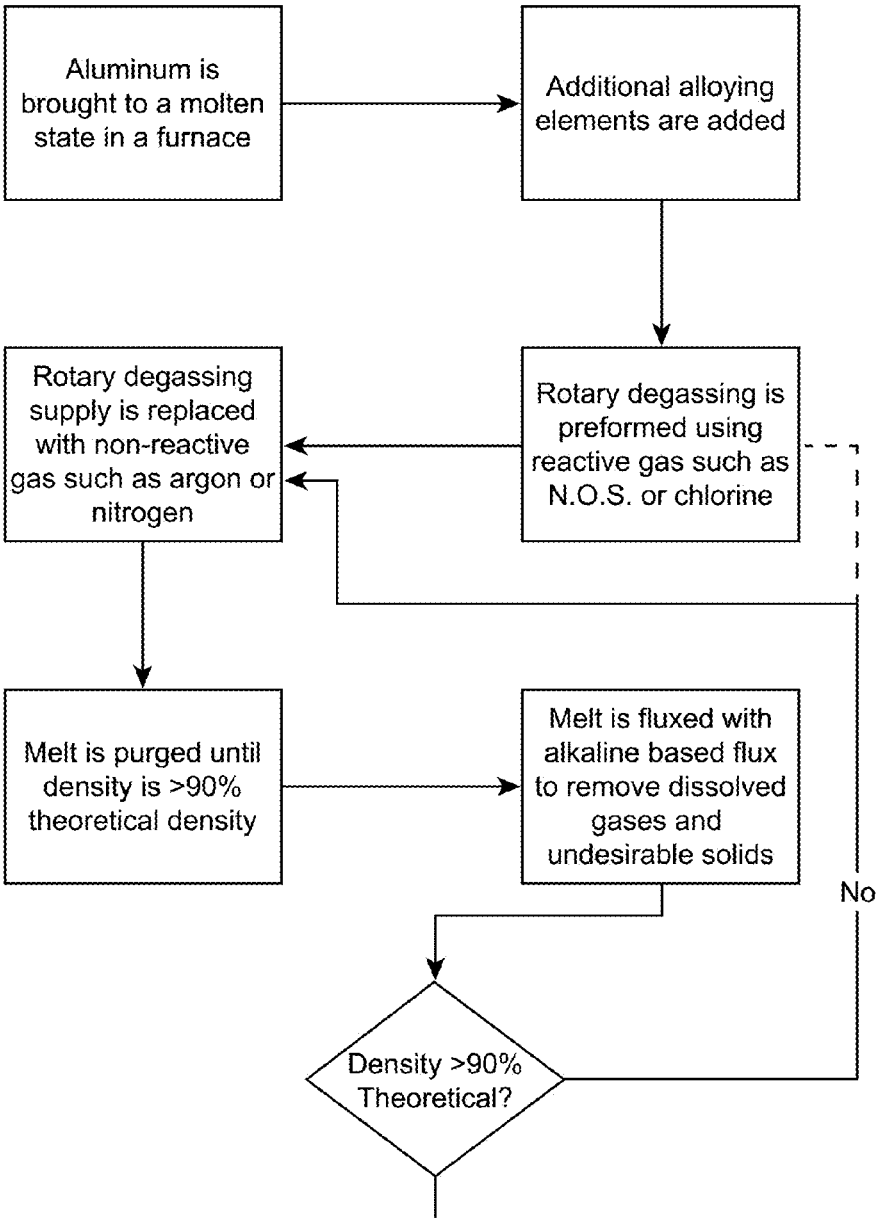

FIG. 134*a* is a first portion of a flowchart showing a first process for casting an Al—Ce alloy.

Figure 134B:
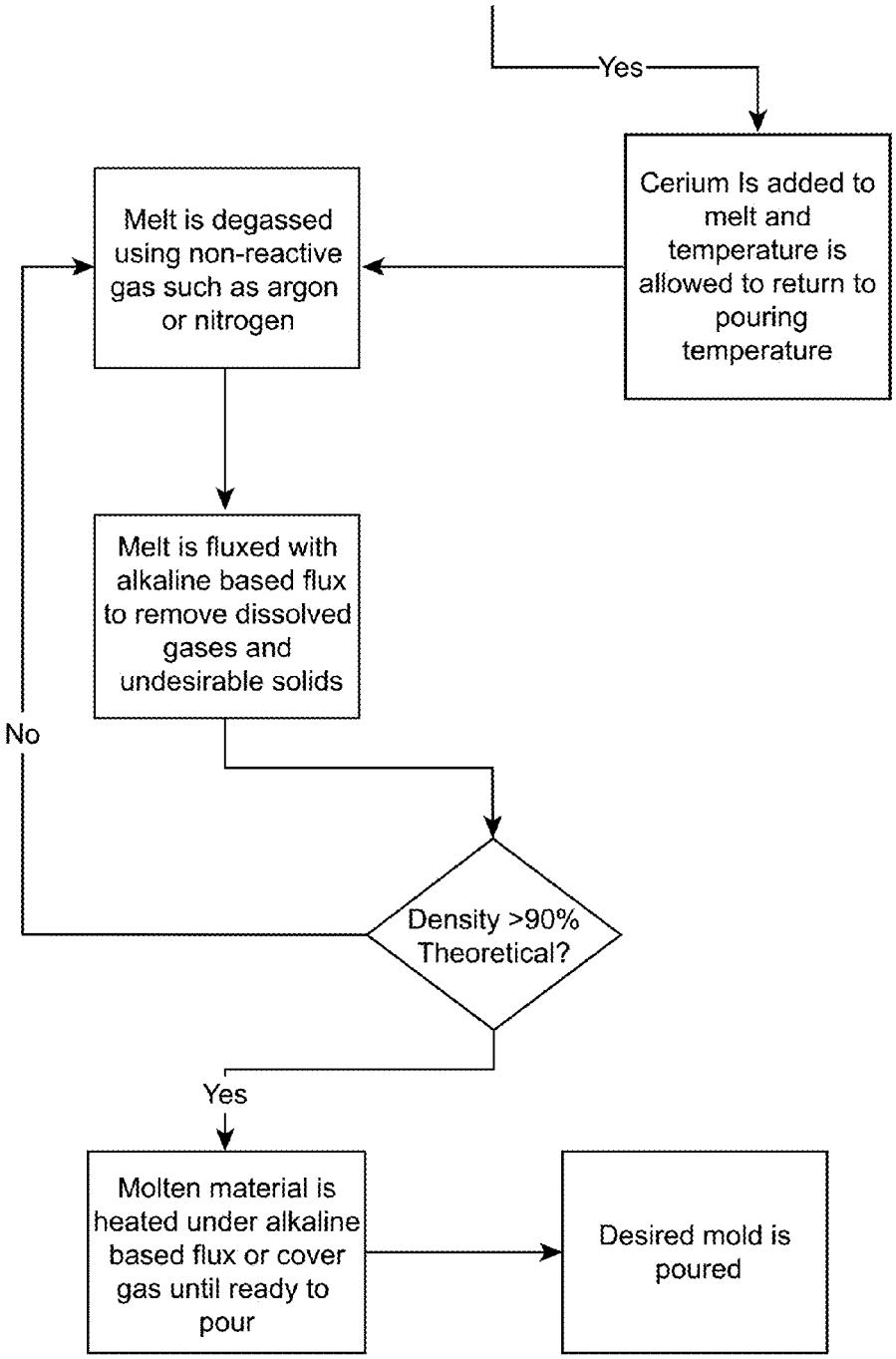

FIG. 134*b* is a second portion of a flowchart showing a first process for casting an Al—Ce alloy.

Figure 135A:
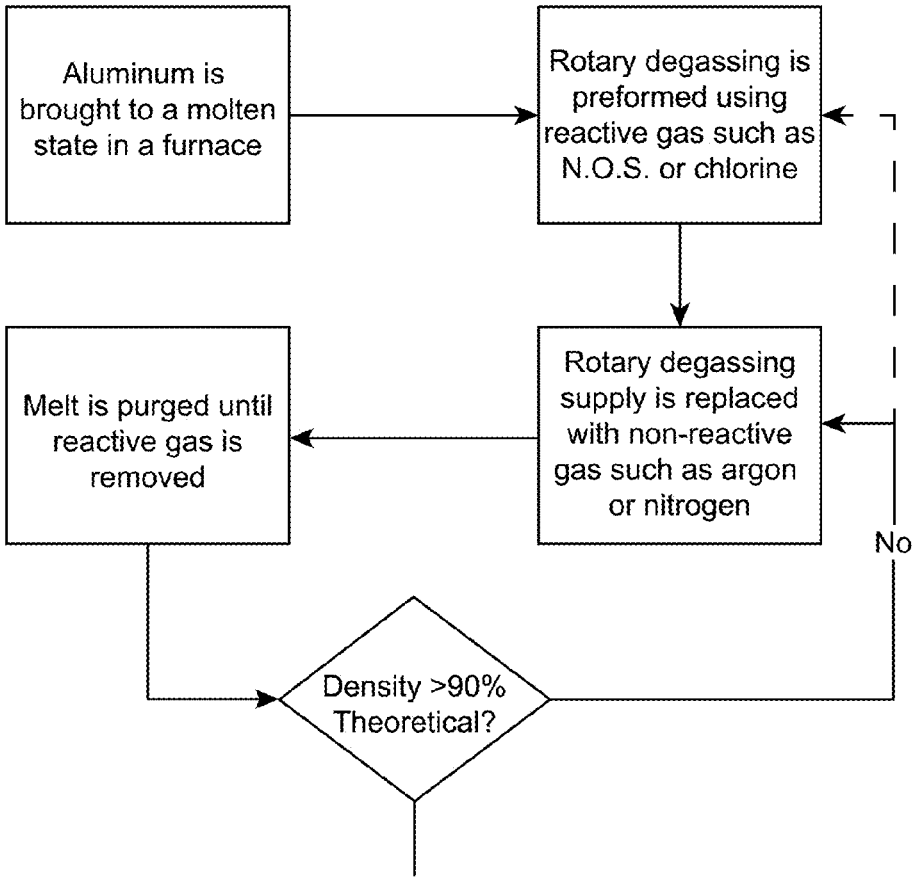

FIG. 135*a* is a first portion of a flowchart showing a second process for casting an Al—Ce alloy.

Figure 135B:
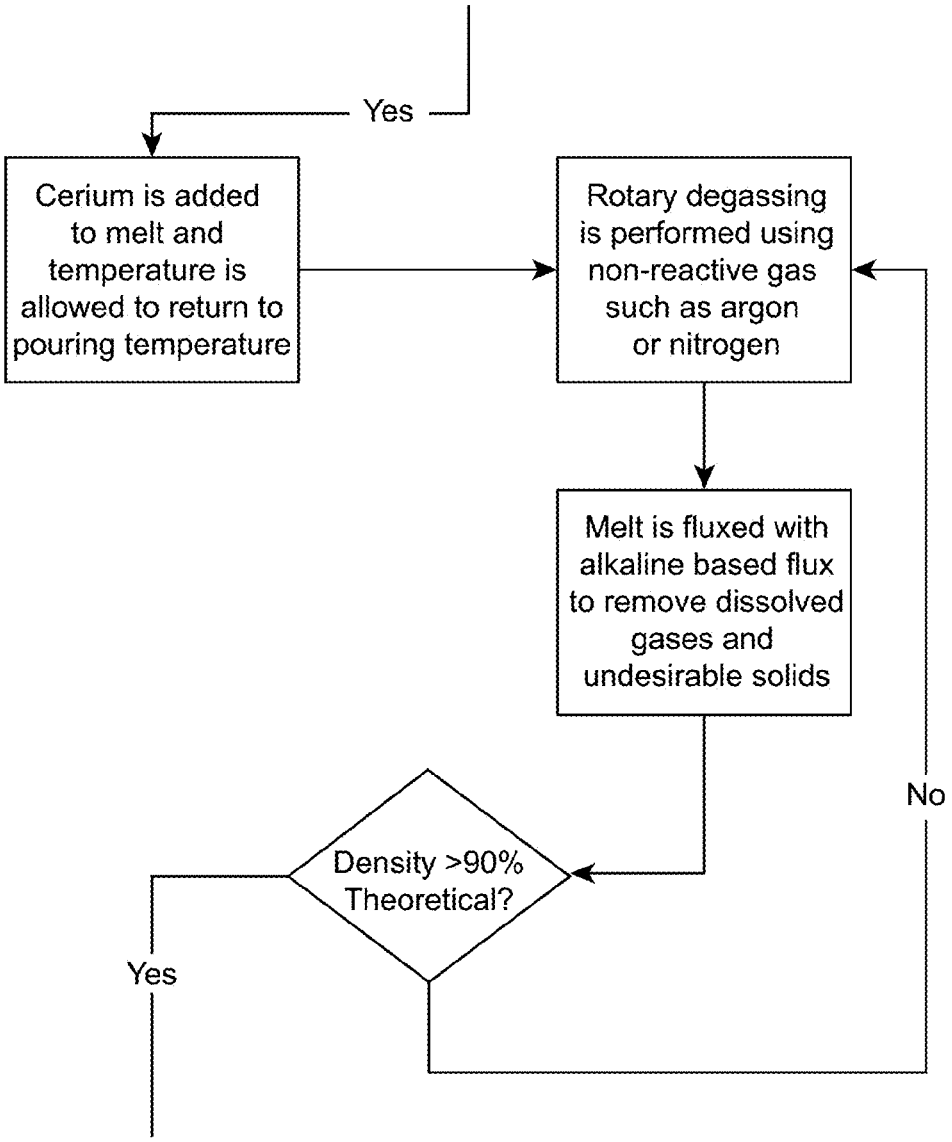

FIG. 135*b* is a second portion of a flowchart showing a second process for casting an Al—Ce alloy.

Figure 135C:
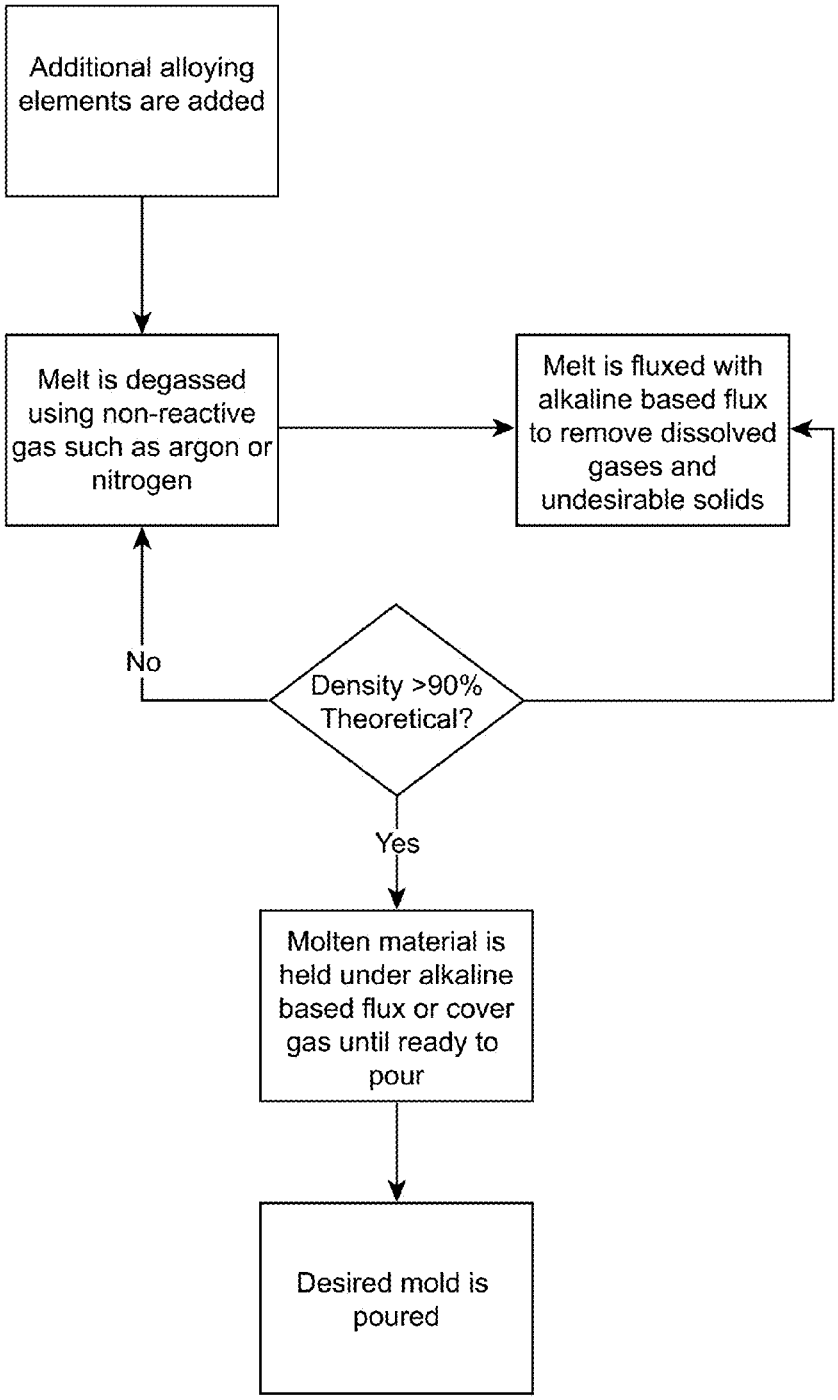

FIG. 135*c* is a third portion of a flowchart showing a second process for casting an Al—Ce alloy.

Figure 136A:
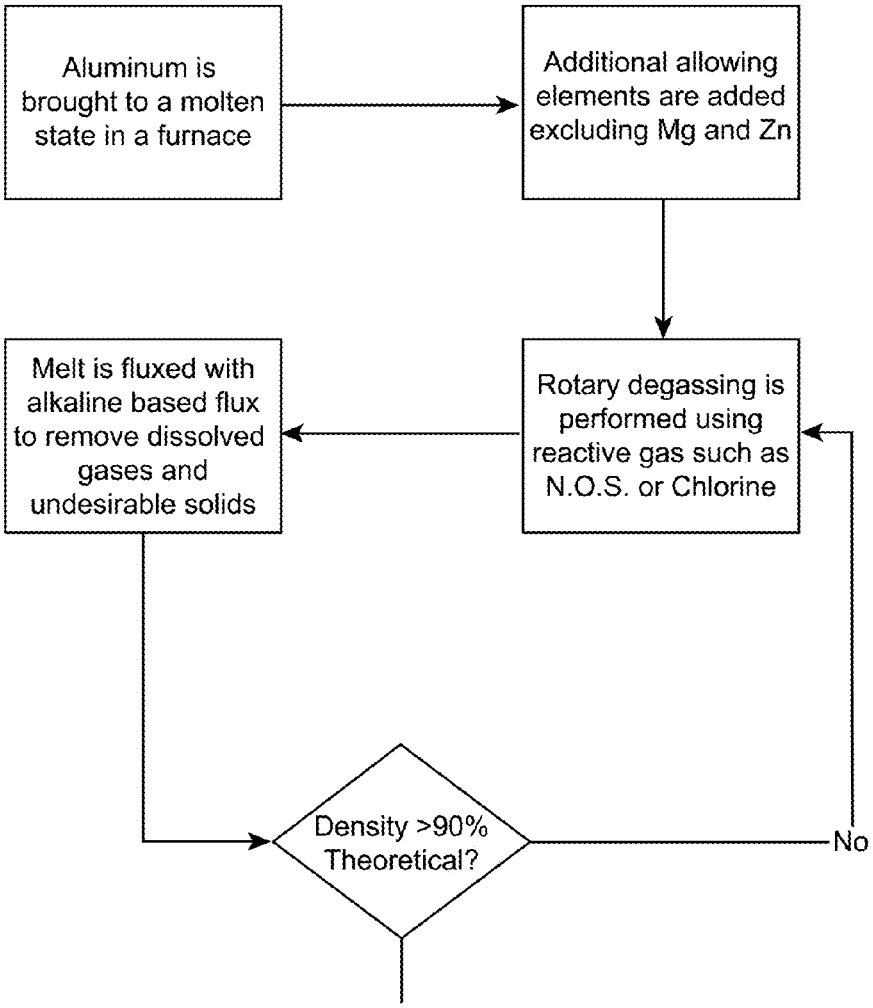

FIG. 136*a* is a first portion of a flowchart showing a first process for casting an Al—Ce—Mg—Zn alloy.

Figure 136B:
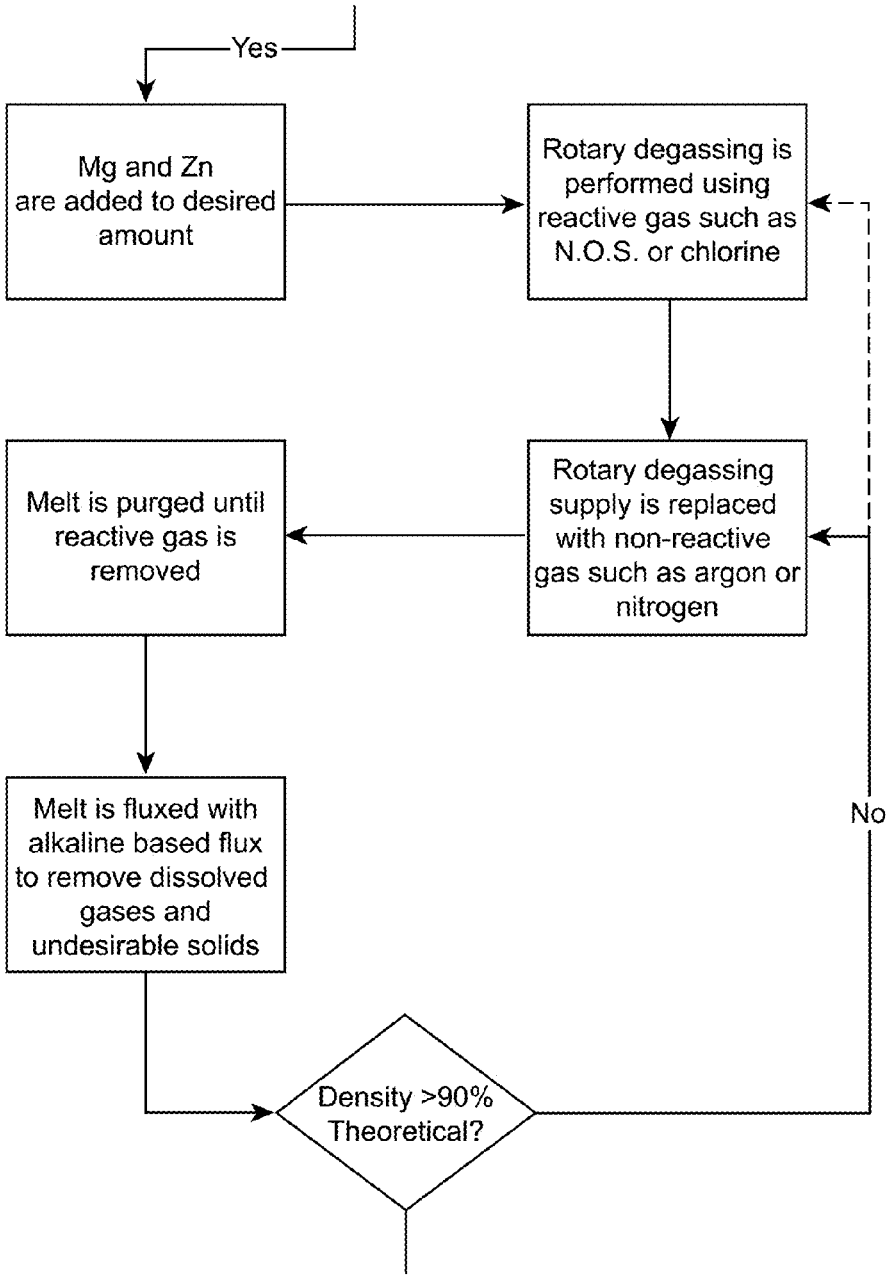

FIG. 136*b* is a second portion of a flowchart showing a first process for casting an Al—Ce—Mg—Zn alloy.

Figure 136C:
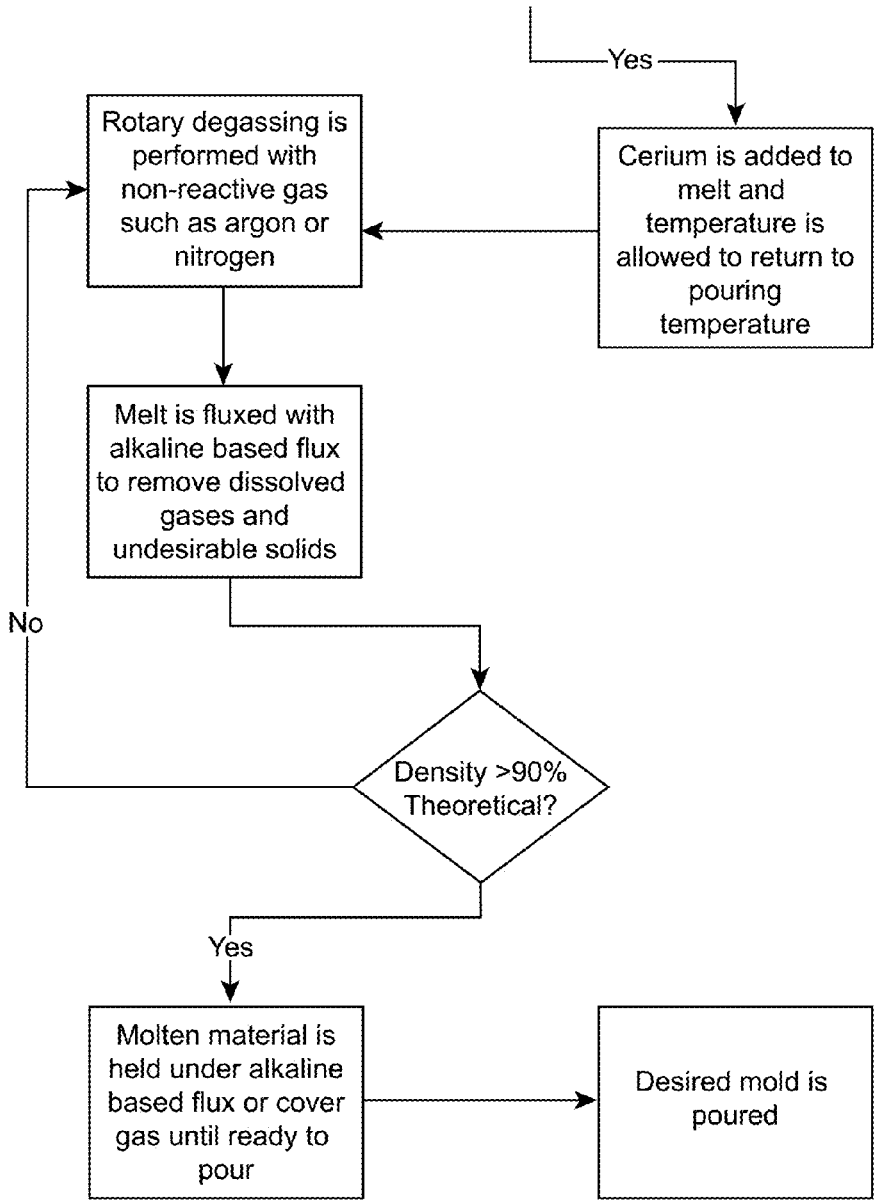

FIG. 136*c* is a third portion of a flowchart showing a first process for casting an Al—Ce—Mg—Zn alloy.

Figure 137A:
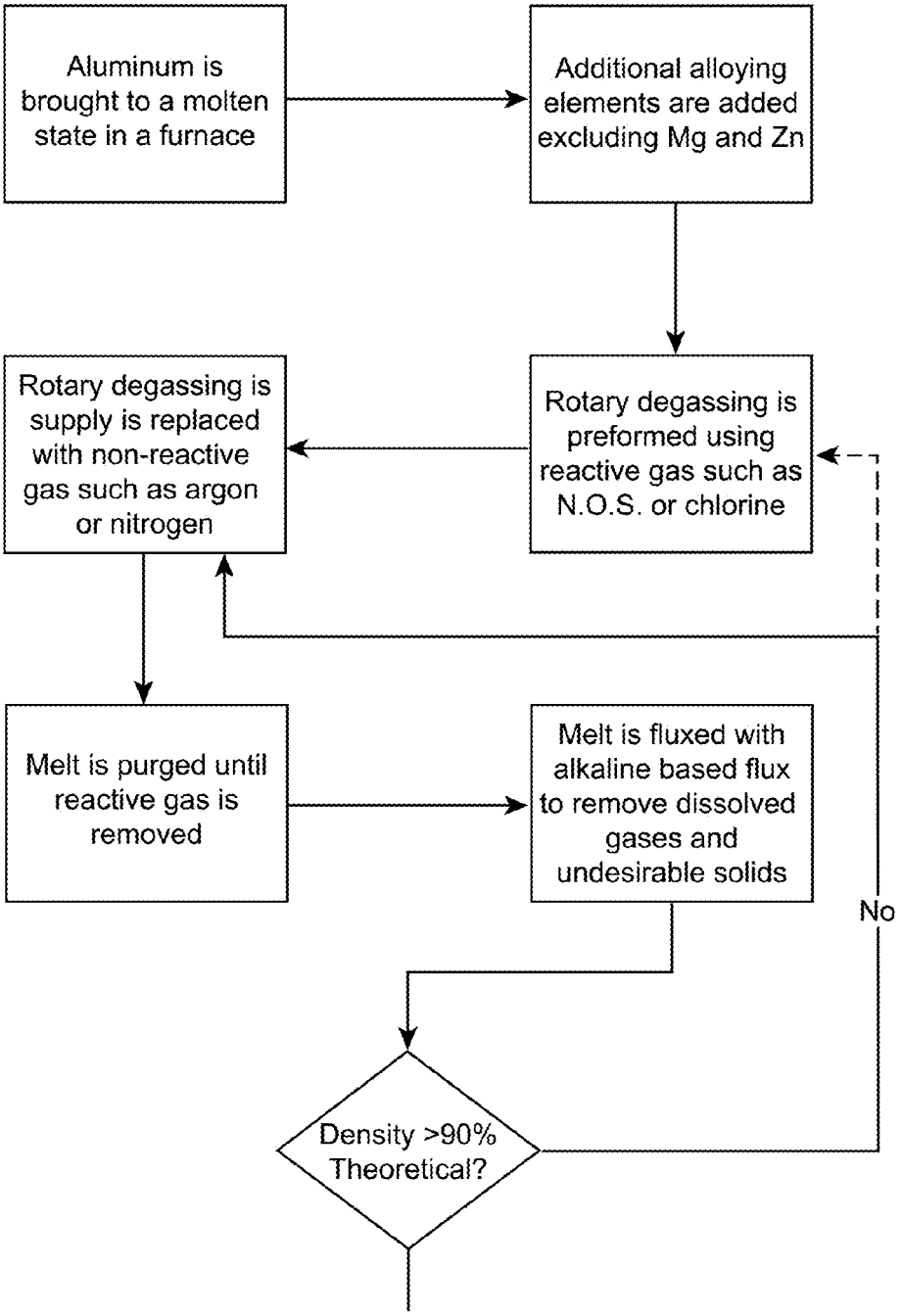

FIG. 137*a* is a first portion of a flowchart showing a second process for casting an Al—Ce—Mg—Zn alloy.

Figure 137B:
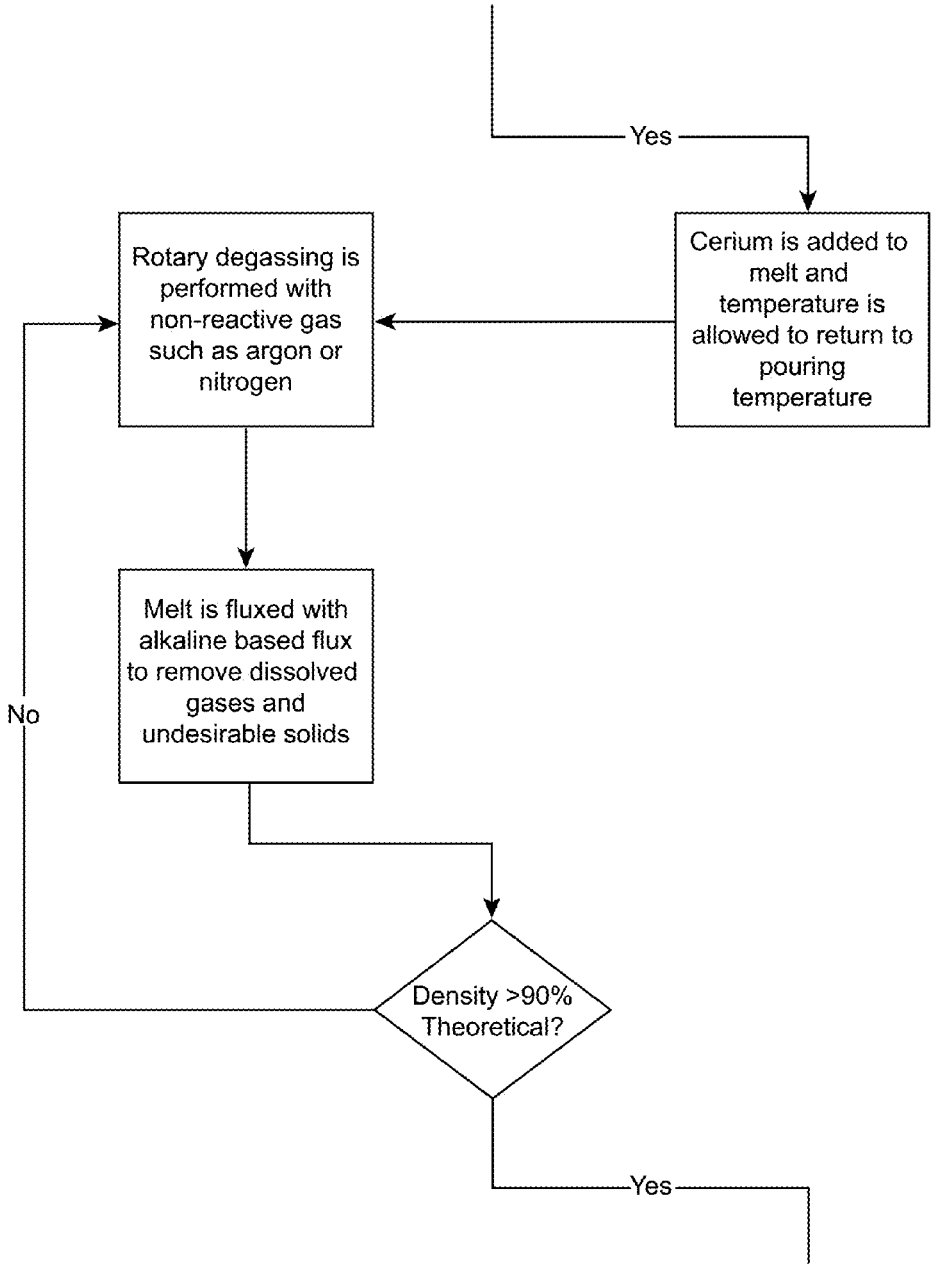

FIG. 137*b* is a second portion of a flowchart showing a second process for casting an Al—Ce—Mg—Zn alloy.

Figure 137C:
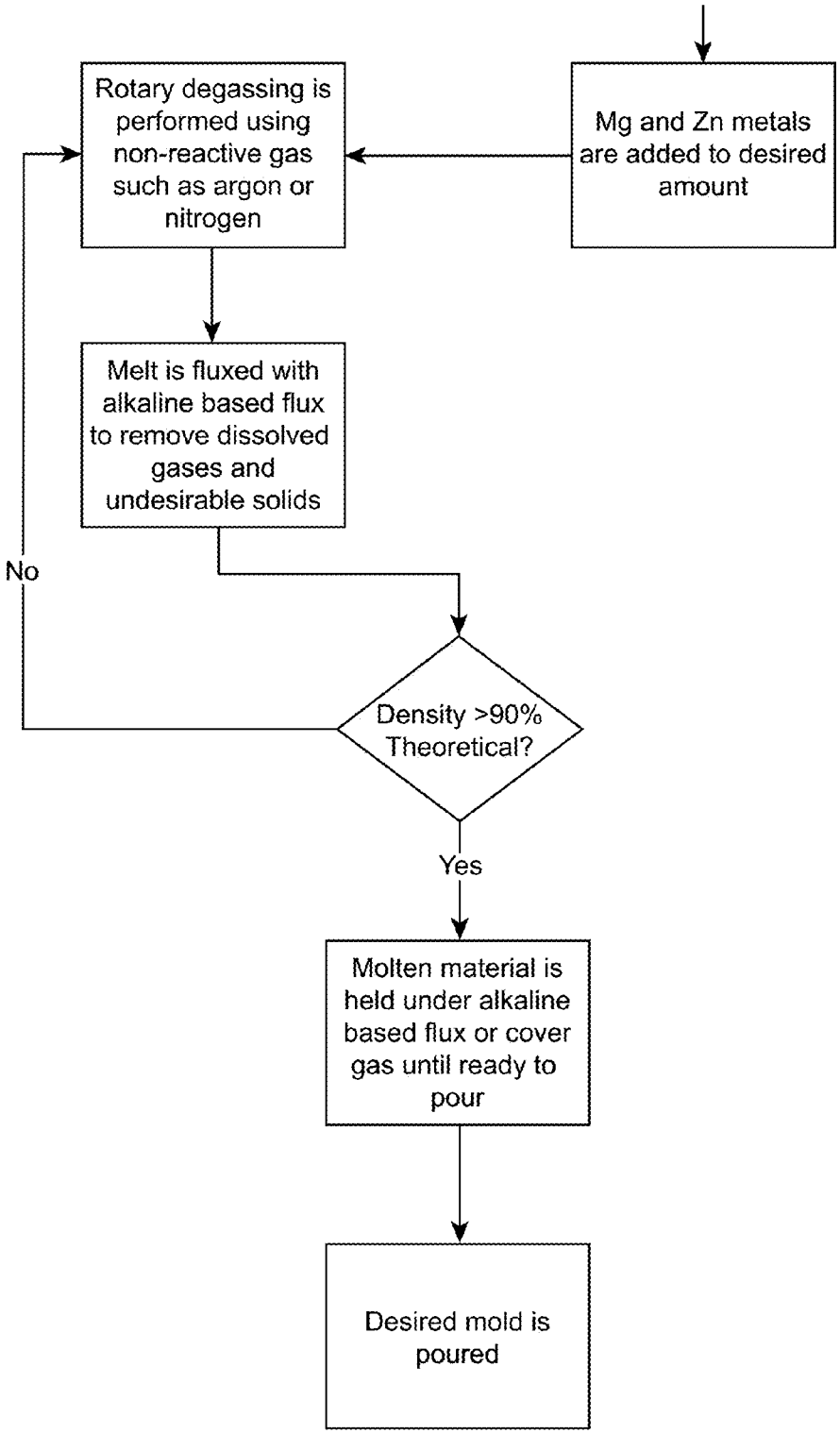

FIG. 137*c* is a third portion of a flowchart showing a second process for casting an Al—Ce—Mg—Zn alloy.

Figure 138:
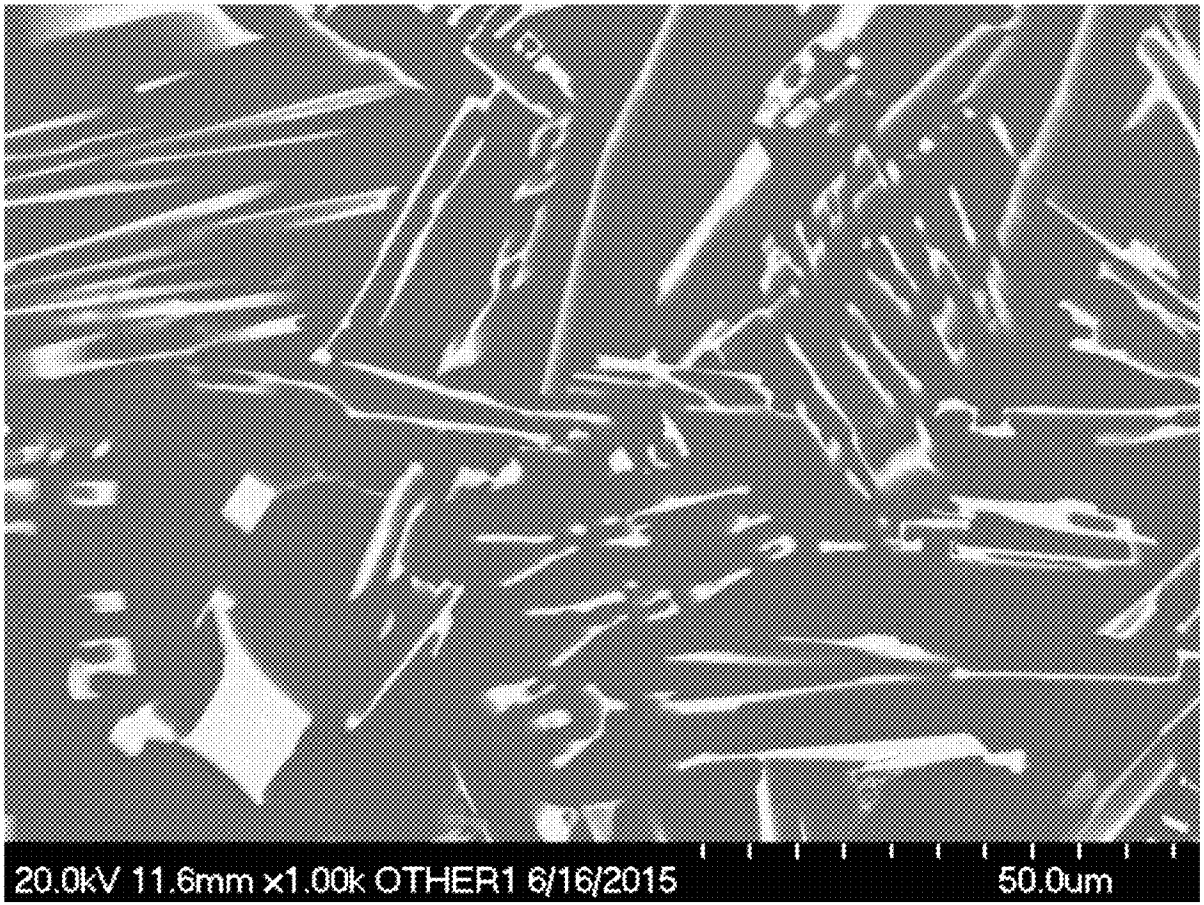

FIG. 138 is a low-magnification SEM image of an Al-12Ce alloy cast under slow cooling rates.

Figure 139:
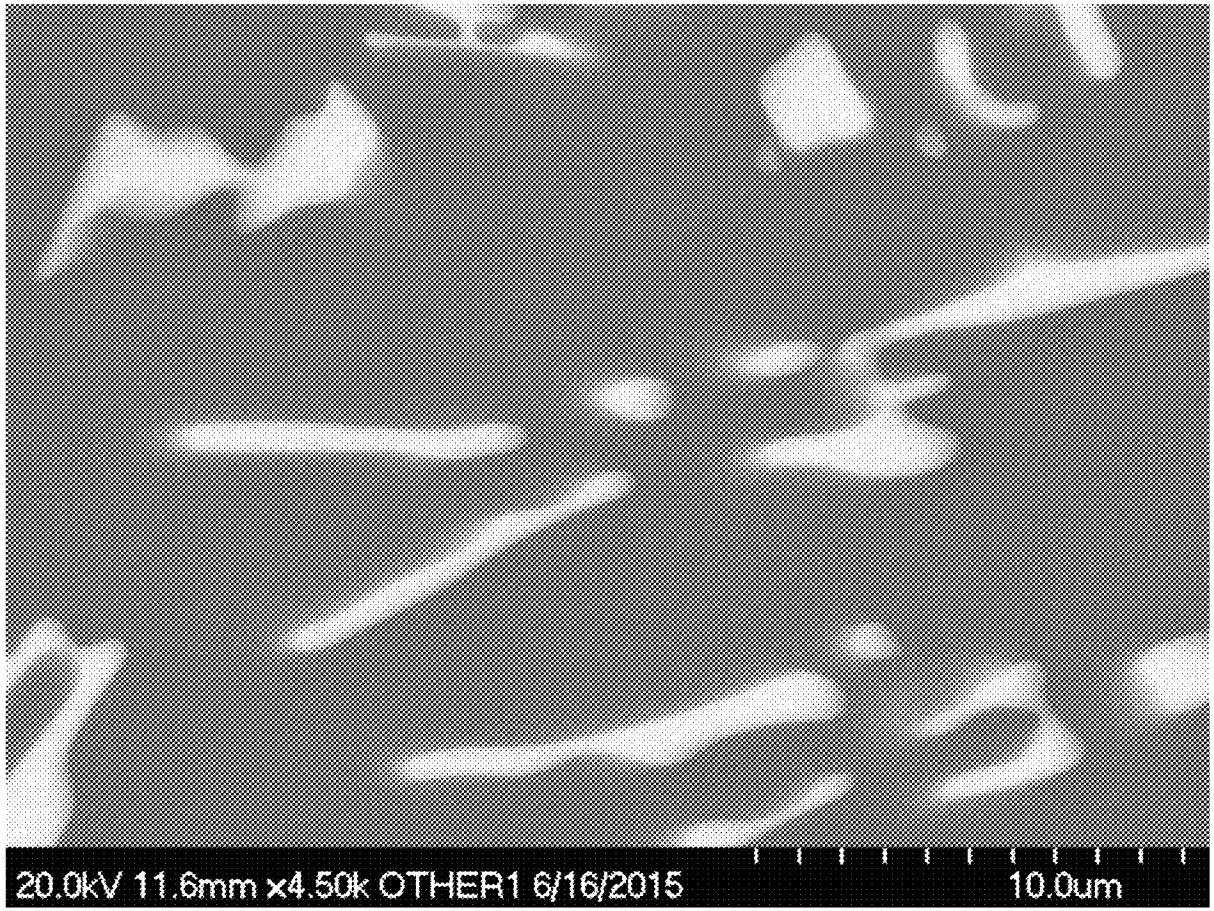

FIG. 139 is a high-magnification SEM image of an Al-12Ce alloy cast under slow cooling rates.

Figure 140:
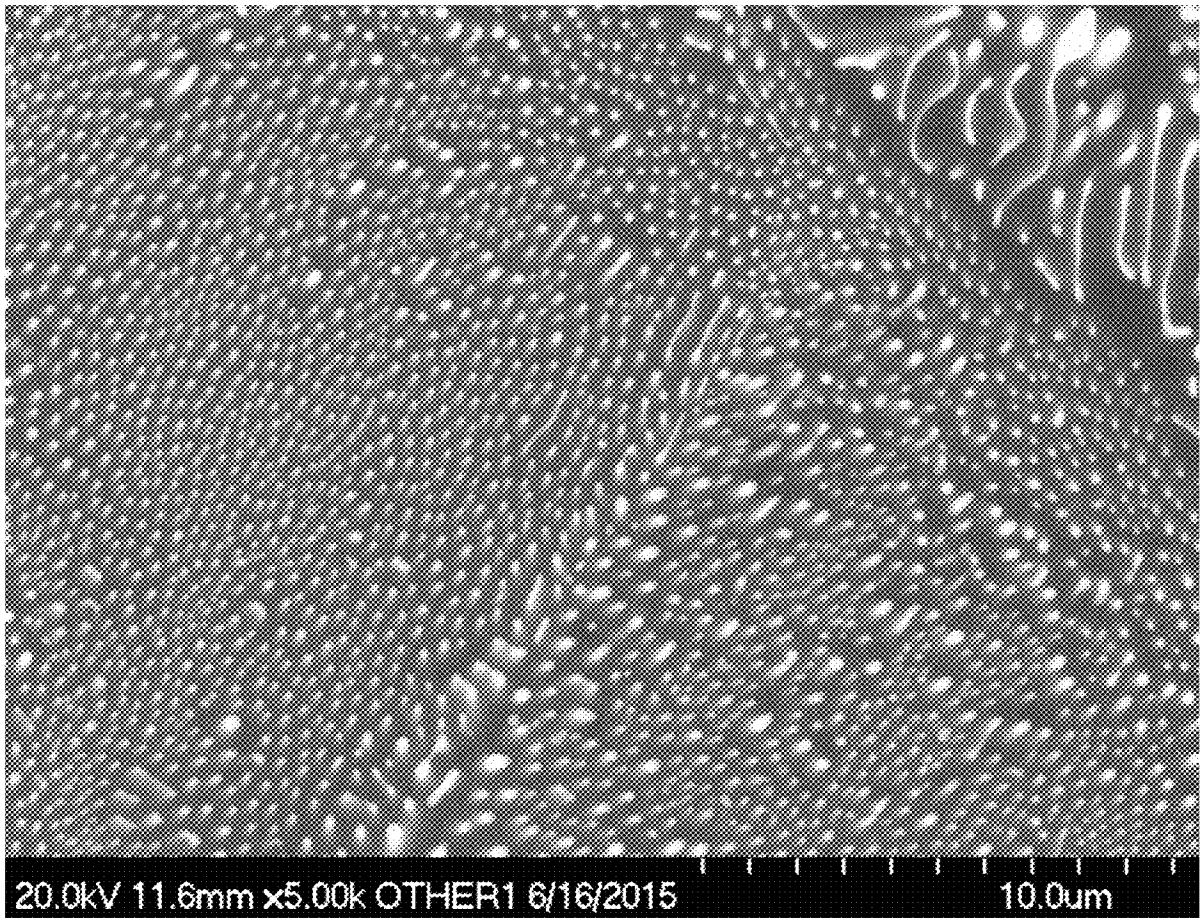

FIG. 140 is a low-magnification SEM image of an Al-12Ce alloy cast under rapid cooling rates.

Figure 141:
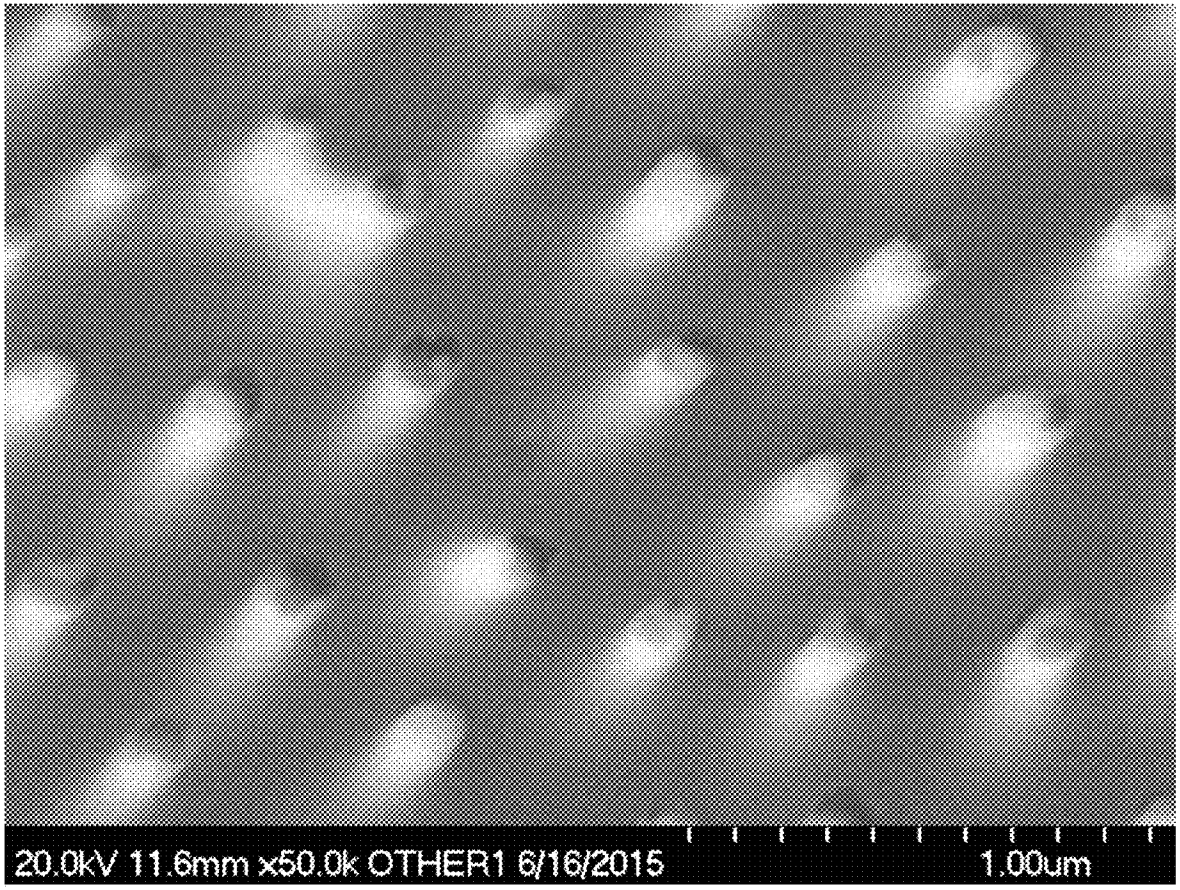

FIG. 141 is a high-magnification SEM image of an Al-12Ce alloy cast under rapid cooling rates.

The scale of SEM images described above is about 50 μm horizontally across the image unless stated otherwise.

For a better understanding of the present invention, together with other and further objects, advantages and capabilities thereof, reference is made to the following disclosure and appended claims in connection with the above-described drawings.

DETAILED DESCRIPTION OF THE INVENTION

Ce-modified aluminum alloys described herein solve two problems, the first being an overabundance of Cerium in the Rare Earth Element (REE) market. By utilizing Cerium in the presently described alloy, the surplus supply of Cerium can be utilized.

A major advantage of high cerium content aluminum alloys is their low cost in comparison to other high-temperature aluminum alloys. Cerium is the most abundant of the rare earths and often accounts for well over half of the yield; is a plentiful, underutilized by-product of rare earth mining processes. Since there is heretofore little use for existing cerium its market value is significantly lower than other rare-earth elements, and its utilization as a primary alloying element with aluminum is advantageous. High temperature-stable alloys can now be cast using low-cost rare earth elements while utilizing traditional casting methods for less than many modern alloys which are not stable at high-temperatures.

The second problem solved by the Ce-modified aluminum alloys described herein is the lack of high temperature Aluminum alloys. Prior to the invention described herein, there are few, very expensive Aluminum alloys which maintain desirable mechanical characteristics at temperatures above 230° C. Ce-modified Aluminum alloys fill that gap by creating aluminum alloys having high temperature mechanical properties that are about 30-40% greater than that of any currently available aluminum alloys, as will be demonstrated hereinbelow.

Aluminum casting alloys are light and strong but do not often have high tolerance for elevated temperatures, and aluminum alloys that do exhibit high temperature stability are generally cost prohibitive for most applications. Through the addition of cerium in amounts in the range of about 5 to about 30 weight percent (hereinafter indicated simply as %), preferably about 5 to about 20%, or about 6 to about 16%, or about 8 to about 12%, aluminum alloys show a marked increase in high temperature mechanical properties. Cerium addition is effective in producing a highly castable aluminum alloy without the addition of silicon, leading to good ductility up to about 30% Ce addition. After which, it is believed mechanical properties will sharply degrade.

Alloys of the present invention can contain lesser additions of conventional aluminum alloying elements in order to produce desired mechanical properties thereof. For example, up to about 5% silicon can be added in order to improve yield and tensile strengths. The Al—Ce alloys containing high content of Ce with little to no silicon can be cast into complex near net shape molds at room or elevated temperatures and do not always require a chill to be present for good castability. Other additions of up to about 5% Fe, up to about 15% Mg, up to about 8% Cu, and/or up to about 8% Ni, are also useful in tailoring the alloy as desired.

Embodiments of the present invention include aluminum alloys modified by cerium, lanthanum, mischmetal, or any combination of the foregoing. Lanthanum modification has the potential to exhibit similar mechanical properties to that of cerium modification. However, lanthanum is much more expensive than cerium as it has other commercial uses. Ce and La exhibit very similar atomic properties with the same number of valence electrons in the 6s energy orbital. They also exhibit a very similar atomic radius. These similarities in atomic structure render their overall reactivity nearly identical in most systems. The skilled artisan will understand that the well-known Al—Ce and Al—La phase diagrams in the aluminum rich region appear identical with the only discernible schism being the depression in the primary $Al_{11}La_3$ liquidus temperature over that of the equivalent $Al_{11}Ce_3$ region. All other features of the diagrams appear near identical. Furthermore if one observes the ternary isotherm plotted by the Al—La—Ce system at 500° C. it can be observed that Ce and La form mirrored phase spaces across constant Al isopleth lines. Combining this information it is clear that in an alloy of Al—Ce, Al—La, or any rational combination of Ce and La the present phases would bear the same structure and the alloy exhibit nearly identical mechanical properties.

Natural mischmetal comprises, in terms of weight percent, about 50% cerium, 30% lanthanum, balance other rare earth elements. Thus, modification of aluminum alloys with cerium through addition of mischmetal can be a less expensive alternative to pure cerium.

Of critical importance is a strengthening $Al_{11}X_3$ intermetallic phase, where X is cerium, lanthanum, mischmetal, or any combination of the foregoing. The intermetallic phase is present in an amount in the range of from about 5 to about 30 weight percent. The general formula that applies is as follows: AlXa+CeX1+LaX2+MshX3= and X1+X2+X3>5 and <30 wt %. The intermetallic phase has a microstructure characterized by lath and/or rod features having an average thickness of no more than about 700 um and an average lath spacing of no more than about 10 um.

It is to be understood that wherever cerium is mentioned hereinbelow, lanthanum and/or mischmetal can be substituted for a portion of, or all of the cerium.

Moreover, other elements may be present in the alloy that do not significantly interfere with the formation and stability of the critically important $Al_{11}X_3$ intermetallic constituent. Such elements may include at least one of titanium, vanadium, and Zirconium.

Moreover, alloys of the present invention can contain innocuous amounts of various impurities that have no substantial effect on the chemical or mechanical properties of the alloys.

Optimal castability is found in the X range between about 8-12 wt %. However castability is not greatly reduced until cerium content drops below 6 wt % and mechanical properties are contemplated to remain viable until X exceeds 20 wt % or even 30%.

Al—Ce alloys are denser than standard aluminum alloys due to the addition of cerium, but are lighter than conventional nickel and steel alloys currently being used in many high-temperature applications where aluminum alloys with proper mechanical and thermal properties are prohibitively expensive.

Described herein are new aluminum alloys containing relatively high cerium content and relatively low silicon content with exceptional casting characteristics and mechanical property stability in temperatures at or above 230° C., and at or above 260° C.

The process for casting the Al—Ce alloys is compatible with conventional industrial practices. Little or no modification of existing equipment and infrastructure of modern aluminum foundries is necessary.

The Al metal is heated to 100° C. or about 100° C. above its melting temperature under an oxygen-excluded atmosphere. After the Al reaches a stable fully liquid state, the Ce is added in as large of ingots as possible. The large ingots and oxygen-excluded atmosphere help reduce the likely hood of the Ce causing a fire or oxidizing as a result of its reactivity. After the cerium has completely melted and once the alloys return to an appropriate temperature, a degassing step is taken to remove any present oxides or oxygen from the melt. After degassing the Al—Ce alloy can be cast into molds and allowed to solidify. Chills of various sizes can be used but are not necessary for most Al—Ce alloys.

Assessment for castability of an alloy generally depends almost entirely on three variables: presence and frequency of micro or macro voids in the casting; extent to which the mold filled; and presence of cracking or hot tearing resulting in mold failure.

Castability is an indicator of feasibility of an alloy for casting into complex shapes and can be rated in a system of 0 (poor) to 5 (excellent). Characteristics of castings are generally rated herein as follows:

0. Incomplete filling with frequent hot-tearing and macro-voids resulting in multiple breaks in casting.
1. Incomplete filling of casting mold with hot-tearing and cracking present along with abundant micro-voids and moderately numerous macro-voids.
2. Complete filling of the mold with moderate hot-tearing and cracking or complete fill with little hot-tearing or cracking and moderately numerous micro and macro-voids.
3. Complete filling of the mold with little hot-tearing or cracking or complete filling with moderate frequency of micro-voids and few macro-voids.
4. Complete filling of the casting mold with no hot-tearing or cracking, very few macro-voids in combination with very few micro-voids; or a low/med presence of micro-voids.
5. Complete filling of the casting mold with no hot-tearing or cracking, no macro voids and few micro-voids.

All as-cast Al—Ce alloys exhibit a very complex intermetallic shown via SEM micrographs. This highly interconnected microstructure is unique to these alloys in both morphology and phase fraction. The area and volume fraction of intermetallic $Al_{11}Ce_3$ is very high. This high phase fraction of extremely fine laths likely leads to the exceptional ductility of the samples.

Application of a standard (ASTM) T6 heat-treatment causes the as-cast sample's microstructure to undergo a shift from a complex interconnected structure to a more island like fiber structure. The composition of the intermetallic ($Al_{11}Ce_3$) is unique to Al alloys. In the case of alloy ALC-500 described hereinbelow, a hypereutectic binary alloy, and samples containing Mg or Si large primary crystals are also present. These primary crystals do not undergo any changes after heat-treatment. The crystals are surrounded by the complex intermetallic which does undergo the standard transition after heat-treatment. ASTM T4 and T7 treatments were also tested. A person having ordinary skill in the art will recognize ASTM standard treatments as well-known methods; such methods are standardized and readily available to the public.

The critically important $Al_{11}Ce_3$ intermetallic phase present in the described binary Al—Ce alloys has been shown to be very stable at high temperatures present in the T6 heat treatment cycles. The microstructure does make a slight change in morphology but phase fraction is almost unaffected. The XRD and DSC plots (curves) described hereinbelow show overlays of the as-cast data and T6 heat-treated data. These plots reinforce the high-temperature stability of the intermetallic strengthening phase by noting that the profiles do not have any appreciable differences between the heat-treated and the as-cast and no present phase transition until the onset of melting at ~640° C. Testing showed the alloys to be stable up to 230° C. or about 230° C., which is not expected for aluminum alloys.

In the case of quaternary alloys containing Si addition, present phases appear to change after heat-treatment. Prior to heat-treatment $Al_{11}Ce_3$ is the major intermetallic constituent whereas following heat-treatment ternary Al—Ce—Si compounds dominate the composition. Once precipitated these phases are stable up to the melting temperature.

Example I

Alloy ALC-400 having a composition of 12% Ce, balance Al was made as follows: Aluminum ingots were melted in a resistive furnace under and oxygen excluded environment and brought to a temperature above 750° C. Once the temperature in the crucible was stable ingots of cerium were added and mixed until melted. Once melted the alloy was degassed and mixed further. After the temperature in the crucible again stabilized above 750° C. the melt was poured into various molds, including at least one of: a preheated permanent test-bar mold, a near net shape sand hot-tear mold, and a step-plate mold. The molds employed for testing were kept at room temperature; the step-plate molds contained either and iron chill or a copper chill.

Figure 1:
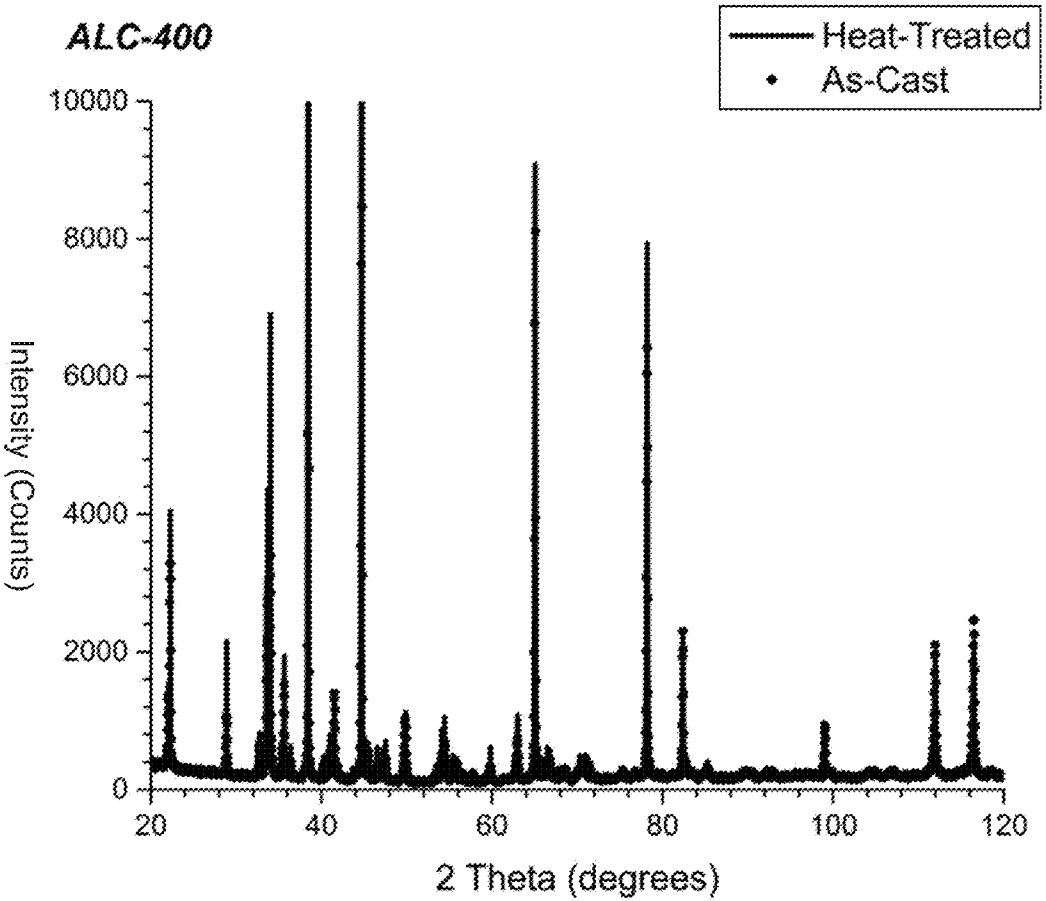
FIG. 1 is a graph showing full X-ray diffraction (XRD) spectra of both the as-cast and the heat-treated samples of alloy ALC-400.
Figure 2:
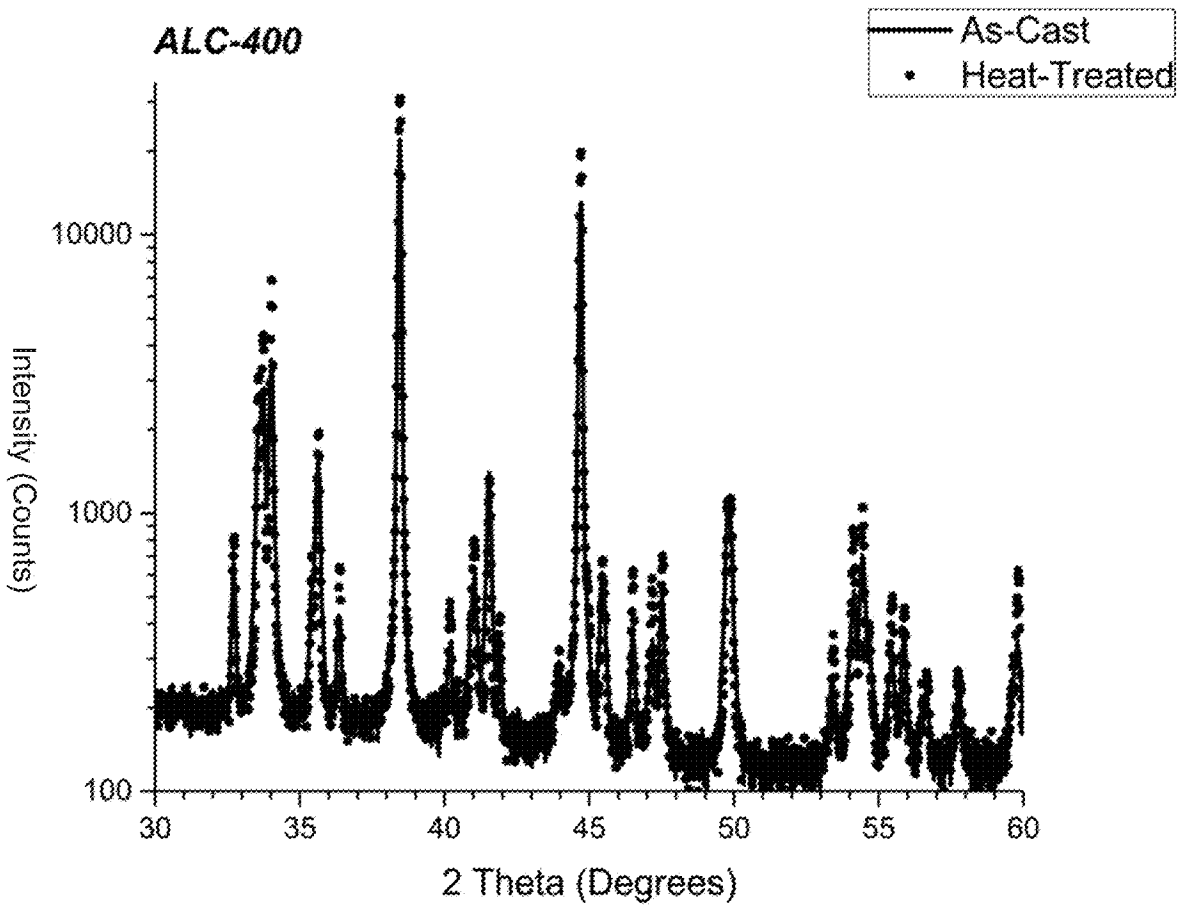
FIG. 2 is a graph showing focused XRD spectra of both the as-cast and the heat-treated samples of alloy ALC-400.
Figure 3:
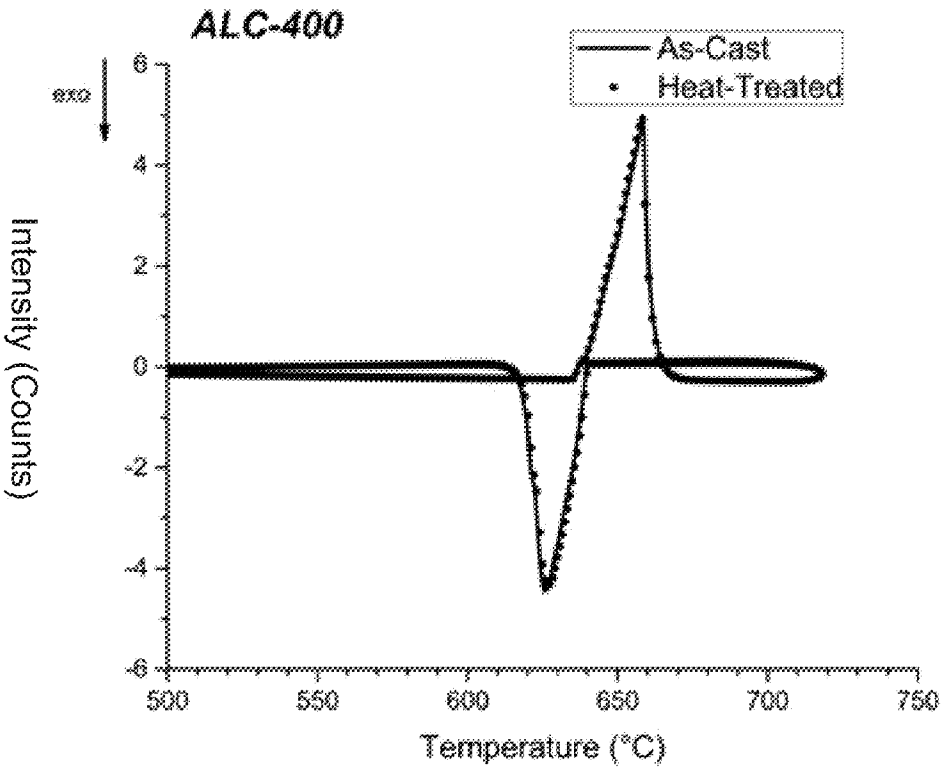
FIG. 3 is a graph showing differential scanning calorimetry (DSC) curves of both the as-cast and the heat-treated samples of alloy ALC-400.

After the alloy was cast and broken from the mold test-bars were heat-treated using a T6 heat-treatment. FIGS. 1, 2 show, respectively, full and focused XRD spectra of both the as-cast and the heat-treated sample. In all XRD spectra disclosed herein the peak positions resulting from the aluminum contributions are: 38.43°, 44.67°, 65.02°, 78.13°, 82.33°, 98.93°, 111.83°, and 116.36°. All other peaks result from the intermetallic contributions to the X-ray spectra. The spectra show the high stability of the Al—Ce samples at elevated temperatures. The spectra show no appreciable change between the as-cast and the heat-treated sample. The intermetallic strengthening phase does not break down or diffuse during high temperature heat-treatment. This is further enforced the DSC curves shown in FIG. 3. The curves are overlaid on top of each other show that there are no measurable phase shifts prior to the very sharp onset of melting at approximately 640° C. for either the heat-treated or the as-cast alloy. The similarity between the two curves again reinforces the stability of the intermetallic at elevated temperatures for long periods of time.

Figure 4:
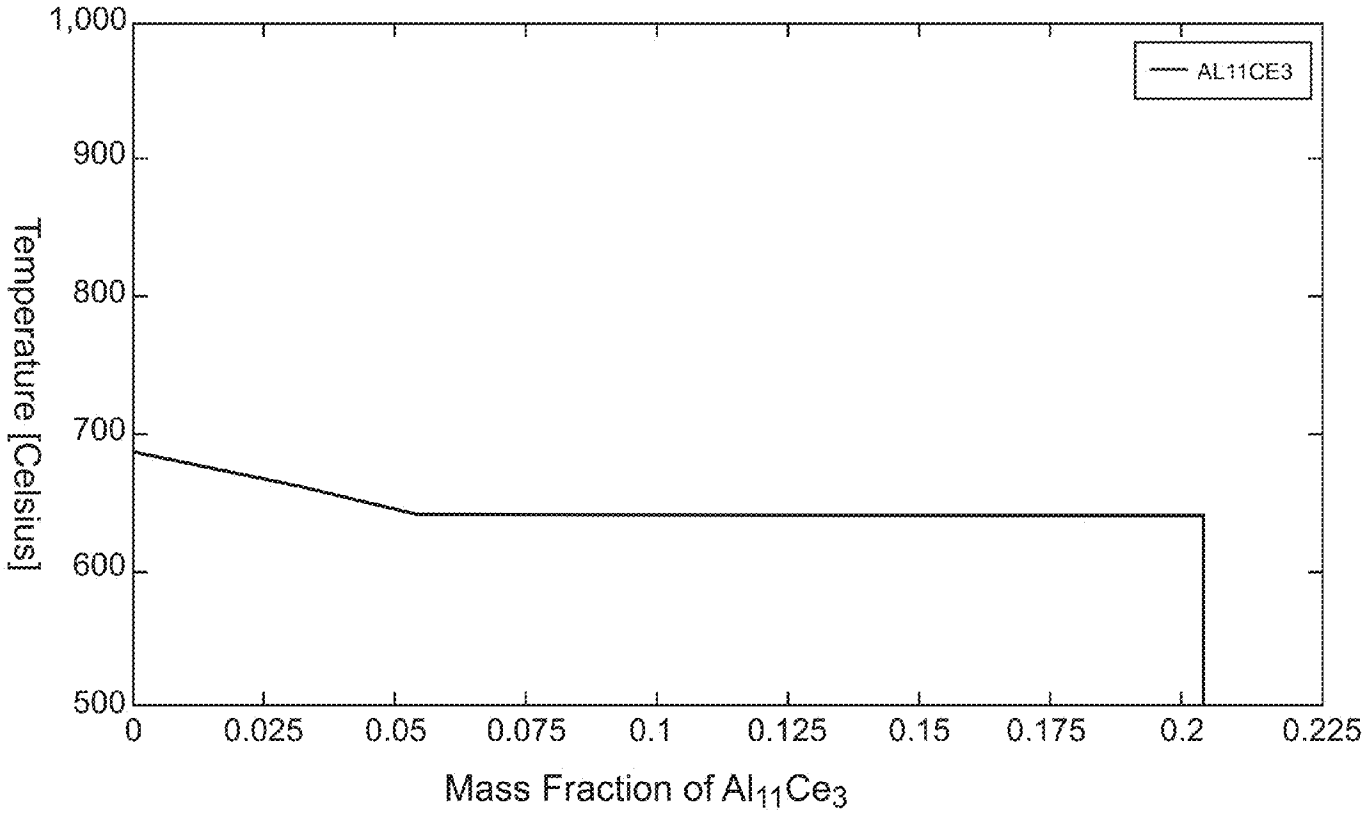
FIG. 4 is a graph showing an equilibrium solidification diagram for alloy ALC-400.

FIG. 4 shows an equilibrium solidification diagram for alloy ALC-400. The diagram shows a final mass fraction of intermetallic at or around 20 wt %. This data compares well with both the XRD and Magnetic Properties Measurement System (MPMS) data gathered for this sample (see FIGS. 77, 78).

Figure 6:
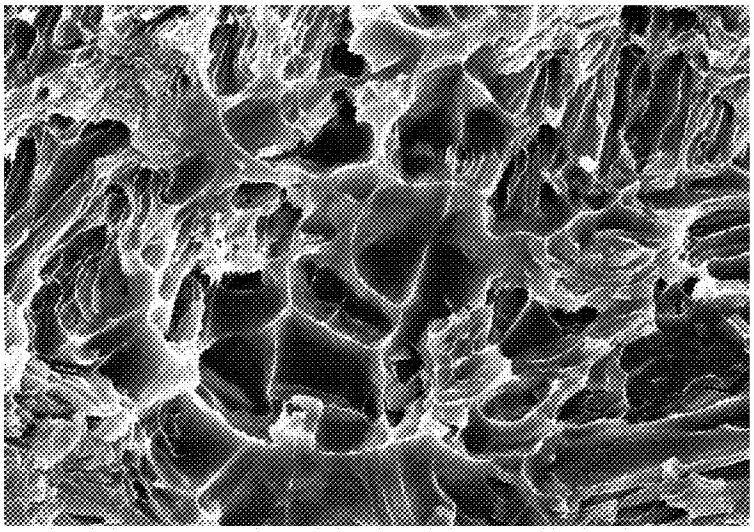
FIG. 6 is an SEM image of a fracture surface of as-cast alloy ALC-400.
Figure 5:
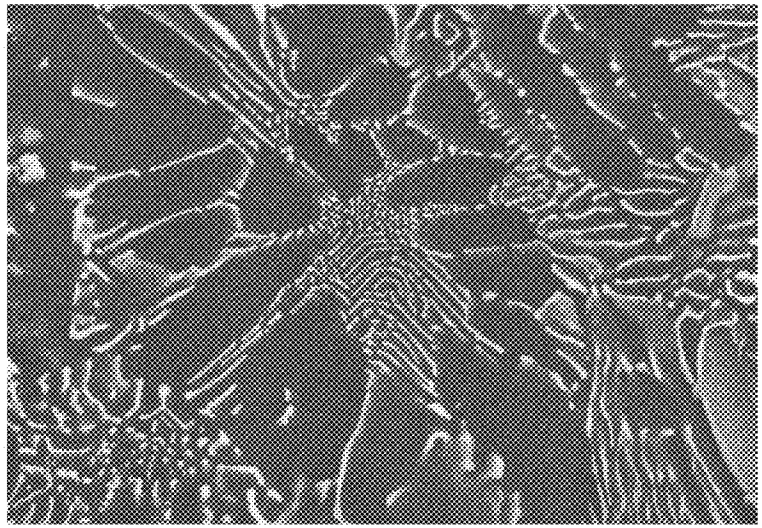
FIG. 5 is an SEM image showing the microstructure of as-cast alloy ALC-400.

FIGS. 5, 6 are respective SEM images showing the microstructure of as-cast and heat-treated alloy ALC-400. The microstructures are both very complex and show minor changes between the as-cast and heat-treated state. The only change is the movement from a very interconnected structure of the as-cast alloy to a more island like structure in the heat-treated sample. This transition appears to increase the ductility but has no appreciable effect on other mechanical properties as detailed in Table 1. Tensile (KSI), Yield (KSI), and Elongation (%) were measured at room temperature.

TABLE 1

| ALC-400 | Tensile (KSI) | Yield (KSI) | Elongation (%) | Phase Fraction FCC (wt %) | Phase Fraction Binary Intermetallic (wt %) |
|---|---|---|---|---|---|
| As-Cast Trial 1 | 23.6 | 8.4 | 13.0 | 81.3 | 18.7 |
| As-cast Trial 2 | 23.4 | 8.3 | 13.5 | — | — |
| T6 Trial 1 | 19.2 | 6.9 | 25.0 | 84.1 | 15.9 |
| T6 Trial 2 | 19.1 | 6.9 | 26.5 | — | — |

Figure 8:
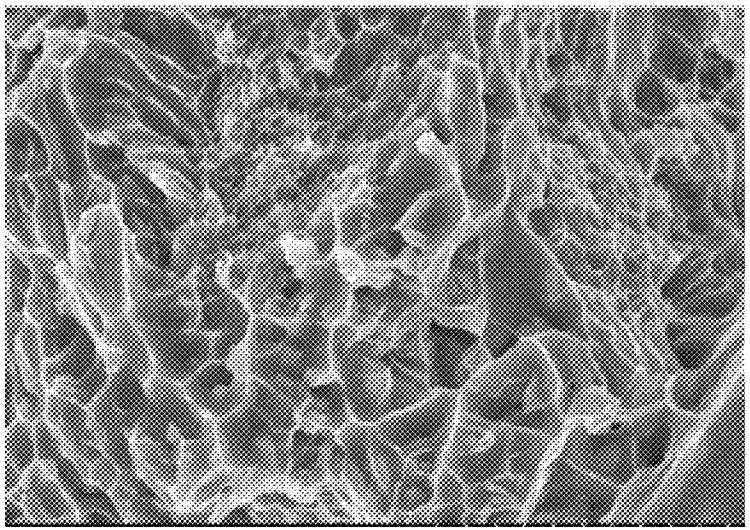
FIG. 8 is an SEM image of a fracture surface of heat-treated alloy ALC-400.
Figure 7:
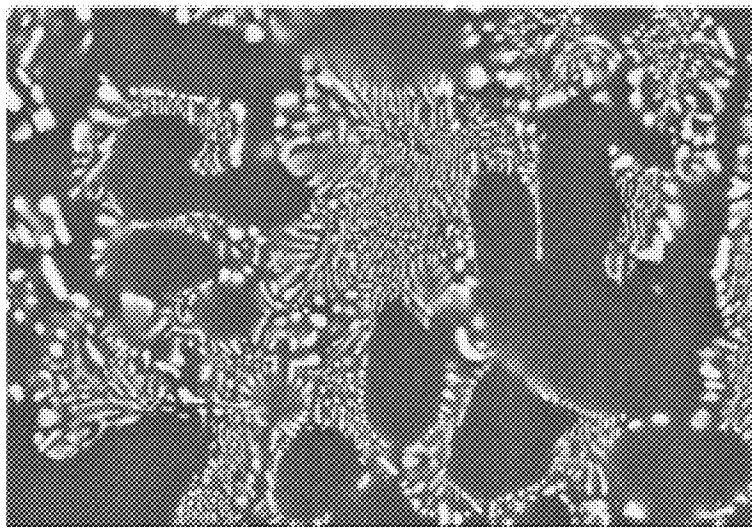
FIG. 7 is an SEM image showing the microstructure of heat-treated alloy ALC-400.

FIGS. 7, 8 are SEM images of respective fracture surfaces of as-cast and heat-treated alloy ALC-400. The fracture surfaces are overall ductile in nature with abundant microvoids and stepping present on each fracture surface. With the mechanical properties of these samples as they are ductile fracture is to be expected, and nothing abnormal is present on the fracture surfaces.

Figure 9:
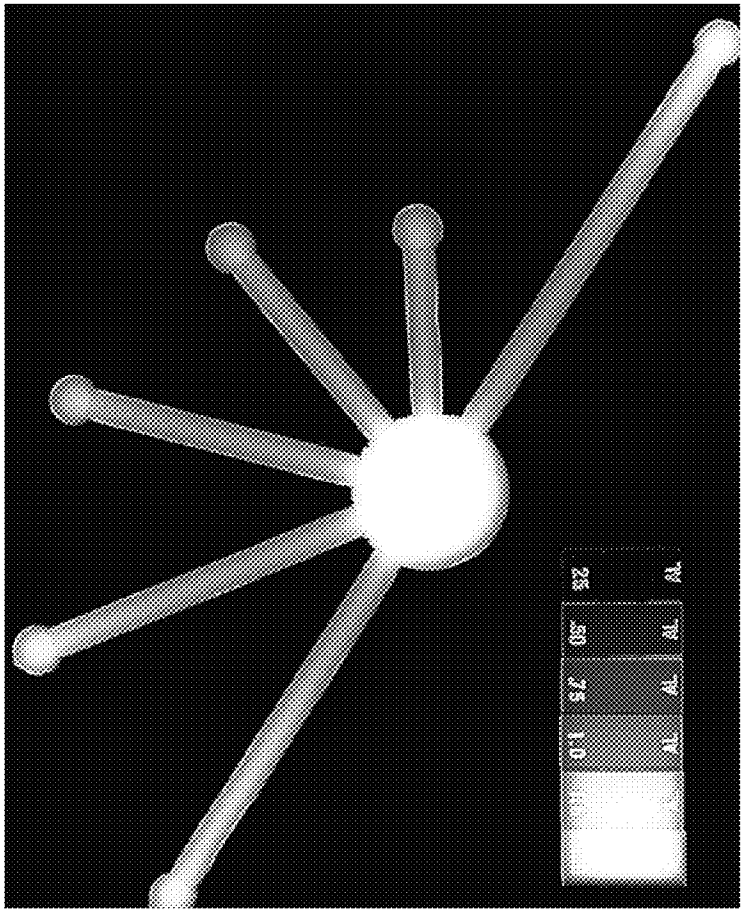
FIG. 9 is an X-ray photograph of a hot-tear molded test sample of alloy ALC-400.
Figure 10:
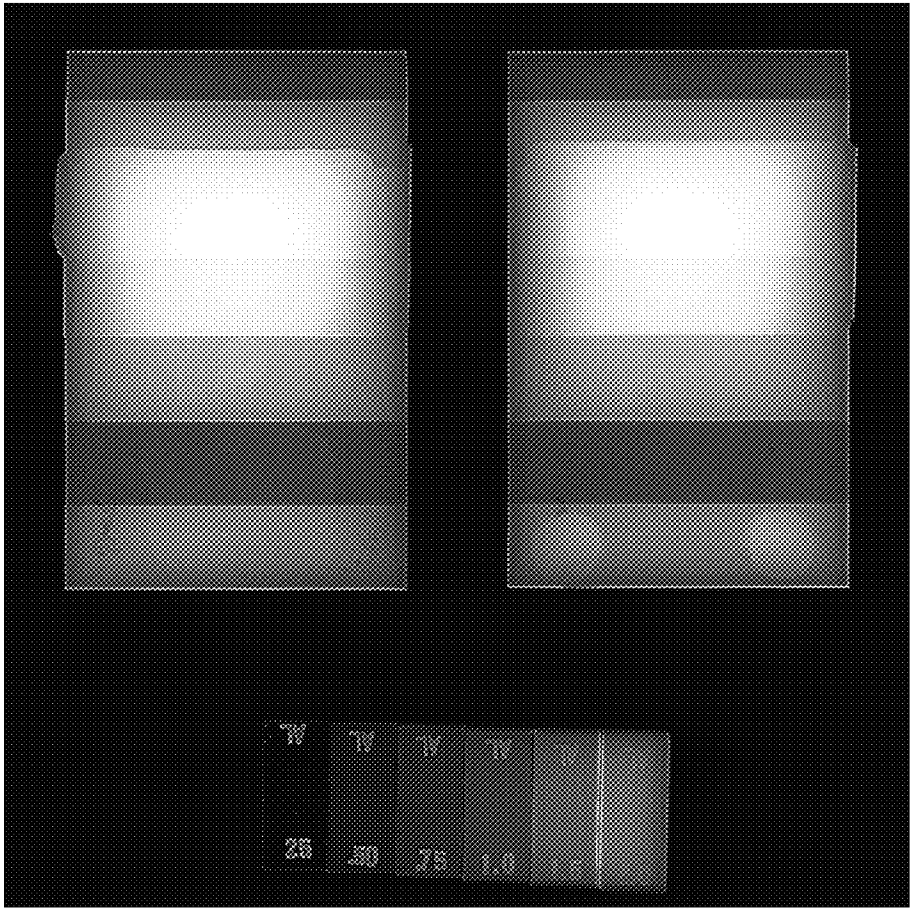
FIG. 10 is an X-ray photograph of a step-plate molded test sample of alloy ALC-400.

FIGS. 9, 10 show the castings conducted to determine alloy castability. Castability of ALC-400 was determined to be rated as a 5 out of 5.

Example II

Figure 11:
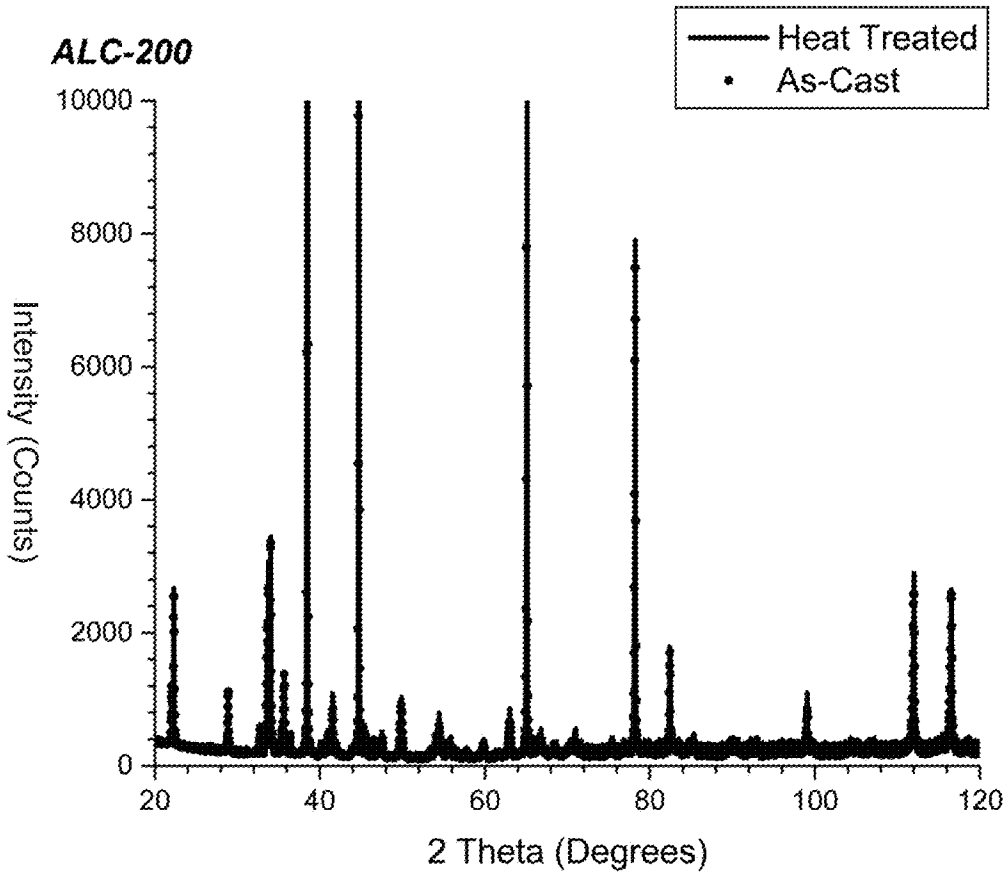
FIG. 11 is a graph showing full XRD spectra of both the as-cast and the heat-treated samples of alloy ALC-200.
Figure 12:
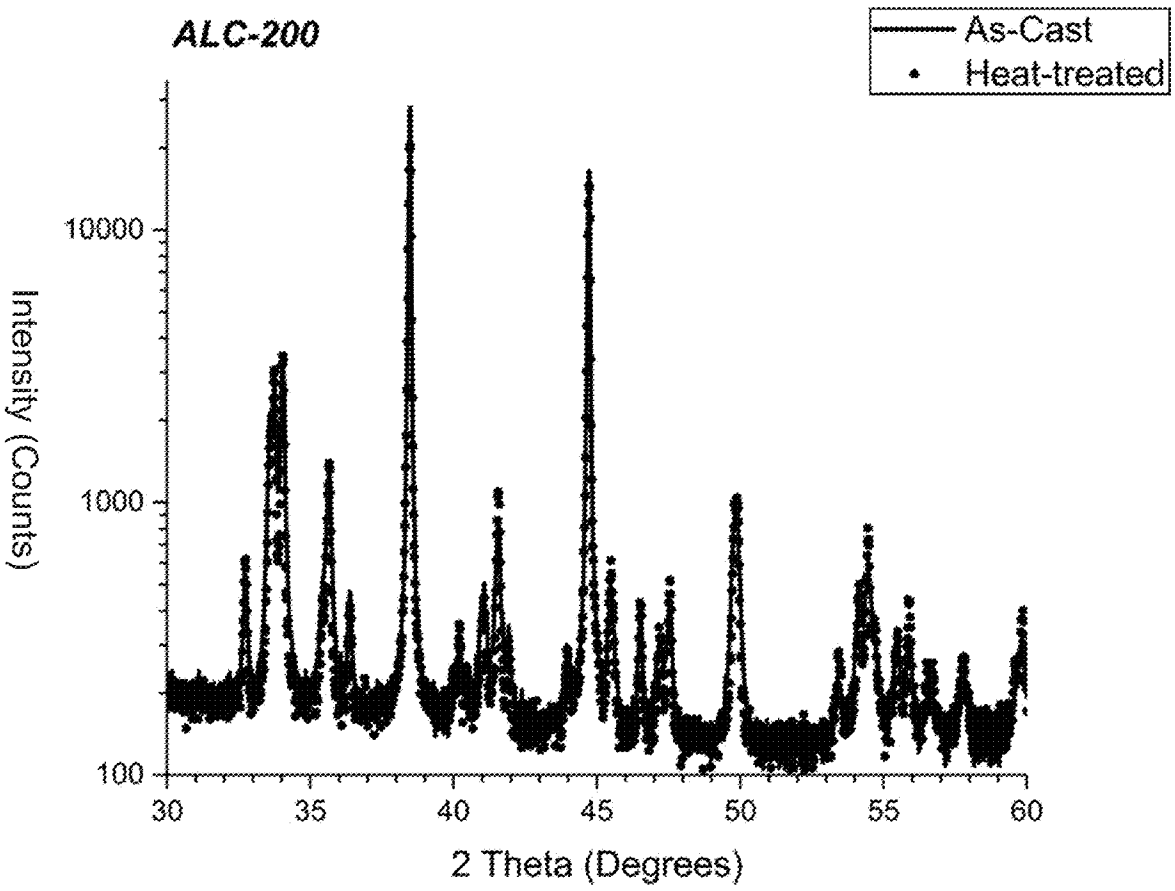
FIG. 12 is a graph showing focused XRD spectra of both the as-cast and the heat-treated samples of alloy ALC-200.
Figure 13:
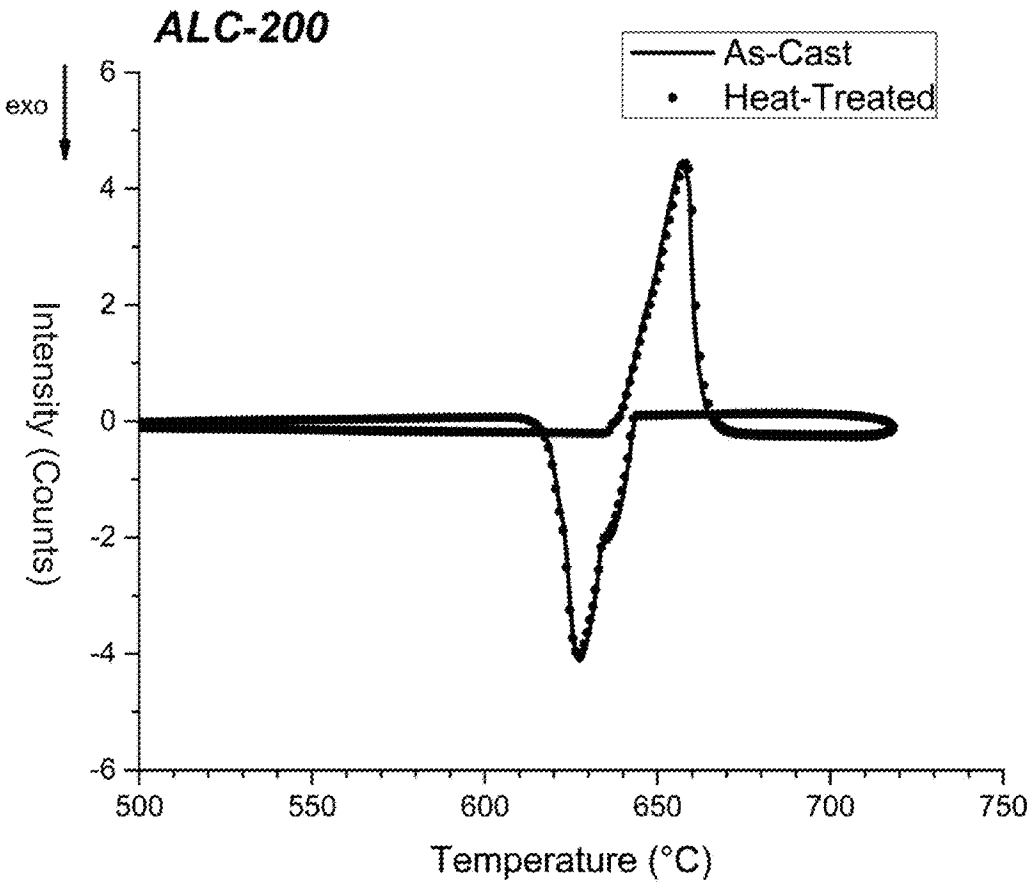
FIG. 13 is a graph showing DSC curves of both the as-cast and the heat-treated samples of alloy ALC-200.
Figure 14:
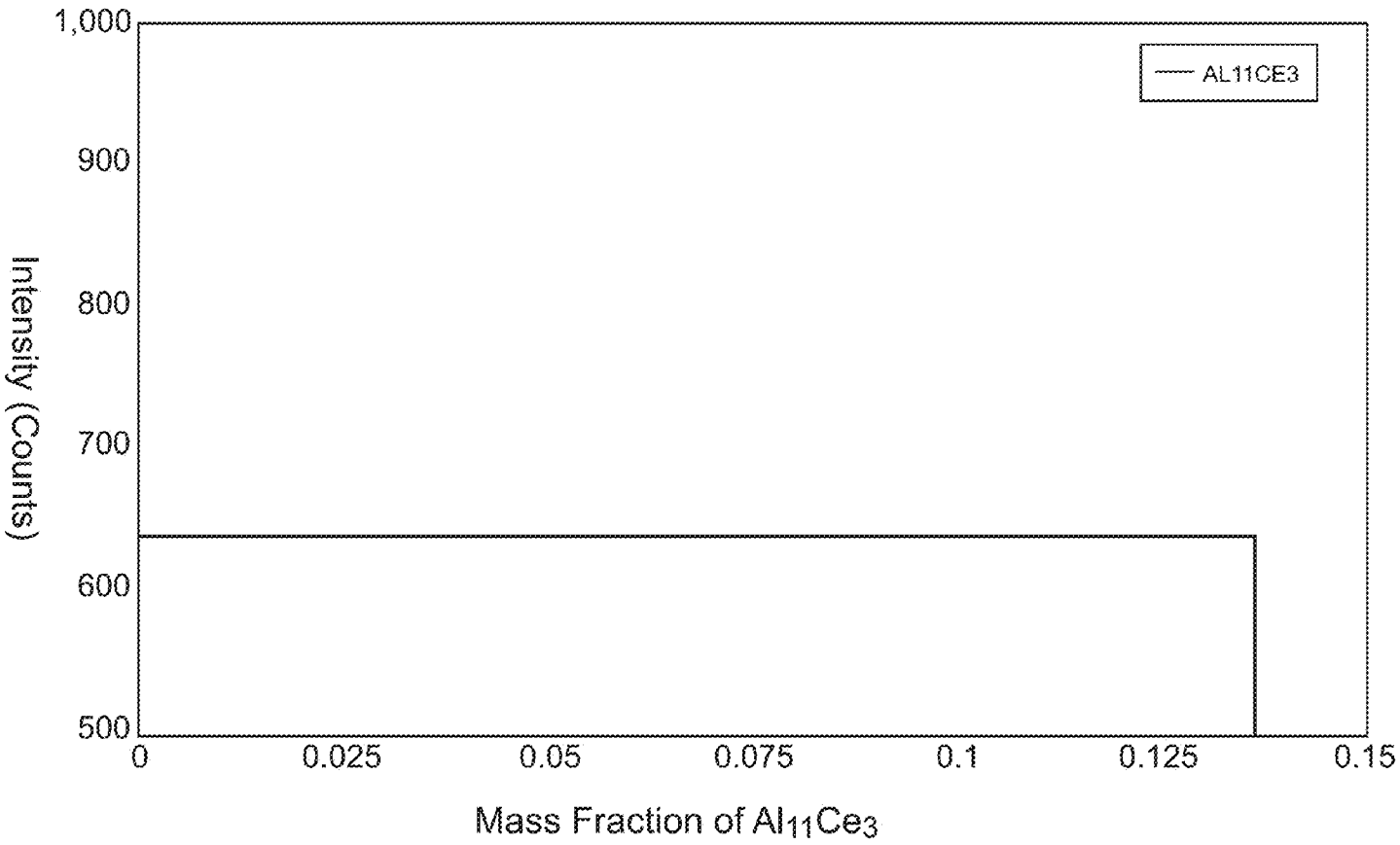
FIG. 14 is a graph showing an equilibrium solidification diagram for alloy ALC-200.
Figure 16:
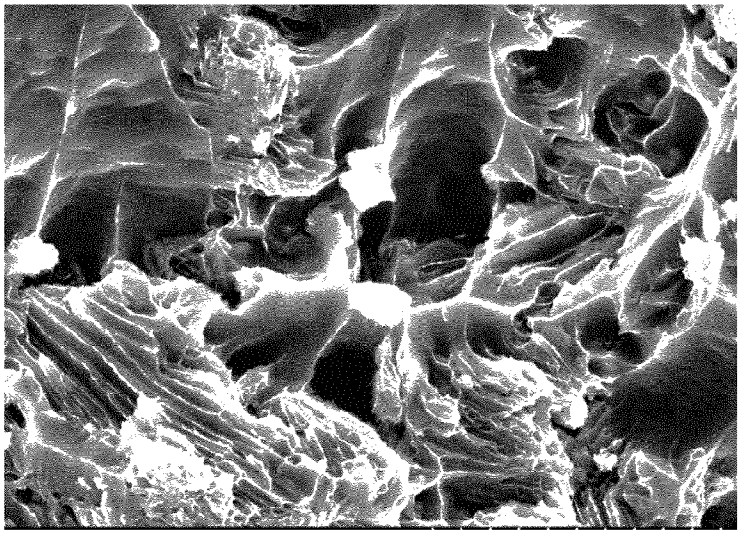
FIG. 16 is an SEM image of a fracture surface of as-cast alloy ALC-200.
Figure 15:
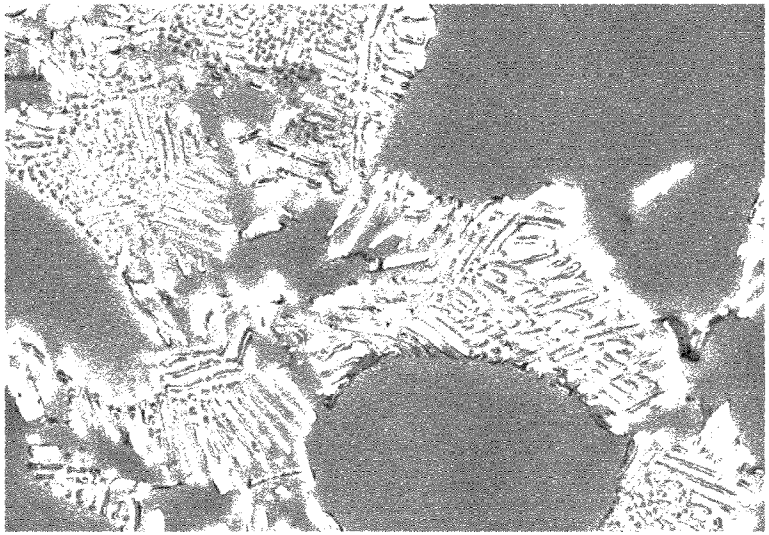
FIG. 15 is an SEM image showing the microstructure of as-cast alloy ALC-200.

Alloy ALC-200 having a composition of 8% Ce, balance Al was made and tested as described above in Example I. FIGS. 11, 12 show, respectively, full and focused XRD spectra of both the as-cast and the heat-treated sample. FIG. 13 shows DSC curves of both the as-cast and the heat-treated samples. FIG. 14 shows an equilibrium solidification diagram, which indicates an expected lower concentration of the intermetallic microstructure when compared with alloy ALC-400. FIGS. 15, 16 are respective SEM images showing the microstructure of as-cast and heat-treated alloy ALC-200.

Mechanical properties of as-cast and heat-treated alloy ALC-200 are presented in Table 2.

TABLE 2

| ALC-200 | Tensile (KSI) | Yield (KSI) | Elongation (%) | Phase Fraction FCC (wt %) | Phase Fraction Binary Intermetallic (wt %) |
|---|---|---|---|---|---|
| As-Cast Trial 1 | 21.5 | — | 15.0 | 89.4 | 10.6 |
| As-cast Trial 2 | 21.4 | — | 19.0 | — | — |
| T6 Trial 1 | 18.0 | 6.2 | 25.5 | 89.2 | 10.8 |
| T6 Trial 2 | 17.7 | 8.5 | 26.5 | — | — |

Figure 18:
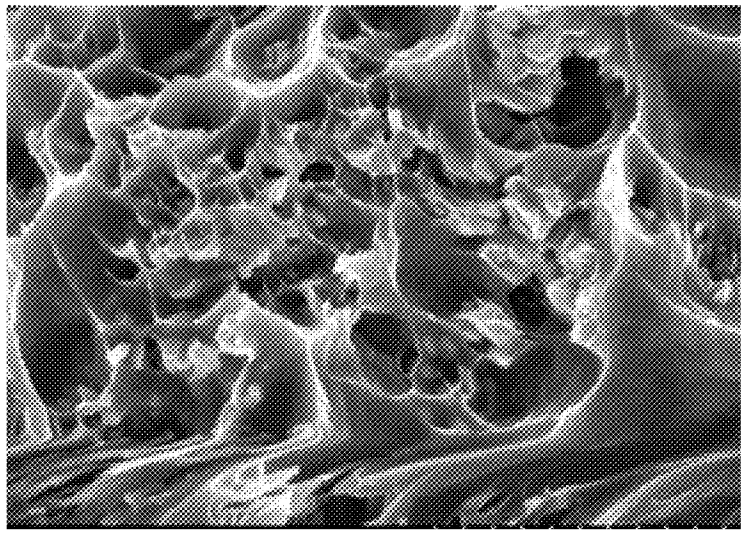
FIG. 18 is an SEM image of a fracture surface of heat-treated alloy ALC-200.
Figure 17:
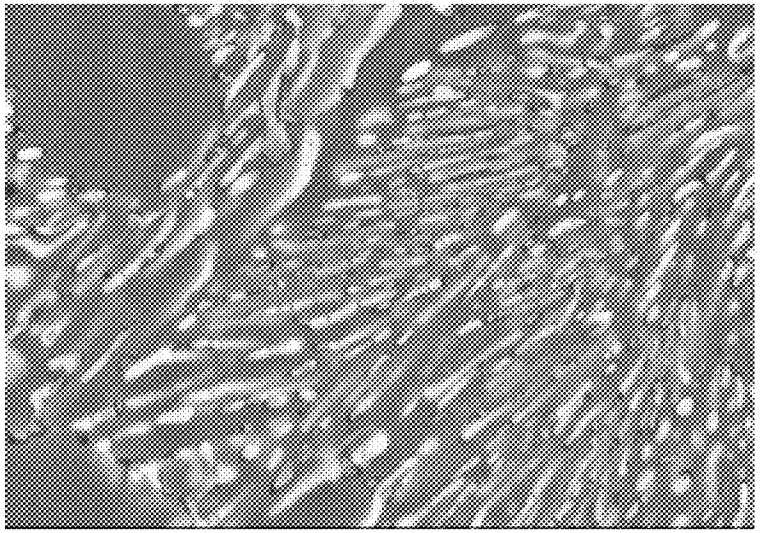
FIG. 17 is an SEM image showing the microstructure of heat-treated alloy ALC-200.
Figure 19:
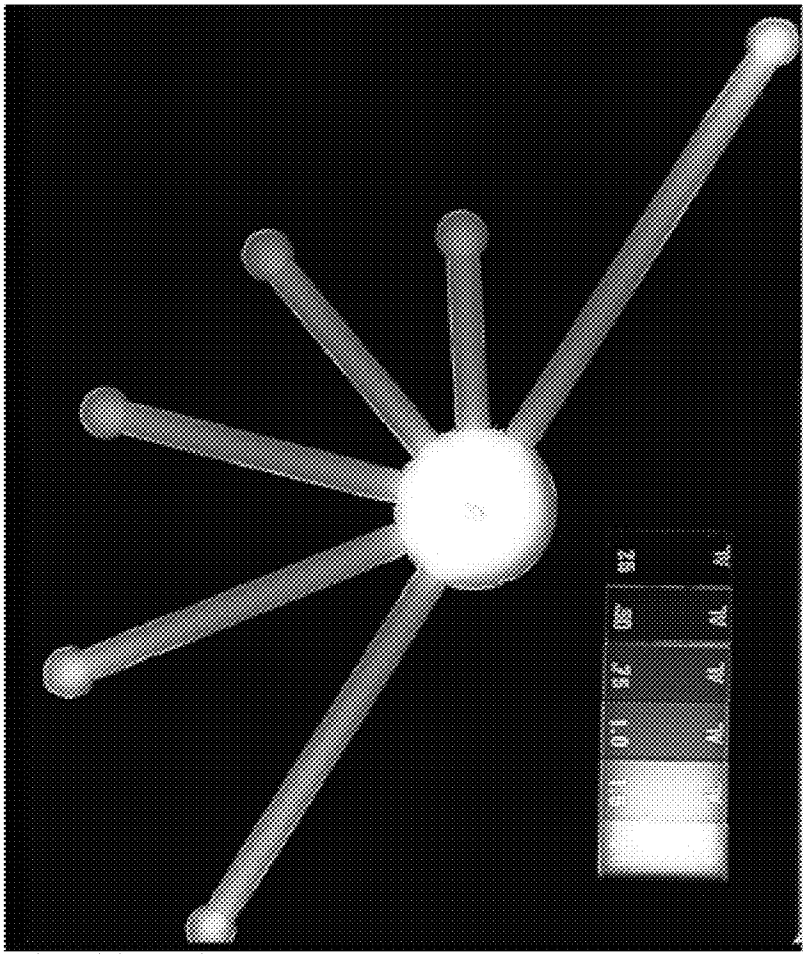
FIG. 19 is an X-ray photograph of a hot-tear molded test sample of alloy ALC-200.
Figure 20:
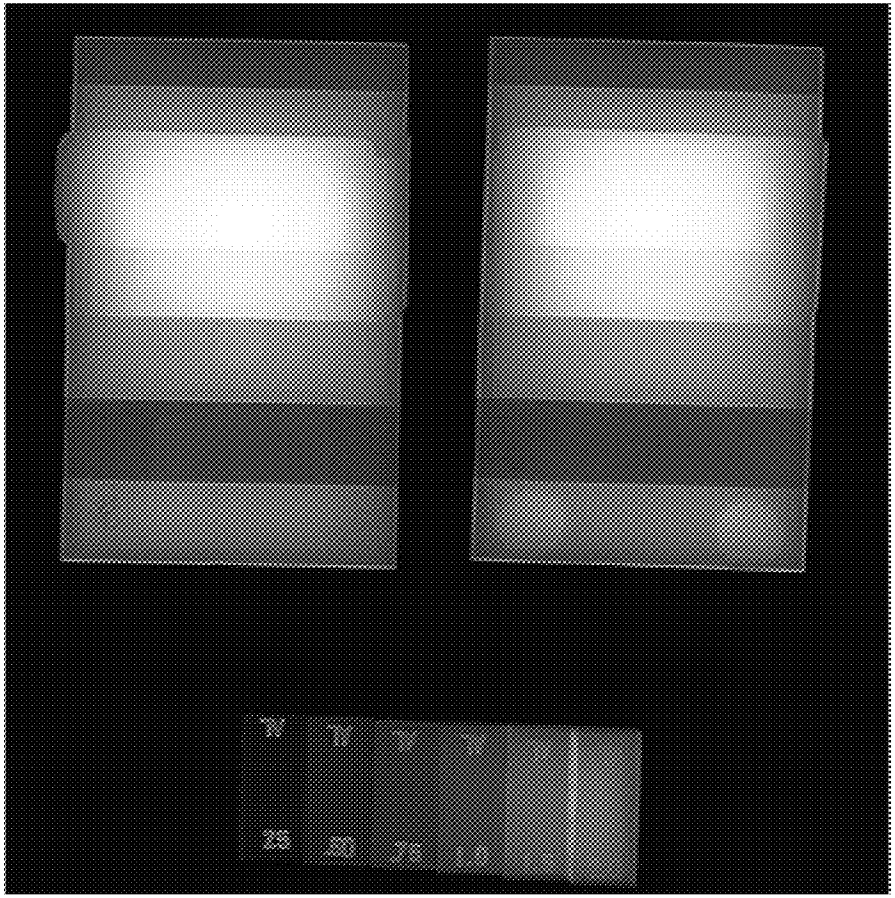
FIG. 20 is an X-ray photograph of a step-plate molded test sample of alloy ALC-200.

FIGS. 17, 18 are SEM images of respective fracture surfaces of as-cast and heat-treated alloy ALC-200. FIGS. 19, 20 show the castings conducted to determine alloy castability. Castability of ALC-200 was determined to be rated as a 5 out of 5.

Example III

Figure 21:
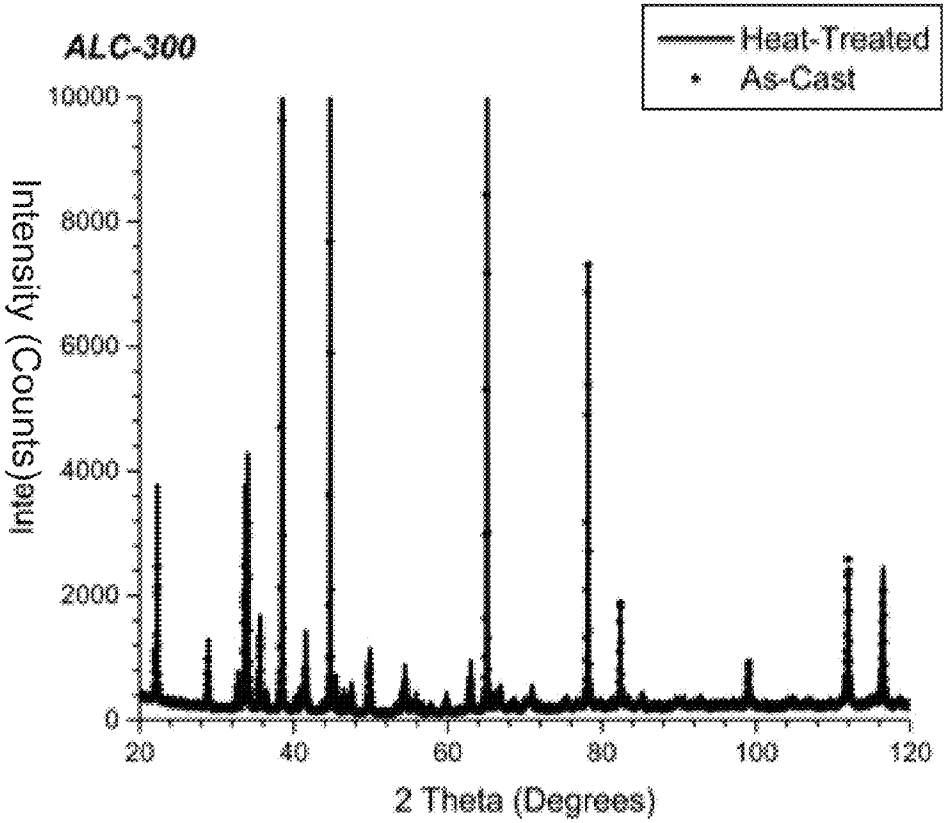
FIG. 21 is a graph showing full XRD spectra of both the as-cast and the heat-treated samples of alloy ALC-300.
Figure 22:
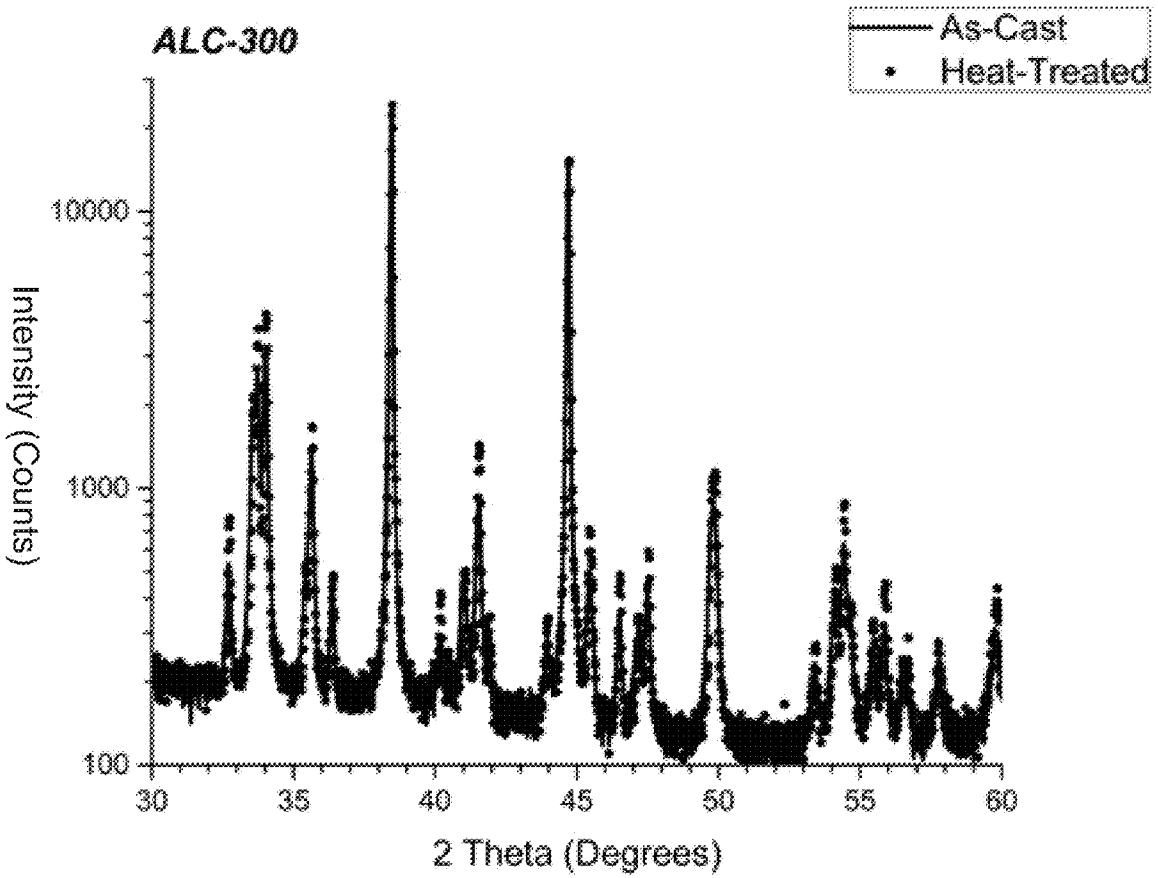
FIG. 22 is a graph showing focused XRD spectra of both the as-cast and the heat-treated samples of alloy ALC-300.
Figure 23:
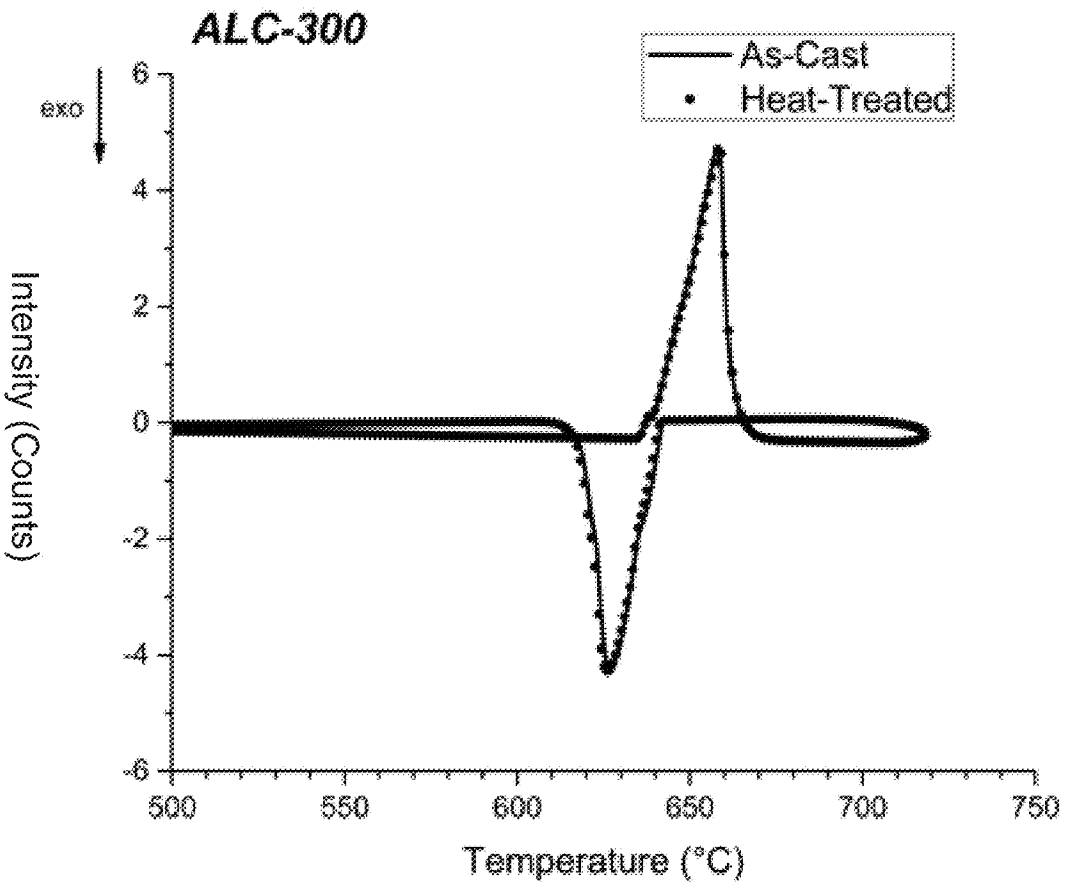
FIG. 23 is a graph showing DSC curves of both the as-cast and the heat-treated samples of alloy ALC-300.
Figure 24:
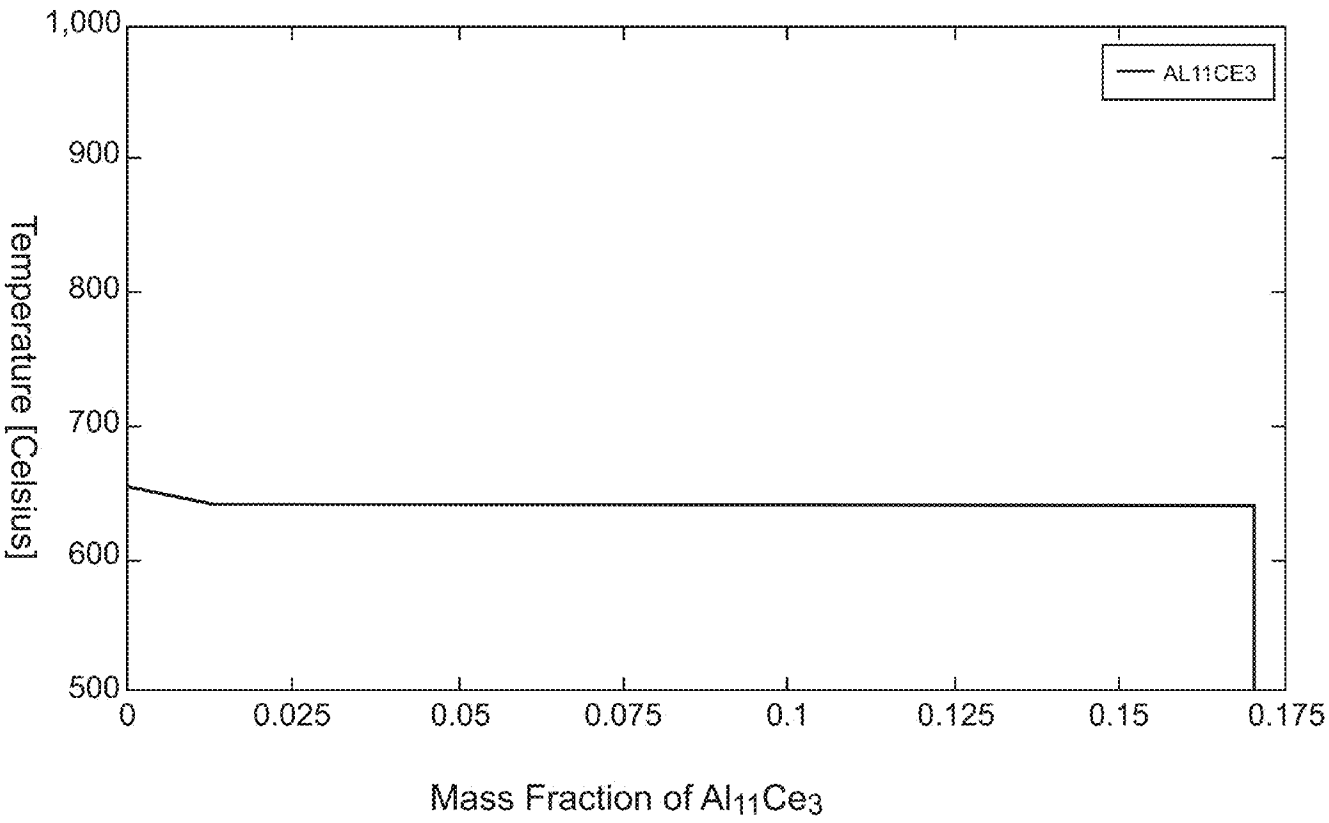
FIG. 24 is a graph showing an equilibrium solidification diagram for alloy ALC-300.
Figure 26:
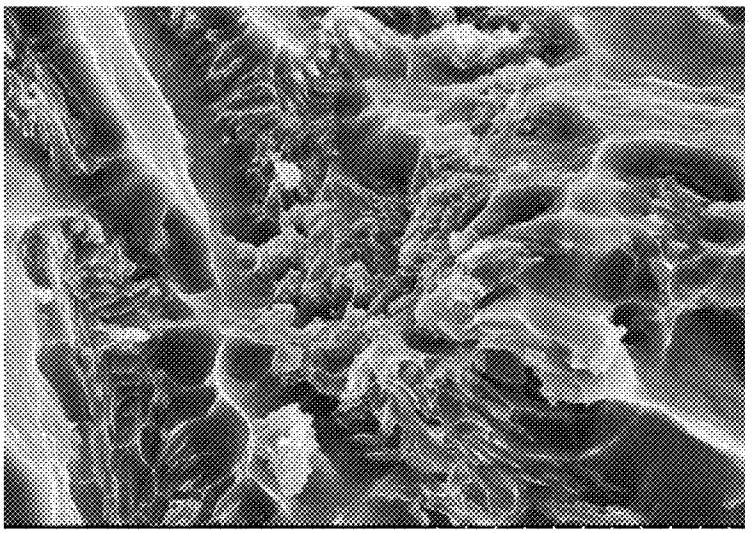
FIG. 26 is an SEM image of a fracture surface of as-cast alloy ALC-300.
Figure 25:
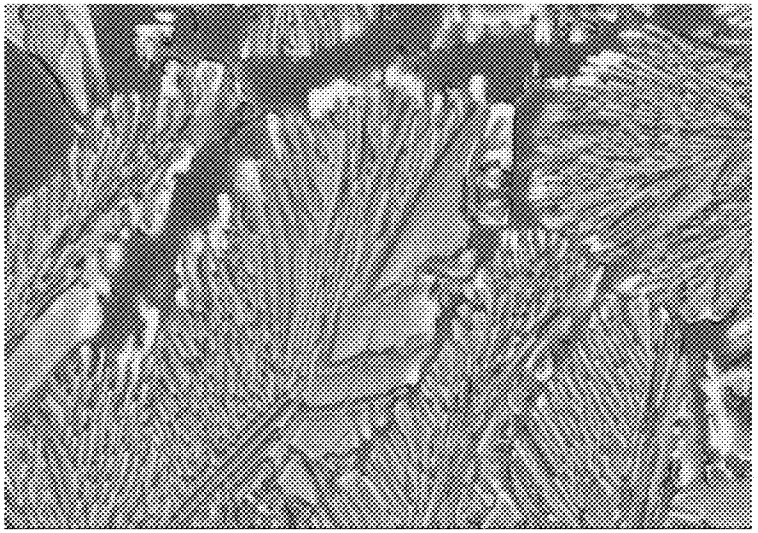
FIG. 25 is an SEM image showing the microstructure of as-cast alloy ALC-300.

Alloy ALC-300 having a composition of 10% Ce, balance Al was made and tested as described above in Example I. FIGS. 21, 22 show, respectively, full and focused XRD spectra of both the as-cast and the heat-treated sample. FIG. 23 shows DSC curves of both the as-cast and the heat-treated samples. FIG. 24 shows an equilibrium solidification diagram. FIGS. 25, 26 are respective SEM images showing the microstructure of as-cast and heat-treated alloy ALC-300.

Mechanical properties of as-cast and heat-treated alloy ALC-300 are presented in Table 3.

TABLE 3

| ALC-300 | Tensile (KSI) | Yield (KSI) | Elongation (%) | Phase Fraction FCC (wt %) | Phase Fraction Binary Intermetallic (wt %) |
|---|---|---|---|---|---|
| As-Cast Trial 1 | 22.2 | — | 8.0 | 85.3 | 15.7 |
| As-cast Trial 2 | 21.7 | — | 8.5 | — | — |
| T6 Trial 1 | 18.7 | 6.7 | 24.0 | 86.6 | 13.4 |
| T6 Trial 2 | 18.6 | 6.6 | 24.0 | — | — |

Figure 28:
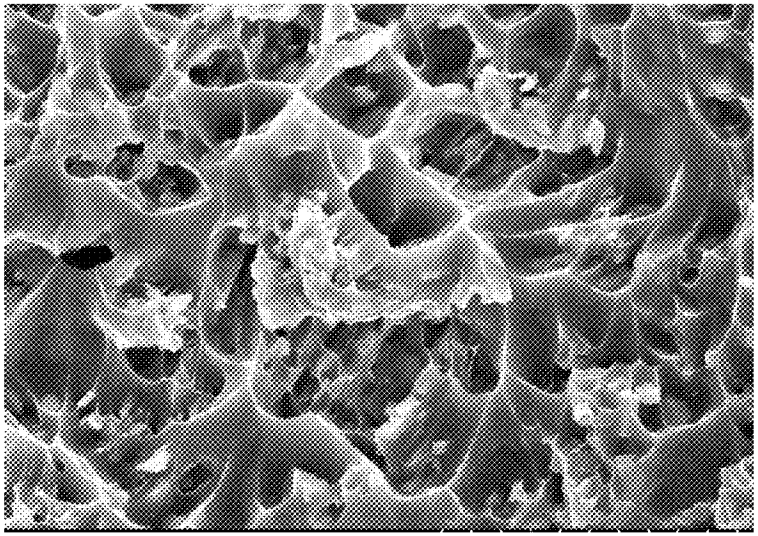
FIG. 28 is an SEM image of a fracture surface of heat-treated alloy ALC-300.
Figure 27:
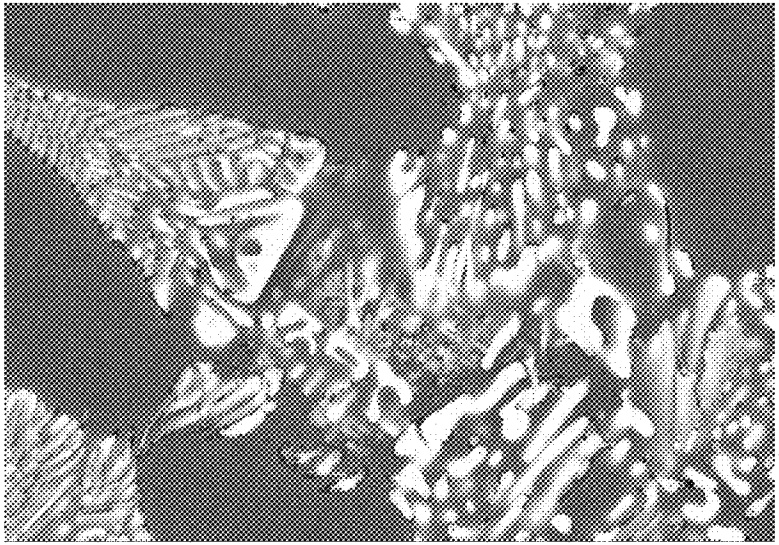
FIG. 27 is an SEM image showing the microstructure of heat-treated alloy ALC-300.
Figure 29:
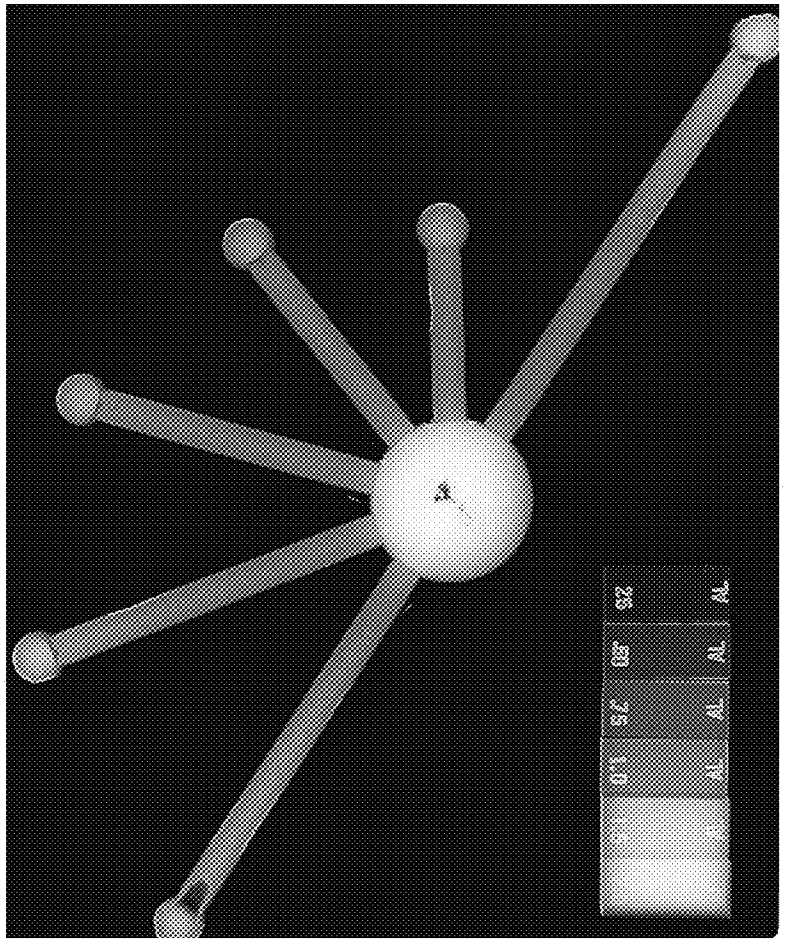
FIG. 29 is an X-ray photograph of a hot-tear molded test sample of alloy ALC-300.
Figure 30:
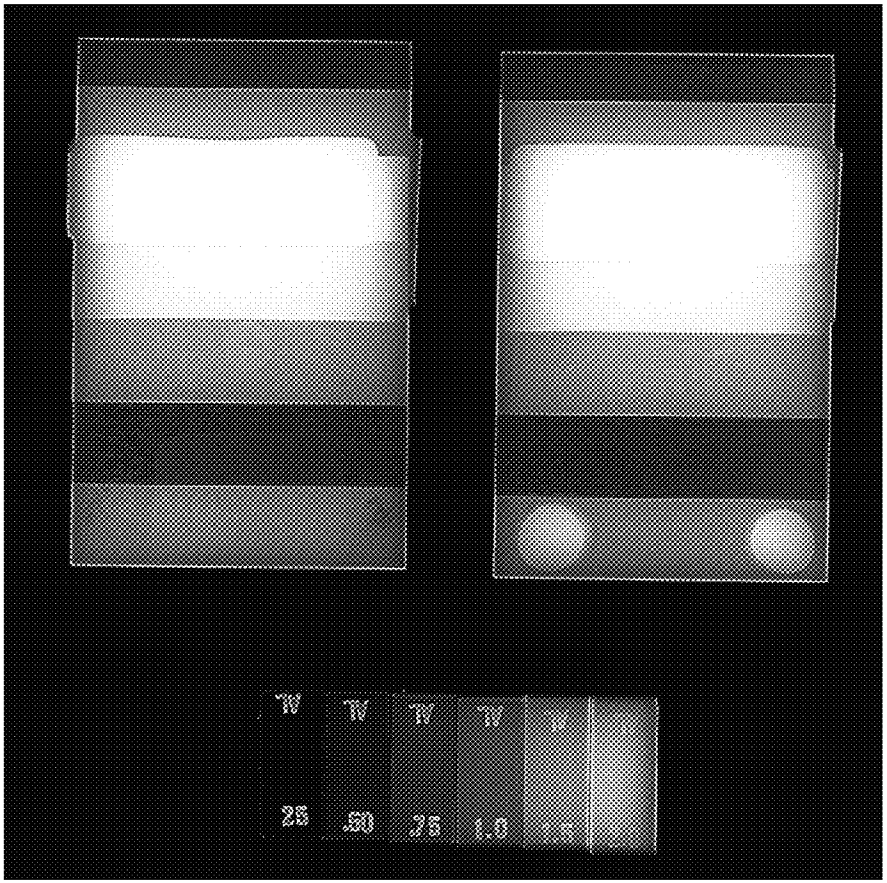
FIG. 30 is an X-ray photograph of a step-plate molded test sample of alloy ALC-300.

FIGS. 27, 28 are SEM images of respective fracture surfaces of as-cast and heat-treated alloy ALC-300. FIGS. 29, 30 show the castings conducted to determine alloy castability. Castability of ALC-300 was determined to be rated as a 4 out of 5.

Example IV

Figure 31:
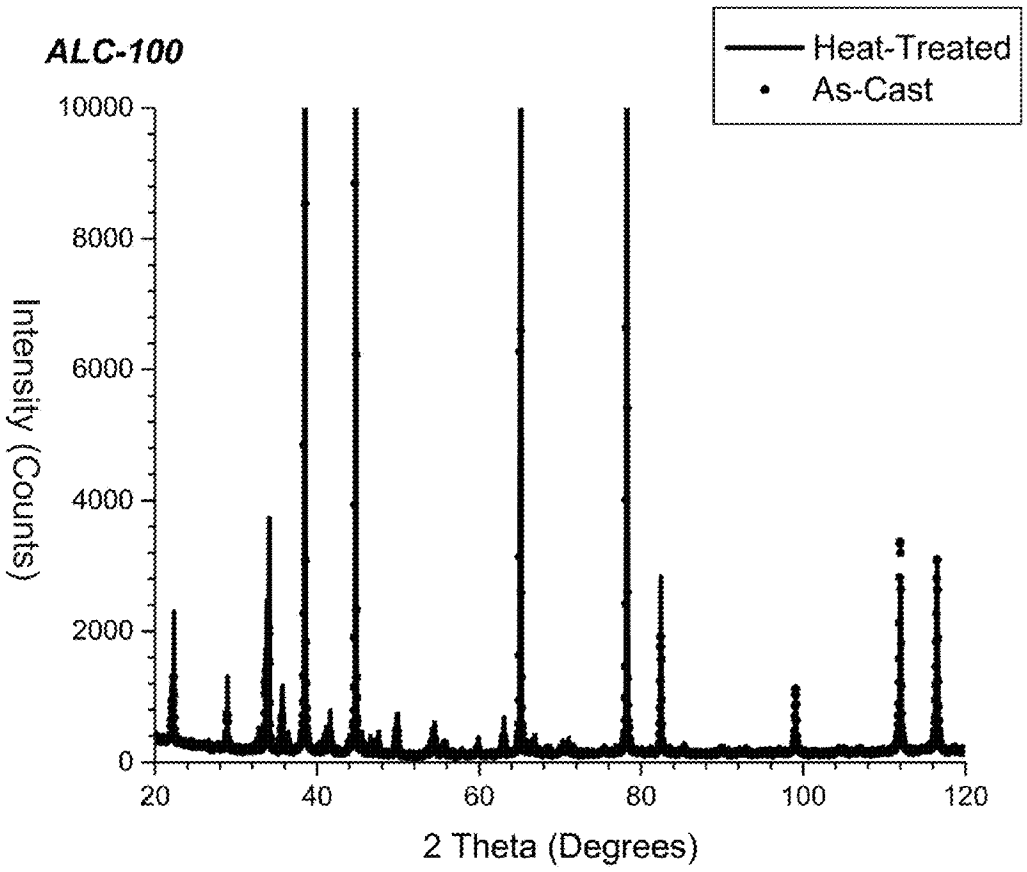
FIG. 31 is a graph showing full XRD spectra of both the as-cast and the heat-treated samples of alloy ALC-100.
Figure 32:
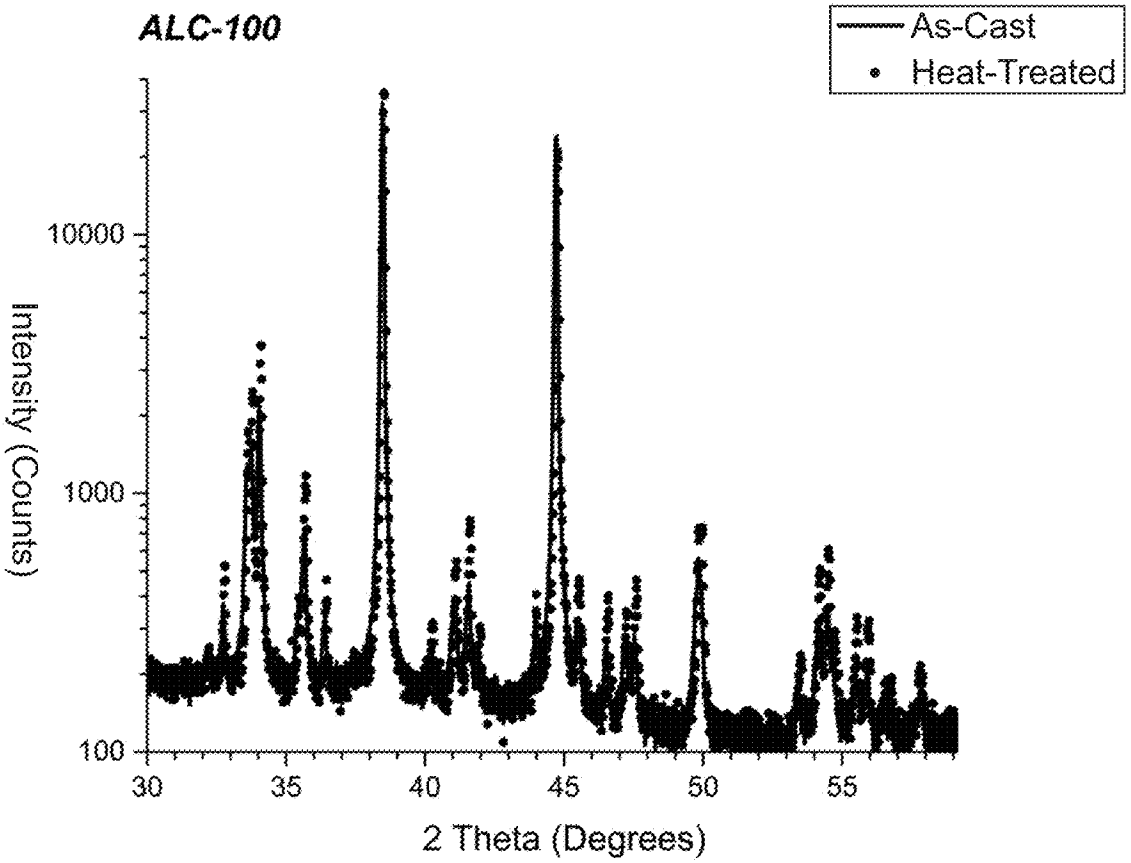
FIG. 32 is a graph showing focused XRD spectra of both the as-cast and the heat-treated samples of alloy ALC-100.
Figure 33:
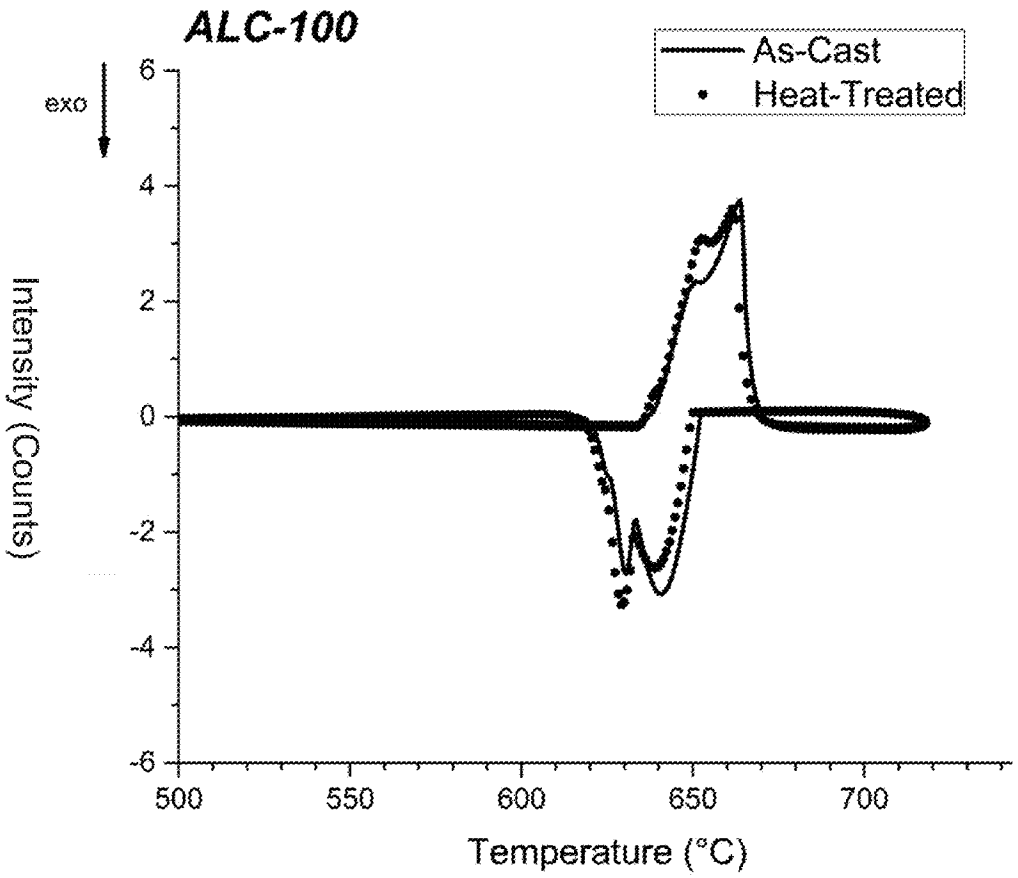
FIG. 33 is a graph showing DSC curves of both the as-cast and the heat-treated samples of alloy ALC-100.

Alloy ALC-100 having a composition of 6% Ce, balance Al was made and tested as described above in Example I. FIGS. 31, 32 show, respectively, full and focused XRD spectra of both the as-cast and the heat-treated sample. FIG. 33 shows DSC curves of both the as-cast and the heat-treated samples. The DCS curves for ALC-100 show a different shape than other binary alloy samples; there is a second phase transition just before the solidification peak.

Figure 34:
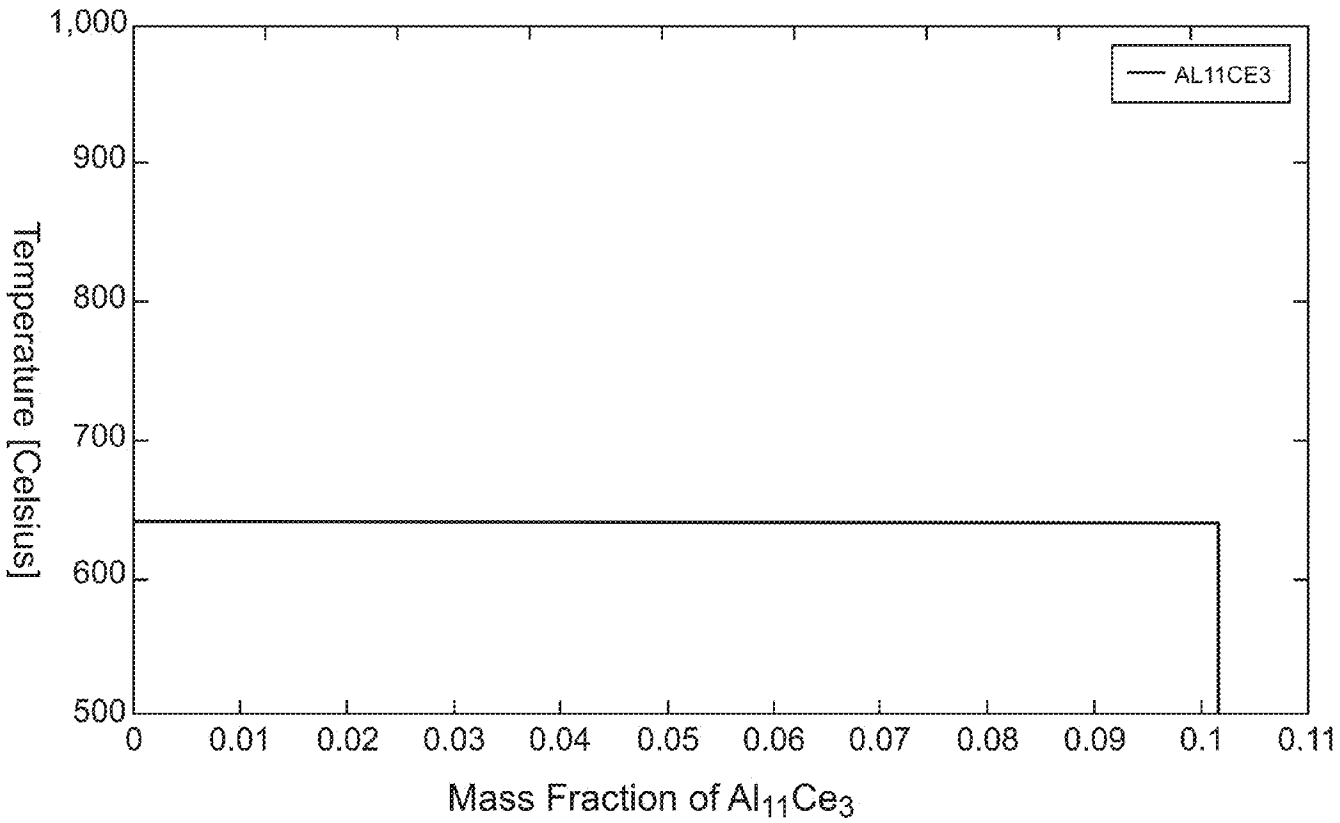
FIG. 34 is a graph showing an equilibrium solidification diagram for alloy ALC-100.
Figure 36:
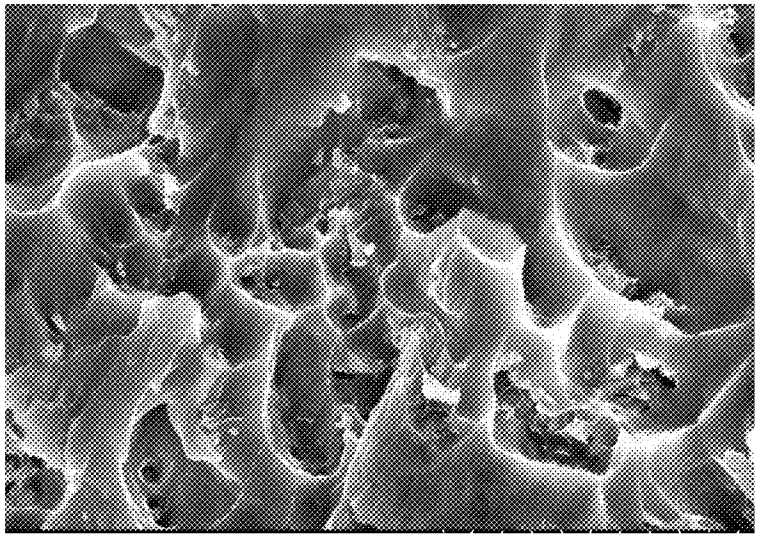
FIG. 36 is an SEM image of a fracture surface of as-cast alloy ALC-100.
Figure 35:
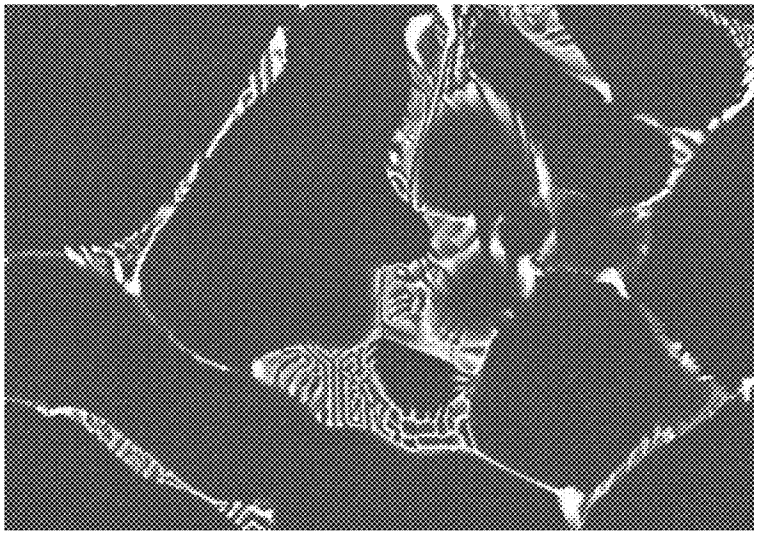
FIG. 35 is an SEM image showing the microstructure of as-cast alloy ALC-100.

FIG. 34 shows an equilibrium solidification diagram. FIGS. 35, 36 are respective SEM images showing the microstructure of as-cast and heat-treated alloy ALC-100.

Mechanical properties of as-cast and heat-treated alloy ALC-100 are presented in Table 4.

TABLE 4

| ALC-100 | Tensile (KSI) | Yield (KSI) | Elongation (%) | Phase Fraction FCC (wt %) | Phase Fraction Binary Intermetallic (wt %) |
|---|---|---|---|---|---|
| As-Cast Trial 1 | 15.0 | 4.3 | 25.0 | 93.0 | 7.0 |
| As-cast Trial 2 | 14.7 | 4.0 | 21.5 | — | — |
| T6 Trial 1 | 14.9 | 4.8 | 33.5 | 93.3 | 6.7 |
| T6 Trial 2 | 14.4 | 5.8 | 18.0 | — | — |

Figure 38:
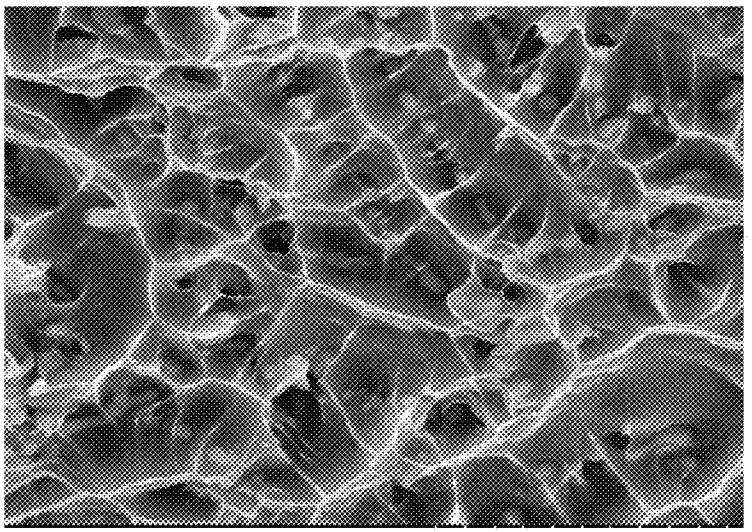
FIG. 38 is an SEM image of a fracture surface of heat-treated alloy ALC-100.
Figure 37:
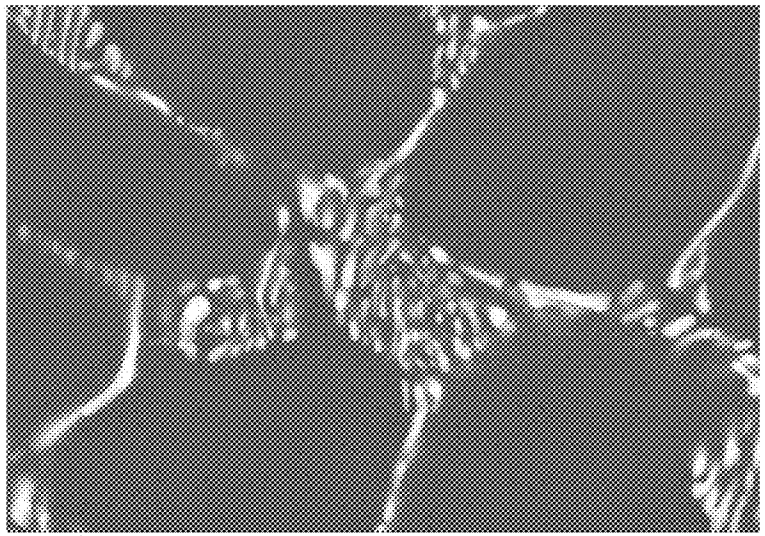
FIG. 37 is an SEM image showing the microstructure of heat-treated alloy ALC-100.
Figure 39:
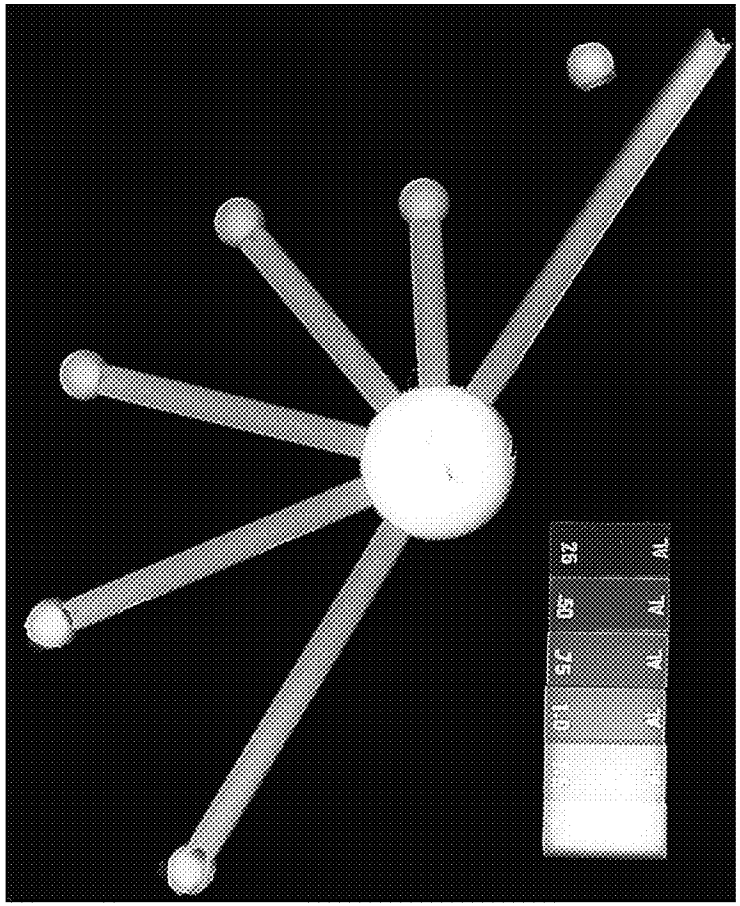
FIG. 39 is an X-ray photograph of a hot-tear molded test sample of alloy ALC-100.
Figure 40:
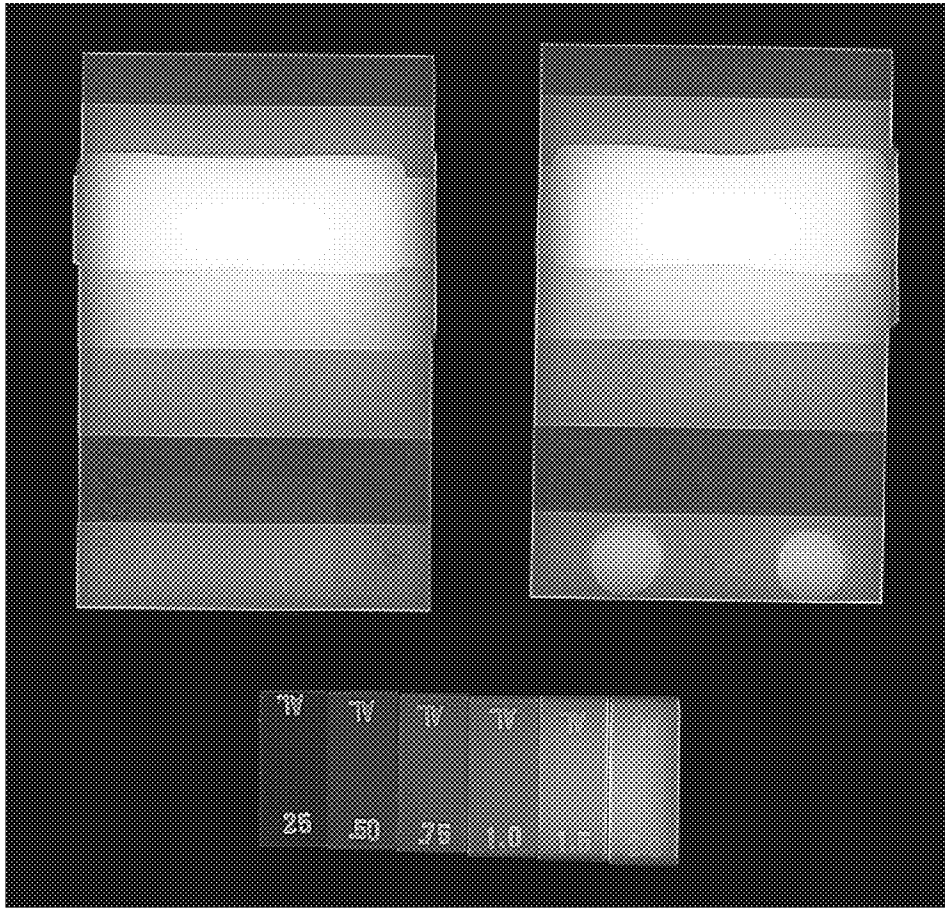
FIG. 40 is an X-ray photograph of a step-plate molded test sample of alloy ALC-100.

FIGS. 37, 38 are SEM Images of respective fracture surfaces of as-cast and heat-treated alloy ALC-100. FIGS. 39, 40 show the castings conducted to determine alloy castability. Castability of ALC-100 was rated a 3 out of 5.

Example V

Figure 41:
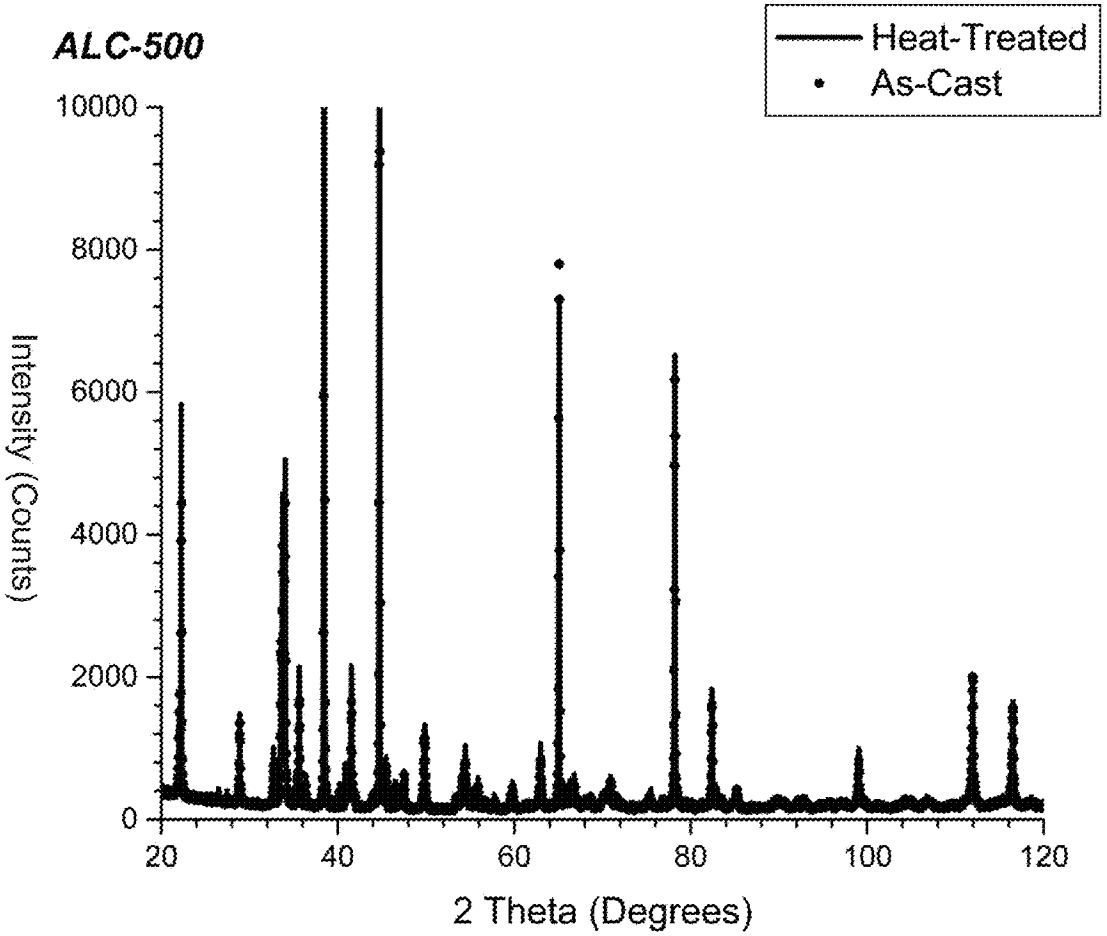
FIG. 41 is a graph showing full XRD spectra of both the as-cast and the heat-treated samples of alloy ALC-500.
Figure 42:
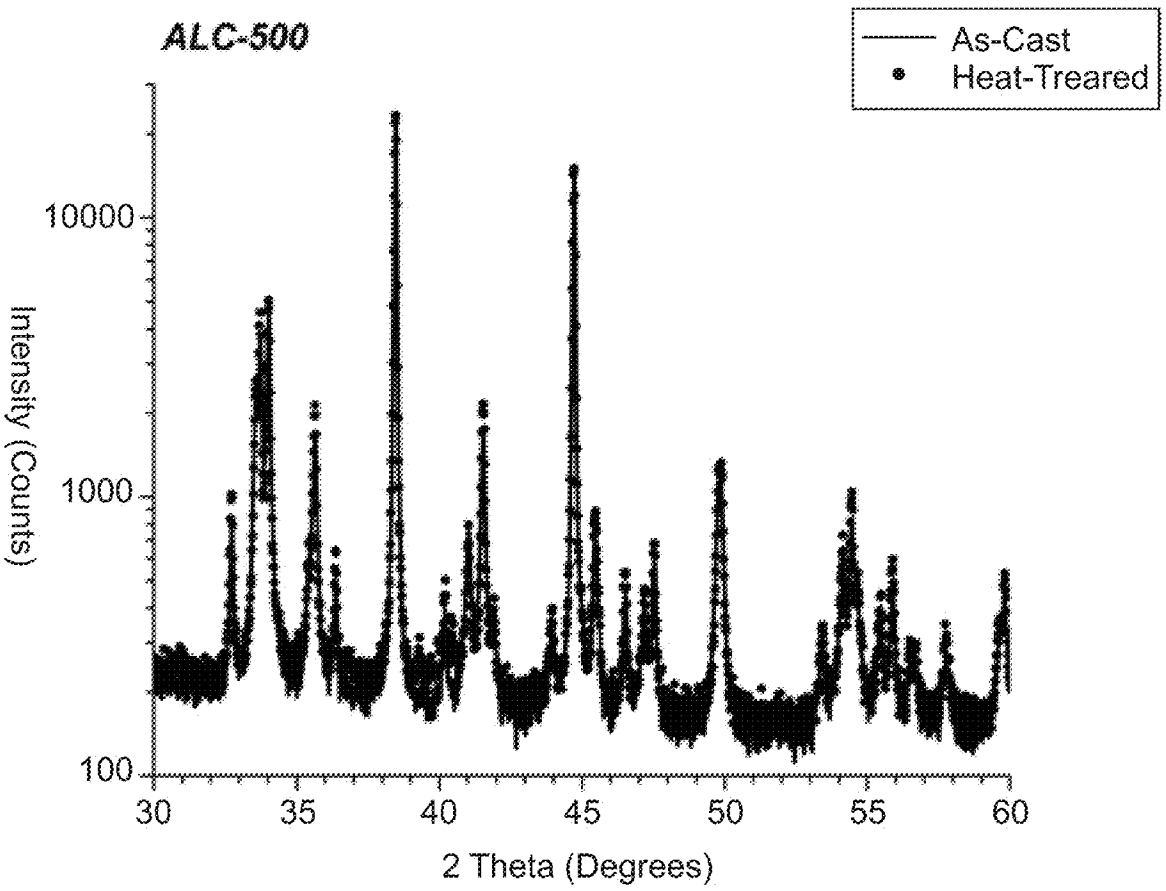
FIG. 42 is a graph showing focused XRD spectra of both the as-cast and the heat-treated samples of alloy ALC-500.
Figure 43:
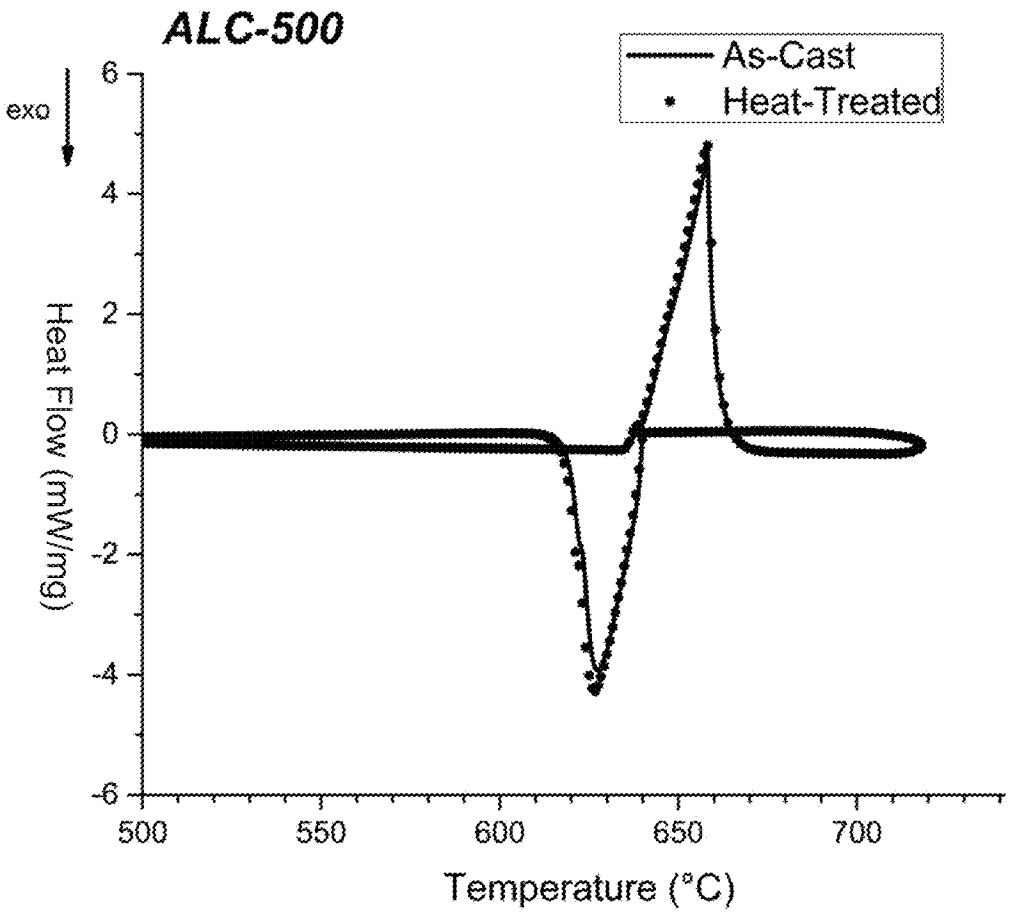
FIG. 43 is a graph showing DSC curves of both the as-cast and the heat-treated samples of alloy ALC-500.

Alloy ALC-500 having a composition of 16% Ce, balance Al was made and tested as described above in Example I. FIGS. 41, 42 show, respectively, full and focused XRD spectra of both the as-cast and the heat-treated sample. FIG. 43 shows DSC curves of both the as-cast and the heat-treated samples.

Figure 44:
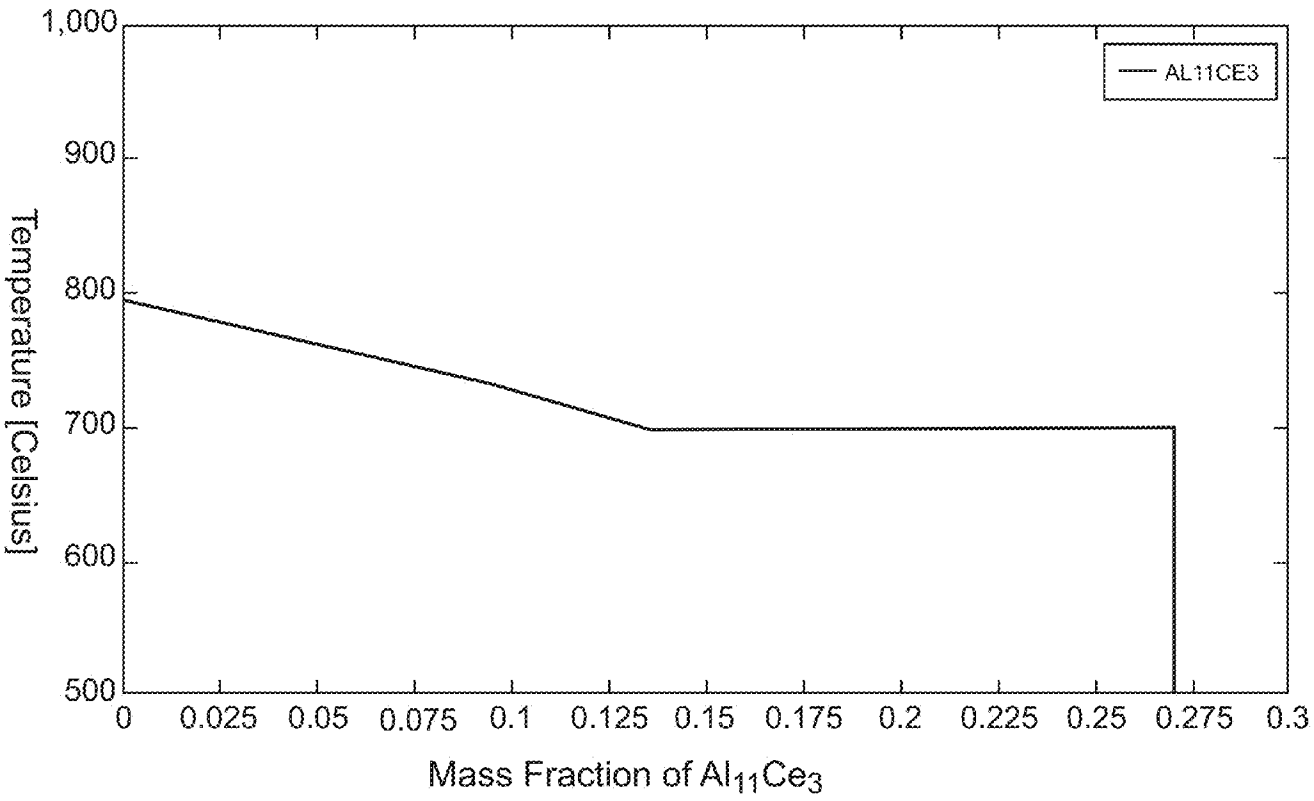
FIG. 44 is a graph showing an equilibrium solidification diagram for alloy ALC-500.

FIG. 44 shows a equilibrium solidification diagram. Alloy ALC-500 has the highest content of the intermetallic and also shows the greatest similarity between the as-cast and heat-treated DSC curves and XRD spectra.

Figure 46:
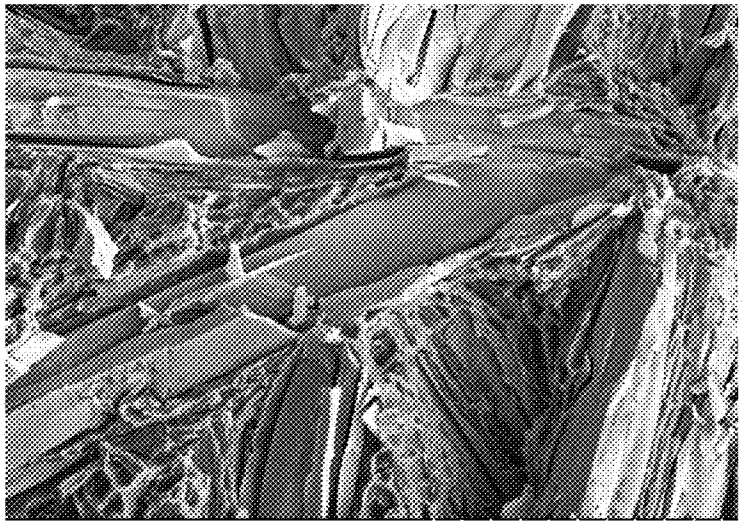
FIG. 46 is an SEM image of a fracture surface of as-cast alloy ALC-500.
Figure 45:
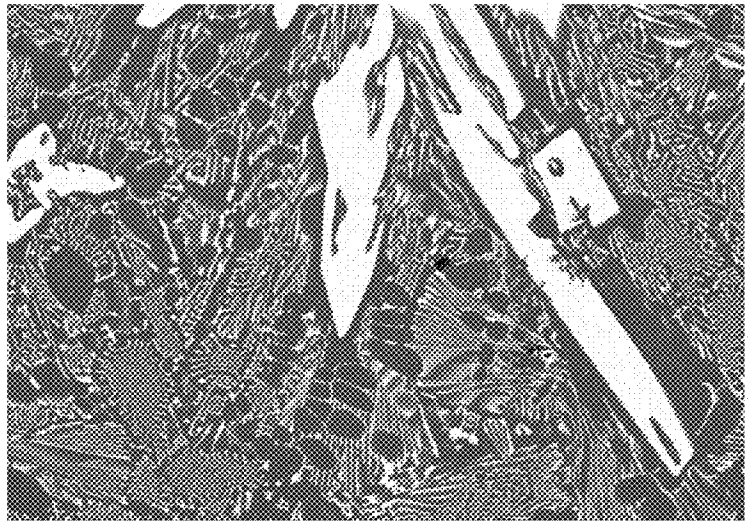
FIG. 45 is an SEM image showing the microstructure of as-cast alloy ALC-500.

FIGS. 45, 46 are respective SEM images showing the microstructure of as-cast and heat-treated alloy ALC-500. Large primary crystals can be seen in the microstructures. These large primary crystals are likely the cause of the low ductility observed in these samples, as they create large brittle fracture planes, which can be seen in the SEM images of the fracture surfaces.

Mechanical properties of as-cast and heat-treated alloy ALC-500 are presented in Table 5.

TABLE 5

| ALC-500 | Tensile (KSI) | Yield (KSI) | Elongation (%) | Phase Fraction FCC (wt %) | Phase Fraction Binary Intermetallic (wt %) |
|---|---|---|---|---|---|
| As-Cast Trial 1 | 20.9 | 9.8 | 2.5 | 75.9 | 24.1 |
| As-cast Trial 2 | 20.4 | 9.9 | 2.0 | — | — |
| T6 Trial 1 | 16.5 | 11.3 | 3.5 | 77.6 | 22.4 |
| T6 Trial 2 | 17.1 | 8.1 | 3.5 | — | — |

Figure 48:
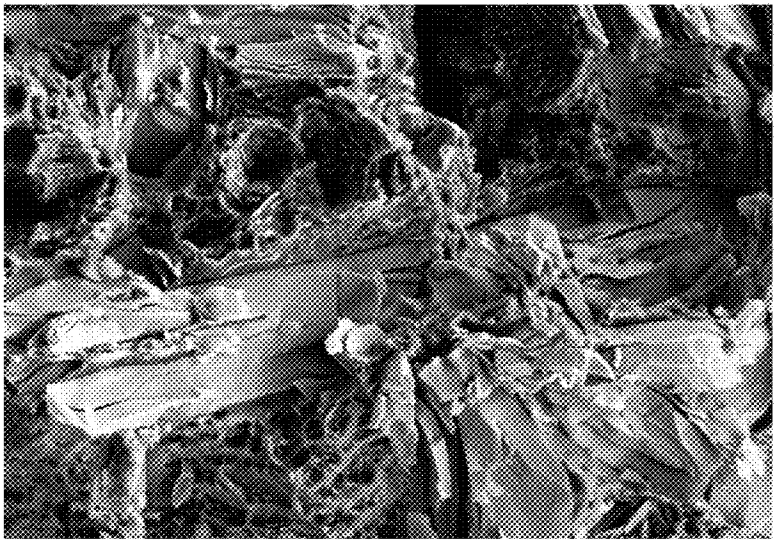
FIG. 48 is an SEM Image of a fracture surface of heat-treated alloy ALC-500.
Figure 47:
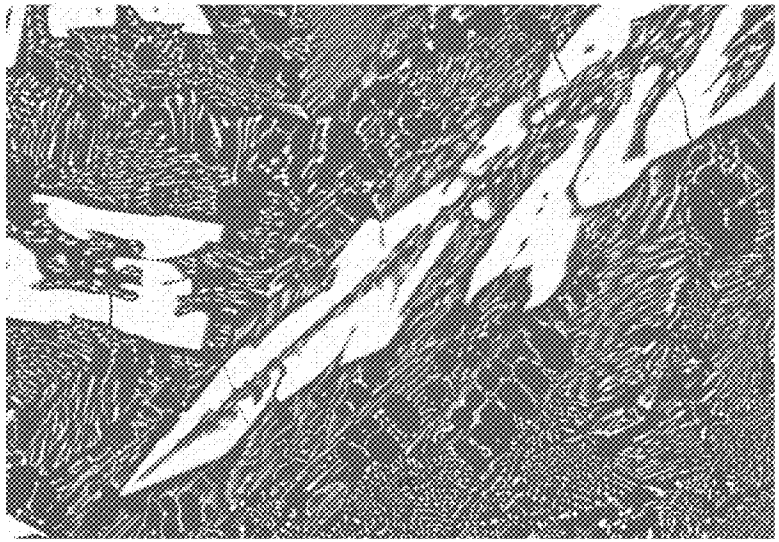
FIG. 47 is an SEM image showing the microstructure of heat-treated alloy ALC-500.

FIGS. 47, 48 are SEM images of respective fracture surfaces of as-cast and heat-treated alloy ALC-500. The fracture surfaces show the very large brittle fracture surfaces. Alloy ALC-500 was not cast in hot-tear molds or step-plates; however, sufficient evidence was seen in the castings of other test bars to rate castability as about 4 out of 5.

A specimen of alloy ALC-500 was characterized by its magnetic properties near and below room temperature, as shown in FIGS. 49-52. The magnetic susceptibility per gram at 300 K is $2.85\times10^{-6}$ $cm^3/g$. The material exhibits an increasing susceptibility with decreasing temperature typical of paramagnetic materials with local magnetic moments. Below about 10 K the susceptibility increases sharply. Measurements at low magnetic field (1 kOe) reveal a ferromagnetic Curie temperature of 6-7 K. A downturn below about 3.4 K suggests a transition out of the ferromagnetic state at lower temperatures. The observed temperature dependence is consistent with literature reports for $Ce_3Al_{11}$, which is known to have upon cooling, a paramagnetic to ferromagnetic transition at 6.3 K and a ferromagnetic to antiferromagnetic transition at 3.2 K.

XRD spectra in FIGS. 41, 42 show that ALC-500 has 24 wt. % $Ce_3Al_{11}$ with the balance "Al". The average magnetic susceptibility of these constituents at 300K is reported to be $9.3\times10^{-6}$ $cm^3/g$ for $Ce_3Al_{11}$, and $0.61\times20^{-6}$ $cm^3/g$ for Al. Thus, the weighted susceptibility calculated to be $2.7\times10^{-6}$ $cm^3/g$, in good agreement with the measured value of $2.85\times10^{-6}$ $cm^3/g$.

Figure 49:
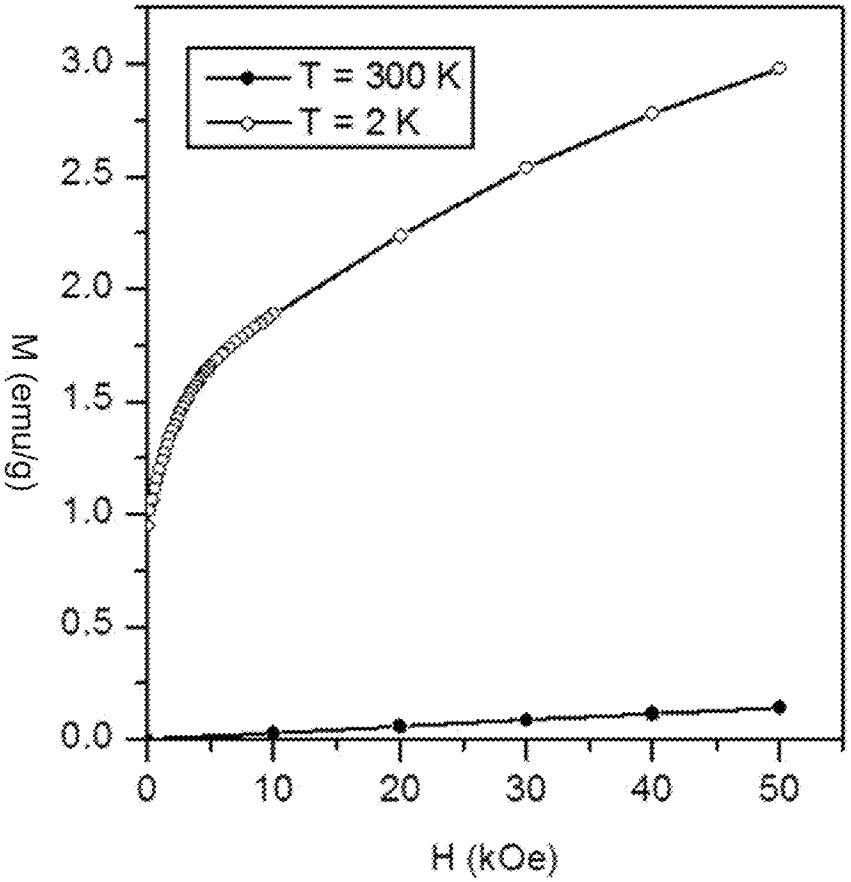
FIG. 49 is a graph showing the magnetic moment of alloy ALC-500 measured at 300K and 2K in an applied field of up to 5 T.

Referring to FIG. 49, the magnetic moment of alloy ALC-500 measured at 2K in an applied field of 5 T is 3.0 emu/g. The reported average moment for $Ce_3Al_{11}$ at this temperature and field is 10.8 emu/g. This indicates a concentration of 28 wt. % $Ce_3Al_{11}$ in ALC-500, similar to the XRD result (24 wt. %), and within expected margin-of-error considerations.

Figure 77:
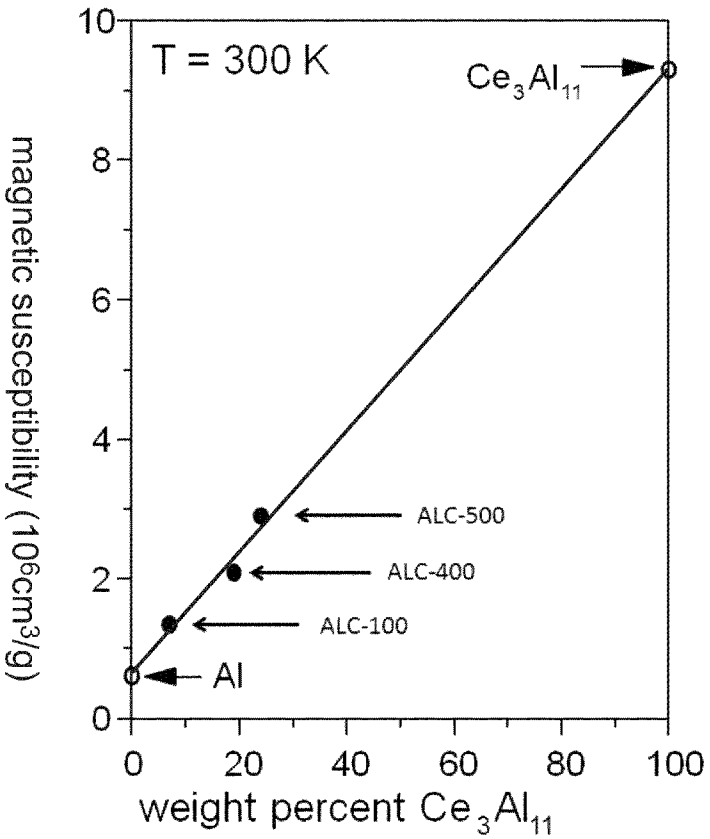
FIG. 77 is a graph showing magnetic susceptibility at 300K of alloys ALC-100, ALC-400, and ALC-500 relative to that of Al and $Al_{11}Ce_3$.
Figure 78:
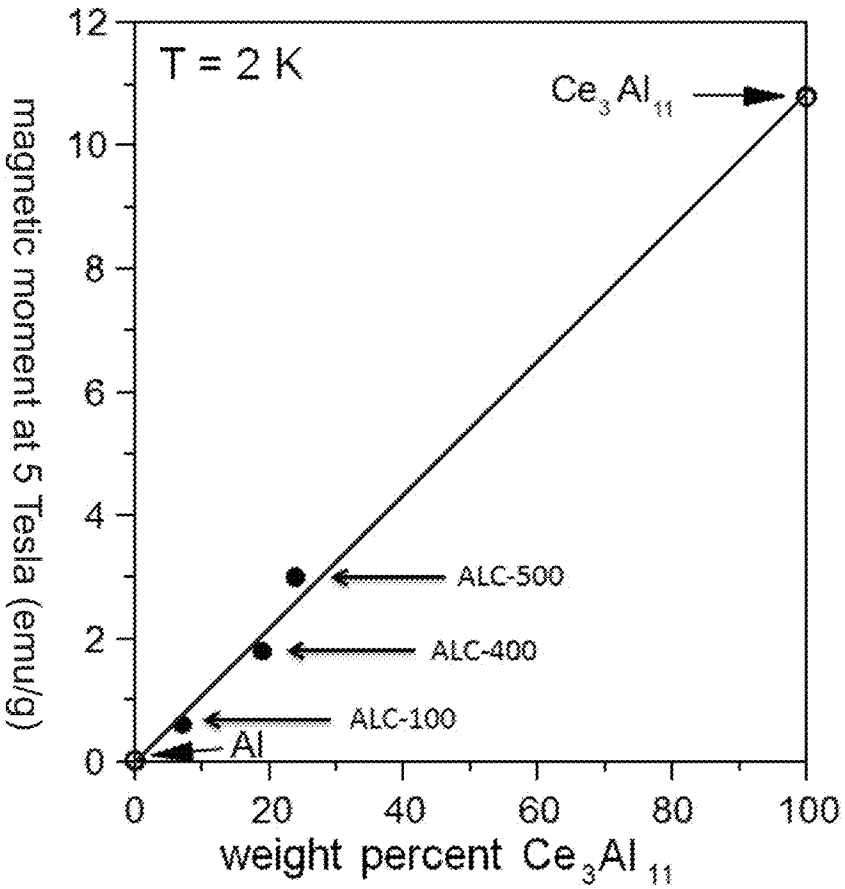
FIG. 78 is a graph showing magnetic moment at 2K of alloys ALC-100, ALC-400, and ALC-500 relative to that of Al and $Al_{11}Ce_3$.

FIG. 77 shows for a series of alloys with varying Ce content the magnetic susceptibility measured at 300K. FIG. 78 shows the magnetic moment measured at 2K in an applied magnetic field of 5 T. Literature data for Al and $Ce_3Al_{11}$ are included. Both figures show linear behavior between these two end members. This demonstrates that magnetic behavior is strongly correlated to the alloy composition.

The measured values of the moment at 2 K and the susceptibility at 300 K support the presence of $Ce_3Al_{11}$ as the primary Ce containing phase in ALC-500 and the temperature dependence and transition temperatures indicates this phase is present in well-ordered grains which behave very similarly to bulk single crystal $Ce_3Al_{11}$.

Example VI

Figure 50:
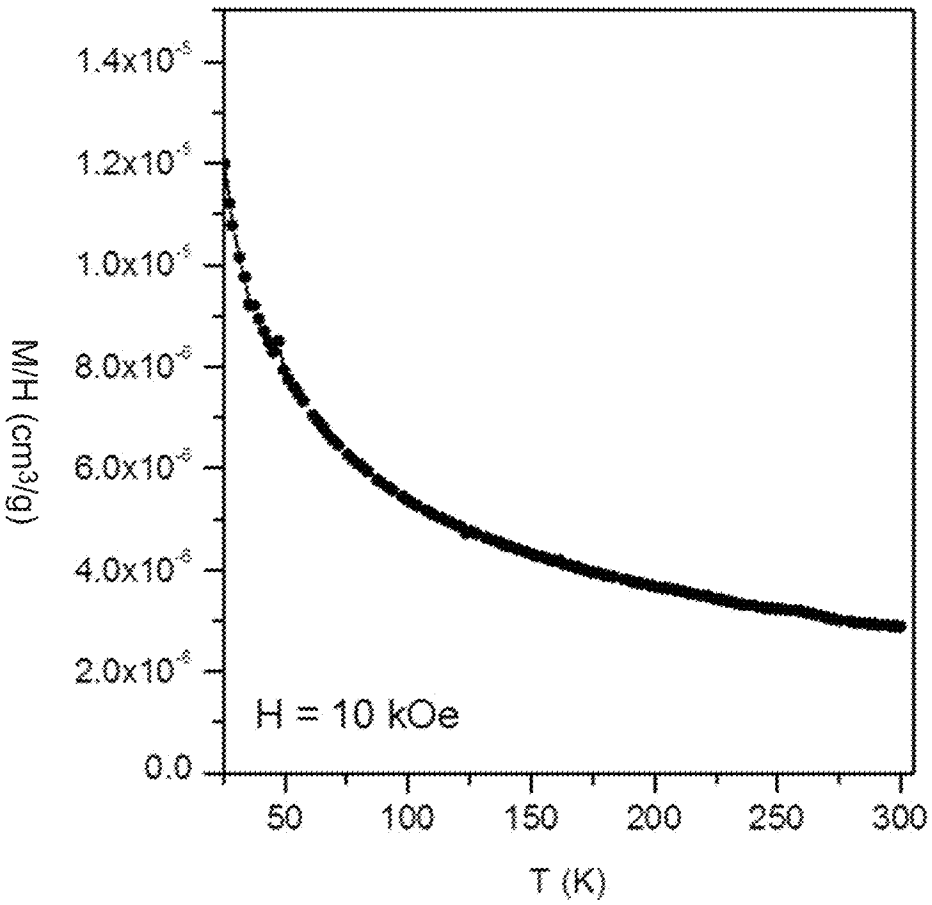
FIG. 50 is a graph showing the magnetic susceptibility per gram of alloy ALC-500 at temperatures up to 300 K.
Figure 51:
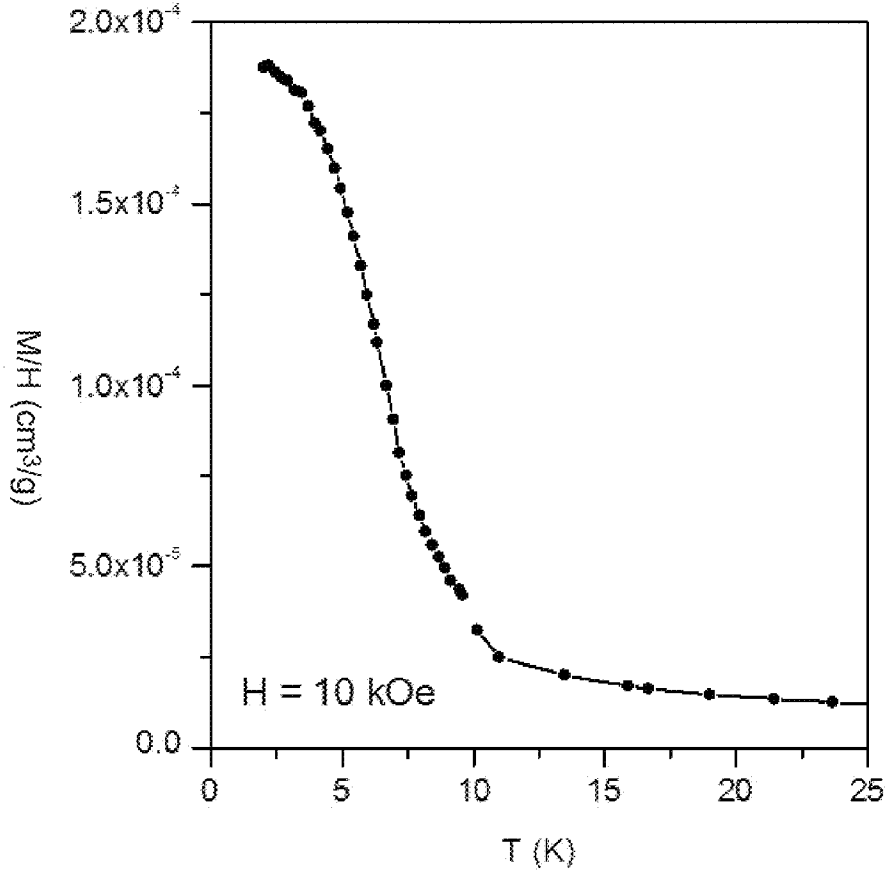
FIG. 51 is a graph showing the magnetic susceptibility per gram of alloy ALC-500 at temperatures up to 25 K.

Alloy ALC-315 having a composition of 8% Ce, 1% Ni, balance Al was made and tested as described above in Example I. FIGS. 49, 50 show, respectively, full and focused XRD spectra of both the as-cast and the heat-treated sample. FIG. 51 shows DSC curves of both the as-cast and the heat-treated samples.

Figure 52:
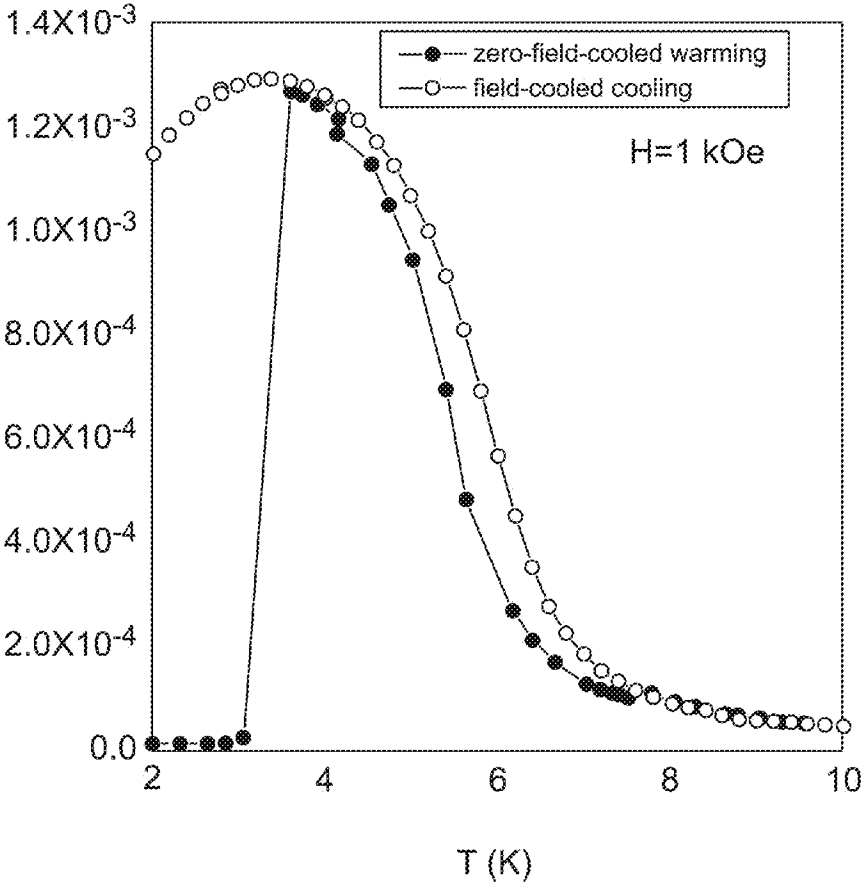
FIG. 52 is a graph showing the low-field magnetic susceptibility per gram of alloy ALC-500 at temperatures up to 10 K under zero-field cooled warming and field cooled cooling conditions.
Figure 53:
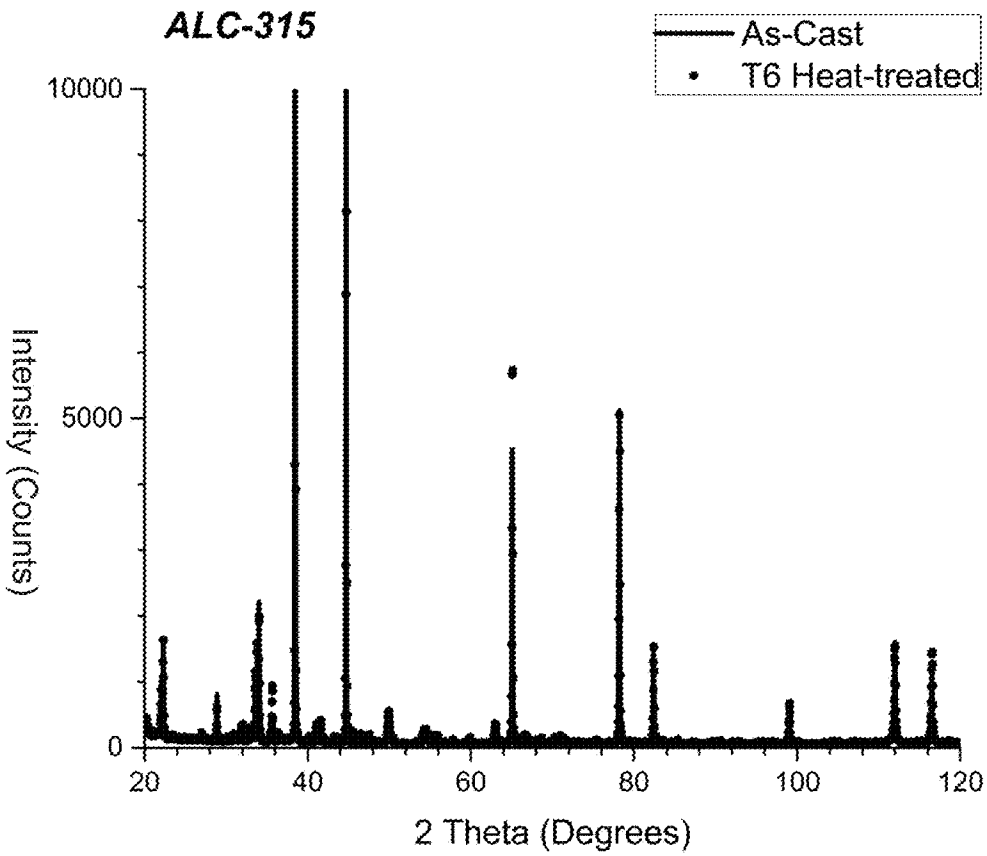
FIG. 53 is a graph showing full XRD spectra of both the as-cast and the heat-treated samples of alloy ALC-315.

FIGS. 52, 53 are respective SEM images showing the microstructure of as-cast and heat-treated alloy ALC-315.

Mechanical properties of as-cast and heat-treated alloy ALC-315 are presented in Table 6.

TABLE 6

| ALC-315 | Tensile (KSI) | Yield (KSI) | Elongation (%) | Phase Fraction FCC (wt %) | Phase Fraction Binary Intermetallic (wt %) |
|---|---|---|---|---|---|
| As-Cast Trial 1 | 16.7 | 7.6 | 4.0 | 81.3 | 13.8 |
| As-cast Trial 2 | 20.6 | 8.3 | 9.5 | — | — |
| T4 Trial 1 | 17.9 | 8.5 | 13.5 | — | — |
| T4 Trial 2 | 17.0 | 6.2 | 13.5 | — | — |
| T6 | 31.6 | 29.7 | 0.5 | 88.6 | 11.4 |
| T7 | 18.3 | 9.5 | 4.0 | — | — |

Figure 54:
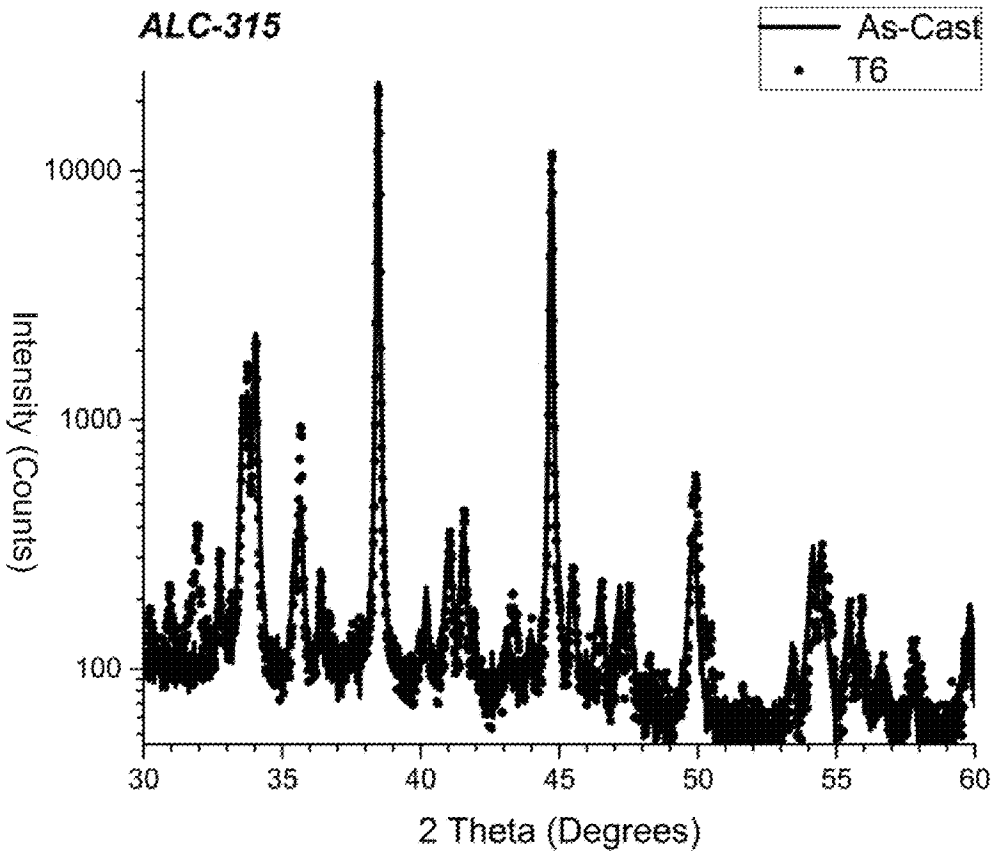
FIG. 54 is a graph showing focused XRD spectra of both the as-cast and the heat-treated samples of alloy ALC-315.
Figure 55:
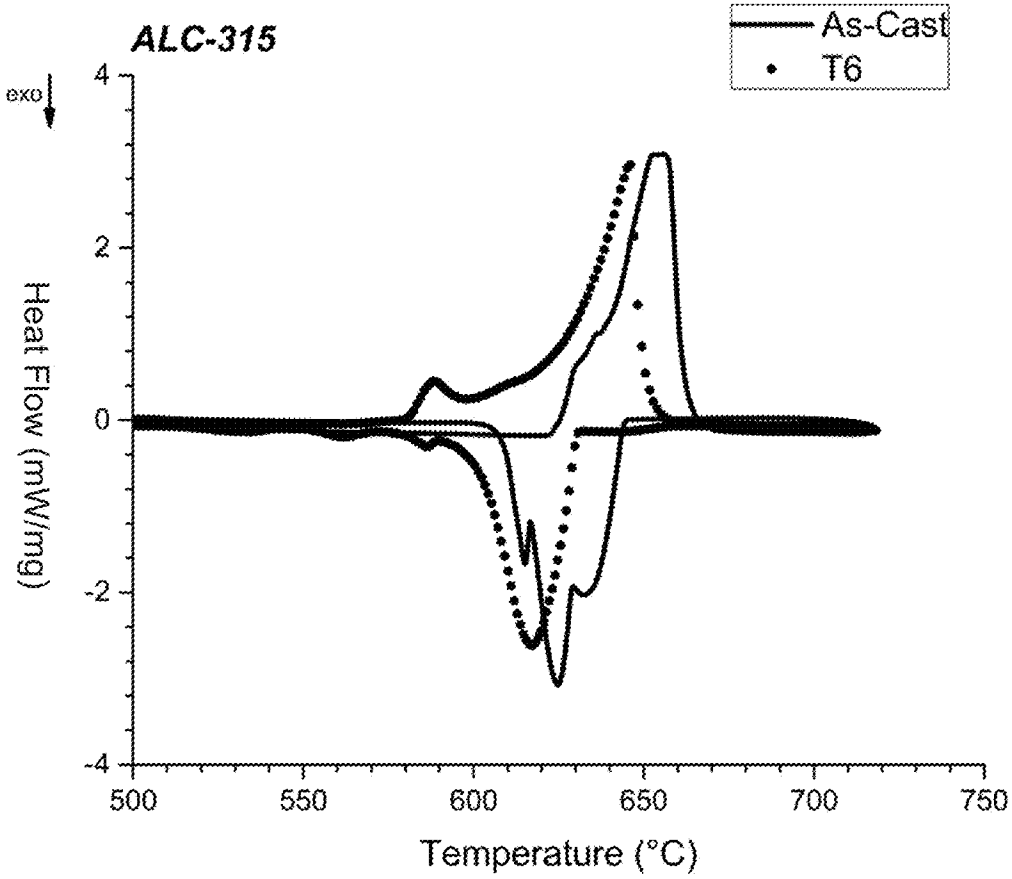
FIG. 55 is a graph showing DSC curves of both the as-cast and the heat-treated samples of alloy ALC-315.

FIGS. 54, 55 show the castings conducted to determine alloy castability. Castability of ALC-315 was determined to be rated as a 3 out of 5.

Example VII

Figure 57:
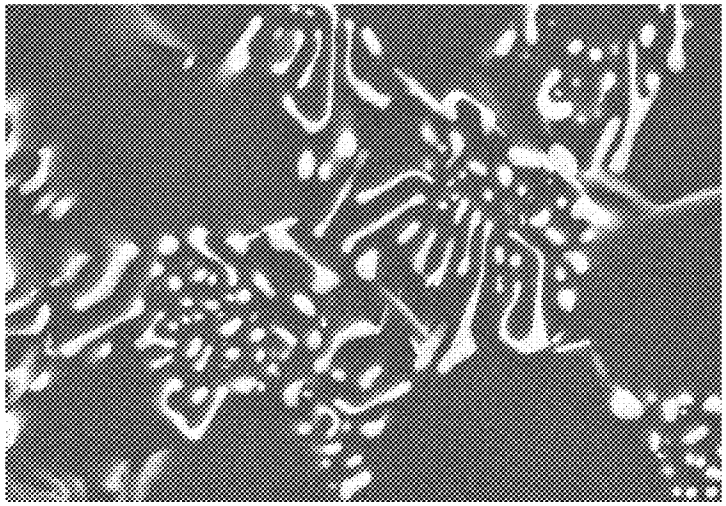
FIG. 57 is an SEM image showing the microstructure of heat-treated alloy ALC-315.
Figure 56:
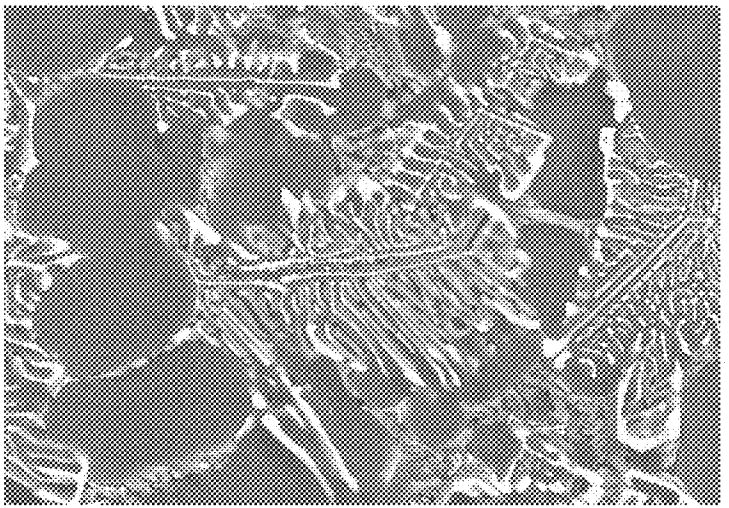
FIG. 56 is an SEM image showing the microstructure of as-cast alloy ALC-315.
Figure 58:
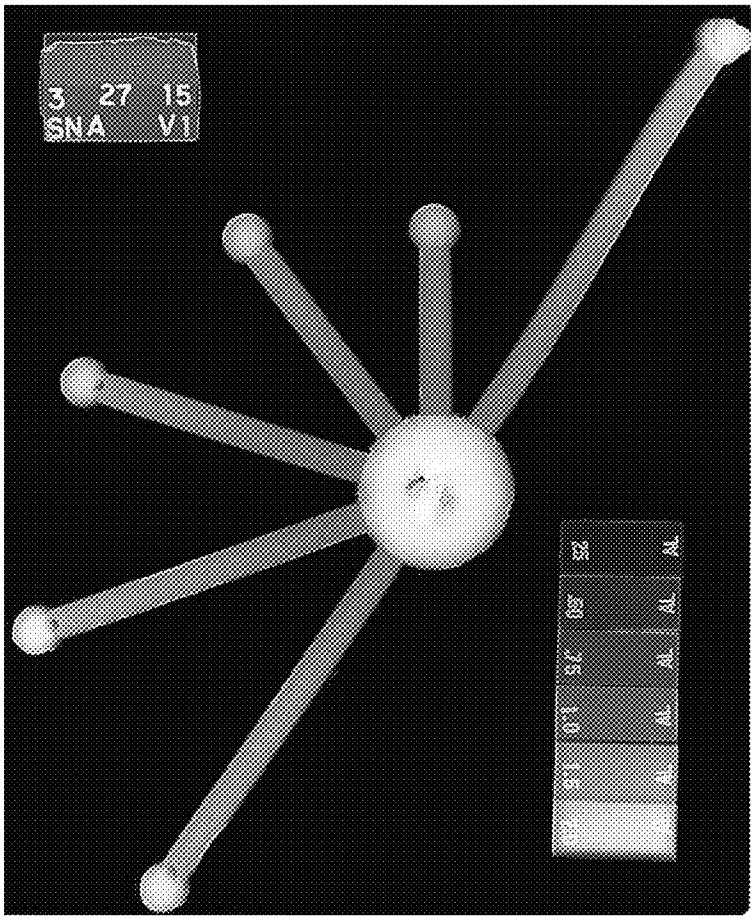
FIG. 58 is an X-ray photograph of a hot-tear molded test sample of alloy ALC-315.

Alloy ALC-412 having a composition of 12% Ce, 0.4% Mg, balance Al was made and tested as described above in Example I. FIGS. 56, 57 show, respectively, full and focused XRD spectra of the as-cast sample. FIG. 58 shows DSC curves of the as-cast sample.

Figure 59:
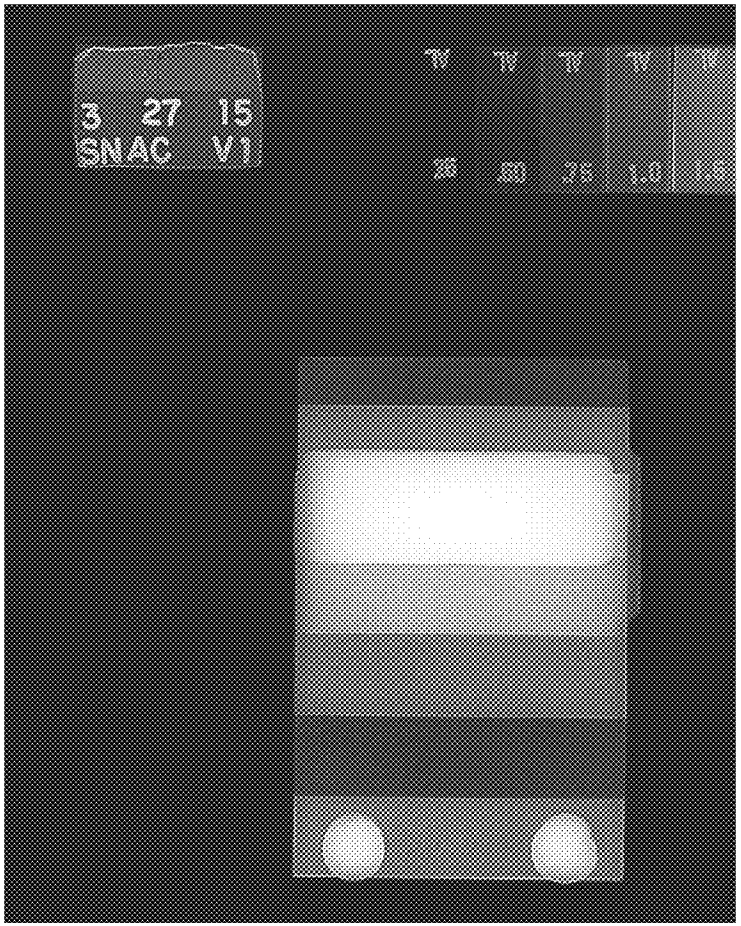
FIG. 59 is an X-ray photograph of a step-plate molded test sample of alloy ALC-315.

FIG. 59 is an SEM image showing the microstructure of as-cast alloy ALC-412. Mechanical properties of as-cast and heat-treated alloy ALC-412 are presented in Table 7.

TABLE 7

| ALC-412 | Tensile (KSI) | Yield (KSI) | Elongation (%) | Phase Fraction FCC (wt %) | Phase Fraction Binary Intermetallic (wt %) |
|---|---|---|---|---|---|
| As-Cast Trial 1 | 29.1 | 11.4 | 6.0 | 81.3 | 18.7 |
| As-cast Trial 2 | 23.8 | 11.0 | 2.5 | — | — |
| T6 Trial 1 | 29.1 | 11.4 | 6.0 | — | — |
| T6 Trial 2 | 23.8 | 11.0 | 2.5 | — | — |

Figure 60:
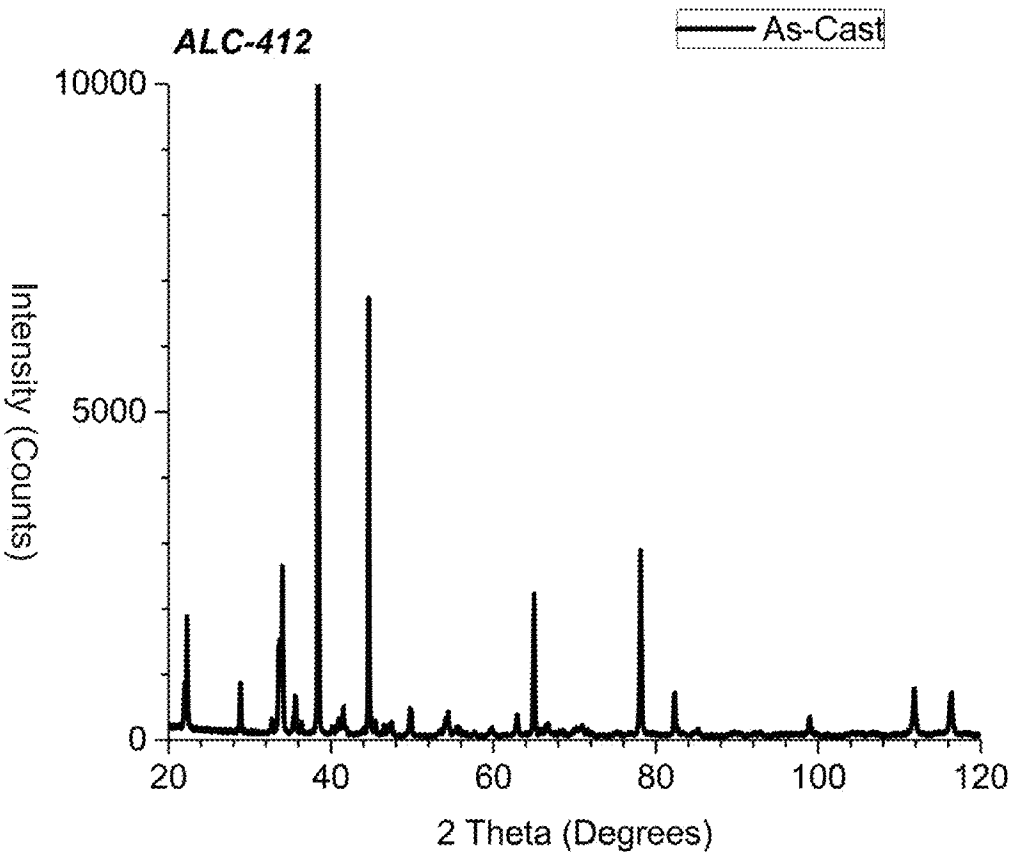
FIG. 60 is a graph showing full XRD spectra of as-cast sample of alloy ALC-412.
Figure 61:
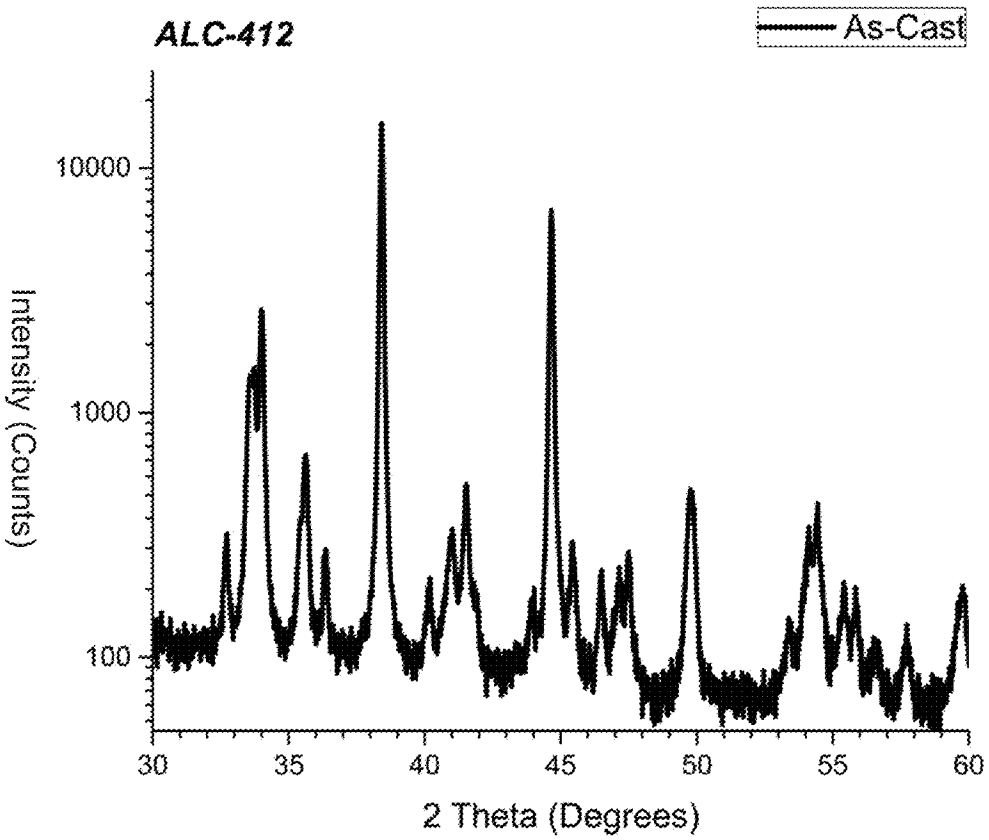
FIG. 61 is a graph showing focused XRD spectra of as-cast sample of alloy ALC-412.

FIGS. 60, 61 show the castings conducted to determine alloy castability. Castability of ALC-412 was rated as a 5 out of 5.

Example VIII

Figure 62:
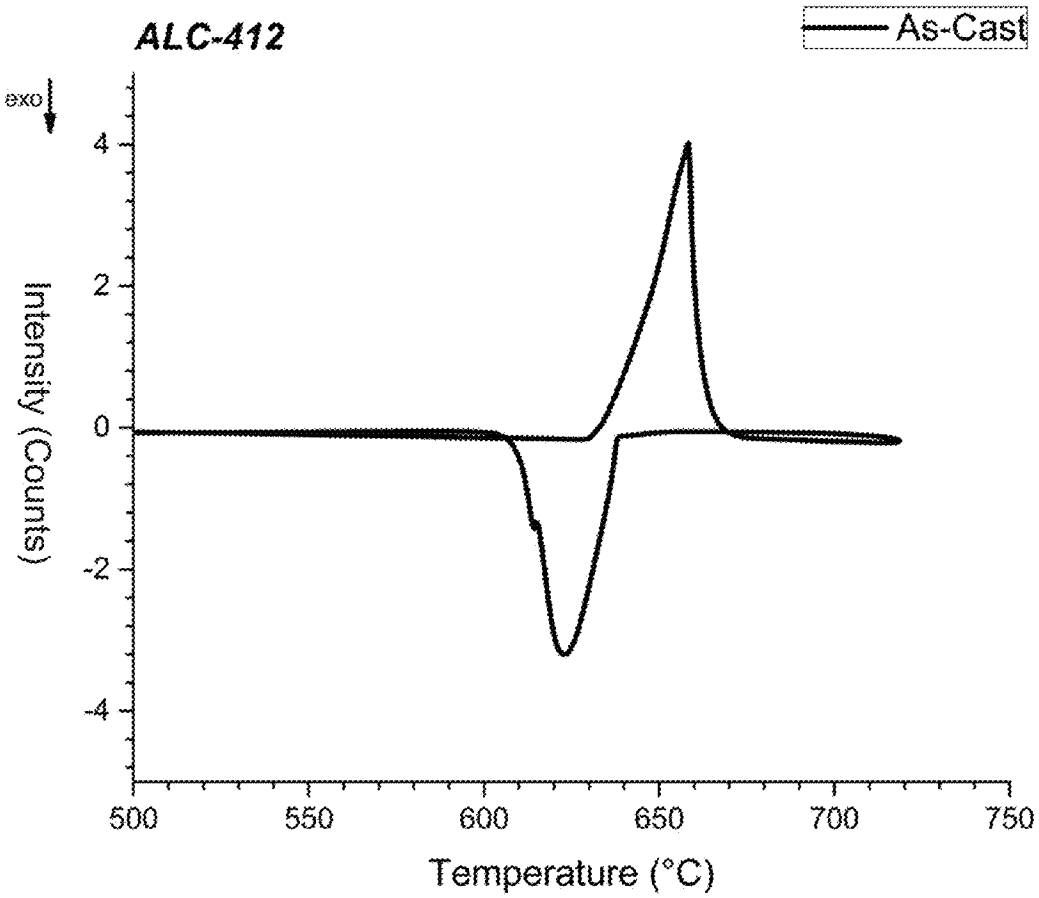
FIG. 62 is a graph showing DSC curves of the as-cast sample of alloy ALC-412.
Figure 63:
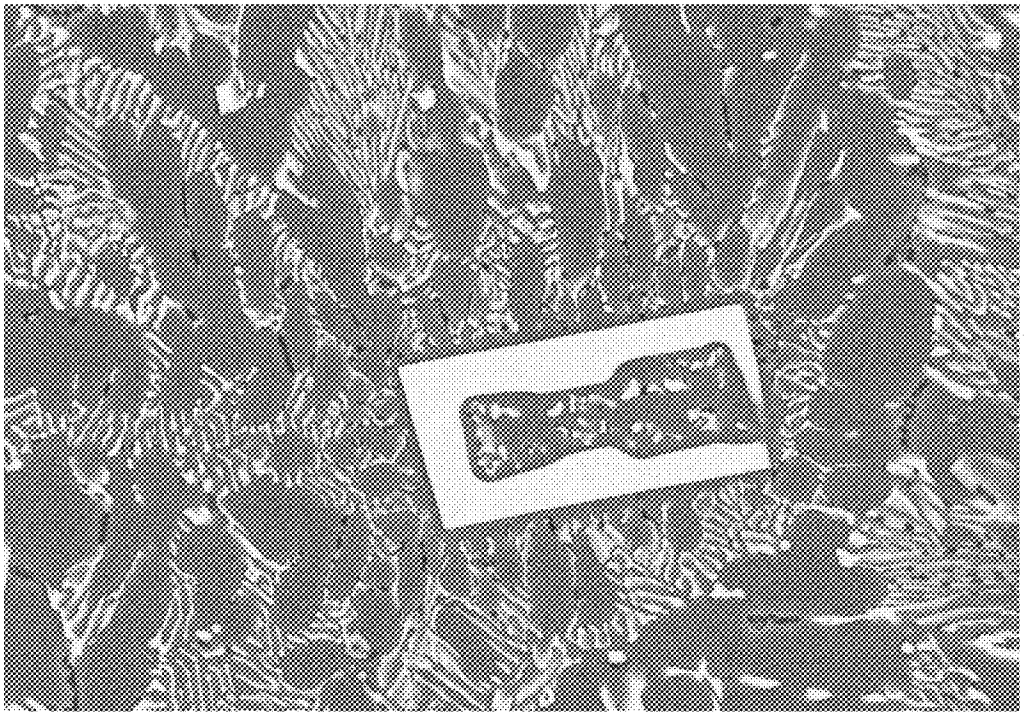
FIG. 63 is an SEM image showing the microstructure of as-cast alloy ALC-412.
Figure 64:
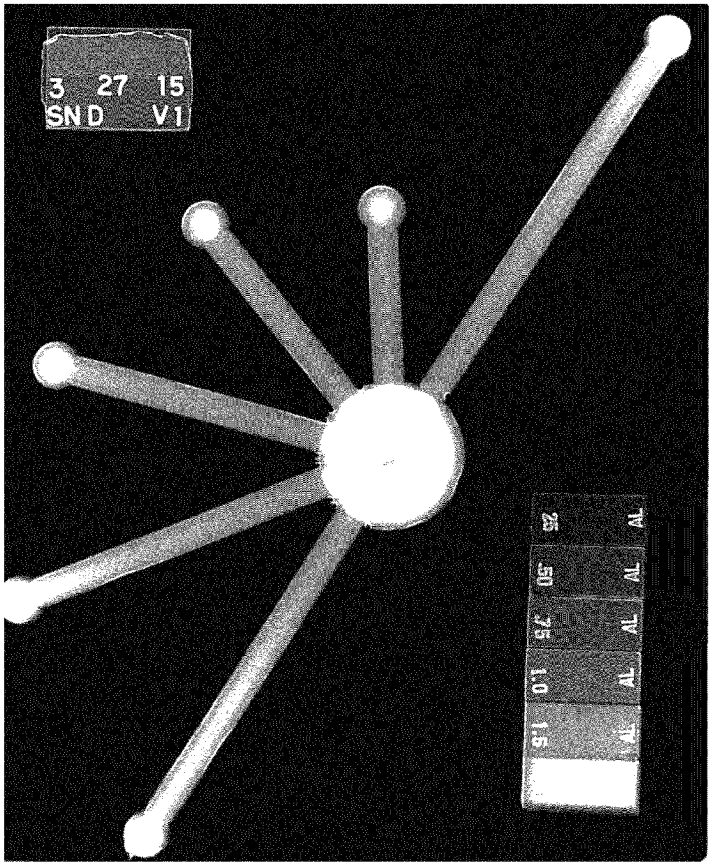
FIG. 64 is an X-ray photograph of a hot-tear molded test sample of alloy ALC-412.

Alloy ALC-413 having a composition of 12% Ce, 1% Fe, balance Al was made and tested as described above in Example I. FIGS. 62, 63 show, respectively, full and focused XRD spectra of the as-cast sample. FIG. 64 shows DSC curves of both the as-cast and the heat-treated samples.

Figure 65:
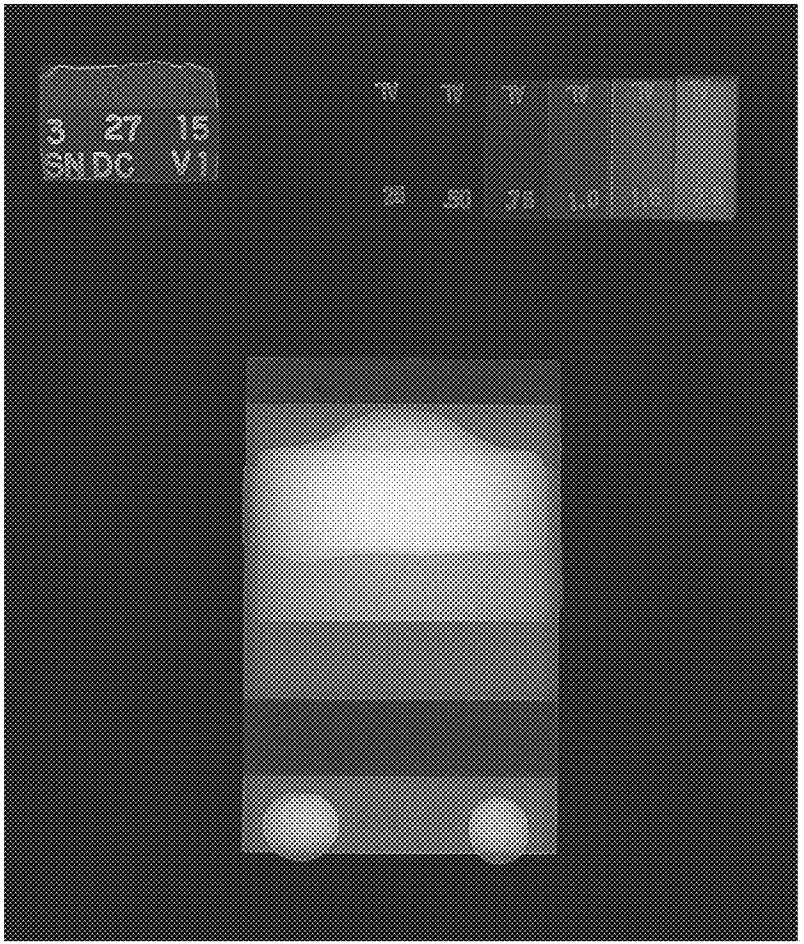
FIG. 65 is an X-ray photograph of a step-plate molded test sample of alloy ALC-412.
Figure 66:
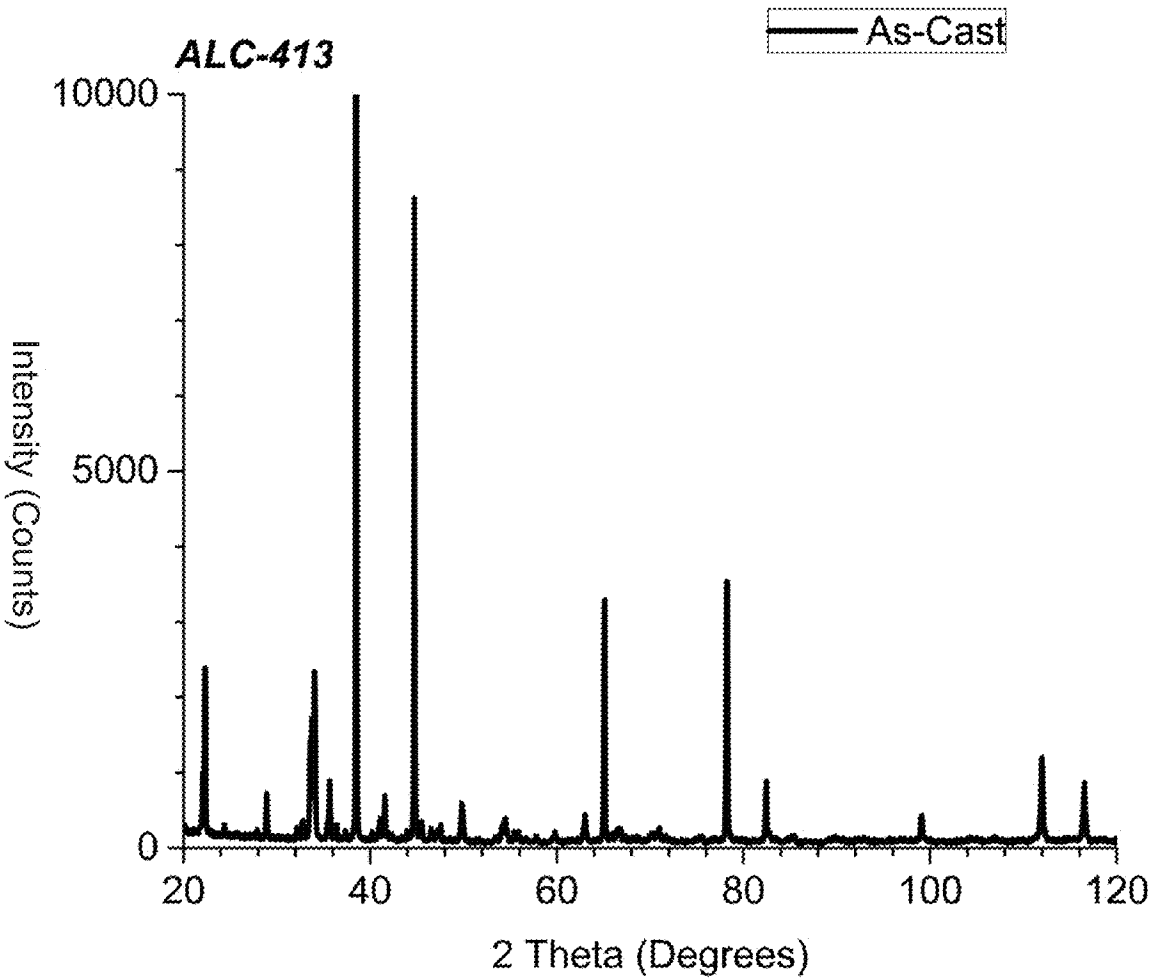
FIG. 66 is a graph showing full XRD spectra of the as-cast and sample of alloy ALC-413.
Figure 67:
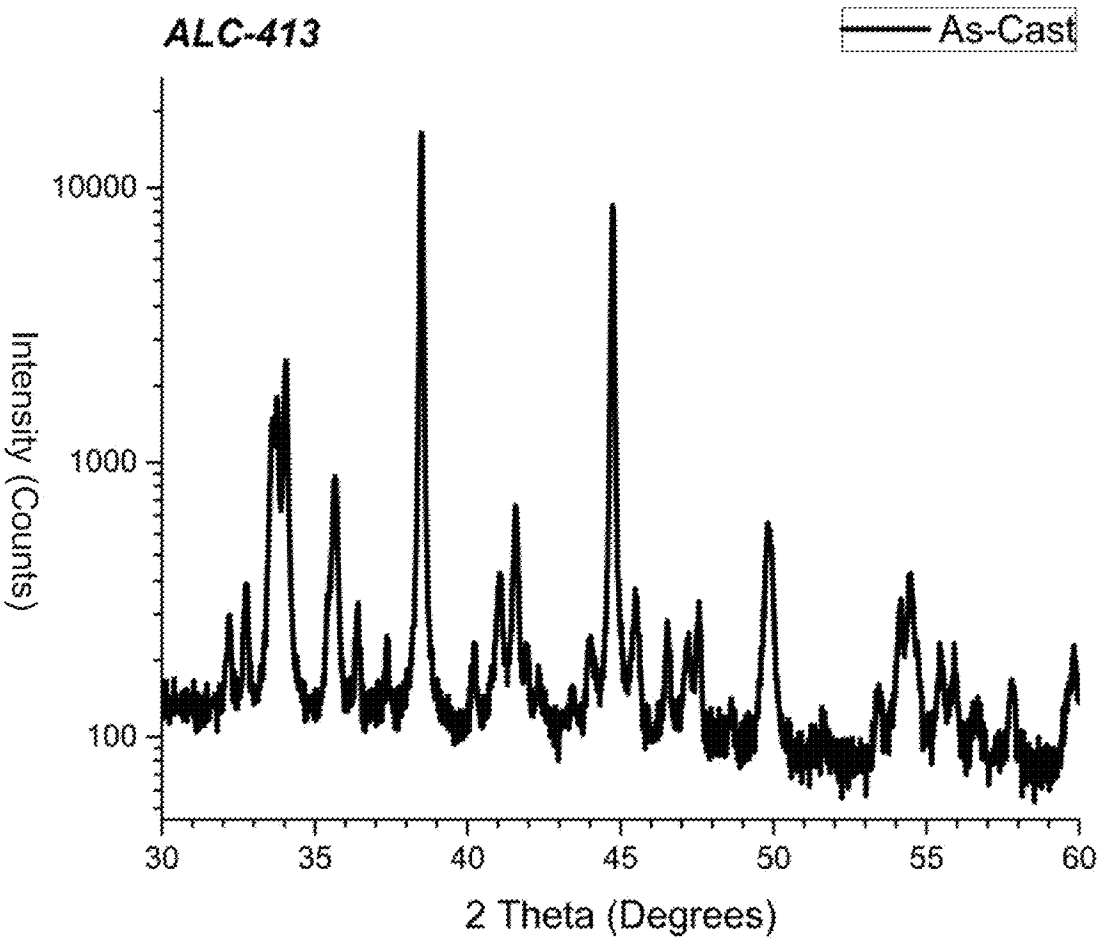
FIG. 67 is a graph showing focused XRD spectra of the as-cast sample of alloy ALC-413.

FIG. 65 is an SEM image showing the microstructure of as-cast alloy ALC-413. FIGS. 66, 67 show the castings conducted to determine alloy castability. Castability of ALC-413 was determined to be rated as a 5 out of 5.

Example IX

Figure 68:
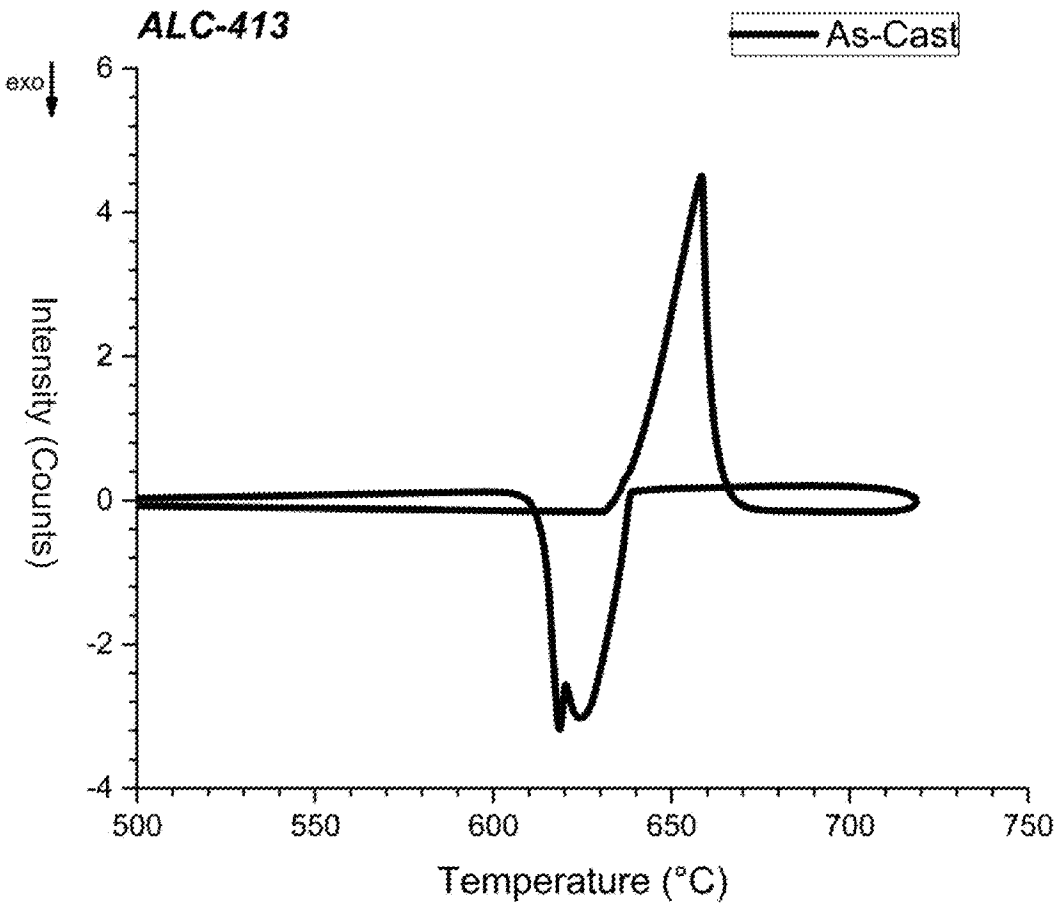
FIG. 68 is a graph showing DSC curves of the as-cast sample of alloy ALC-413.
Figure 69:
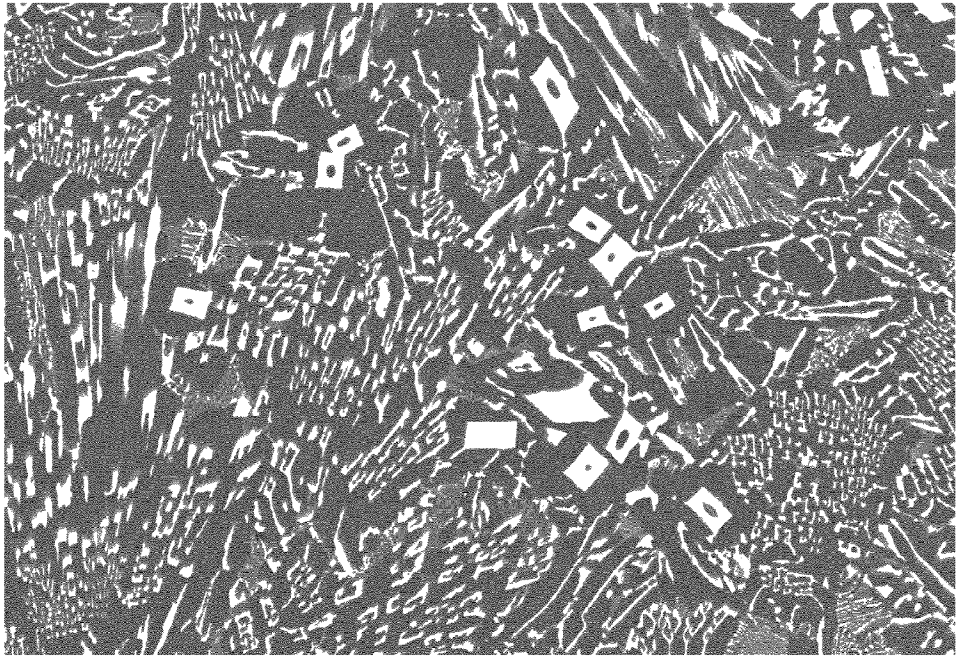
FIG. 69 is an SEM image showing the microstructure of as-cast alloy ALC-413.
Figure 70:
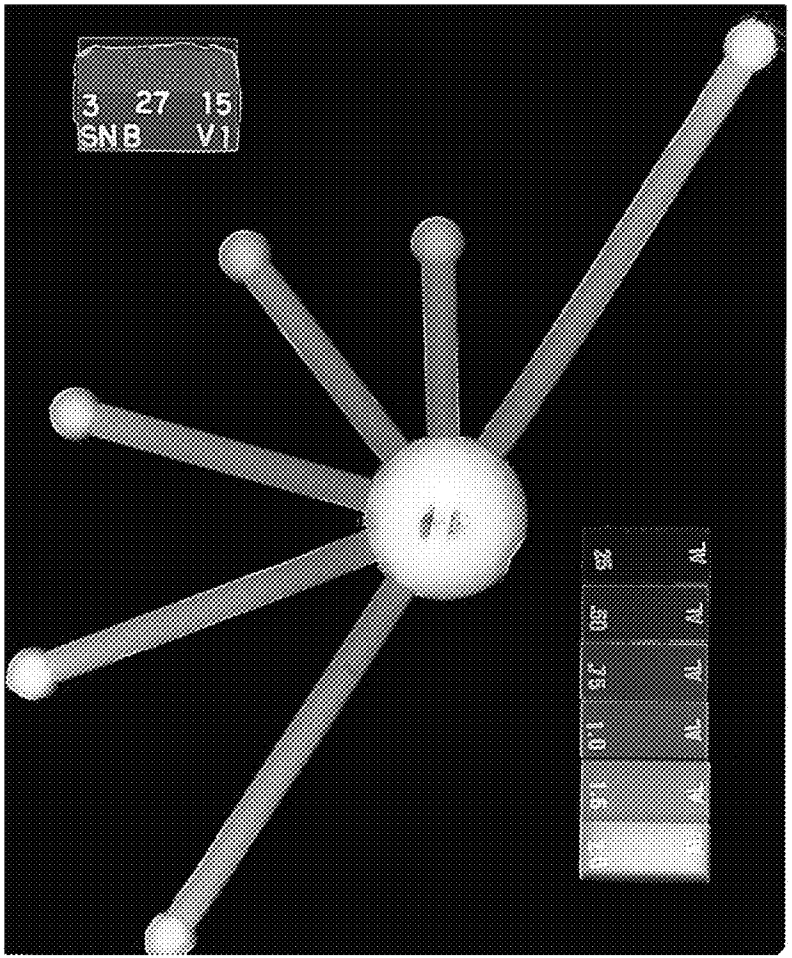
FIG. 70 is an X-ray photograph of a hot-tear molded test sample of alloy ALC-413.
Figure 71:
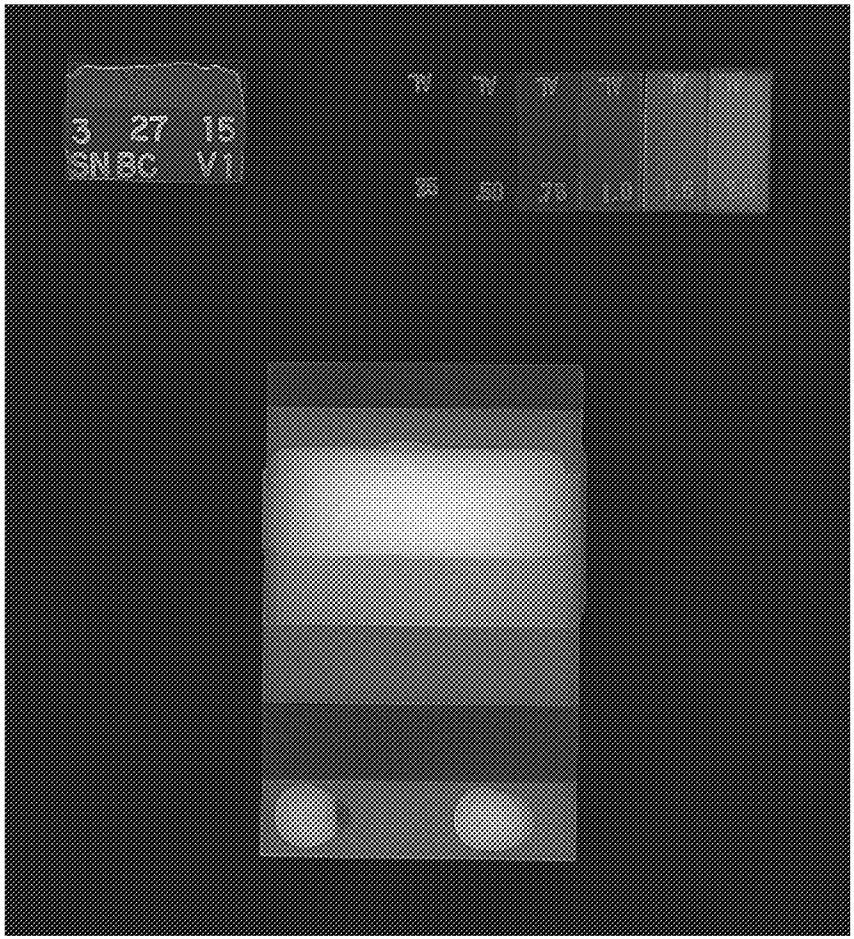
FIG. 71 is an X-ray photograph of a step-plate molded test sample of alloy ALC-413.
Figure 72:
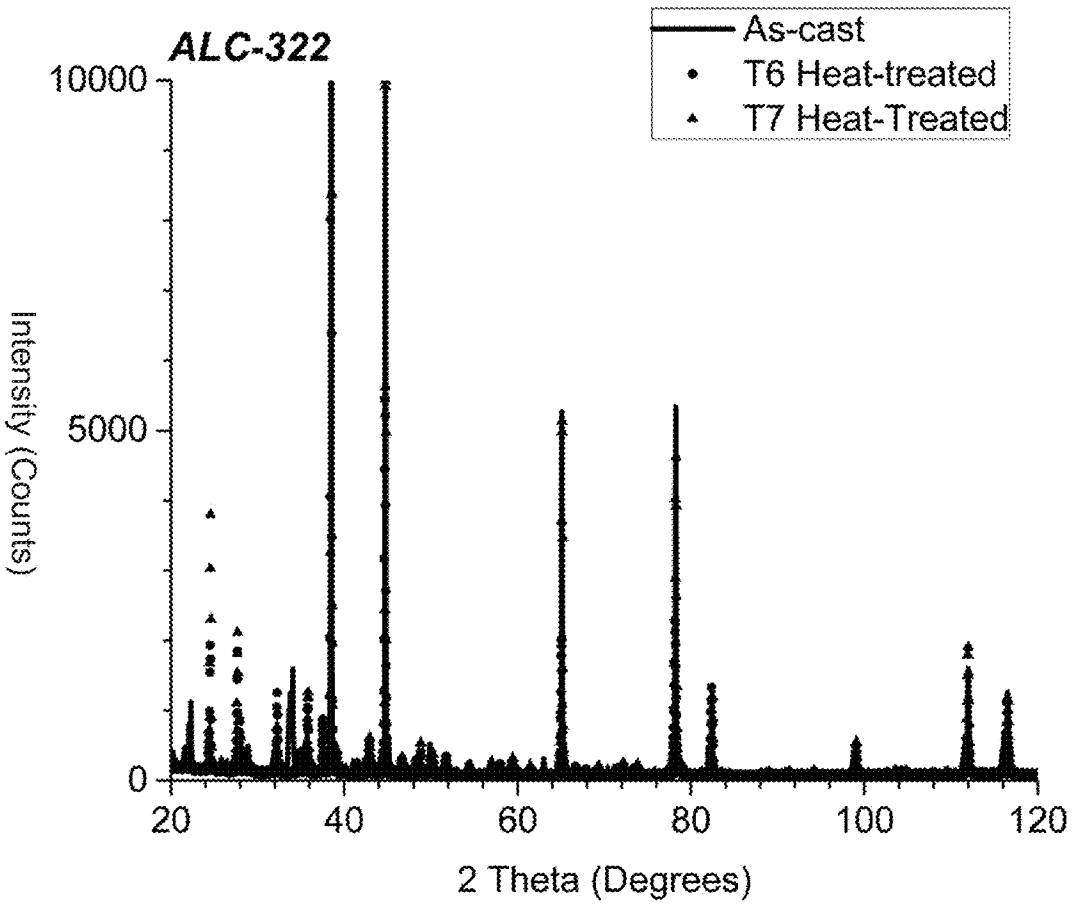
FIG. 72 is a graph showing full XRD spectra of both the as-cast and the heat-treated samples of alloy ALC-322.
Figure 73:
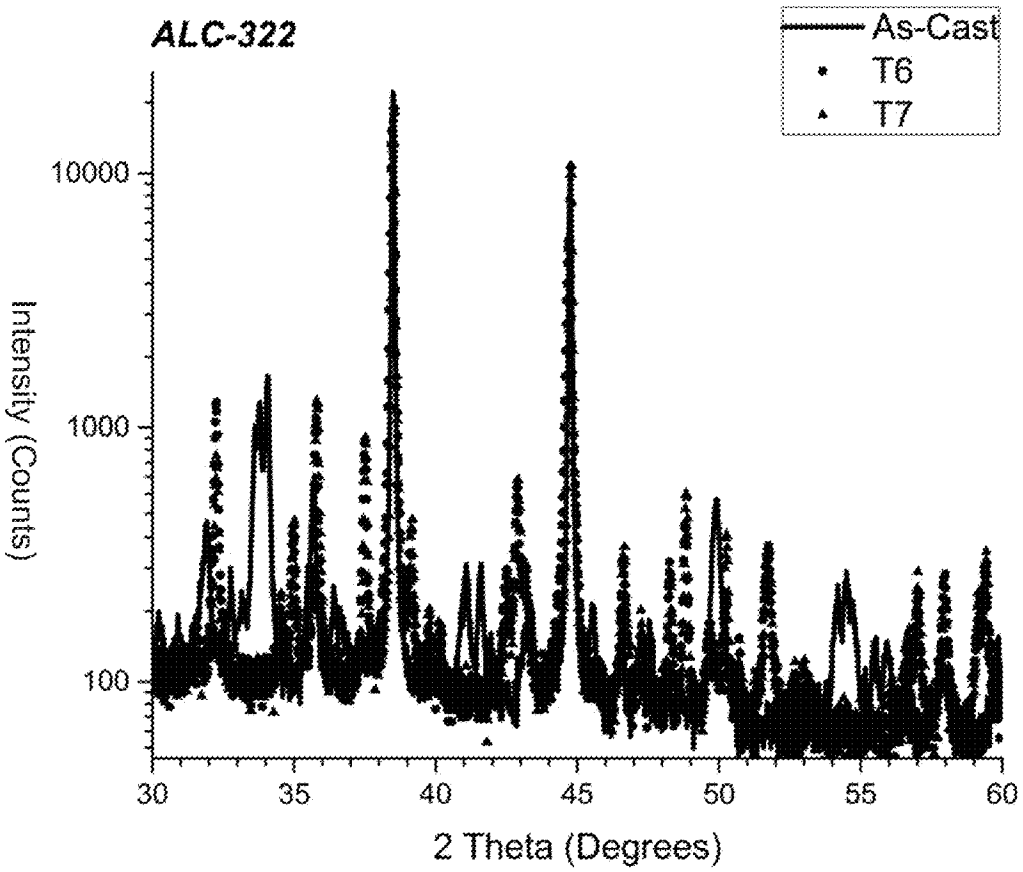
FIG. 73 is a graph showing focused XRD spectra of both the as-cast and the heat-treated samples of alloy ALC-322.
Figure 74:
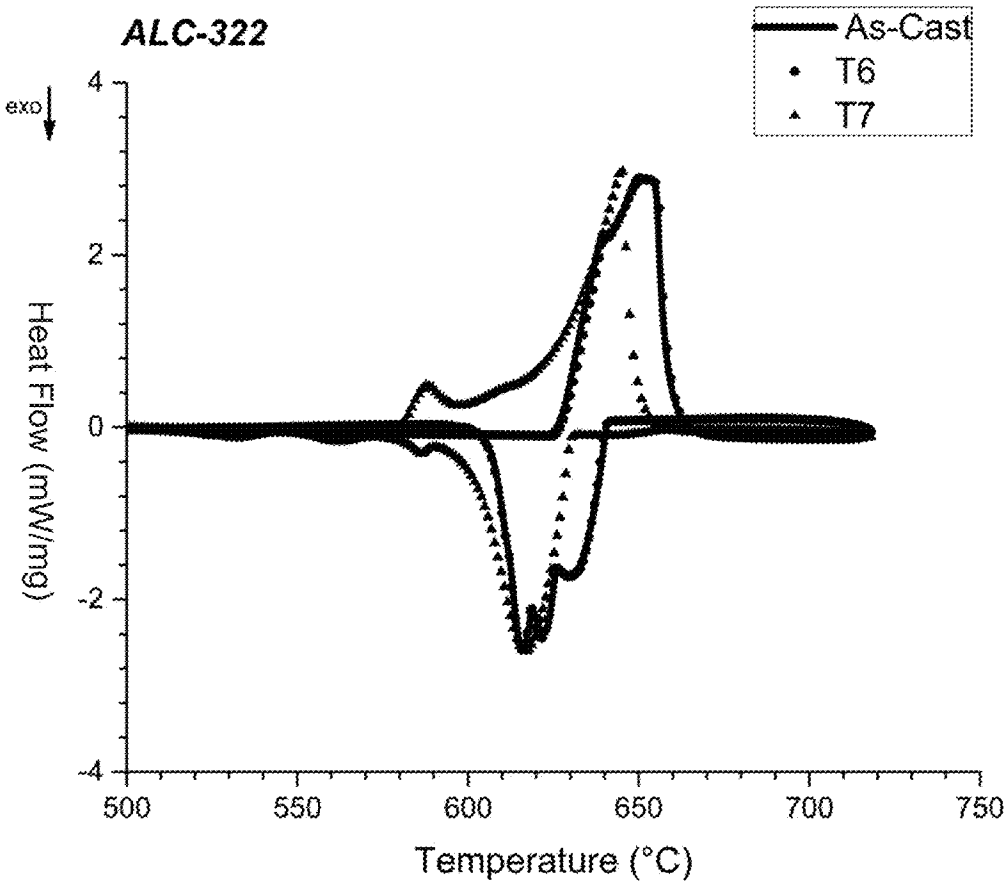
FIG. 74 is a graph showing DSC curves of both the as-cast and the heat-treated samples of alloy ALC-322.
Figure 76:
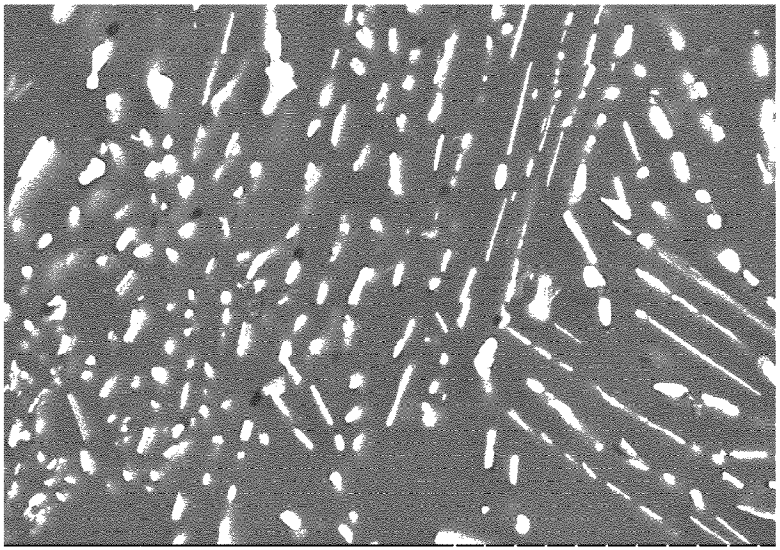
FIG. 76 is an SEM image showing the microstructure of heat-treated alloy ALC-322.
Figure 75:
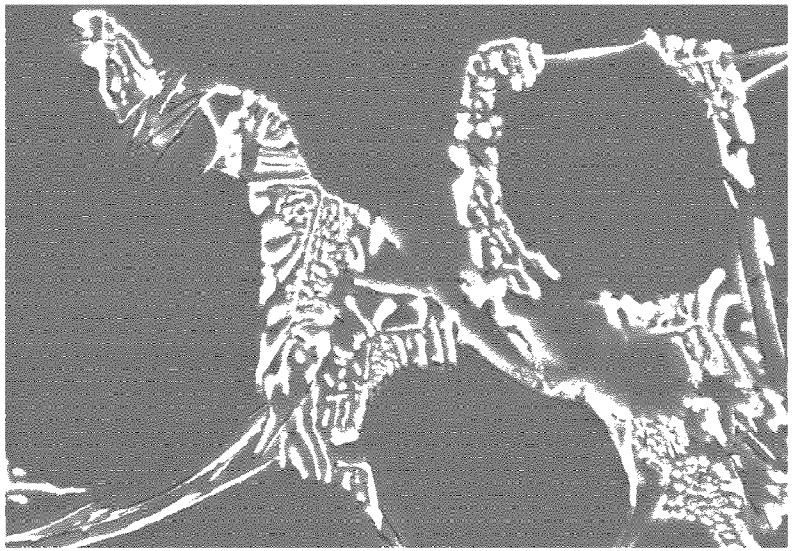
FIG. 75 is an SEM image showing the microstructure of as-cast alloy ALC-322.

Alloy ALC-322 having a composition of 8% Ce, 1% Ni, 1% Si, balance Al was made and tested as described above in Example I. FIGS. 68, 69 show, respectively, full and focused XRD spectra of both the as-cast and the heat-treated sample. FIG. 70 shows DSC curves of both the as-cast and the heat-treated samples. FIGS. 71, 72 are respective SEM images showing the microstructure of as-cast and heat-treated alloy ALC-322.

Mechanical properties of as-cast and heat-treated alloy ALC-322 are presented in Table 8.

TABLE 8

| ALC-322 | Tensile (KSI) | Yield (KSI) | Elongation (%) | Phase Fraction FCC (wt %) | Phase Fraction of Binary Intermetallic (wt %) | Phase fraction of Ternary Intermetallic (wt %) |
|---|---|---|---|---|---|---|
| As-Cast Trial 1 | 19.7 | — | 6.0 | 87.8 | 12.2 | — |
| As-cast Trial 2 | 19.8 | 6.8 | 7.0 | — | — | |
| T6 Trial 1 | 17.8 | 5.9 | 11.0 | 84.6 | — | 8.1 |
| T6 Trial 2 | 17.4 | 8.5 | 9.5 | — | — | |

The samples described hereinabove were tested and compared to show the unique and unexpected properties and characteristics thereof. In some cases, the samples were compared to conventional, well-known alloy A-7075.

Figure 79:
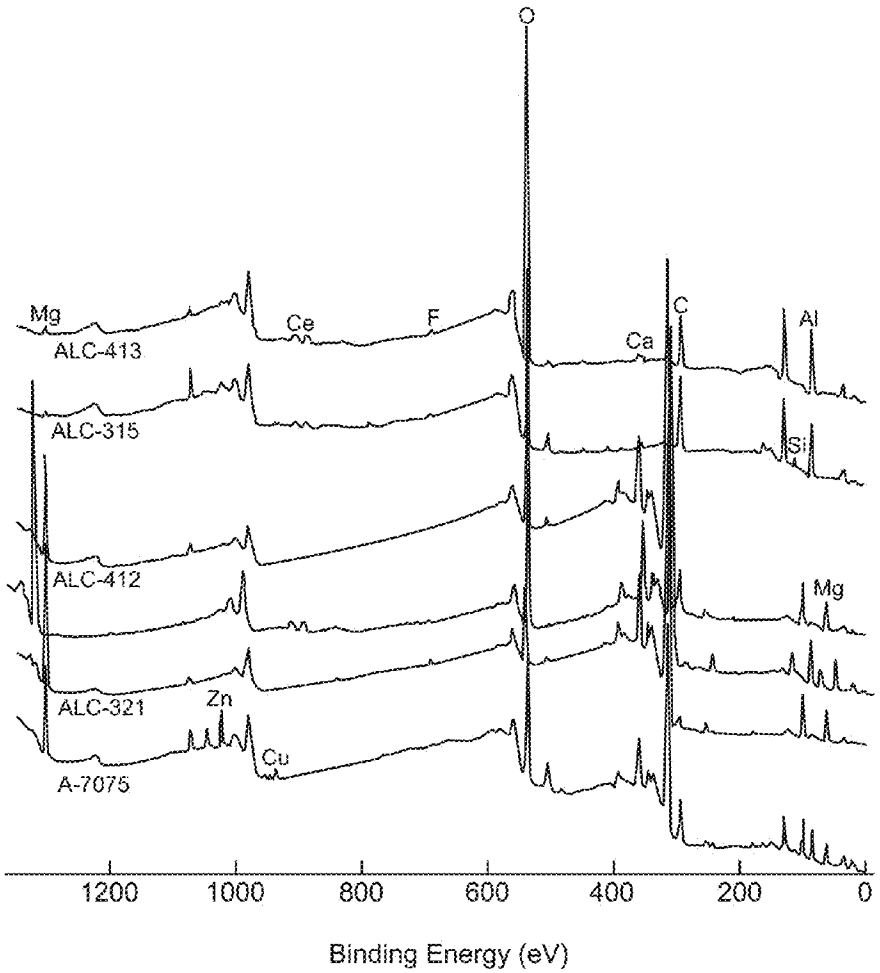
FIG. 79 is a graph showing offset X-ray photoelectron spectroscopy (XPS) data for several as-cast alloy samples.
Figure 80:
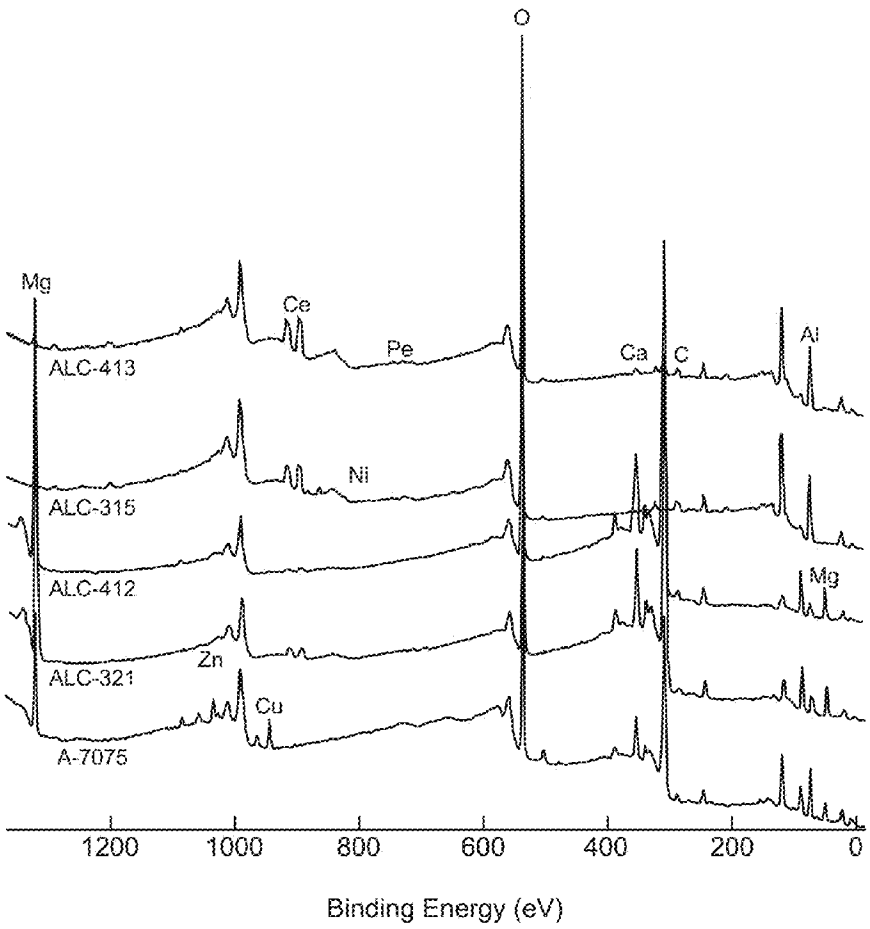
FIG. 80 is a graph showing offset X-ray photoelectron spectroscopy (XPS) data for several argon ion sputter-etched (~12 nm) alloy samples.

In Al—Ce alloys there exists a unique oxide layer. X-ray photoelectron spectroscopy (XPS) analysis was employed to provide further evidence of the distinction between non-cerium aluminum alloys and the new alloys described herein. XPS data spectra were obtained for all the as-cast ternary and quaternary samples. After measuring the as-received samples, the samples were etched using an ar-ion beam. They were then measured again. Data profiles were plotted for the Al—Ce alloys, shown in FIGS. 79 and 80.

Figure 81:
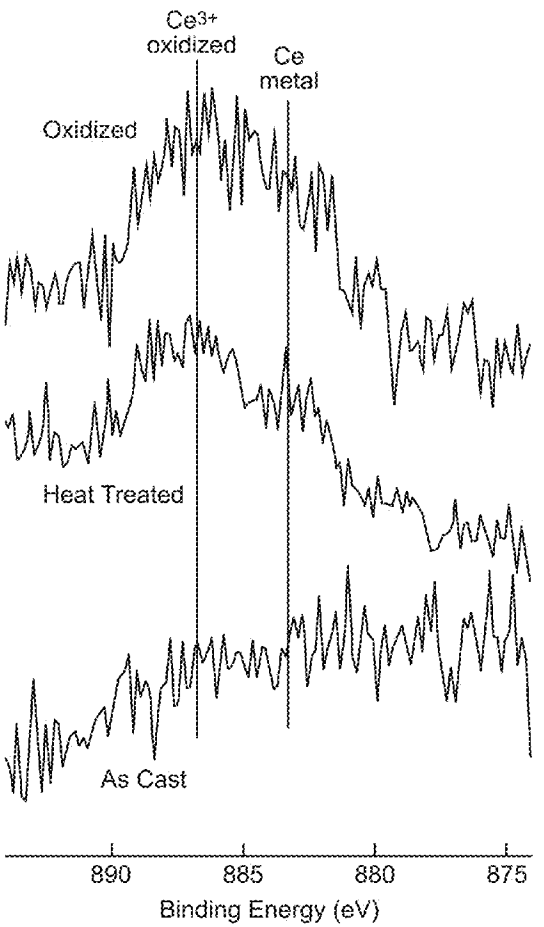
FIG. 81 is a graph showing offset, focused X-ray photoelectron spectroscopy (XPS) data for Al-12Ce alloy.
Figure 82:
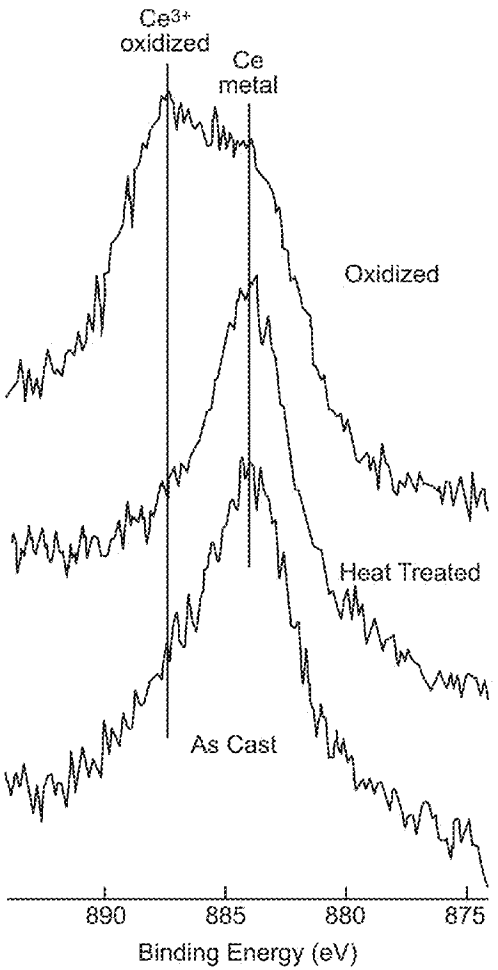
FIG. 82 is a graph showing offset, focused X-ray photoelectron spectroscopy (XPS) data for argon ion sputter-etched (~12 nm) Al-12Ce alloy.

FIGS. 81 and 82 are respective small spectral range graphs that focus on the oxide section of the spectrum of Al-12Ce in as-cast, heat-treated, and oxidized states. It is clear that all the samples contain a surface Ce-Ox. The surface oxide that contains Cerium is an individual feature of the Al—Ce alloys which have been cast in our experiments. Table 9 shows respective, calculated surface composition data in atomic percent for as-cast and argon ion sputter-etched (~12 nm) alloys. Tables 10 and 11 show surface composition data in atomic percent for as-cast and argon ion sputter-etched (~12 nm) alloy ALC-400. The data show a distinct presence of a Ceria contribution to the oxide layer composition. The presence of the Ceria in the oxide layer is distinct from other Al alloys. The ratios of alumina to ceria vary across the samples. In some alloys, Ce is visibly present at the surface of the alloy.

TABLE 9

| Sample | Al | C | Ce | Cu | Fe | Mg | Na | Ni | O | Si | Zn |
|---|---|---|---|---|---|---|---|---|---|---|---|
| Al-7075 as-cast | 17.0 | 13.3 | 0 | 0.6 | 0 | 16.4 | 1.8 | 0 | 49.6 | 0 | 1.3 |
| Al-7075 etched | 28.7 | 2.5 | 0 | 0.9 | 0 | 19.1 | 0 | 0 | 48.3 | 0 | 0.6 |
| ALC-321 as-cast | 0.1 | 6.1 | 0 | 0 | 0 | 48.0 | 1.0 | 0 | 44.6 | 0.2 | 0 |
| ALC-321 etched | 15.4 | 0.8 | 0.4 | 0 | 0 | 47.3 | 0.2 | 0 | 35.1 | 0.8 | 0 |
| ALC-412 as-cast | 0.6 | 19.8 | 0 | 0 | 0 | 32.9 | 1.6 | 0 | 45.1 | 0 | 0 |
| ALC-412 etched | 10.6 | 2.0 | 0.2 | 0 | 0 | 49.5 | 0.3 | 0 | 37.4 | 0 | 0 |
| ALC-315 as-cast | 30.1 | 18.6 | 0.3 | 0 | 0 | 0.5 | 2.5 | 0 | 48.0 | 0 | 0 |
| ALC-315 etched | 48.3 | 3.3 | 0.9 | 0 | 0 | 0 | 0.2 | 0.3 | 47.1 | 0 | 0 |
| ALC-413 as-cast | 34.2 | 14.1 | 0.4 | 0 | 0 | 1.3 | 0.6 | 0 | 49.3 | 0 | 0 |
| ALC-413 etched | 45.3 | 3.5 | 1.3 | 0 | 0.1 | 2.2 | 0.3 | 0 | 47.3 | 0 | 0 |

TABLE 10

| ALC-400 | Al-ox | Al-me | Ce-ox | Ce-me | O | C | N | Na | Si | Cl |
|---|---|---|---|---|---|---|---|---|---|---|
| As-cast | 5.9 | 8.7 | 0.1 | 0.1 | 12.7 | 69.8 | 0.9 | 0.9 | 0.2 | 0.7 |
| T6 | 13.5 | 21.1 | 0.1 | 0.2 | 19.8 | 44.9 | 0.0 | 0.0 | 0.4 | 0.0 |
| Oxidized | 24.4 | 1.1 | 0.2 | 0.2 | 34.2 | 38.0 | 0.5 | 0.7 | 0.8 | 0.0 |

TABLE 11

| ALC-400 | Al-ox | Al-me | Ce-ox | Ce-me | O | C | N | Na | Si | Cl |
|---|---|---|---|---|---|---|---|---|---|---|
| As-cast | 9.1 | 38.4 | 0.2 | 0.4 | 14.0 | 34.1 | 1.2 | 1.5 | 0.0 | 1.1 |
| T6 | 10.2 | 59.6 | 0.1 | 0.6 | 10.3 | 19.2 | 0.0 | 0.0 | 0.0 | 0.0 |
| Oxidized | 29.3 | 10.1 | 0.5 | 0.5 | 40.4 | 17.7 | 0.3 | 0.6 | 0.5 | 0.0 |

Example X

Figure 83:
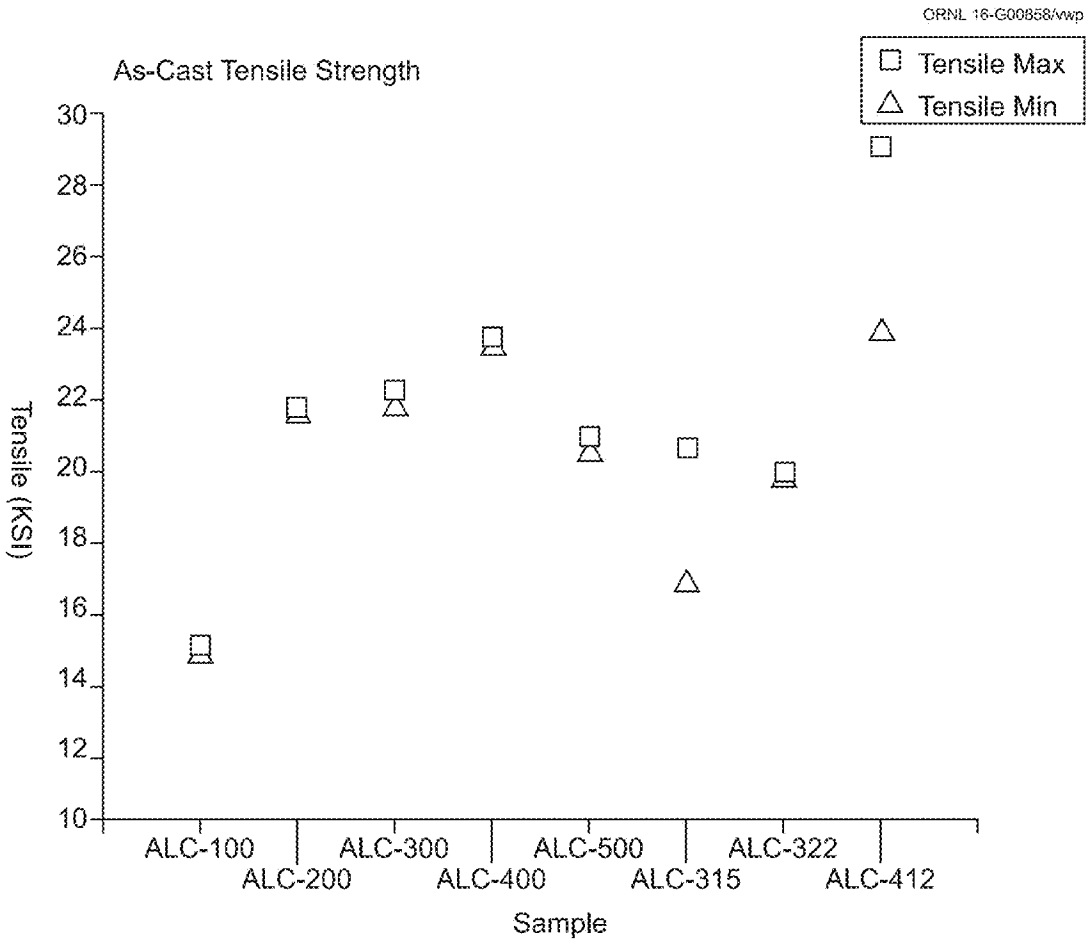
FIG. 83 is a graph showing a comparison of as-cast samples for tensile strength.
Figure 84:
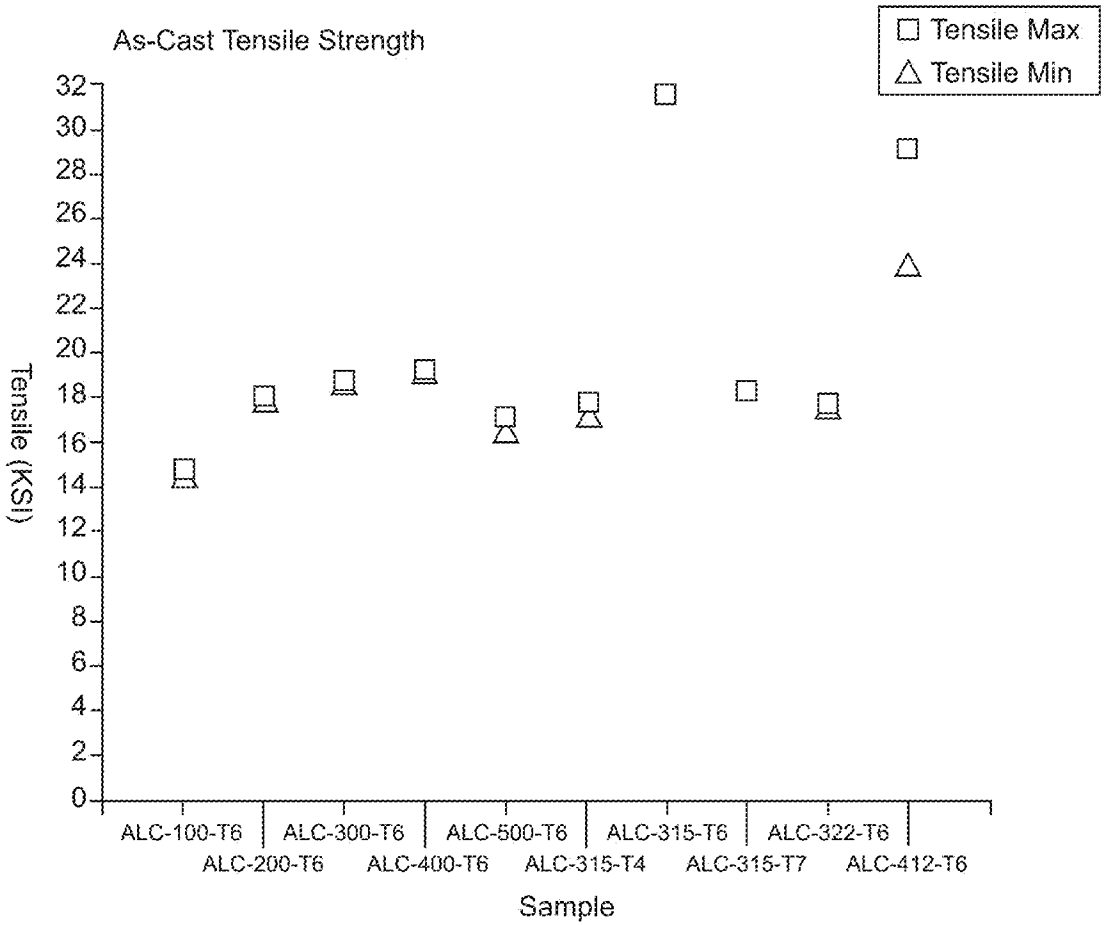
FIG. 84 is a graph showing a comparison of heat-treated samples for tensile strength.
Figure 85:
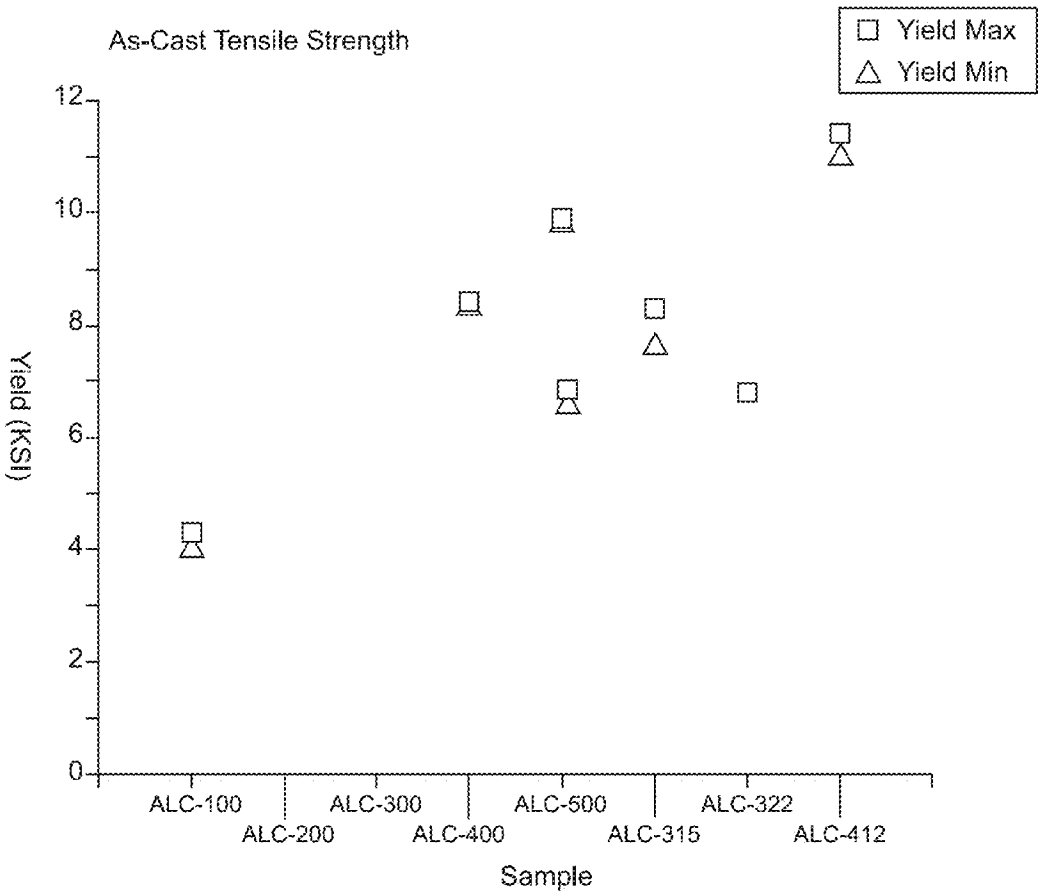
FIG. 85 is a graph showing a comparison of as-cast samples for yield strength.
Figure 86:
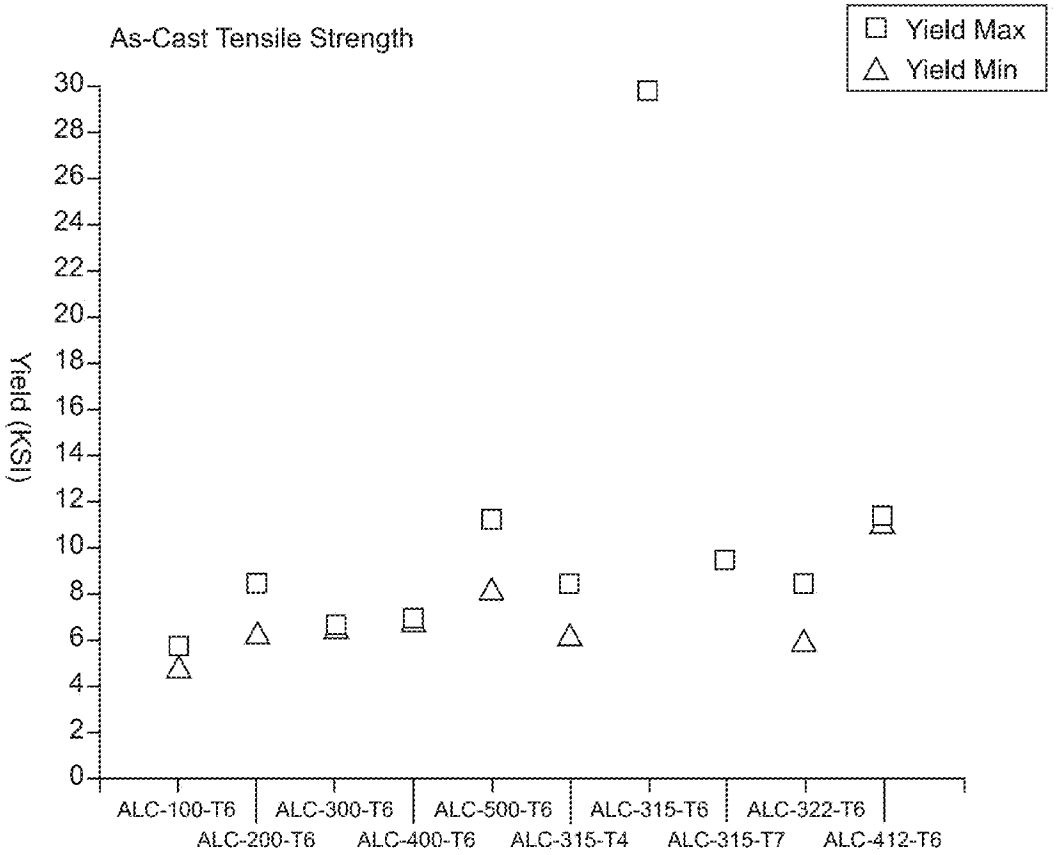
FIG. 86 is a graph showing a comparison of heat-treated samples for yield strength.
Figure 87:
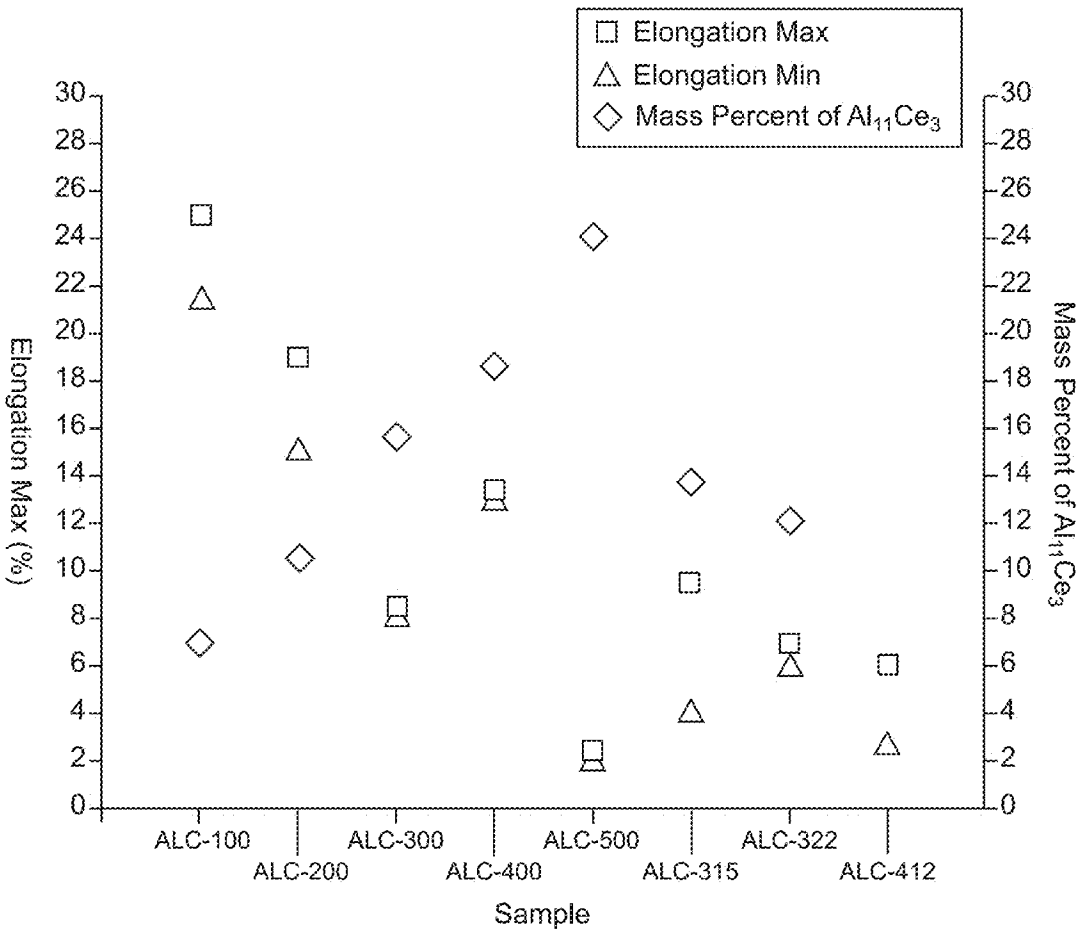
FIG. 87 is a graph showing a comparison of as-cast samples for elongation and mass fraction of $Al_{11}Ce_3$ phase.
Figure 88:
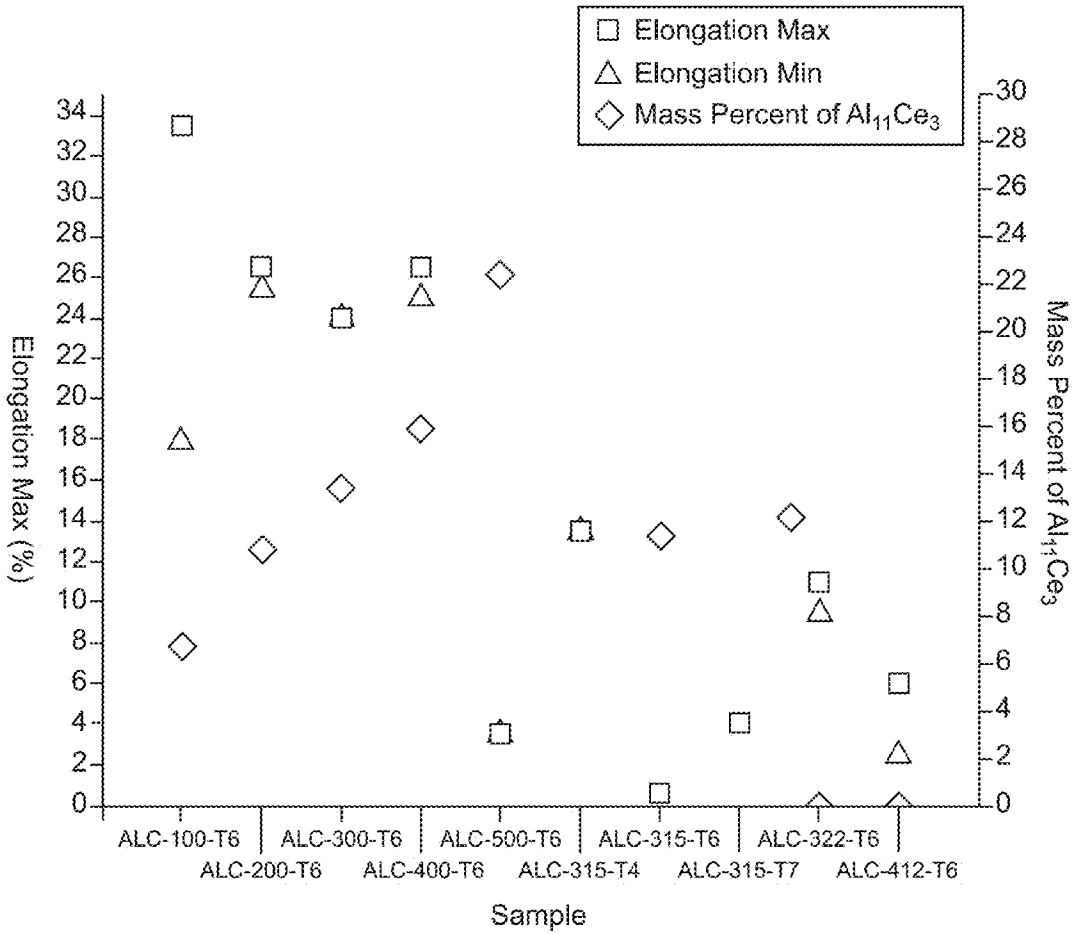
FIG. 88 is a graph showing a comparison of heat-treated samples for elongation and mass fraction of $Al_{11}Ce_3$ phase.

An alloy having a composition of 8% Ce, 1% Cu, balance Al (commonly written as Al-8Ce-1Cu) is made as described above in Example I. Properties are contemplated to be similar to alloy ALC-315 described hereinabove in Example VI Graphs were prepared to compare mechanical properties of various alloys described hereinabove. FIGS. 83 and 84 show respective comparisons of as-cast and heat-treated samples for tensile strength. FIGS. 85 and 86 show respective comparisons of as-cast and heat-treated samples for yield strength. FIGS. 87 and 88 show respective comparisons of as-cast and heat-treated samples for elongation and mass fraction of $Al_{11}Ce_3$ phase.

Example XI

Figure 89:
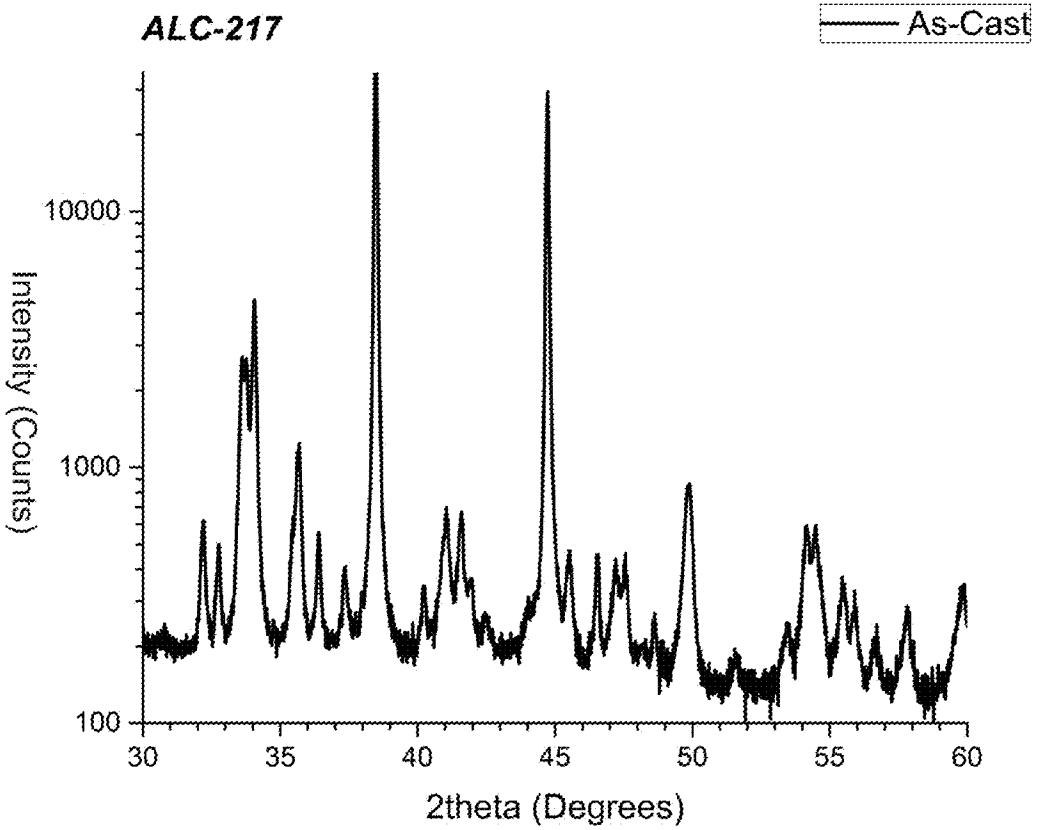
FIG. 89 is a graph showing focused XRD spectra of both the as-cast and the heat-treated samples of alloy ALC-217.
Figure 90:
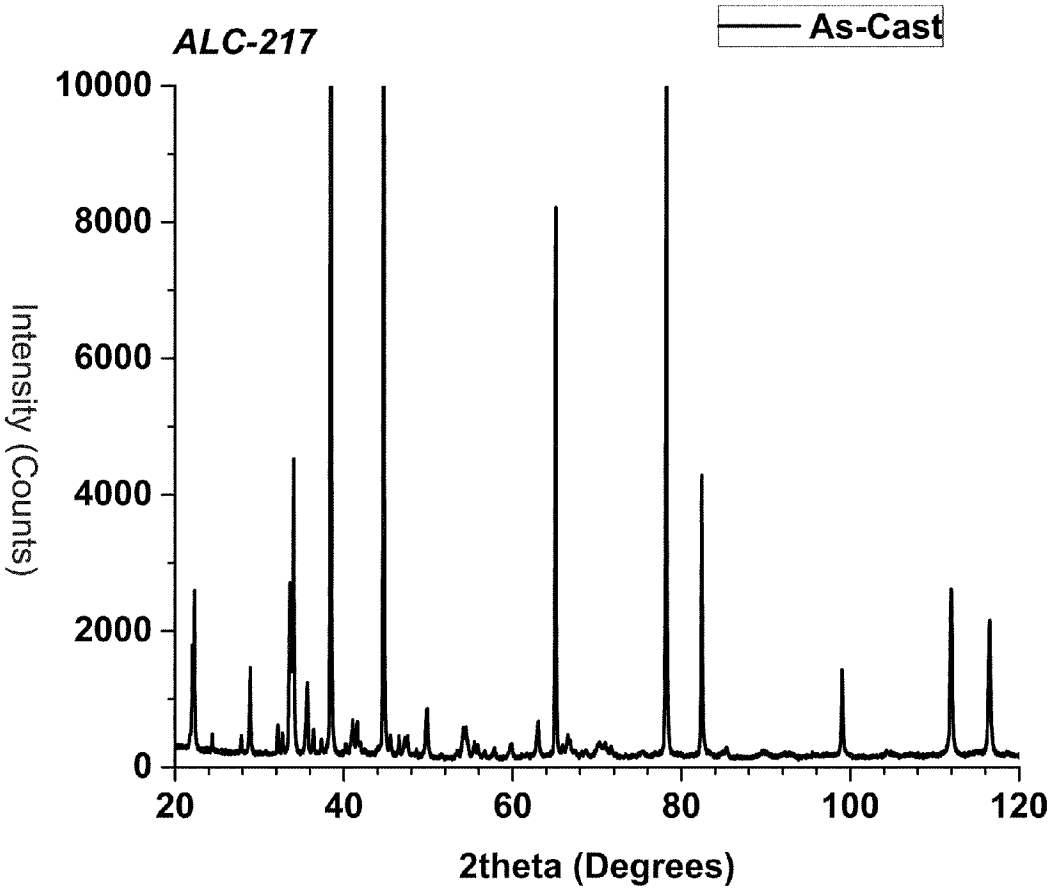
FIG. 90 is a graph showing full XRD spectra of both the as-cast and the heat-treated samples of alloy ALC-217.

Alloy ALC-217 having a composition of Al-8Ce-0.25Zr was made and tested as described above in Example I. FIGS. 89, 90 show, respectively, full and focused XRD spectra of both the as-cast and the heat-treated sample.

Mechanical properties of as-cast and heat-treated alloy ALC-217 are presented in Table 12.

TABLE 12

| ALC-217 | Tensile (KSI) | Yield (KSI) | Elongation (%) |
|---|---|---|---|
| As-cast trial 1 | 20 | 6.5 | 15.5 |
| As-cast trial 2 | 19.5 | 6.6 | 13 |

Example XII

Figure 91:
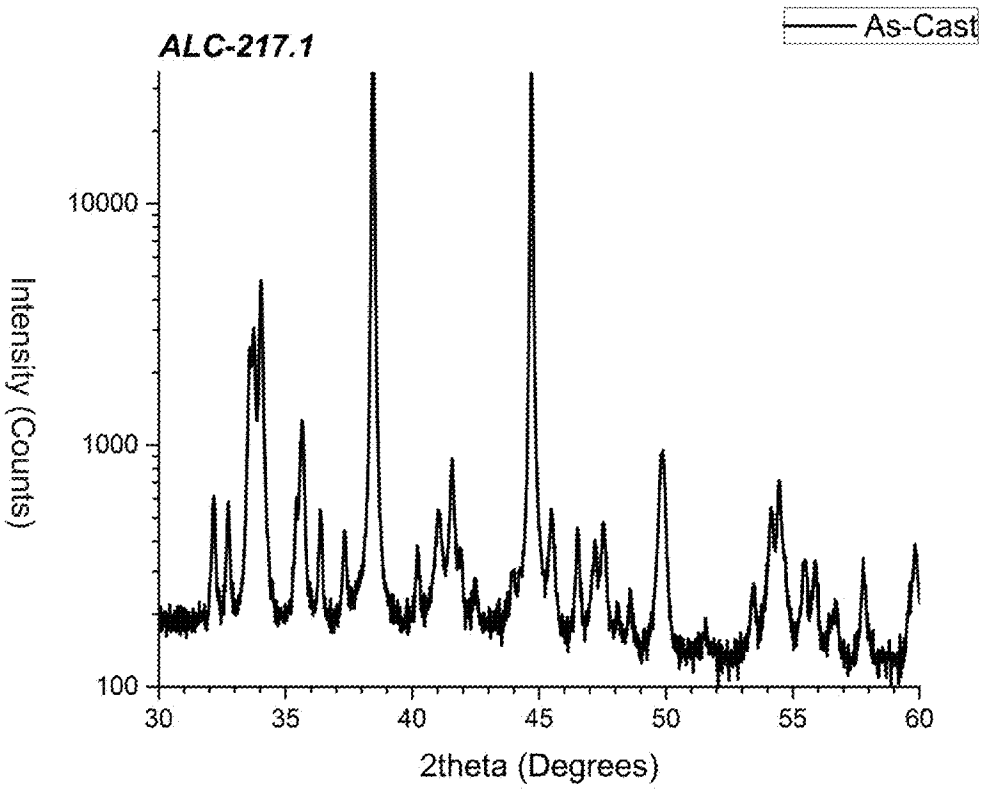
FIG. 91 is a graph showing focused XRD spectra of both the as-cast and the heat-treated samples of alloy ALC-217.1.
Figure 92:
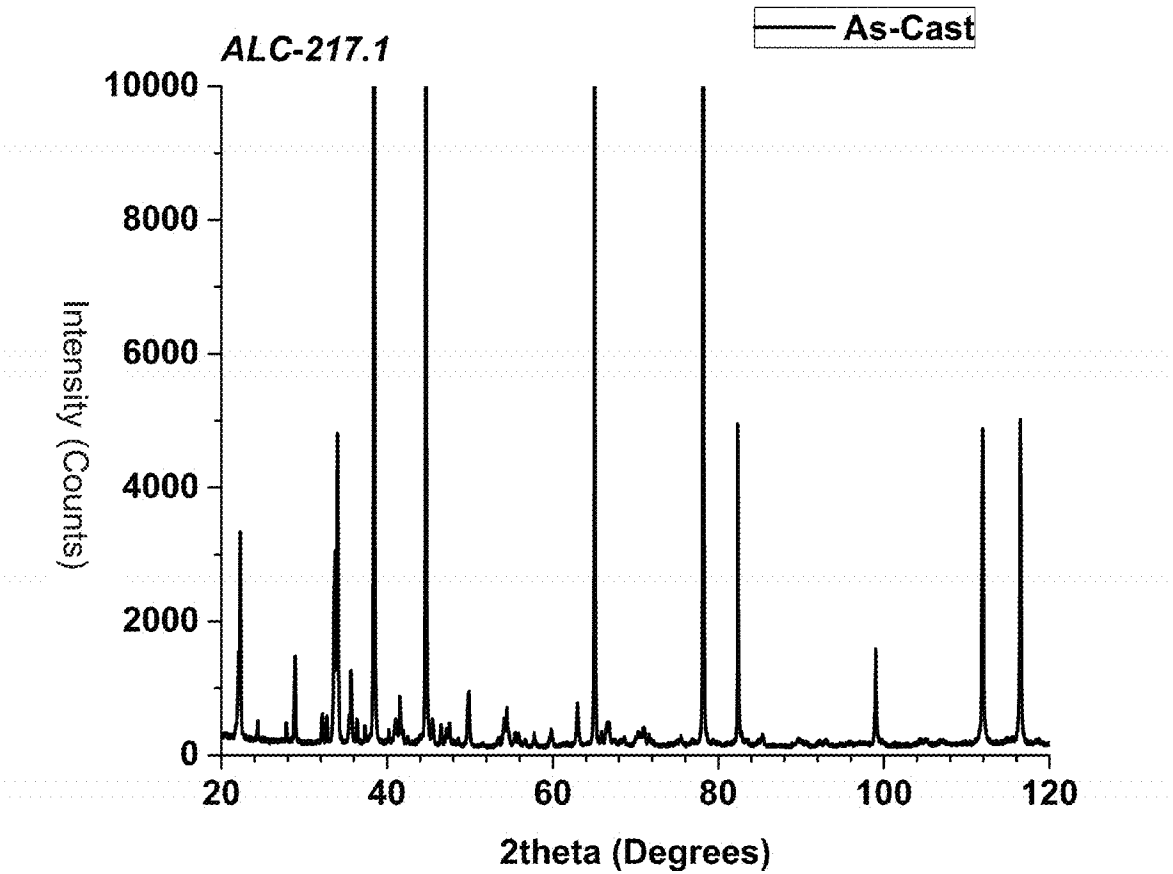
FIG. 92 is a graph showing full XRD spectra of both the as-cast and the heat-treated samples of alloy ALC-217.1.

Alloy ALC-217.1 having a composition of Al-8Ce-0.25Zr was made and tested as described above in Example I. FIGS. 91, 92 show, respectively, full and focused XRD spectra of both the as-cast and the heat-treated sample.

Example XIII

Figure 93:
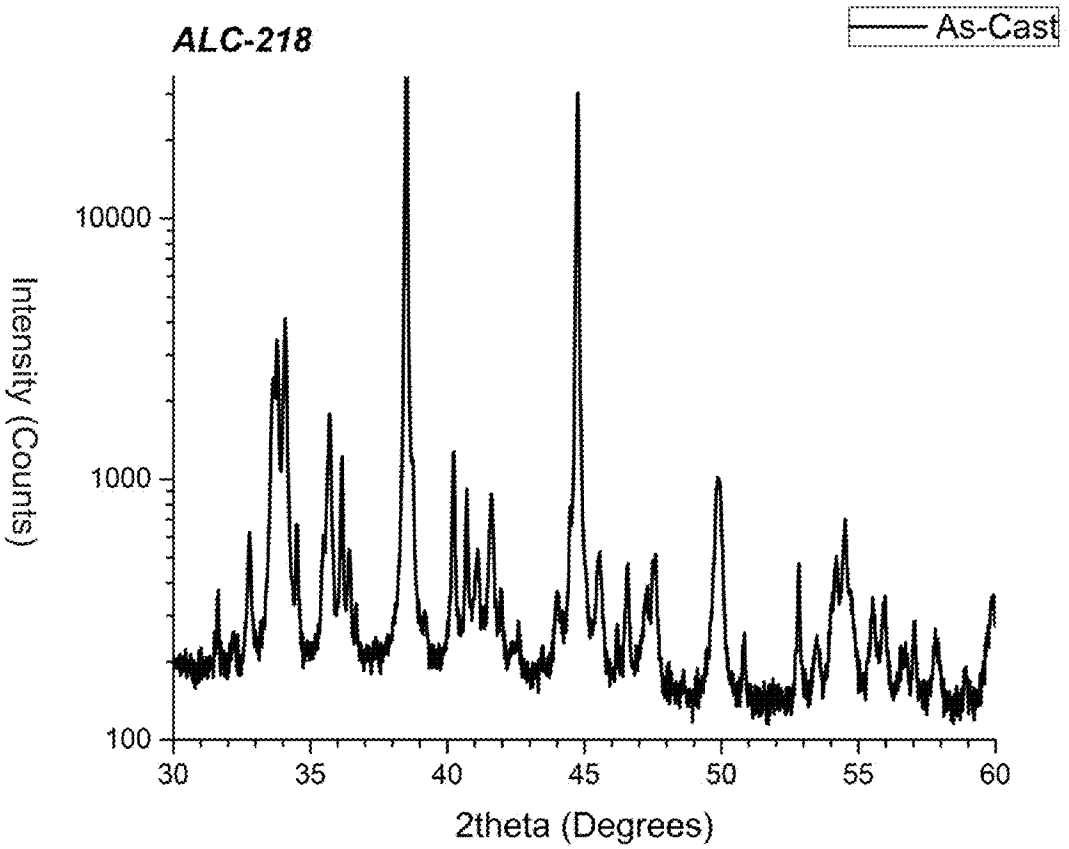
FIG. 93 is a graph showing focused XRD spectra of both the as-cast and the heat-treated samples of alloy ALC-218.
Figure 94:
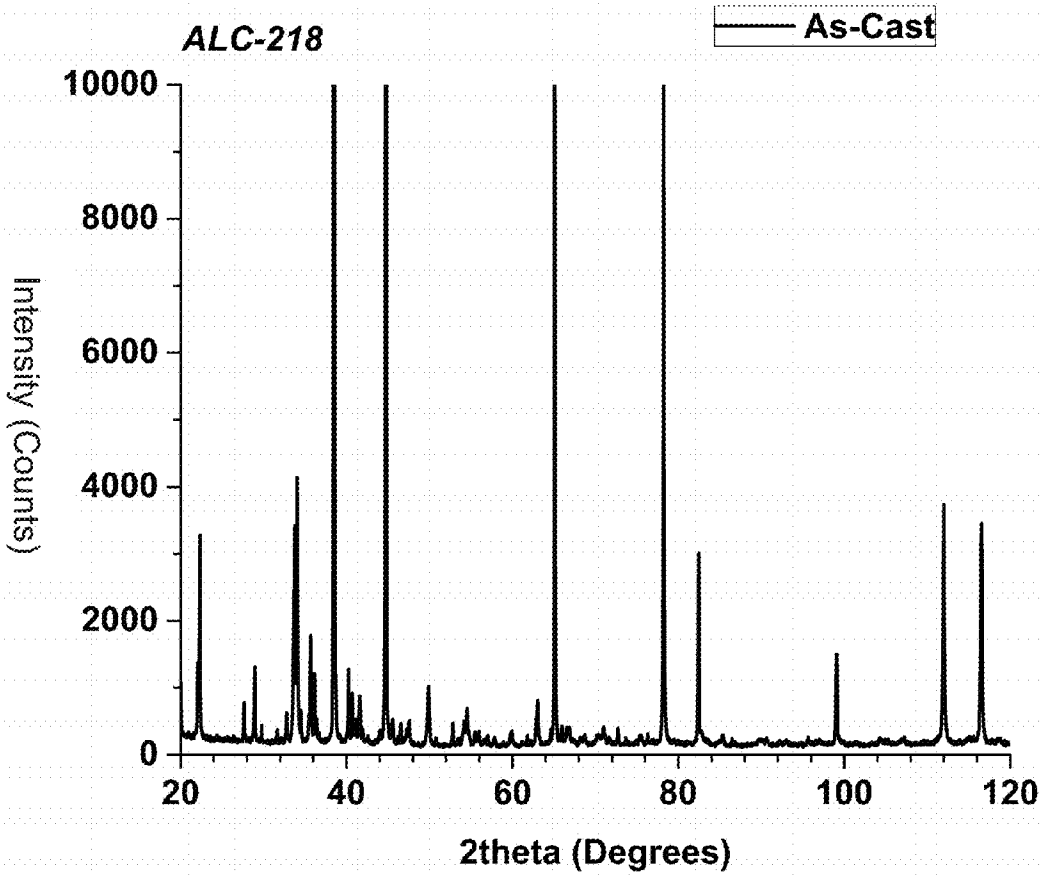
FIG. 94 is a graph showing full XRD spectra of both the as-cast and the heat-treated samples of alloy ALC-218.

Alloy ALC-218 having a composition of Al-8Ce-1.3Ti was made and tested as described above in Example I. FIGS. 93, 94 show, respectively, full and focused XRD spectra of both the as-cast and the heat-treated sample.

Mechanical properties of as-cast and heat-treated alloy ALC-218 are presented in Table 13.

TABLE 13

| ALC-218 | Tensile (KSI) | Yield (KSI) | Elongation (%) |
|---|---|---|---|
| As-cast trial 1 | 18 | 6.3 | 10 |
| As-cast trial 2 | 18.5 | 6.8 | 10 |

Example XIV

Figure 95:
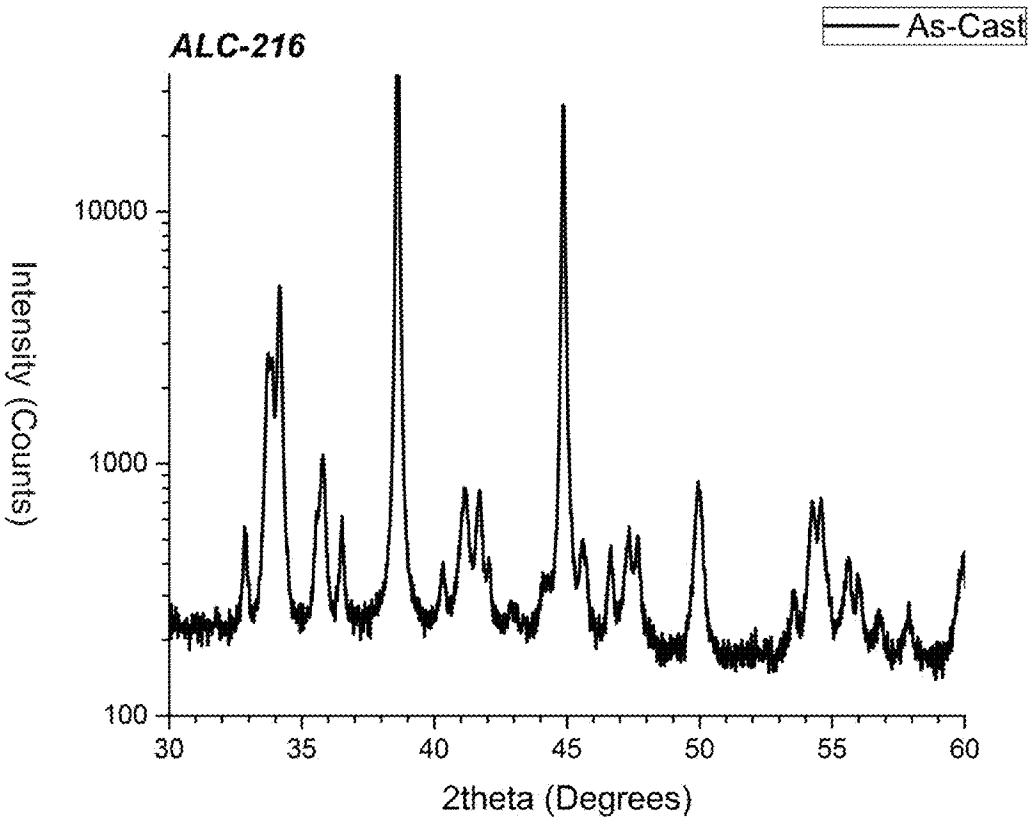
FIG. 95 is a graph showing focused XRD spectra of both the as-cast and the heat-treated samples of alloy ALC-216.
Figure 96:
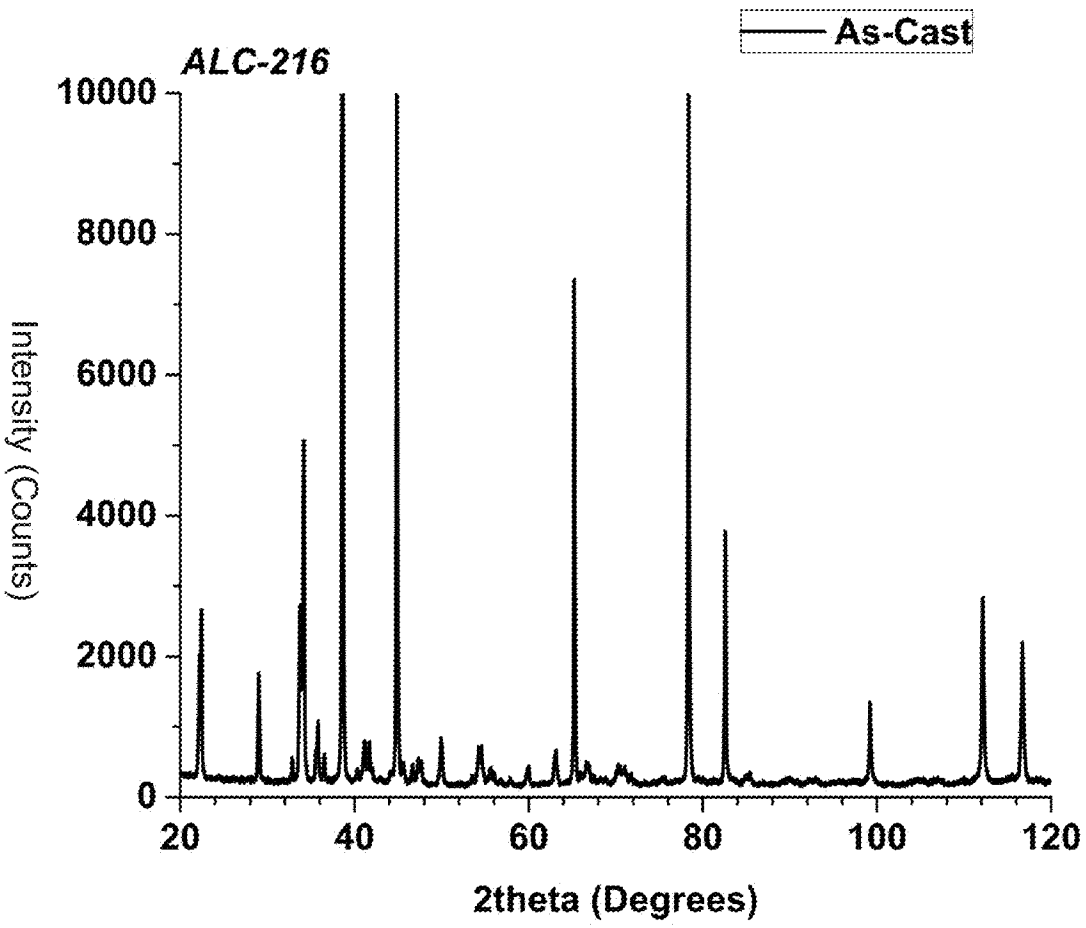
FIG. 96 is a graph showing full XRD spectra of both the as-cast and the heat-treated samples of alloy ALC-216.

Alloy ALC-216 having a composition of Al-8Ce-0.75Mn was made and tested as described above in Example I. FIGS. 95, 96 show, respectively, full and focused XRD spectra of both the as-cast and the heat-treated sample.

Mechanical properties of as-cast and heat-treated alloy ALC-216 are presented in Table 14.

TABLE 14

| ALC-216 | Tensile (KSI) | Yield (KSI) | Elongation (%) |
|---|---|---|---|
| As-cast Trial 1 | 21.9 | 12.4 | 13.50 |
| As-cast trial 2 | 21.6 | 12.6 | 12.50 |
| T6 trial 1 | 18.6 | 6.9 | 13 |
| T6 trial 2 | 18.9 | 9.6 | 16 |

Example XV

Figure 97:
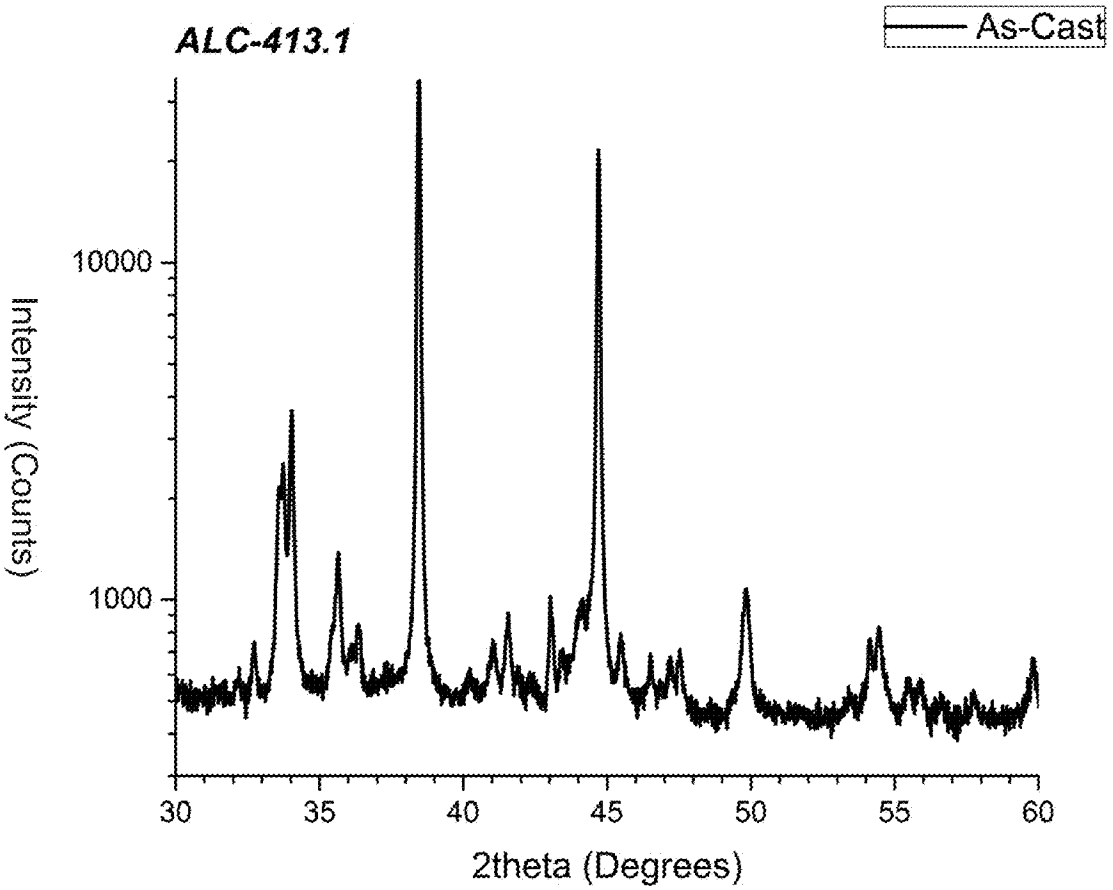
FIG. 97 is a graph showing focused XRD spectra of both the as-cast and the heat-treated samples of alloy ALC-413.1.
Figure 98:
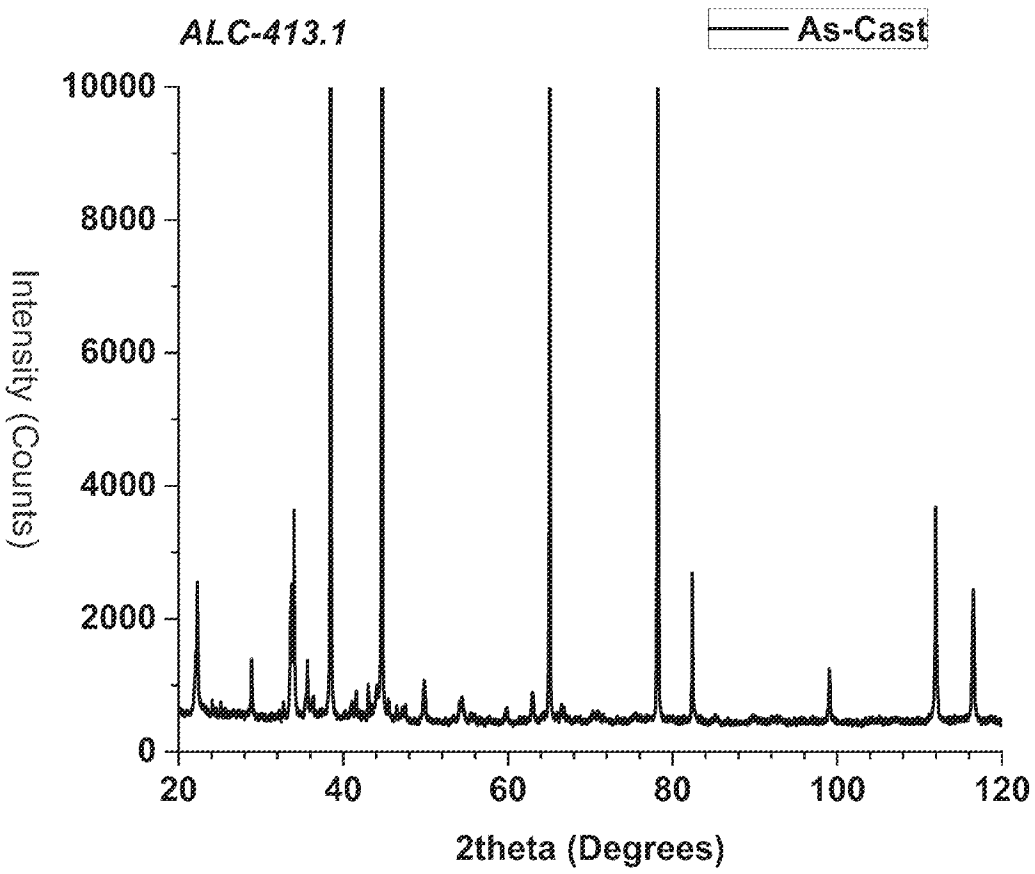
FIG. 98 is a graph showing full XRD spectra of both the as-cast and the heat-treated samples of alloy ALC-413.1.

Alloy ALC-413.1 having a composition of Al-2Ce-4Fe was made and tested as described above in Example I. FIGS. 97, 98 show, respectively, full and focused XRD spectra of both the as-cast and the heat-treated sample.

Mechanical properties of as-cast and heat-treated alloy ALC-413.1 are presented in Table 15.

TABLE 15

| ALC-413.1 | Tensile (KSI) | Yield (KSI) | Elongation (%) |
|---|---|---|---|
| As-cast Trial 1 | 16 | 7.9 | 2 |
| As-cast trial 2 | 16.3 | 8.7 | 2 |

Example XVI

Figure 99:
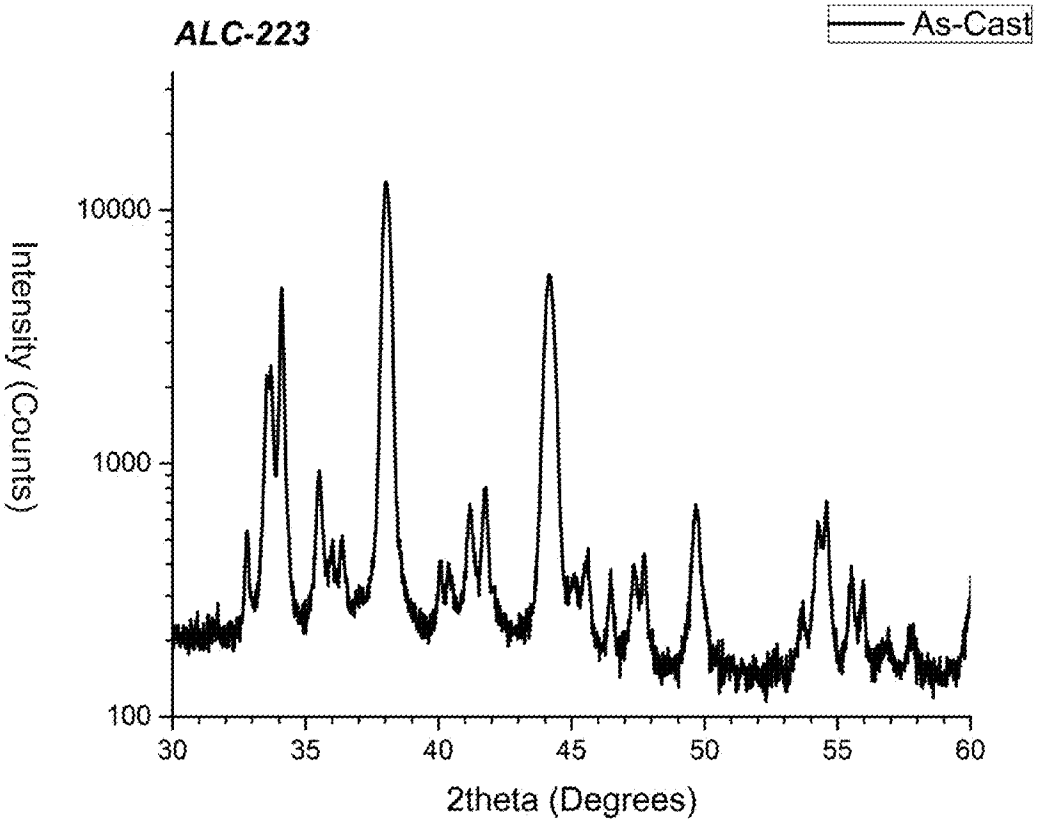
FIG. 99 is a graph showing focused XRD spectra of both the as-cast and the heat-treated samples of alloy ALC-223.
Figure 100:
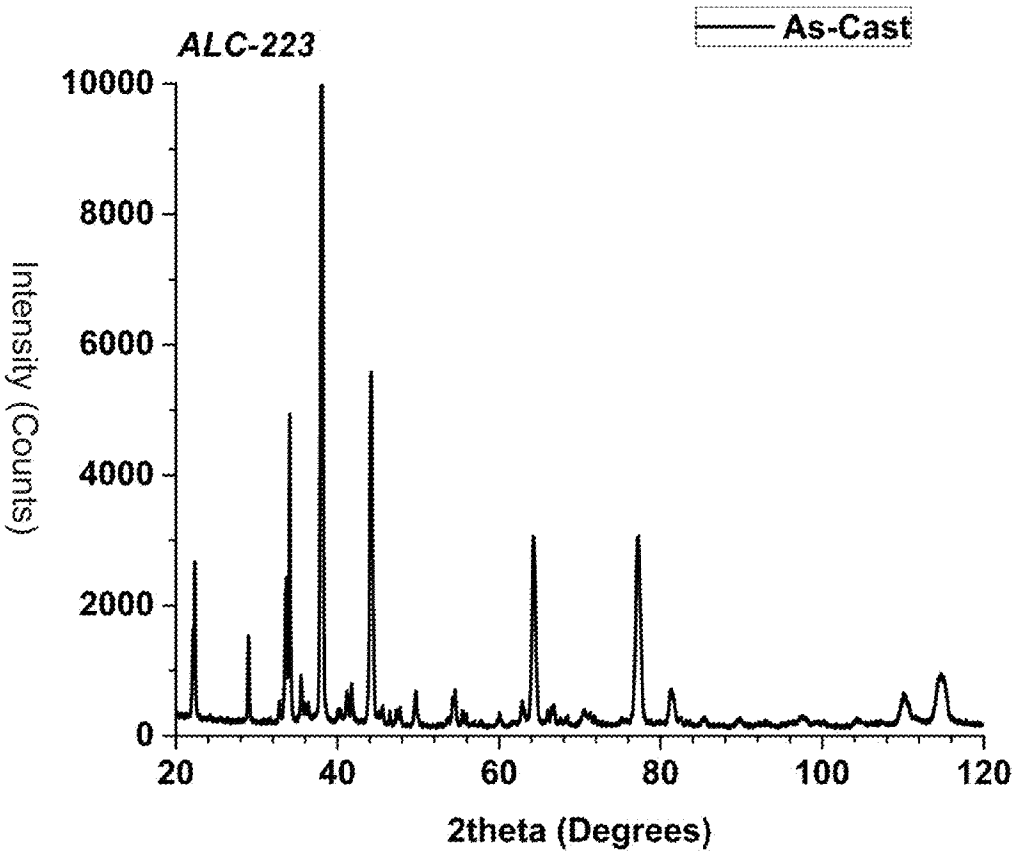
FIG. 100 is a graph showing full XRD spectra of both the as-cast and the heat-treated samples of alloy ALC-223.

Alloy ALC-223 having a composition of Al-8Ce-10Mg-2.5Zn was made and tested as described above in Example I. FIGS. 99, 100 show, respectively, full and focused XRD spectra of both the as-cast and the heat-treated sample.

Mechanical properties of as-cast and heat-treated alloy ALC-223 are presented in Table 16.

TABLE 16

| ALC-223 | Tensile (KSI) | Yield (KSI) | Elongation (%) |
|---|---|---|---|
| As-cast Trial 1 | 29.2 | 26.9 | 1.7 |
| As-cast trial 2 | 31 | 27.3 | 1 |
| T6 trial 1 | 39 | 32 | 2.0 |

Figure 101:
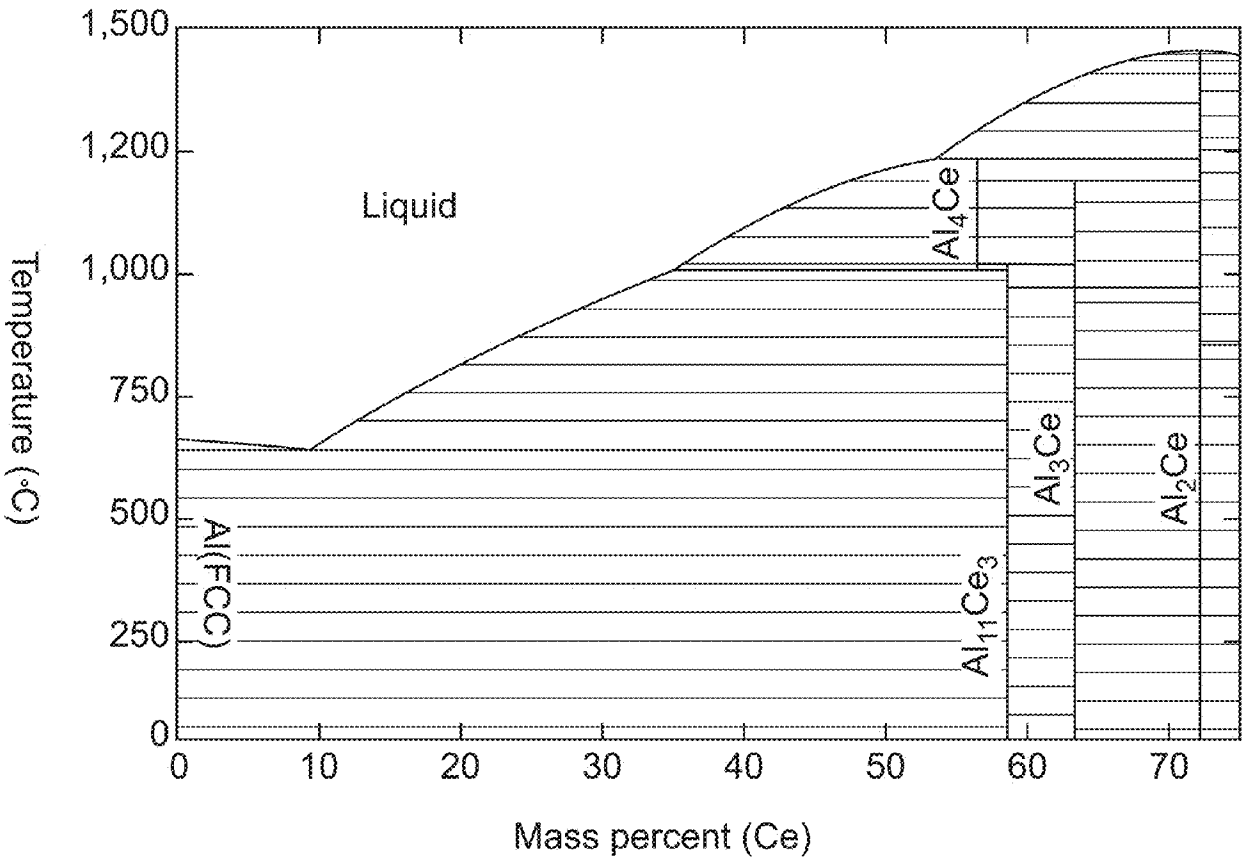
FIG. 101 is a graph showing an Al-rich portion of an Al—Ce phase diagram.
Figure 102:
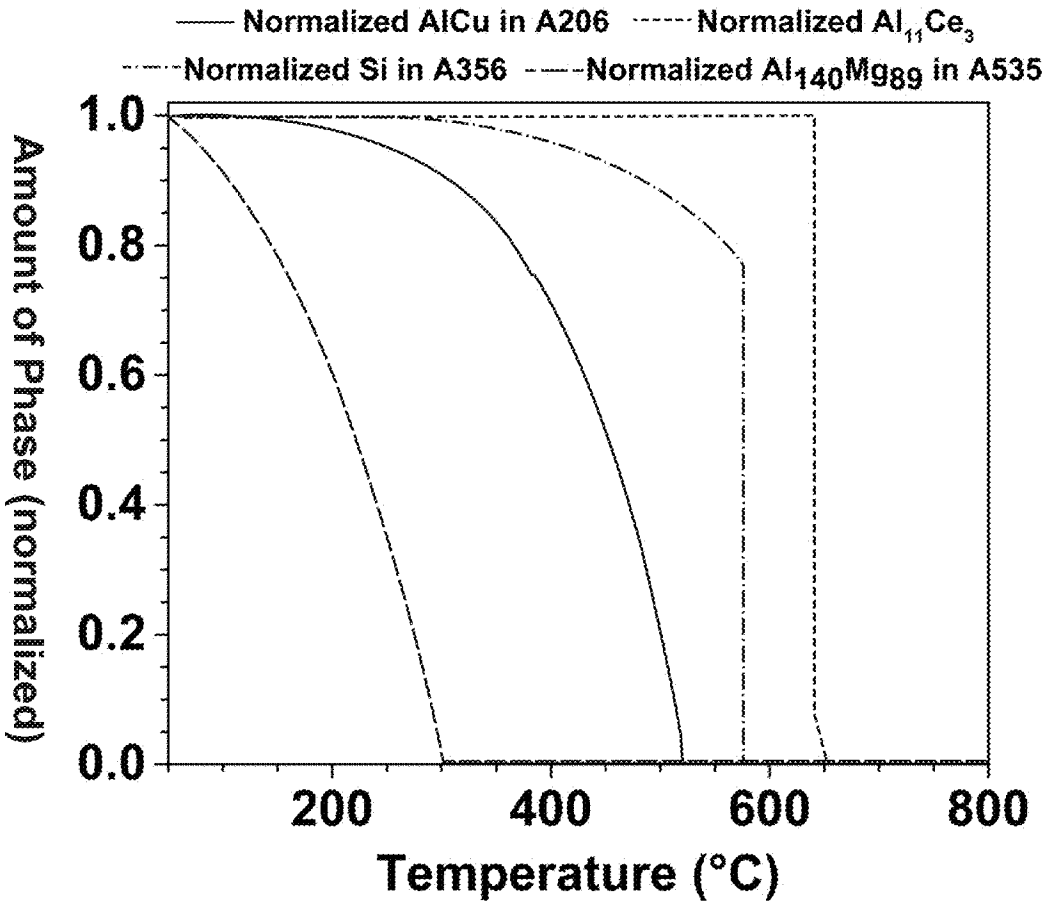
FIG. 102 is a property diagram depicting phase solubility in Aluminum alloys vs. temperature.
Figure 103:
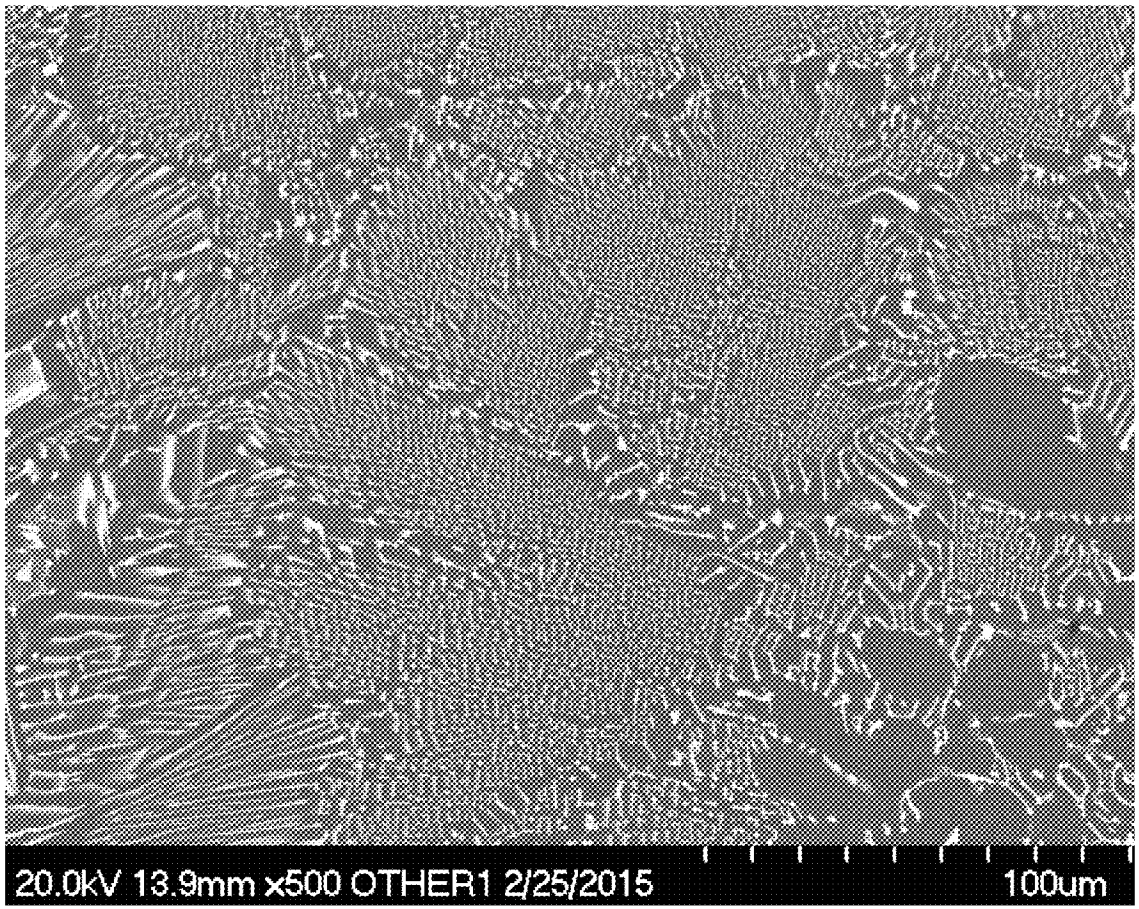
FIG. 103 is an SEM image of Al-12Ce in the as-cast condition.
Figure 104:
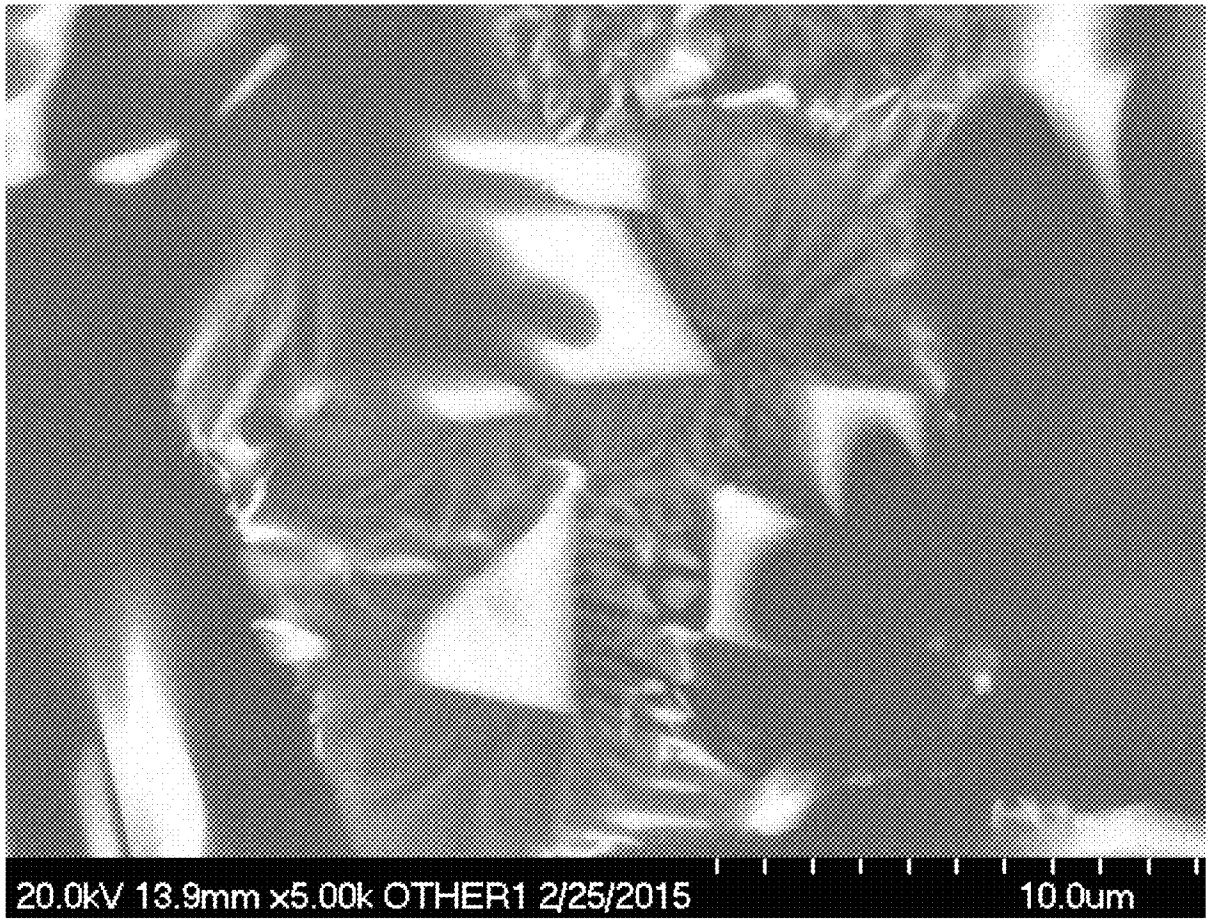
FIG. 104 is a higher magnification of a portion of FIG. 103.
Figure 105:
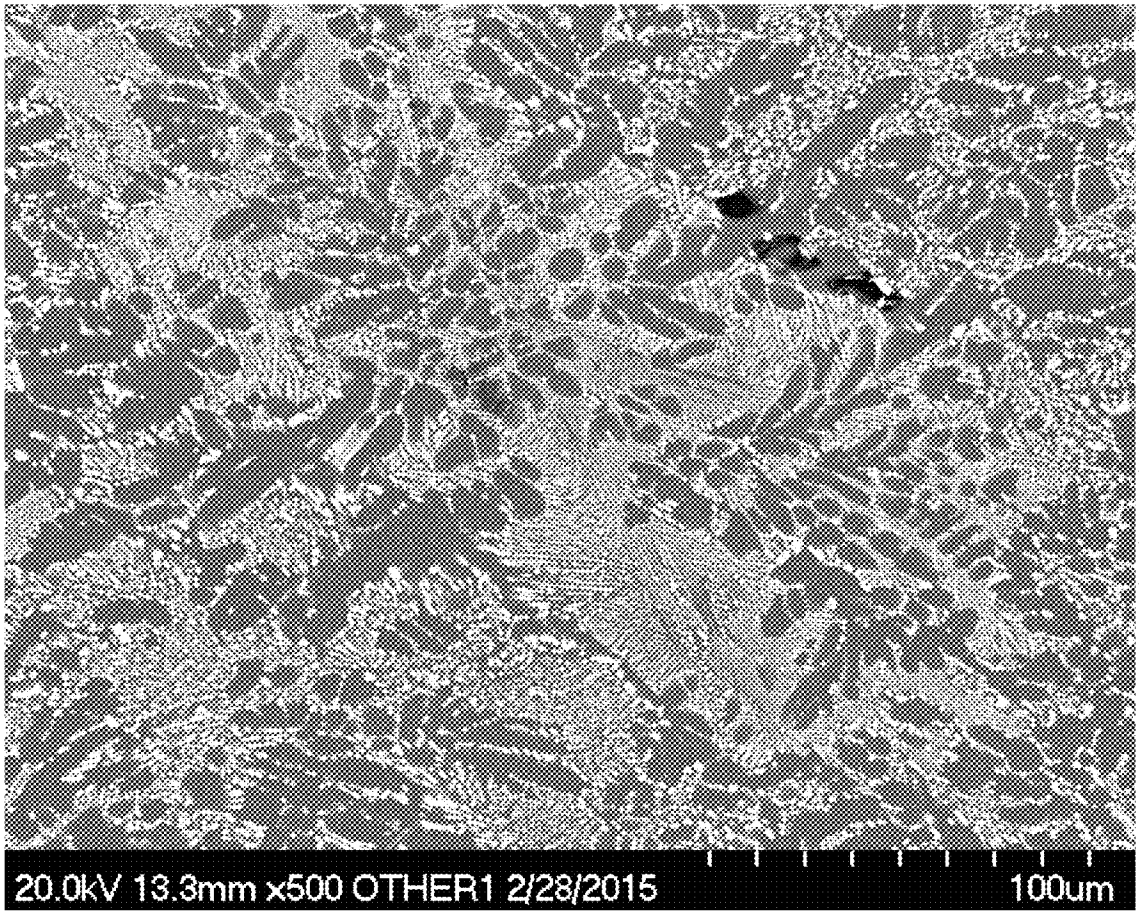
FIG. 105 is an SEM image of Al-12Ce in the T6 heat-treated condition.
Figure 106:
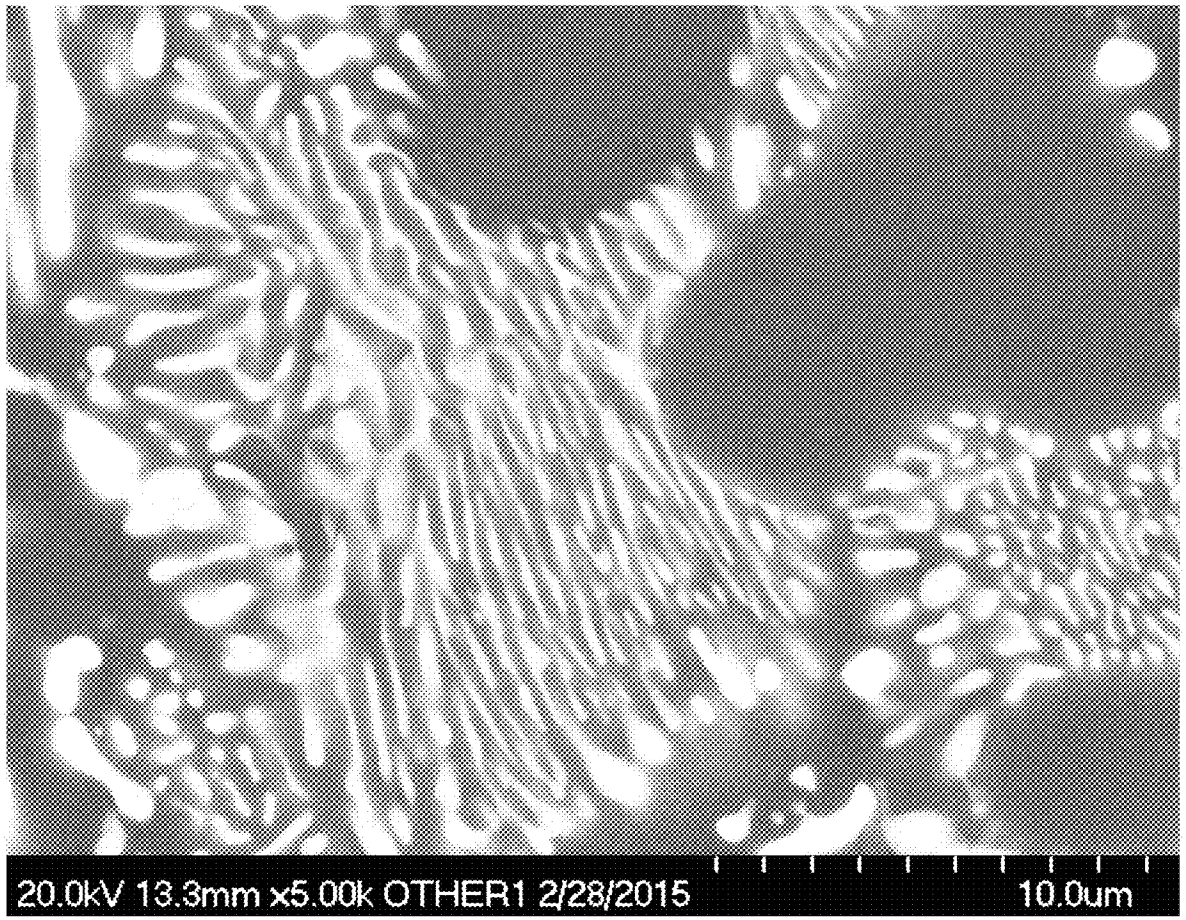
FIG. 106 is a higher magnification of a portion of FIG. 105.
Figure 107:
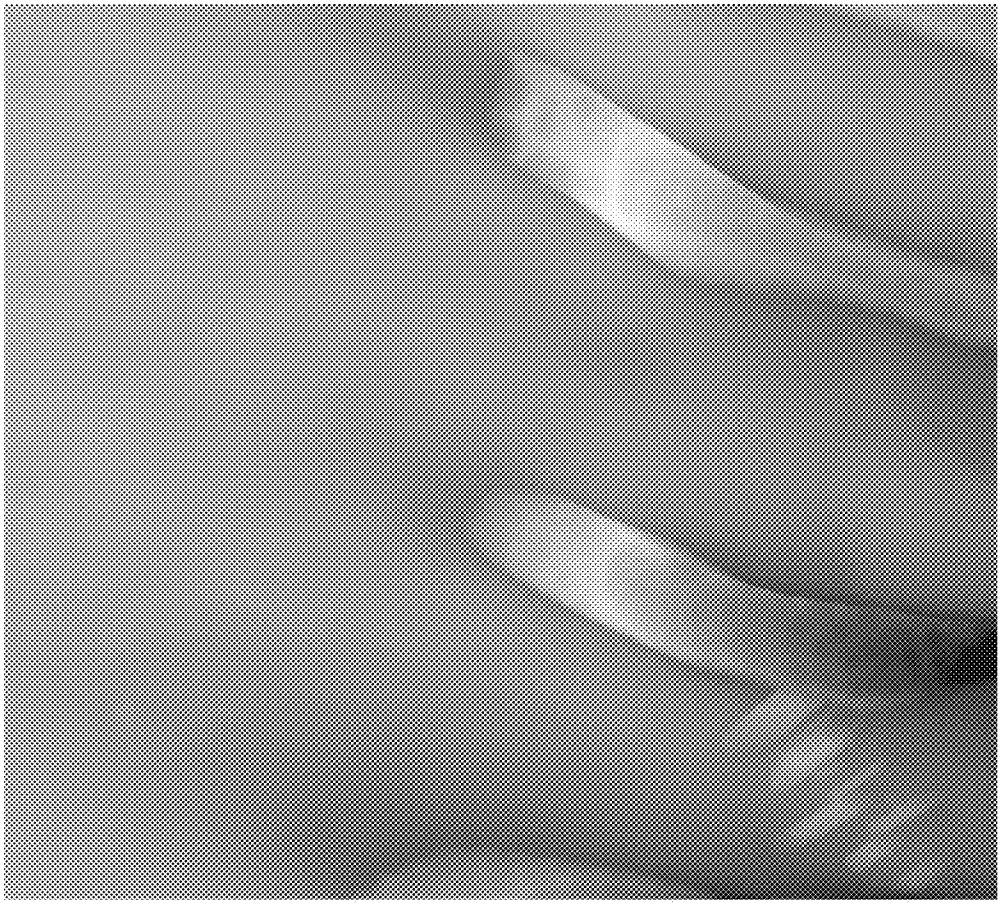
FIG. 107 is a TEM image of Al-10Ce intermetallic.
Figure 108:
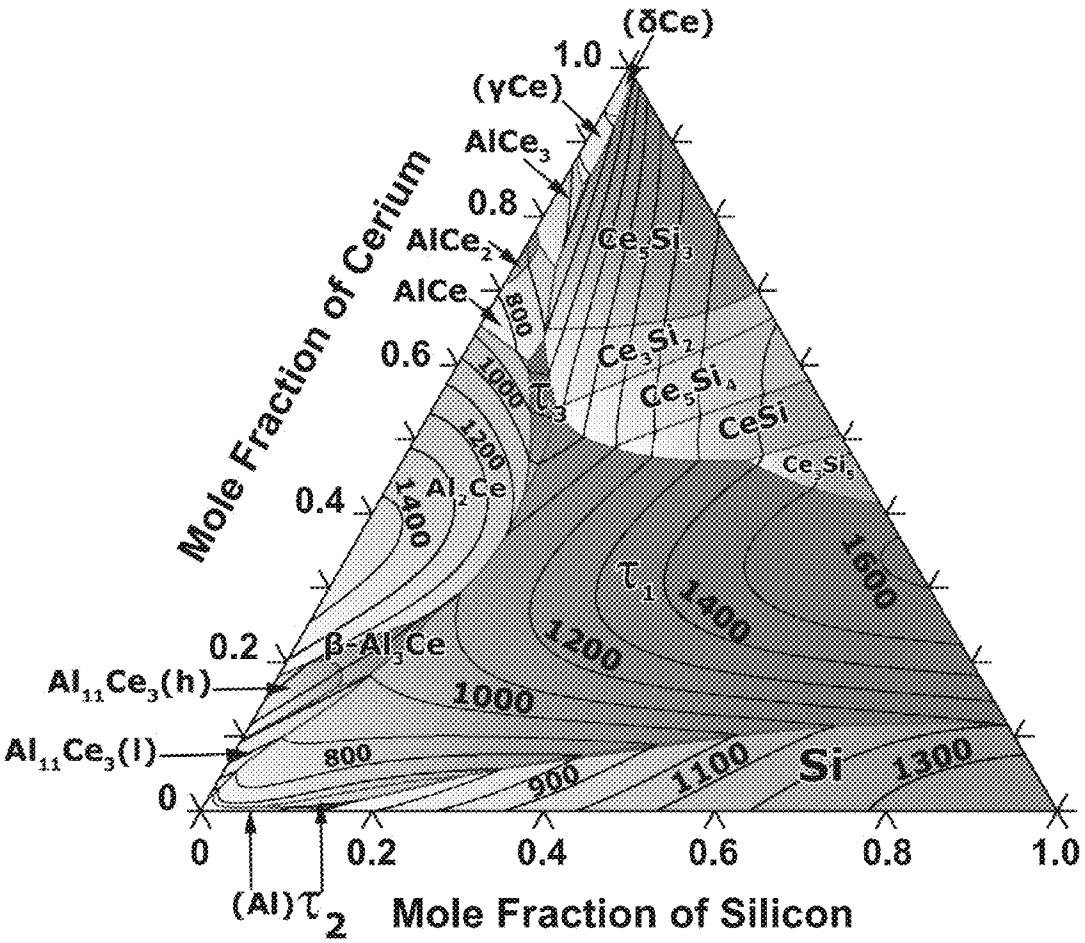
FIG. 108 is a diagram showing Al—Ce—Si ternary liquidus projection.

Further illustrations are provided as follows: FIG. 101 shows an Al-rich portion of an Al—Ce phase diagram. FIG. 102 shows phase solubility in Aluminum alloys vs. temperature. FIGS. 103, 104 are SEM images of Al-12Ce in the as-cast condition showing the Al—Ce rich intermetallic. FIGS. 105, 106 are SEM images of Al-12Ce in the T6 heat treated condition showing Al—Ce rich intermetallic and mild spheroidization. FIG. 107 is a TEM image of Al-10Ce intermetallic; the larger "fingers" are about 275 nm wide at the widest point thereof, and the smaller "fingers" are about 130 nm wide at the widest point thereof. FIG. 108 shows Al—Ce—Si ternary liquidus projection.

Figure 109:
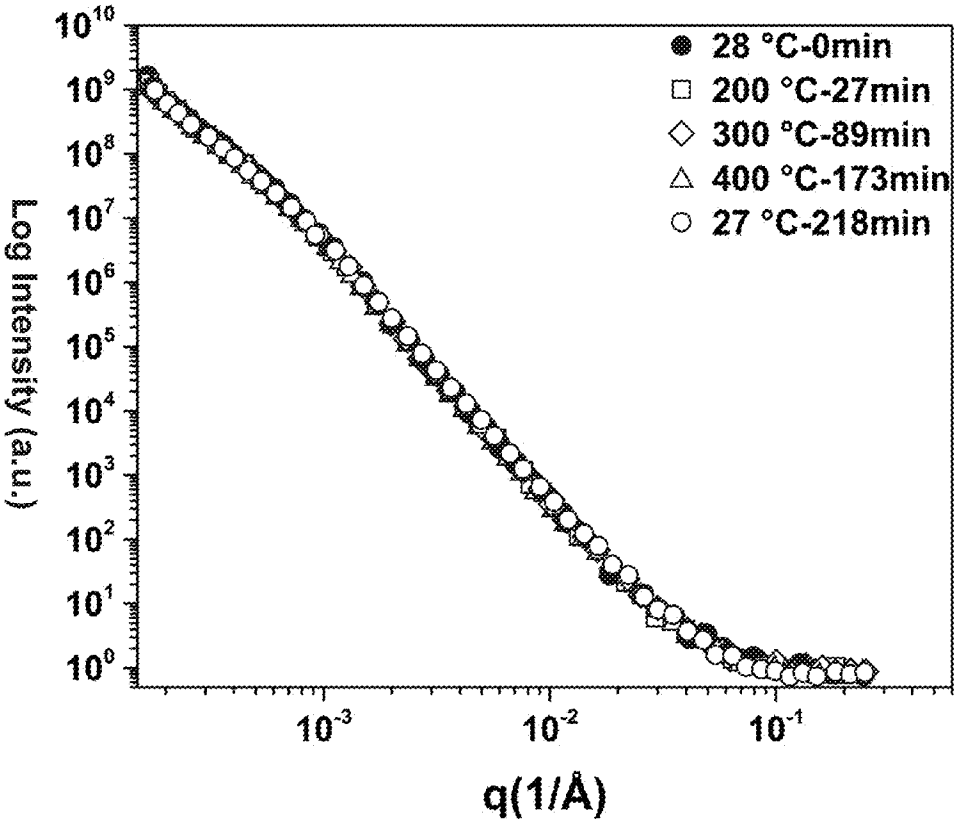
FIG. 109 is a graph showing small-angle X-Ray scattering spectra of Intensity vs. q for Al-12Ce-4Si-0.4Mg thermal cycles.
Figure 110:
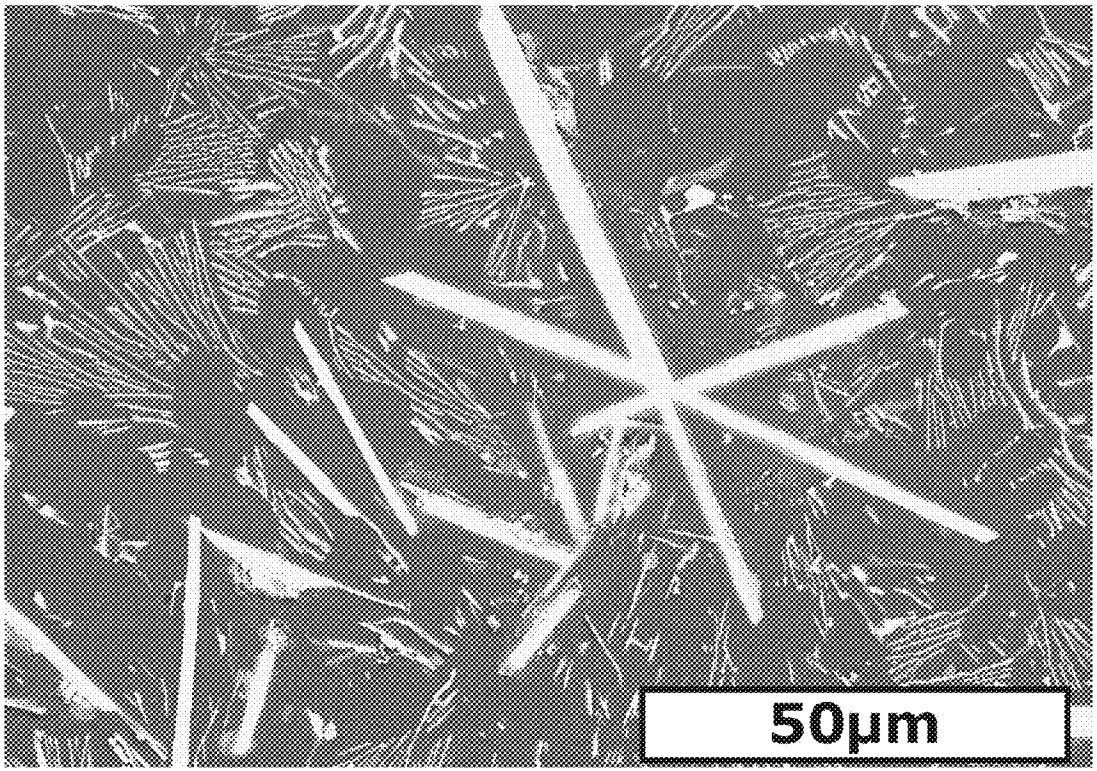
FIG. 110 is an SEM image of Al-12Ce-4Si-0.4Mg in the as-cast condition.
Figure 111:
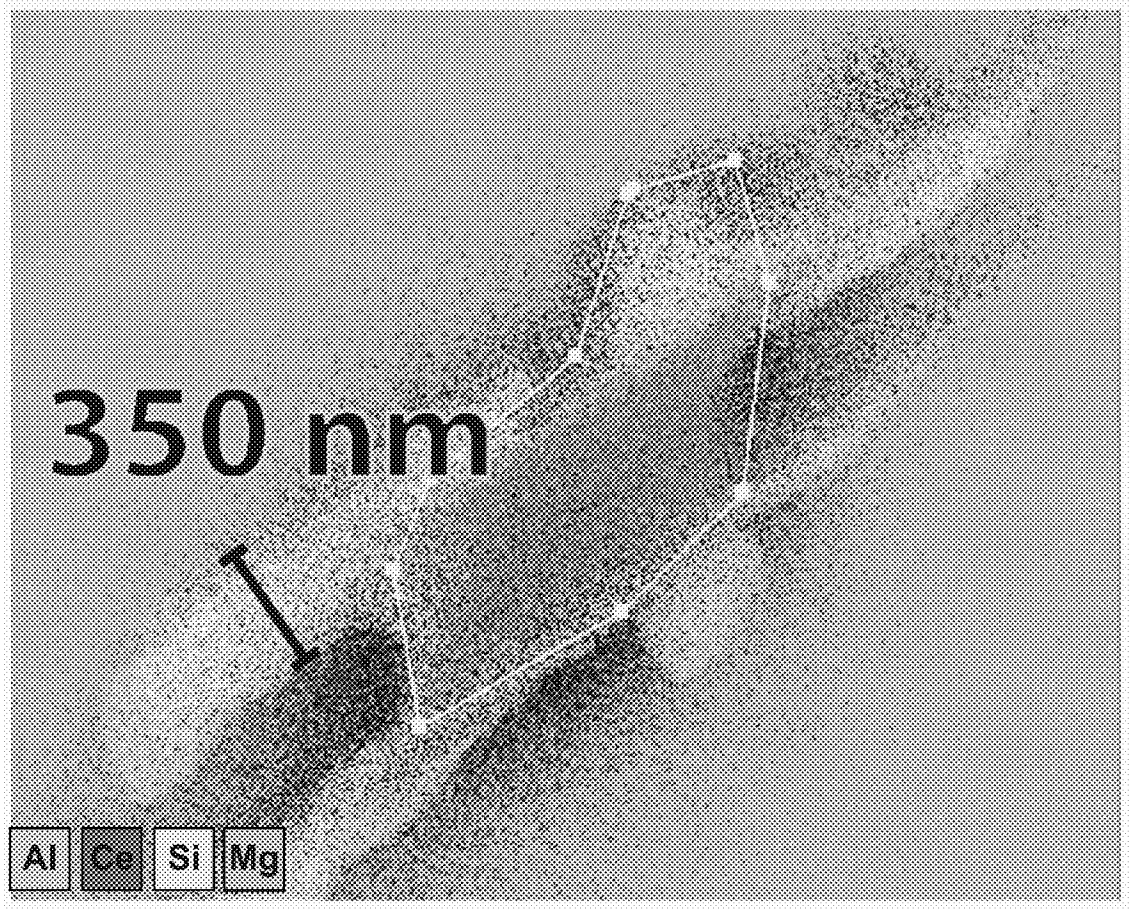
FIG. 111 is an EDS image of intermetallic precipitates of same composition as white phases in SEM image shown in FIG. 110.
Figure 112:
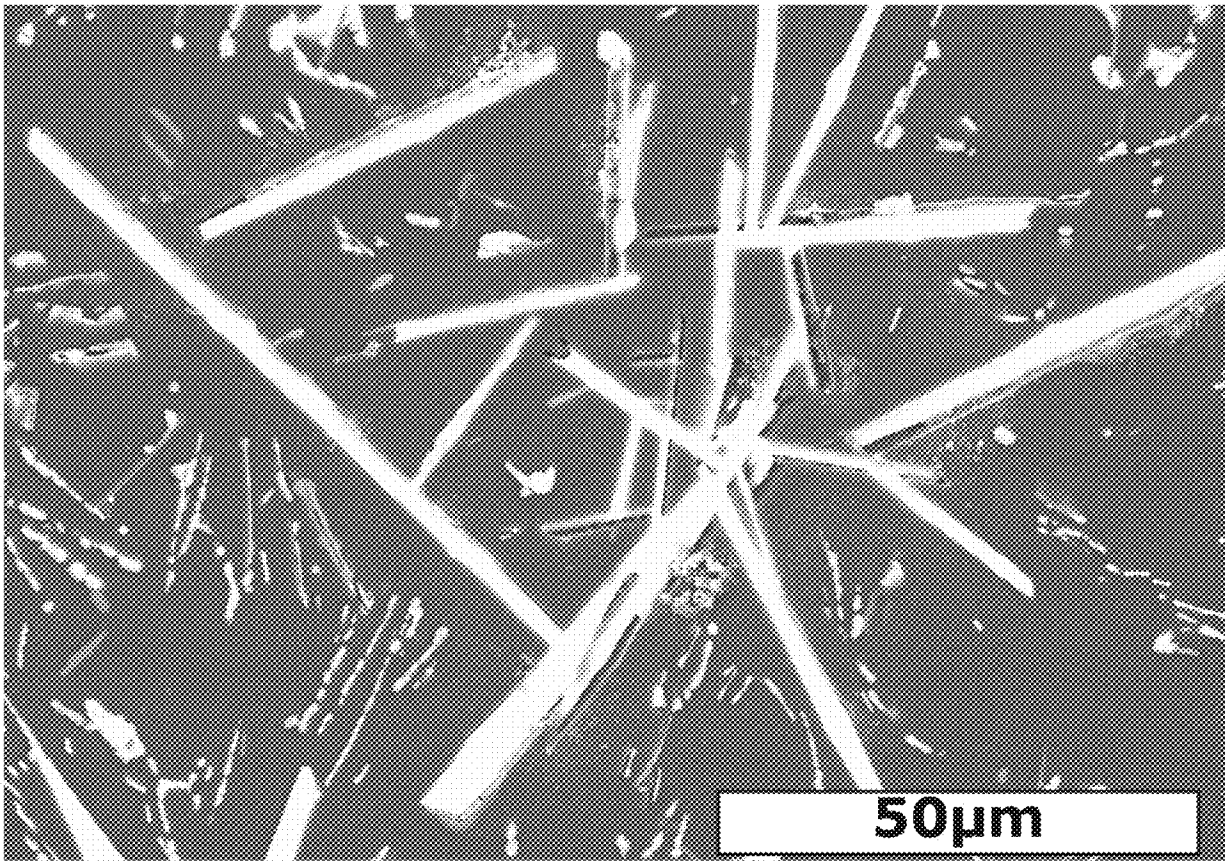
FIG. 112 is an SEM image of Al-12Ce-4Si-0.4Mg in the T6 heat-treated condition.
Figure 113:
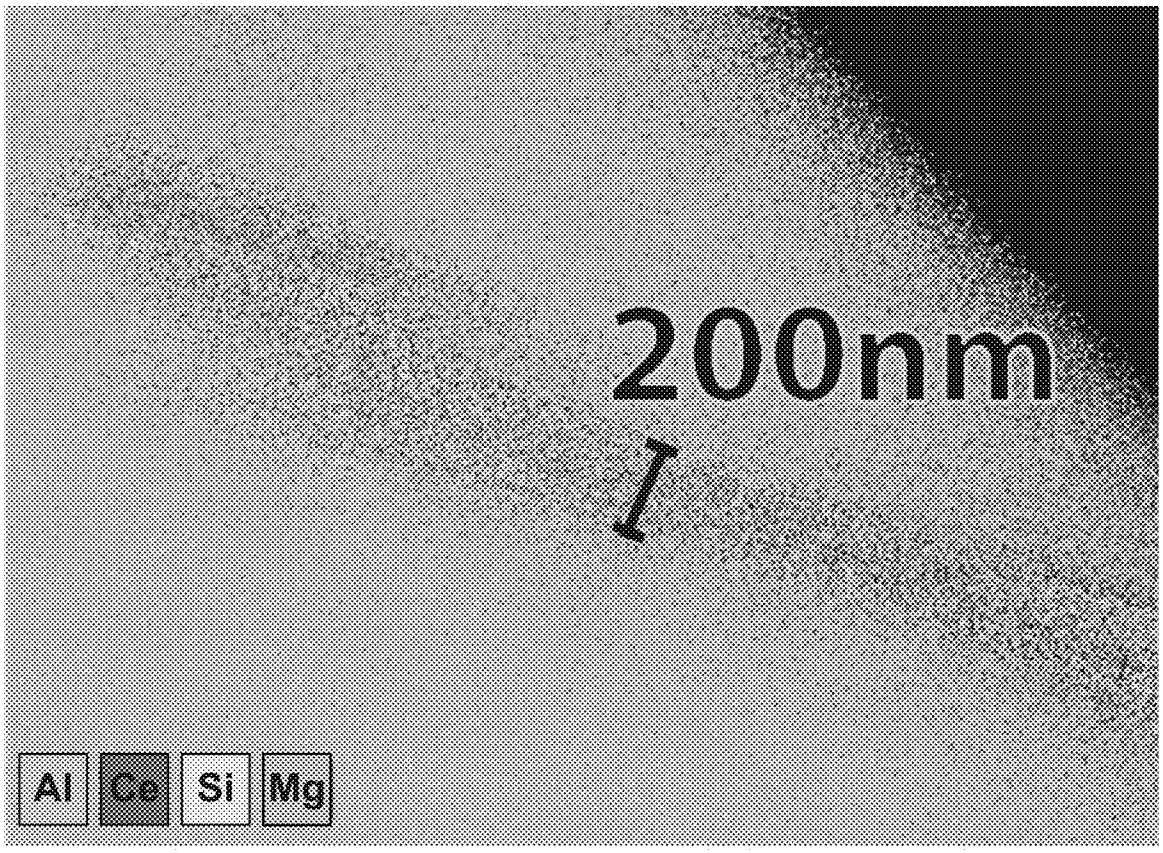
FIG. 113 is an EDS image of intermetallic precipitates of same composition as white phases in SEM image shown in FIG. 112.

FIG. 109 shows small-angle X-Ray scattering spectra of Intensity vs. q for Al-12Ce-4Si-0.4Mg thermal cycles showing measurable effect. FIG. 110 is an SEM image of Al-12Ce-4Si-0.4Mg in the as-cast condition. FIG. 111 is an EDS image of intermetallic precipitates (especially the encircled area) of same composition as white phases in SEM image shown in FIG. 110. FIG. 112 is an SEM image of Al-12Ce-4Si-0.4Mg in the T6 heat treated condition. FIG. 113 is an EDS image of intermetallic precipitates of same composition as white phases in SEM image shown in FIG. 112.

Figure 114:
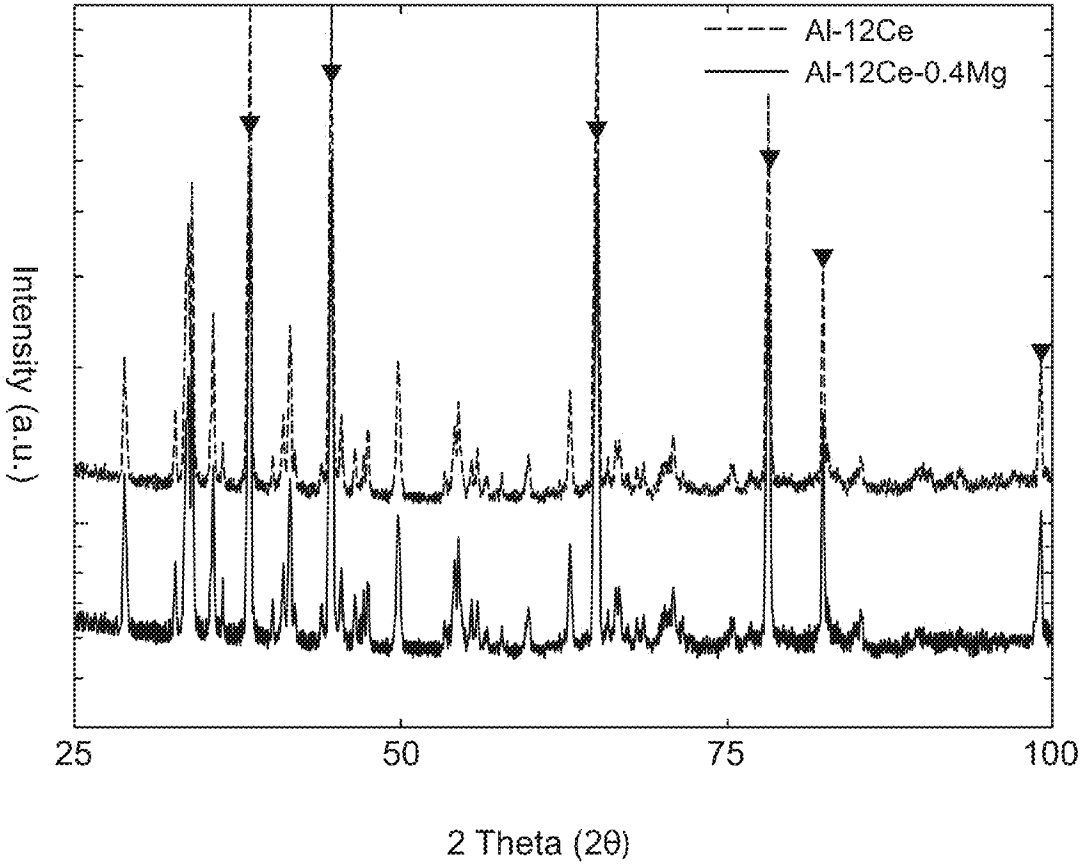
FIG. 114 is a graph showing offset XRD spectra of Al-12Ce and Al-12Ce-0.4Mg with arbitrary offset.
Figure 115:
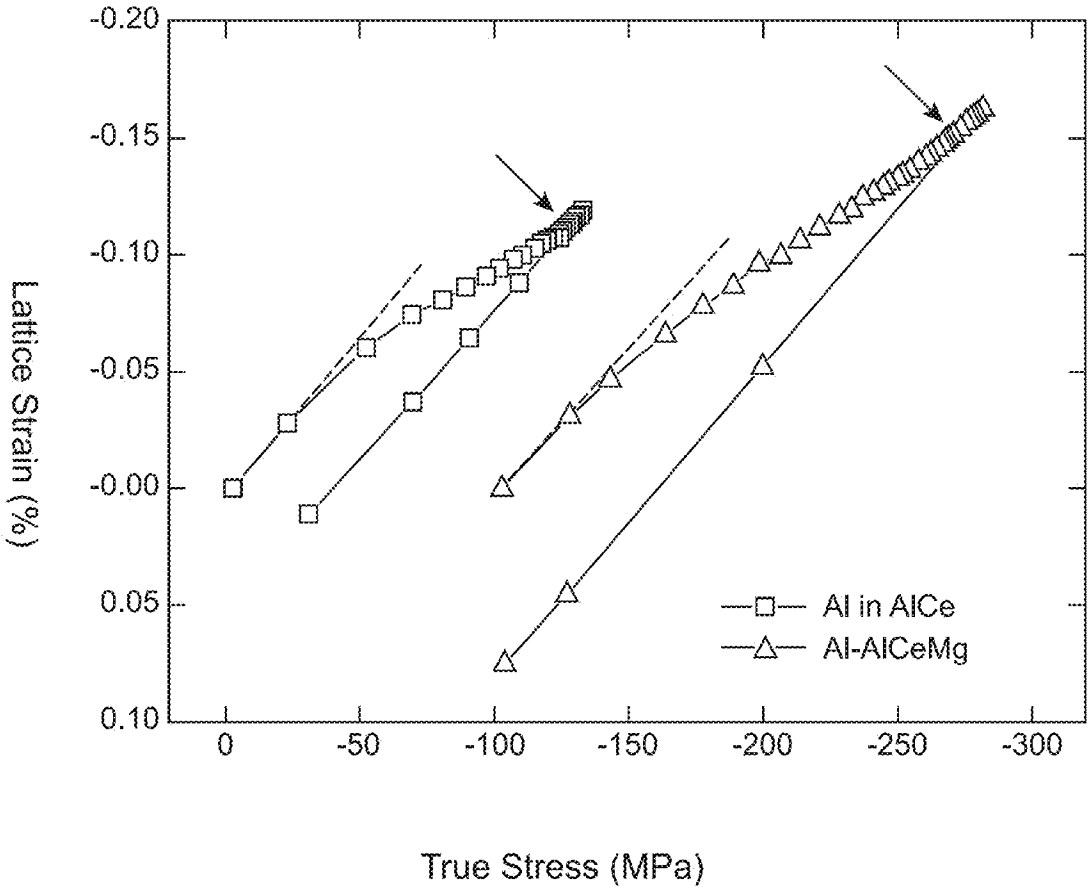
FIG. 115 is a graph showing neutron lattice strain measurements of Al-12Ce and Al-12Ce-0.4Mg performed under compressive load (offset for visibility).
Figure 116:
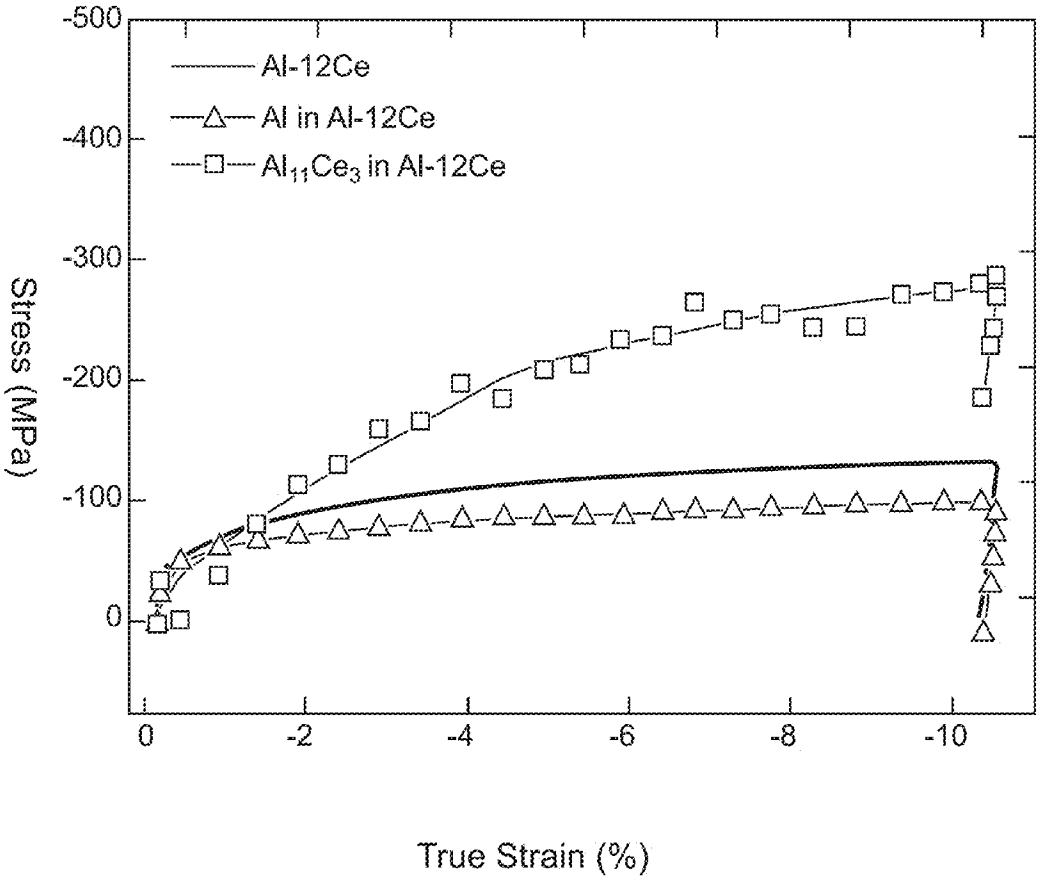
FIG. 116 is a graph showing neutron measurements of phase load-sharing for Al-12Ce under compressive load.
Figure 117:
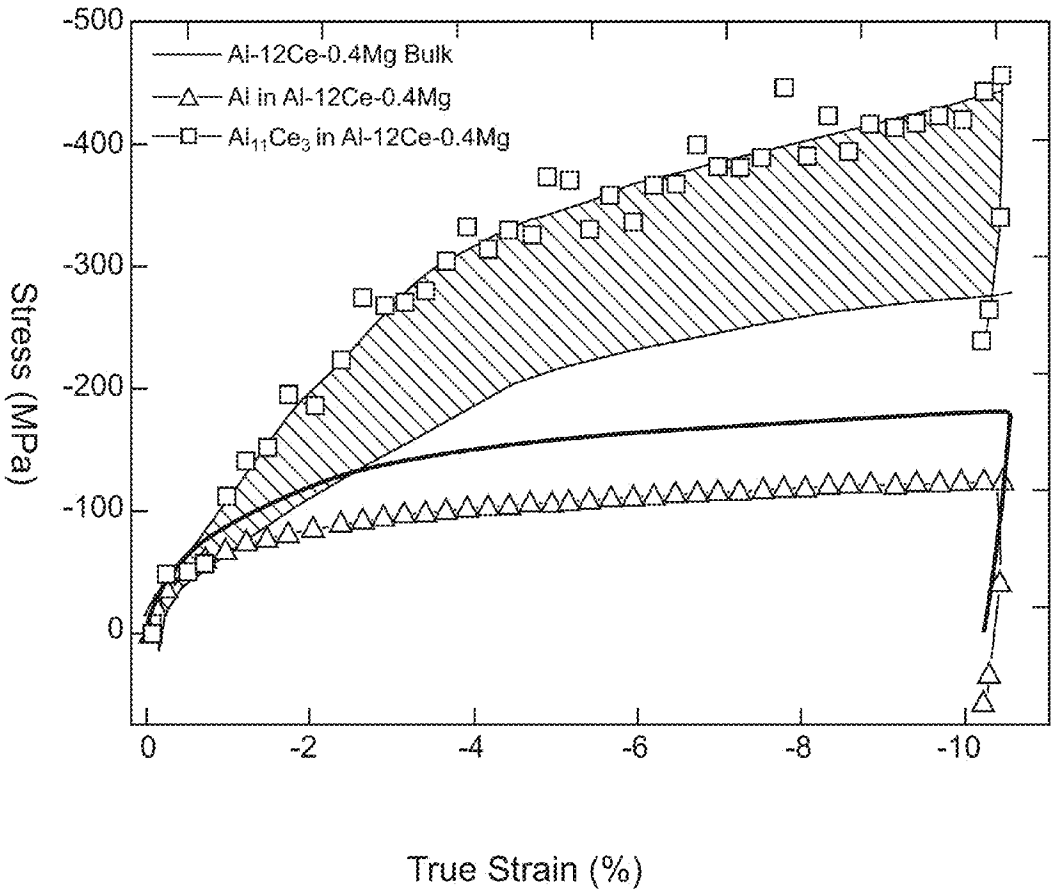
FIG. 117 is a graph showing neutron measurements of phase load-sharing for Al-12Ce-0.4Mg under compressive load.

FIG. 114 shows offset XRD spectra of Al-12Ce and Al-12Ce-0.4Mg with arbitrary offset; arrows denote Al (FCC) phase. FIG. 115 shows neutron lattice strain measurements of Al-12Ce and Al-12Ce-0.4Mg performed under compressive load (offset for visibility). FIG. 116 shows neutron measurements of phase load-sharing for Al-12Ce under compressive load. FIG. 117 shows neutron measurements of phase load-sharing for Al-12Ce-0.4Mg under compressive load; shaded region denotes area between binary and ternary alloy composition mechanical response.

Referring again to FIGS. 114-117, some of the largest increases in the mechanical properties combined with minimal addition of ternary elements have been observed in the Al—Ce—Mg family. Amounts of Mg as low as 0.4 wt % show drastic in-creases in the UTS of the alloys and nominal increases in yield. Neutron measurements have the capability to probe the interior and measure the phase-by-phase load sharing.

FIG. 114 shows the XRD spectra of the Al-12Ce and Al-12Ce-0.4Mg, both in the as-cast condition. The two spectra, which have been offset, are nearly identical showing very little detection in the aluminum peaks as resulting from the addition of Mg. The Al matrix with anomalous lattice strains is revealed in FIG. 115 as a three-stage behavior instead of a linear lattice strain versus stress dependence in conventional Al alloy. At stage I, the Al matrix deforms elastically under low stress (i.e. <50 MPa), in which the slope of the linear dependence is consistent with that at unloading. At Stage II, after an early yielding, the Al matrix shows a decelerated lat-tice strain response upon additional stress. At Stage III with high stress (designated by the arrows in sec-tion b) by further taking load in Al matrix, the slope of the lattice strain curve gradually recovers, with a tendency toward the original linear slope observed the elastic phase 1 region. The additional Mg doping slightly improves the strength of Al matrix, but the three-stage scenario remains. The abnormal behavior of Al matrix results from the complex load partition of the matrix and the minor intermetallic $Al_{11}Ce_3$ phase.

FIGS. 116, 117 show both Al matrix and $Al_{11}Ce_3$ phase share the stress at the beginning of loading. While Al matrix yields at 50 MPa, the $Al_{11}Ce_3$ intermetallic phase continues taking more stress than the Al matrix, and it exhibits a linear elastic response until the strain is 4%. Corresponding to Stage II where Al beings to exchange the load to the $Al_{11}Ce_3$ phase. When the $Al_{11}Ce_3$ phase starts to yield (or partially fracture), Stage III is triggered. The Al matrix starts to take on more stress, and the load partition rebalances between Al and $Al_{11}Ce_3$ at this stage. The Mg doping alters the load sharing between the two phases, leading to more micro-stress taken by the intermetallic phase and eventually the improvement of the strength the alloy. Due to the tangled two-phase coexistence and the complex load sharing, the residual stress in each phase is expected after unloading. It is revealed a significant compressive residual stress in the hard $Al_{11}Ce_3$ phase while a slight tensile one in the relatively soft Al matrix.

Figure 118:
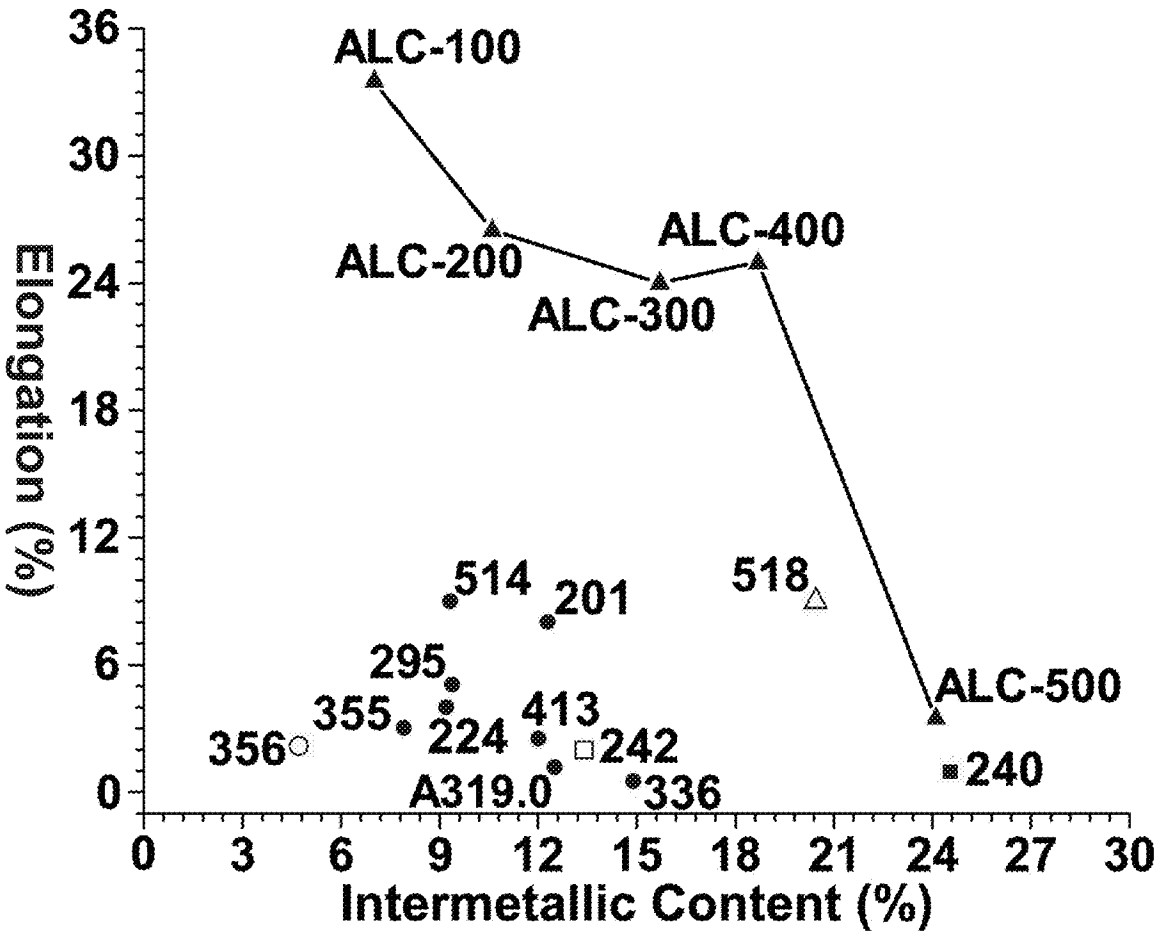
FIG. 118 is a graph showing elongation vs. intermetallic content, with Al—Ce alloys denoted with triangles connected by a line; conventional aluminum alloys are denoted with circles and stars.
Figure 119:
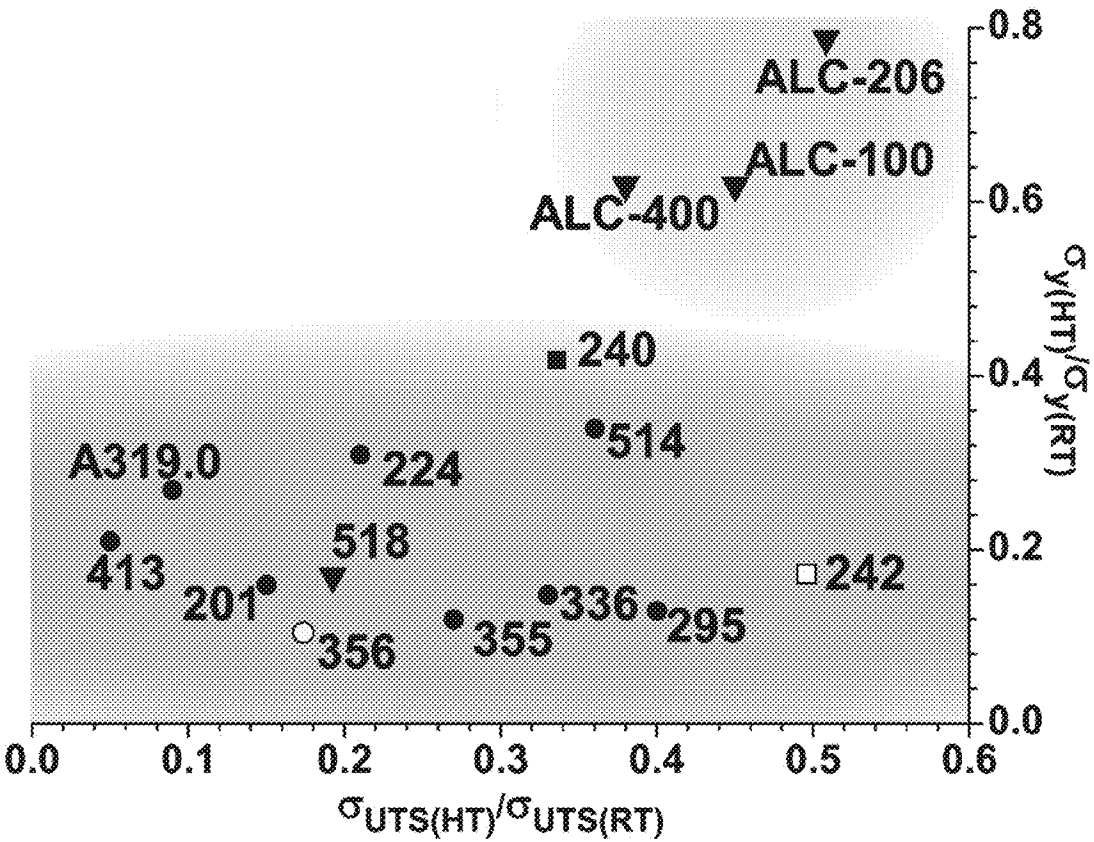
FIG. 119 is a plot showing yield vs tensile maintenance of various alloys at 300° C.
Figure 120:
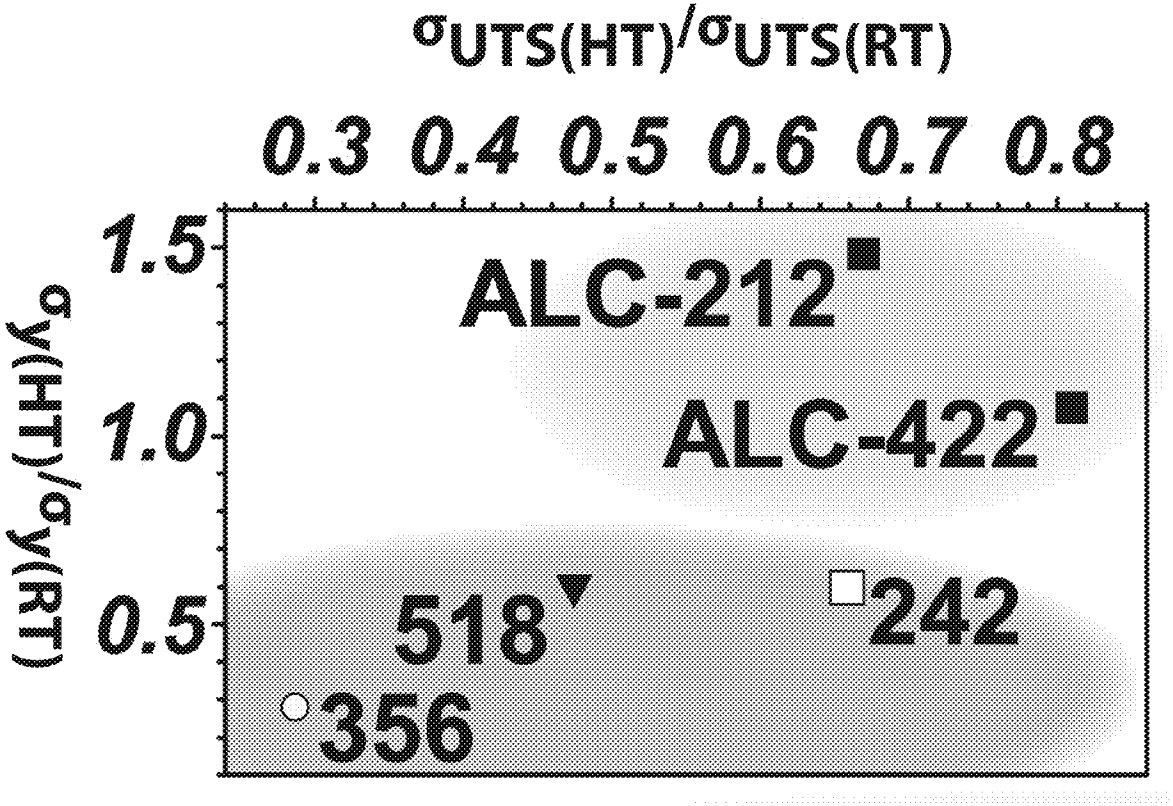

Further comparative illustrations are provided as follows: FIG. 118 shows elongation vs. intermetallic content, with Al—Ce alloys denoted with triangles connected by a line; conventional aluminum alloys are denoted with circles and stars. FIGS. 119 and 120 show yield vs tensile maintenance of various alloys at 300° C. and 200° C., respectively.

Figure 121:
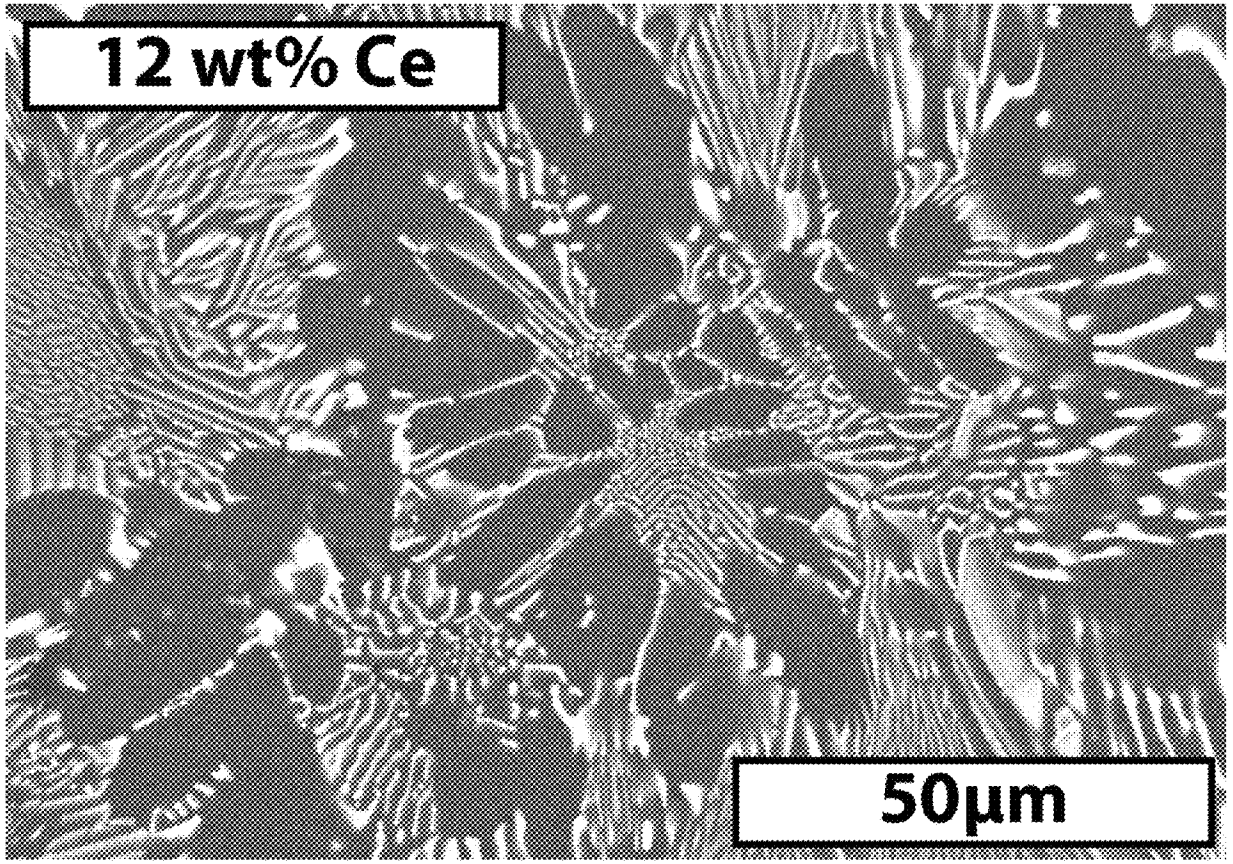
Figure 122:
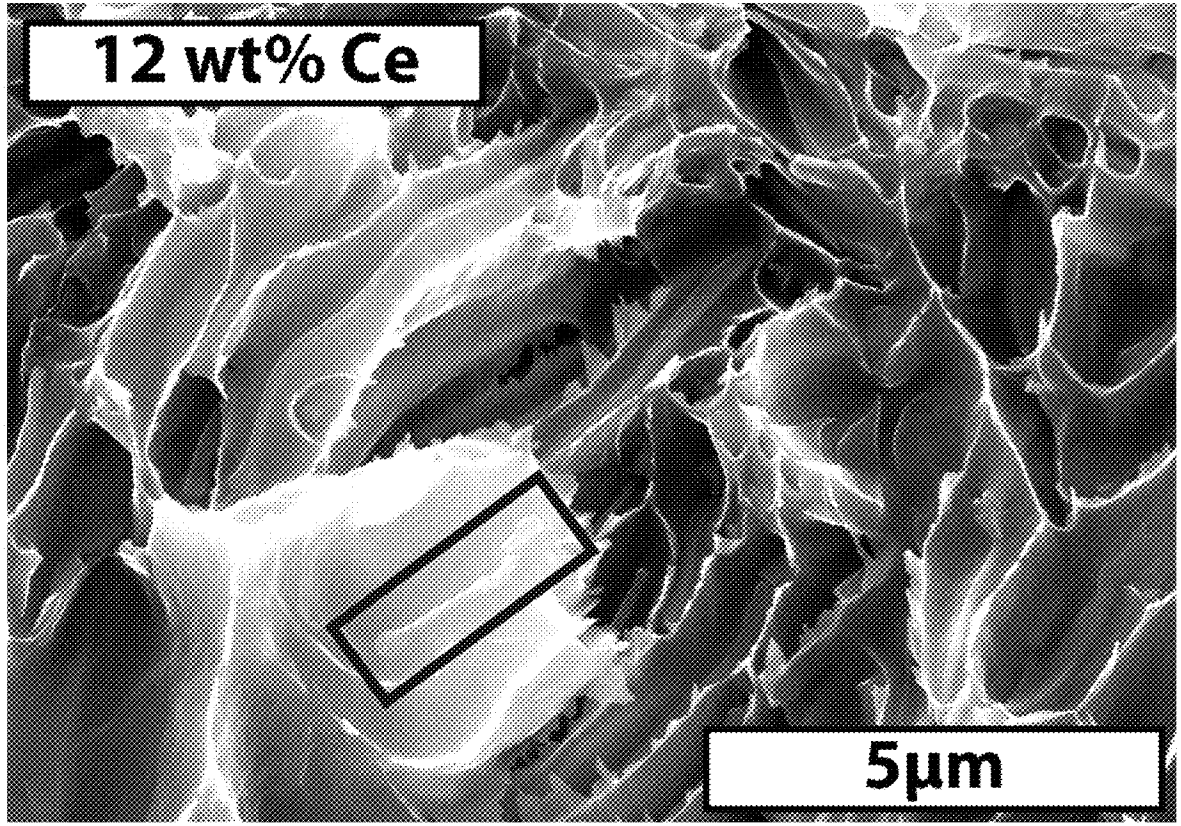
Figure 123:
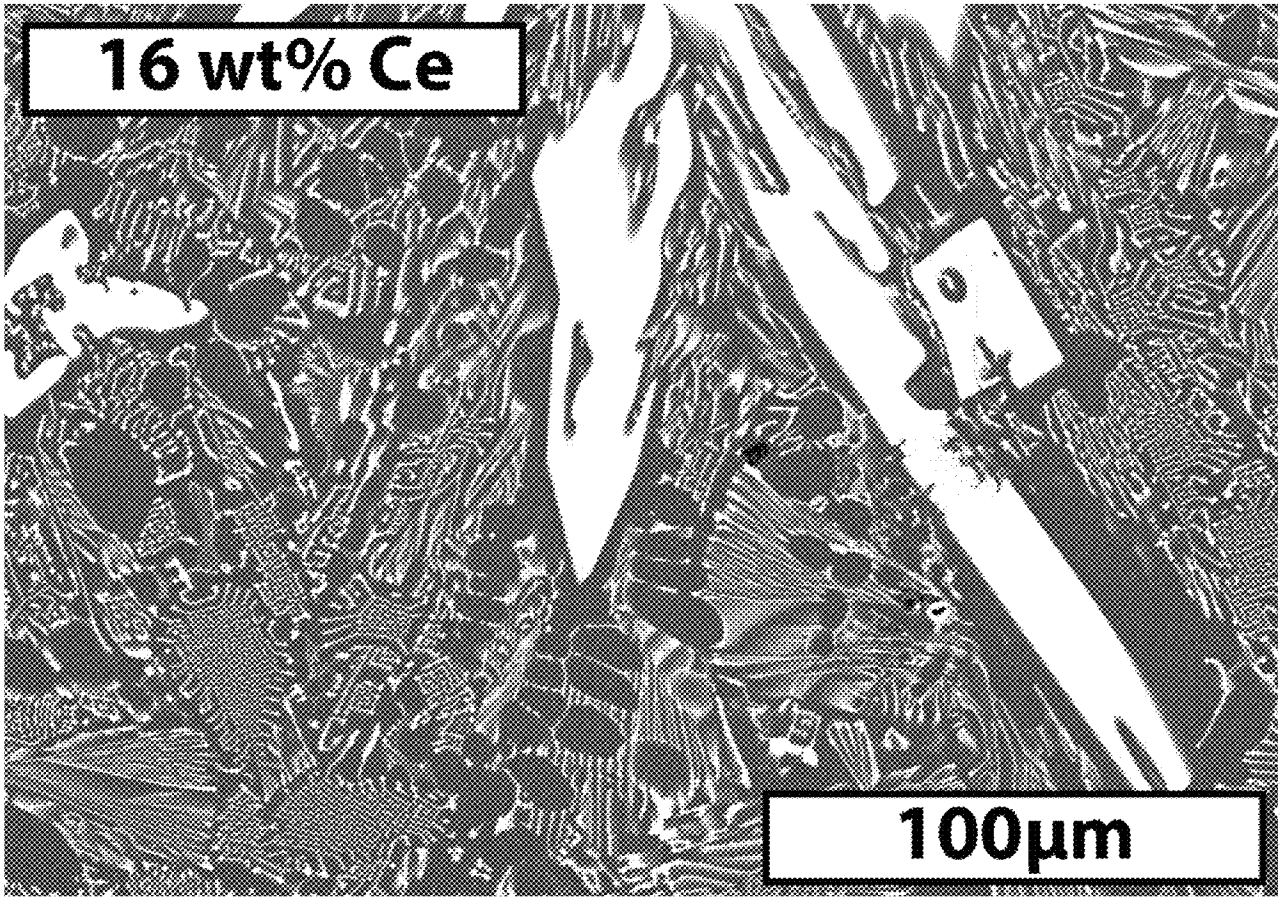
Figure 124:
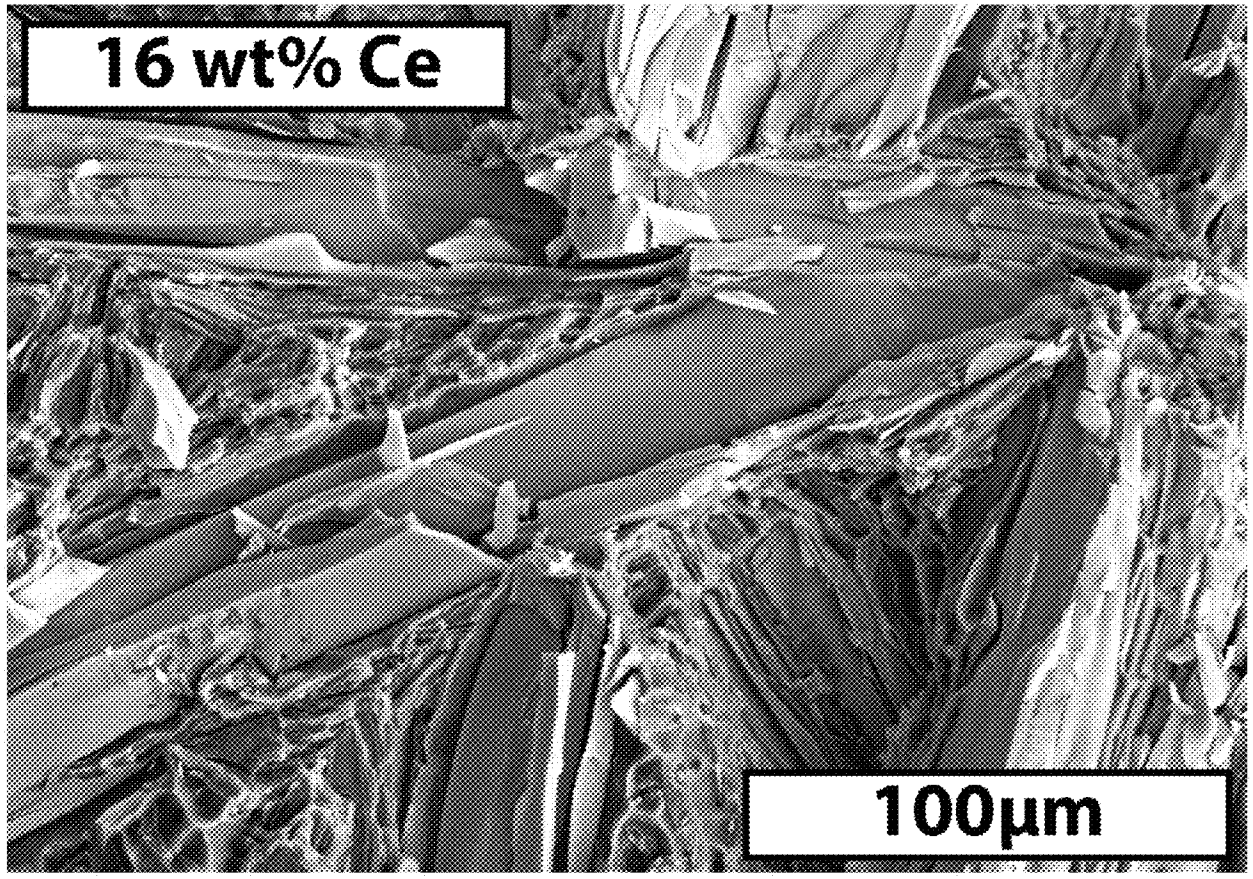

FIG. 121 is an SEM image of Al-12 wt % Ce in the as-cast condition. FIG. 122 is an SEM image of fracture surface of as-cast Al-12 wt % Ce. A box indicates the location of a Ce rich intermetallic lath which was fractured during tensile testing. FIG. 123 is an SEM image of Al-16 wt % Ce in the as-cast condition. FIG. 124 is an SEM image of fracture surface of as-cast Al-16 wt % Ce.

Heat treating cast Al—Ce alloys that contain Mg can reversibly transfer the Mg between the main phase $Al_{1-x}Mg_x$ and the intermetallic $(Ce_{1-y}Mg_y)_3(Al_{1-z}Mg_z)_{11}$. This is observed by thermal analysis, x-ray diffraction, and magnetization measurements. Similar behavior is seen in alloys that contain Al, Ce, Mg, and Zn.

Magnesium and Zn can be incorporated into the fcc-Al phase in the $Ce_3Al_{11}$ containing alloys. This is apparent from the behavior of the unit cell volume determined from x-ray diffraction shown in Table 17, which shows unit cell (u.c.) volumes of the $Ce_3Al_{11}$ intermetallic and the FCC—Al matrix phases determined by x-ray diffraction.

TABLE 17

| | Heat-treatment | $Ce_3Al_{11}$ u.c. volume (Å$^3$) | FCC-Al u.c. volume (Å$^3$) |
|---|---|---|---|
| Al—8Ce | As-cast | 576.51 | 66.484 |
| Al—8Ce—7Mg | As-cast | 574.92 | 68.265 |
| Al—8Ce—7Mg | 375° C. 120 h | 573.601 | 68.36 |
| Al—8Ce—7Mg | 475° C. 120 h | 574.35 | 68.226 |
| Al—8Ce—10Mg | As-cast | 576.553 | 68.717 |
| Al—8Ce—10Mg | 375° C. 120 h | 576.088 | 68.724 |
| Al—8Ce—10Mg | 475° C. 120 h | 576.297 | 68.547 |

Figure 125:
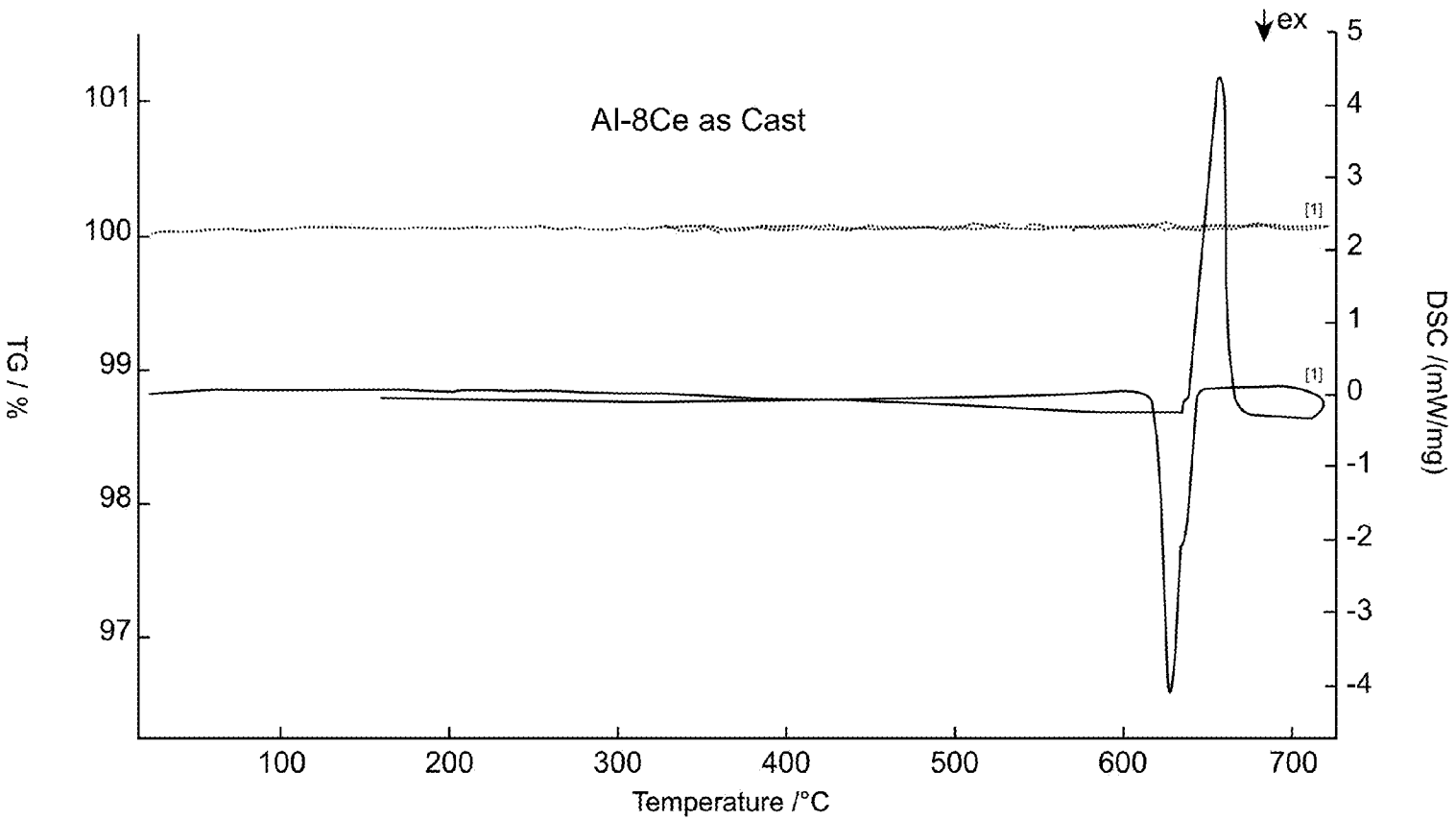
Figure 126:
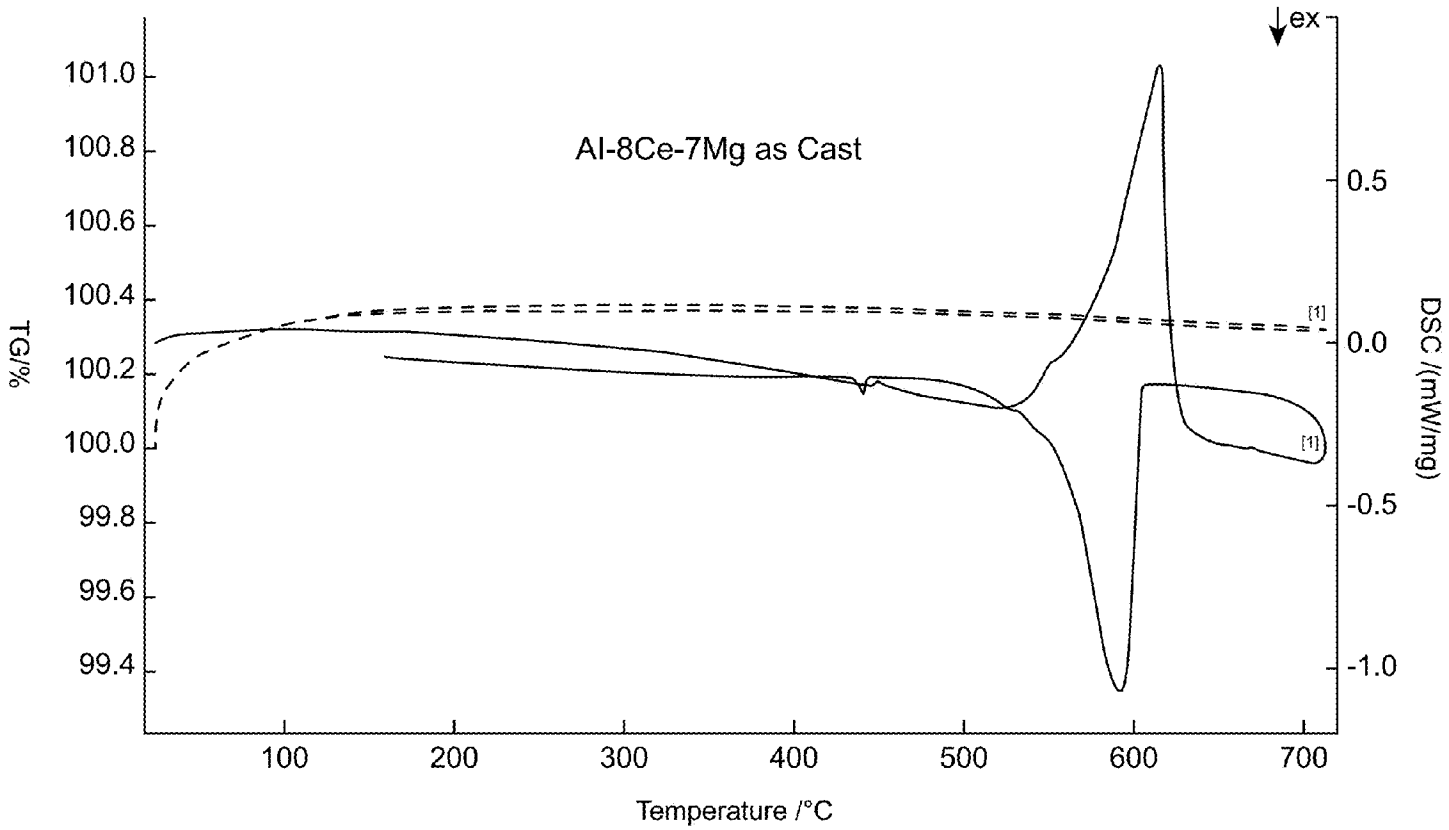
Figure 127:
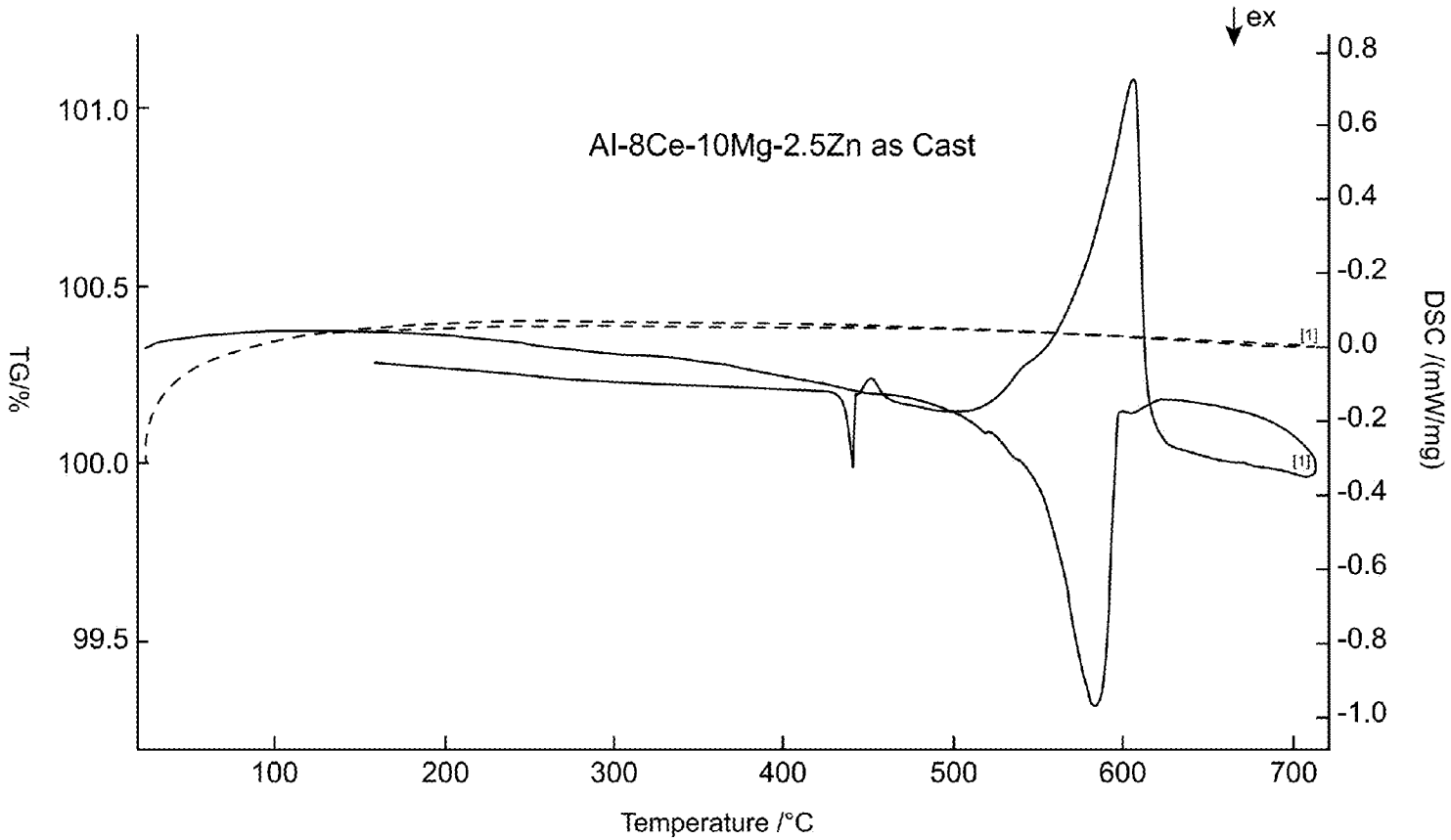

Referring to FIGS. 125-128, Thermal analysis of alloys that contain Al—Ce—Mg and Al—Ce—Mg—Zn shows and additional phase transition near 440° C. that is not observed in Al-8Ce. DSC and TG curves for Al-8C in FIG. 125 show melting near 660° C. DSC and TG curves for Al-8Ce-7Mg in FIG. 126 show melting near 600° C. and another reversible phase transition near 440° C. DSC and TG curves for Al-8Ce-10Mg-2.5Zn in FIG. 127 show melting near 600° C. and another reversible phase transition near 440° C.

Figure 128:
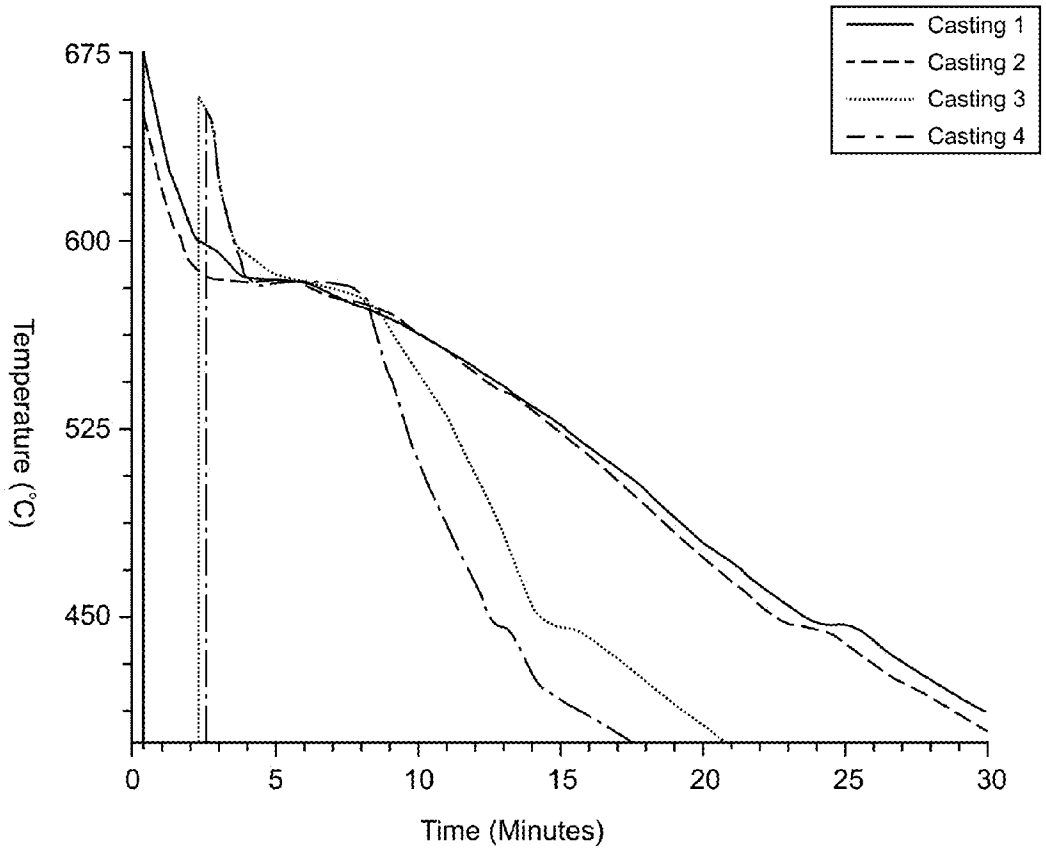

The thermal signature is present on both heating and cooling, indicating that this is a reversible phase transition. FIG. 128 shows cooling curves for four Al-8Ce-10Mg castings after heating to above the melting point. Strong thermal arrest is observed at the 440° C. phase transition, indicating the bulk nature of the transition. Magnetic and x-ray diffraction data shown below suggest this event is related to Mg reacting with the intermetallic at high temperature, removing some Mg from the fcc-Al phase and enriching the $Ce_3Al_{11}$ phase with Mg.

Figure 129:
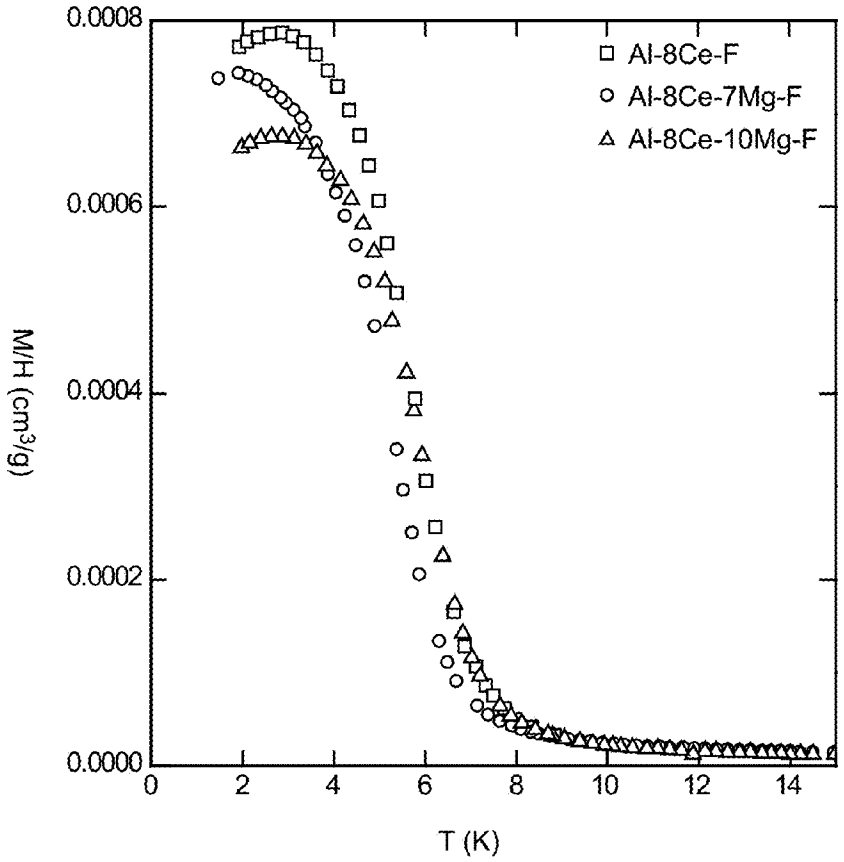

Referring to FIG. 129, magnetic behaviors of as-cast Al-8Ce and Al-8Ce-10Mg are very similar, but values for Al-8Ce-10Mg are lower by about 10-13% over the entire temperature range shown. Ferromagnetic transition temperature is the same in both.

As-cast Al-8Ce-7Mg shows a lower ferromagnetic ordering temperature, by about 1 K. This sample also does not show the downturn at low temperatures seen in the other, which corresponds to a ferromagnetic to antiferromagnetic transition reported in single crystals.

The magnetic data suggests the chemistry of the Al-8Ce-7Mg sample in the as-cast state is different than Al-8Ce and Al-8Ce-10Mg, which appear to be quite similar. This is consistent with the lattice parameter results shown above in Table 17, which give a smaller unit cell volume for Al-8Ce-7Mg (574.9 $Å^3$) vs Al-8Ce and Al-8Ce-10Mg (576.5 $Å^3$ and 576.6 $Å^3$, respectively).

Figure 130:
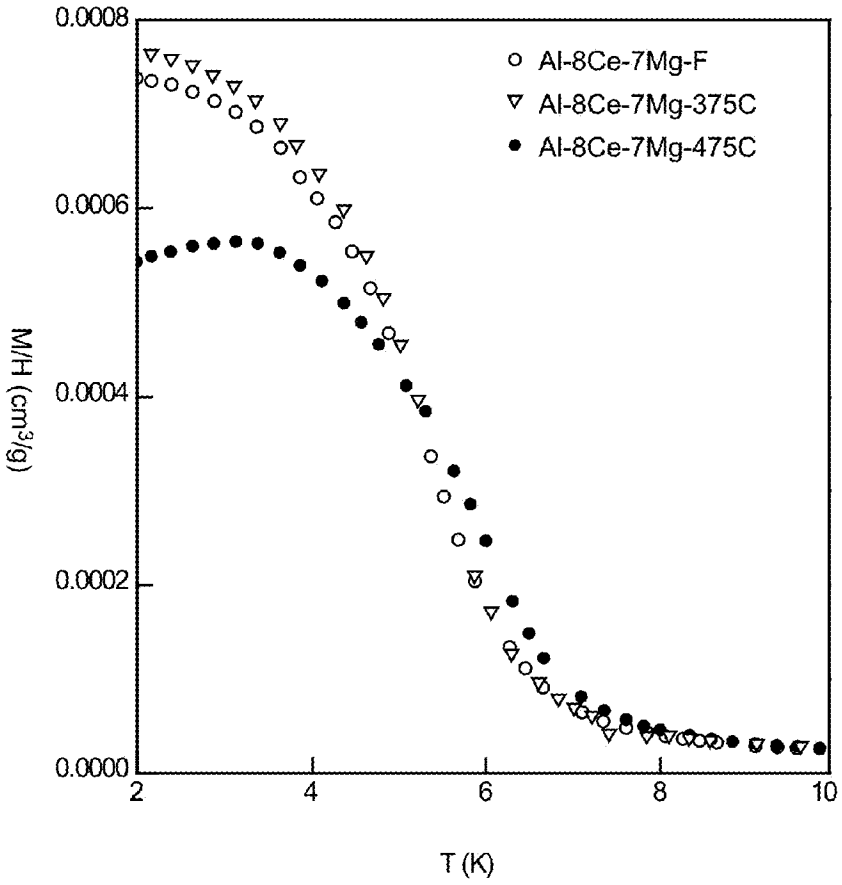
Figure 131:
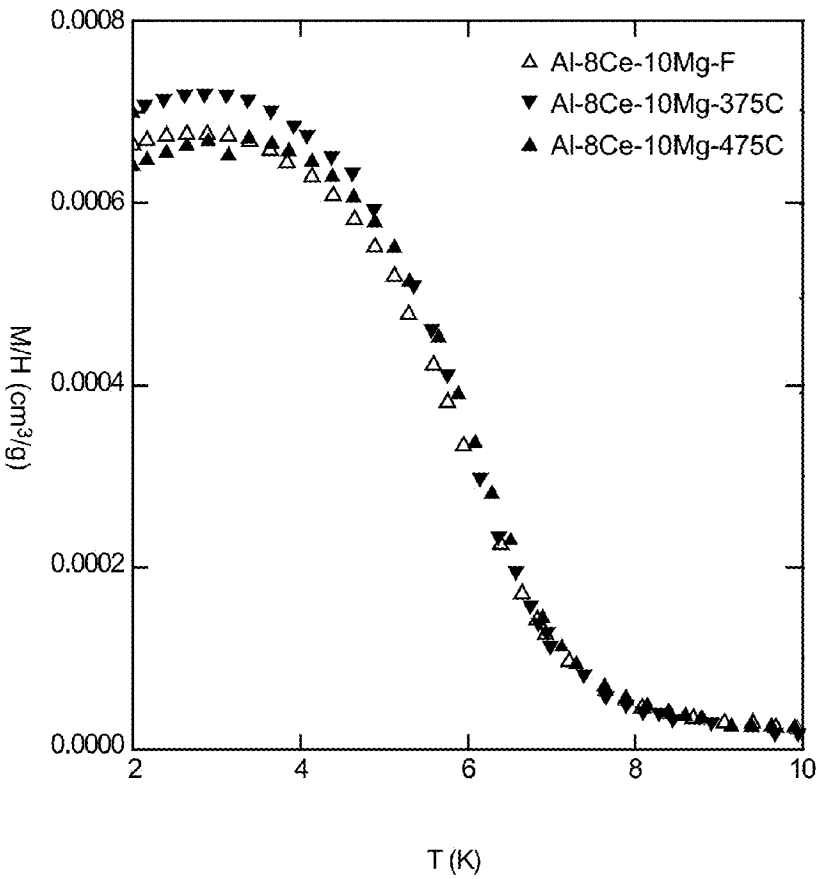

Results of annealing the as cast samples at 375° C. and 475° C. are shown in FIGS. 130 and 131; respectively. Measurements were performed upon cooling in a magnetic field of H=1 kOe. (Note that 1 $cm^3/g$=1 emu/Oe/g.)

Annealing at 375° C. has little influence on the magnetic behavior of either sample. Annealing at 475° C. has a strong effect on Al-8Ce-7Mg and little effect on Al-8Ce-10Mg. This is consistent with measured unit cell volume shown above in Table 17. Among as-cast, 375° C. annealed, and 475° C. annealed specimens, the cell volume changes little in Al-8Ce-10Mg (576.6 $Å^3$, 576.1 $Å^3$, 576.3 $Å^3$, respectively), but considerable changes are seen in Al-8Ce-7Mg (574.9 $Å^3$, 573.6 $Å^3$, 574.4 $Å^3$, respectively). Those changes suggest the chemical composition of the intermetallic phase can be changed with thermal treatment.

Evidence for these chemical composition variation is also seen in the FCC—Al phase in Table 17. Annealing at 475° C. results in a small reduction of the unit cell volume of this phase, suggesting a small fraction of the Mg migrates from the FCC—Al phase into the $Ce_3Al_{11}$ or another secondary phase at this temperature. Table 17 data indicates significant changes are seen in the $Ce_3Al_{11}$ phase unit cell volume during these thermal treatments as well.

Changes in the unit cell volume of the FCC—Al/Mg solid solution Al1-xMgx phase can be used to estimate the Mg concentration changes that occur during thermal treatment. FIG. 132 shows the linear dependence of the unit cell volume V on the Mg concentration obtained from literature reports for Al1-xMgx. The linear trend line shown in FIG. 132 is used to determine the Mg concentration x in the Al-8Ce-7Mg and Al-8Ce-10Mg samples using the unit cell volumes listed above in Table 17. Results are shown in FIG. 133.

Thus, an Al—Ce—Mg alloy has been made that includes an Al—Mg solid solution and $Ce_3Al_{11}$-based intermetallic in which the Mg can be made to move in and out of the Al—Mg phase by heat treating at temperatures above 300° C.

Moreover, an Al—Ce—Zn alloy has been made that includes an Al—Zn solid solution and $Ce_3Al_{11}$-based intermetallic in which the Zn can be made to move in and out of the Al—Zn phase by heat treating at temperatures above 300° C.

Moreover, an Al—Ce—Mg—Zn alloy has been made that includes an Al—Mg—Zn solid solution and $Ce_3Al_{11}$-based intermetallic in which the at least one of the Mg and the Zn can be made to move in and out of the Al—Mg—Zn phase by heat treating at temperatures above 300° C.

Any of the cast alloys described herein can have an eutectic microconstituent that comprises more than 10 volume percent of the microstructure, preferably at least 20 volume percent of the microstructure. A eutectic microconstituent is element of the microstructure having a distinctive lamellar or rod structure consisting on two or more phases that form through coupled growth from the liquid phase. The eutectic constituent forms through an isothermal invariant reaction involving the co-precipitation and growth of two or more phases with a distinct composition. In the examples discussed here the relevant phases are the FCC Al phase with space group FM-3M, the orthorhombic $Al_{11}Ce_3$ phase with space group IMMM, the body centered tetragonal CeAlSi phase with space group I41MD, the primitive cubic phase NiAl with space group PM-3M and the face centered Si phase with the Fd-3m space group. Typically, intermetallics precipitates in an Al matrix that are larger than 5 um do not effectively transfer load to the matrix phase and do not result in effective strengthening of the alloy. Additionally, intermetallics will decrease the ductility of the material related toughness. The formation of the said intermetallic as a phase or phases within the eutectic microconstituent with the specified dimensions leads to effective load transfer between the intermetallic and Al phase that comprise the eutectic microconstituent. This enables strengthening of the alloy while maintaining high ductility and toughness. In particular, FIGS. 125-127 show isothermal invariant reactions that demonstrate the presence of the described eutectic microconstituent. FIG. 25 shows about 75% of the described eutectic microconstituent. FIG. 105 shows about 80% of the described eutectic microconstituent. FIGS. 35 and 37 show a little more than about 10% of the described eutectic microconstituent, which is about the minimum acceptable for the compositions described herein.

Moreover, any of the cast alloys described herein can have a strengthening $Al_{11}X_3$ intermetallic phase in an amount in the range of from about 5 to about 30 weight percent, from about 5 to about 20 weight percent, from about 6 to about 16 weight percent, or from about 8 to about 12 weight percent. Moreover, Any of the cast alloys described herein can include up to about 7 weight percent of an element selected from the group consisting of silicon and zinc, up to about 5 weight percent of an element selected from the group consisting of iron, titanium, zirconium, and vanadium, and up to about 8 weight percent of at least one element selected from the group consisting of copper and nickel. Moreover, Any of the cast alloys described herein can include up to about 20 weight percent magnesium, preferably up to about 15 weight percent, or up to about 12 weight percent.

Any of the cast alloys described herein can have a room-temperature ductility of at least 1%, at least 5%, at least 10%, or at least 20%. Moreover, any of the cast alloys described herein may retain at least 60% of its room-temperature tensile yield strength and at least 60% of its ultimate tensile strength at about 200° C., and may retain at least 50% of its room-temperature tensile yield strength and at least 30% of its ultimate tensile strength at about 300° C. Moreover, any of the cast alloys described herein may retain at least 80% of its room temperature tensile yield strength and at least 80% of its ultimate tensile strength at room temperature after being held at about 50° C. for 40 hours.

Moreover, in any of the cast alloys described herein, the lath or rod spacing and thickness may not increase by more than 20% after being held at about 550° C. for 40 hours. Moreover, in any of the cast alloys described herein, the lath or rod spacing and thickness may not increase by more than 20% after being held at about 400° C. for 40 hours.

Any of the cast alloys described herein may have a castability rating of at least 3. Moreover, any of the cast alloys described herein may exhibit an anti-ferromagnetic transition at a temperature between 2K and 12K, or between 4K and 10K. Moreover, any of the cast alloys described herein may include a rare-earth containing surface oxide. Moreover, any of the cast alloys described herein may exhibit a solid state transformation and associated exothermic thermal signature at a temperature between 250 and 500° C.

Any of the cast alloys described herein may exhibit a complex load sharing relationship between an Al face-centered-cubic phase and the strengthening $Al_{11}X_3$ inter-metallic phase, the complex load sharing relationship characterized by a three-stage deformation mechanism that includes load partitioning preference to the strengthening $Al_{11}X_3$ inter-metallic, and wherein, in a first stage, both of the Al face-centered-cubic phase and the strengthening $Al_{11}X_3$ inter-metallic phase deform elastically, in a second stage, the Al face-centered-cubic phase deforms plastically and the strengthening $Al_{11}X_3$ inter-metallic phase deforms elastically, and in a third stage, the Al face-centered-cubic phase and the strengthening $Al_{11}X_3$ inter-metallic phase deforming plastically, load sharing relationship characterized by a common tangent between the first stage and the second stage, the transition from the elastic to the plastic deformation in the Al face-centered-cubic phase having an onset at no less than 0.025 lattice strain, or no less than 0.05 lattice strain.

FIGS. 138, 139 show high and low magnification images respectively of Al-12Ce alloy cast under slow cooling rates with a binary eutectic microstructure. The lath and rod diameters can reach 700 nm and spacing between laths can be as large as 10 um. FIGS. 140, 141 show high and low magnification images respectively of Al-12Ce alloy cast under rapid cooling rates with a binary eutectic microstructure. The lath and rod diameters can be as small as 75 nm and spacing between laths and rods can be as small as 150 nm Alloy 206 was re-alloyed to make a new alloy comprising up to about 0.1 weight percent Si, up to about 0.15 weight percent Fe, about 4.2-5.0 weight percent Cu, about 0.2-0.5 weight percent Mn, about 0.15-0.35 weight percent Mg, up to about 0.05 weight percent Ni, up to about 0.1 weight percent, about 0.15-0.30 weight percent Ti, from about 6 to about 30 wt weight percent of at least one material selected from the group consisting of cerium, lanthanum, and mischmetal, up to about 0.15 weight percent total other impurities, and balance aluminum.

Alloy 356 is re-alloyed to make a new alloy comprising about 6.5-7.5 weight percent Si, up to about 0.6 weight percent Fe, up to about 0.25 weight percent Cu, up to about 0.35 weight percent Mn, about 0.20-0.45 weight percent Mg, up to about 0.35 weight percent Zn, up to about 0.25 weight percent Ti, from about 6 to about 30 wt weight percent of at least one material selected from the group consisting of cerium, lanthanum, and mischmetal, up to about 0.15 weight percent total other impurities, and balance aluminum.

Alloy 319 is re-alloyed to make a new alloy comprising about 5.5-6.5 weight percent Si, about 1 weight percent Fe, about 3.0-4.0 weight percent Cu, about 0.5 weight percent Mn, up to about 0.1 weight percent Mg, up to about 1 weight percent Zn, up to about 0.25 weight percent Ti, from about 6 to about 30 wt weight percent of either Cerium lanthanum Mischmetal or any mixture of the three, up to about 0.15 weight percent total other impurities, and balance aluminum.

Alloy 535 is re-alloyed to make a new alloy comprising up to about 0.15 weight percent Si, up to about 0.15 weight percent Fe, up to about 0.05 weight percent Cu, about 0.1-0.25 weight percent Mn, about 6.2-7.5 weight percent Mg, about 0.10-0.25 weight percent Ti, from about 6 to about 30 wt weight percent of at least one material selected from the group consisting of cerium, lanthanum, and mischmetal, up to about 0.15 weight percent total other impurities, and balance aluminum.

Alloy 206 was diluted to make a new alloy comprising up to about 0.1 weight percent Si, up to about 0.15 weight percent Fe, about 4.2-5.0 weight percent about Cu, 0.2-0.5 weight percent Mn, about 0.15-0.35 weight percent Mg, up to about 0.05 weight percent Ni, up to about 0.1 weight percent, about 0.15-0.30 weight percent Ti, up to about 0.15 weight percent total other impurities, and balance aluminum, to which from about 6 to about 30 weight percent of at least one material selected from the group consisting of cerium, lanthanum, and mischmetal is added.

Alloy 356 is diluted to make a new alloy comprising about 6.5-7.5 weight percent Si, up to about 0.6 weight percent Fe, up to about 0.25 weight percent Cu, up to about 0.35 weight percent Mn, about 0.20-0.45 weight percent Mg, up to about 0.35 weight percent Zn, up to about 0.25 weight percent Ti, up to about 0.15 weight percent total other impurities, and balance aluminum, to which from about 6 to about 30 weight percent of at least one material selected from the group consisting of cerium, lanthanum, and mischmetal is added.

Alloy 319 is diluted to make a new alloy comprising about 5.5-6.5 weight percent Si, about 1 weight percent Fe, about 3.0-4.0 weight percent Cu, about 0.5 weight percent Mn, up to about 0.1 weight percent Mg, up to about 1 weight percent Zn, up to about 0.25 weight percent Ti, up to about 0.15 weight percent total other impurities, and balance aluminum, to which from about 6 to about 30 weight percent of at least one material selected from the group consisting of cerium, lanthanum, and mischmetal is added.

Alloy 535 is diluted to make a new alloy comprising up to about 0.15 weight percent Si, up to about 0.15 weight percent Fe, up to about 0.05 weight percent Cu, about 0.1-0.25 weight percent Mn, about 6.2-7.5 weight percent Mg, about 0.10-0.25 weight percent Ti, up to about 0.15 weight percent total other impurities, and balance aluminum, to which from about 6 to about 30 weight percent of at least one material selected from the group consisting of cerium, lanthanum, and mischmetal is added.

Any of the cast compositions described hereinabove can be made by the respective casting processes described hereinbelow.

Referring to FIGS. 134*a*, 134*b*, a first process for casting an Al—Ce alloy is carried out as follows:

Step 1: Aluminum is heated to a molten state, which is to be understood throughout the specification as being heated to a temperature suitable for pouring. At this point, any desired additional alloying elements, including silicon, zinc, iron, titanium, zirconium, vanadium, magnesium, copper, and nickel, but excluding cerium, lanthanum, and mischmetal, can be added to the melt.

Step 2: Degassing (generally rotary degassing) is performed using a reactive gas such as, for example, nitrous oxide (N.O.S.) in order to purge the melt of undesirable dissolved materials.

Step 3: The reactive gas is replaced with a non-reactive gas such as, for example, argon or nitrogen. Purging is continued until the reactive gas is removed and the melt exceeds 90% theoretical density.

Step 4: The melt is fluxed with an alkaline based flux to remove dissolved gases and undesirable solids. If the theoretical density does not exceed 90% at this point, then repeat Steps 3 and 4. If the theoretical density does not exceed 70% at this point, then it may be beneficial to repeat Steps 2, 3 and 4. When the theoretical density exceeds 90%, continue to Step 5.

Step 5: Cerium, lanthanum, and/or mischmetal is added to the melt; heating continues until the temperature returns to the desired pouring temperature.

Step 6: Degassing is performed using a non-reactive gas.

Step 7: The melt is fluxed with an alkaline based flux to remove dissolved gases and undesirable solids. If the theoretical density does not exceed 90% at this point, then repeat Steps 6 and 7. When the theoretical density exceeds 90%, continue to Step 8.

Step 8: The melt can be held under alkaline based flux or a cover gas until ready to pour.

Step 9: The melt is poured (transferred) into a casting mold.

Referring to FIGS. 135*a*, 135*b*, 135*c*, a second process for casting an Al—Ce alloy is carried out as follows:

Step 1: Aluminum is heated to a molten state—to a temperature suitable for pouring.

Step 2: Degassing (generally rotary degassing) is performed using a reactive gas such as, for example, nitrous oxide (N.O.S.) in order to purge the melt of undesirable dissolved materials.

Step 3: The reactive gas is replaced with a non-reactive gas such as, for example, argon or nitrogen. Purging is continued until the reactive gas is removed. If the theoretical density does not exceed 90% at this point, then repeat Step 3. If the theoretical density does not exceed 70% at this point, then it may be beneficial to repeat Steps 2 and 3. When the theoretical density exceeds 90%, continue to Step 4.

Step 4: Cerium is added to the melt; heating continues until the temperature returns to the desired pouring temperature.

Step 5: Degassing is performed using a non-reactive gas.

Step 6: The melt is fluxed with an alkaline based flux to remove dissolved gases and undesirable solids. If the theoretical density does not exceed 90% at this point, then repeat Steps 5 and 6. When the theoretical density exceeds 90%, continue to Step 7.

Step 7: Any desired additional alloying elements, including silicon, zinc, iron, titanium, zirconium, vanadium, magnesium, copper, and nickel, but excluding cerium, lanthanum, and mischmetal, can be added.

Step 8: Degassing is performed using a non-reactive gas.

Step 9: The melt is fluxed with an alkaline based flux to remove dissolved gases and undesirable solids. If the theoretical density does not exceed 90% at this point, then repeat Steps 8 and 9. When the theoretical density exceeds 90%, continue to Step 10.

Step 10: The melt can be held under alkaline based flux or a cover gas until ready to pour.

Step 11: The melt is poured (transferred) into a casting mold.

Referring to FIGS. 136*a*, 136*b*, 136*c*, a first process for casting an Al—Ce—Mg—Zn alloy is carried out as follows:

Step 1: Aluminum is heated to a molten state—to a temperature suitable for pouring. At this point, any desired additional alloying elements, including silicon, iron, titanium, zirconium, vanadium, copper, and nickel, but excluding cerium, magnesium, and zinc, can be added to the melt.

Step 2: Degassing (generally rotary degassing) is performed using a reactive gas such as, for example, nitrous oxide (N.O.S.) in order to purge the melt of undesirable dissolved materials.

Step 3: The melt is fluxed with an alkaline based flux to remove dissolved gases and undesirable solids. If the theoretical density does not exceed 90% at this point, then repeat Steps 2 and 3. When the theoretical density exceeds 90%, continue to Step 5.

Step 4: Magnesium and/or zinc are added to the melt; heating continues until the temperature returns to the desired pouring temperature.

Step 5: Degassing (generally rotary degassing) is performed using a reactive gas such as, for example, nitrous oxide (N.O.S.) in order to purge the melt of undesirable dissolved materials.

Step 6: The reactive gas is replaced with a non-reactive gas such as, for example, argon or nitrogen. Purging is continued until the reactive gas is removed.

Step 7: The melt is fluxed with an alkaline based flux to remove dissolved gases and undesirable solids. If the theoretical density does not exceed 90% at this point, then repeat Steps 6 and 7. If the theoretical density does not exceed 70% at this point, then it may be beneficial to repeat Steps 5, 6 and 7. When the theoretical density exceeds 90%, continue to Step 8.

Step 8: Cerium is added to the melt; heating continues until the temperature returns to the desired pouring temperature.

Step 9: Degassing (generally rotary degassing) is performed using a non-reactive gas such as, for example, argon or nitrogen.

Step 10: The melt is fluxed with an alkaline based flux to remove dissolved gases and undesirable solids. If the theoretical density does not exceed 90% at this point, then repeat Step 10. When the theoretical density exceeds 90%, continue to Step 11.

Step 11: The melt can be held under alkaline based flux or a cover gas until ready to pour.

Step 12: The melt is poured (transferred) into a casting mold.

Referring to FIGS. 137*a*, 137*b*, 137*c*, a second process for casting an Al—Ce—Mg—Zn alloy is carried out as follows:

Step 1: Aluminum is heated to a molten state—to a temperature suitable for pouring. At this point, any desired additional alloying elements, including silicon, iron, titanium, zirconium, vanadium, copper, and nickel, but excluding cerium, magnesium, and zinc, can be added to the melt.

Step 2: Degassing (generally rotary degassing) is performed using a reactive gas such as, for example, nitrous oxide (N.O.S.) in order to purge the melt of undesirable dissolved materials.

Step 3: The reactive gas is replaced with a non-reactive gas such as, for example, argon or nitrogen. Purging is continued until the reactive gas is removed.

Step 4: The melt is fluxed with an alkaline based flux to remove dissolved gases and undesirable solids. If the theoretical density does not exceed 90% at this point, then repeat Steps 2, 3 and 4. When the theoretical density exceeds 90%, continue to Step 5.

Step 5: Cerium is added to the melt; heating continues until the temperature returns to the desired pouring temperature.

Step 6: Degassing (generally rotary degassing) is performed using a non-reactive gas such as, for example, argon or nitrogen.

Step 7: The melt us fluxed with an alkaline based flux to remove dissolved gases and undesirable solids. If the theoretical density does not exceed 90% at this point, then repeat Steps 6 and 7. When the theoretical density exceeds 90%, continue to Step 8.

Step 8: Magnesium and/or zinc are added to the melt; heating continues until the temperature returns to the desired pouring temperature.

Step 9: Degassing (generally rotary degassing) is performed using a non-reactive gas such as, for example, argon or nitrogen.

Step 10: The melt is fluxed with an alkaline based flux to remove dissolved gases and undesirable solids. If the theoretical density does not exceed 90% at this point, then repeat Steps 9 and 10. When the theoretical density exceeds 90%, continue to Step 11.

Step 11: The melt can be held under alkaline based flux or a cover gas until ready to pour.

Step 12: The melt is poured (transferred) into a casting mold.

Heat-treating can follow any of the casting methods described hereinabove. Moreover, such heat treatment can include ASTM T6 heat treatment.

While there has been shown and described what are at present considered to be examples of the invention, it will be obvious to those skilled in the art that various changes and modifications can be prepared therein without departing from the scope of the inventions defined by the appended claims.

What is claimed is:

1. A cast alloy comprising: aluminum and from about 5 to about 30 weight percent of at least one material selected from the group consisting of cerium, lanthanum, and mischmetal, said cast alloy having a strengthening $Al_{11}X_3$ intermetallic phase in an amount in the range of from about 5 to about 30 weight percent, wherein X is at least one material selected from the group consisting of cerium, lanthanum, and mischmetal, said $Al_{11}X_3$ intermetallic phase having a microstructure comprising at least one morphological feature selected from the group consisting of lath features and rod features, said morphological features having an average thickness of no more than 700 um and an average spacing of no more than 10 um, said microstructure further comprising an eutectic microconstituent that comprises more than about 10 volume percent of said microstructure.

2. A cast alloy in accordance with claim 1 wherein said eutectic microconstituent comprises at least about 20 volume percent of said microstructure.

3. A cast alloy in accordance with claim 1 wherein said alloy comprises from about 5 to about 20 weight percent of said material.

4. A cast alloy in accordance with claim 3 wherein said alloy comprises from about 6 to about 16 weight percent of said material.

5. A cast alloy in accordance with claim 4 wherein said alloy comprises from about 8 to about 12 weight percent of said material.

6. A cast alloy in accordance with claim 1 further comprising up to about 7 weight percent of an element selected from the group consisting of silicon and zinc.

7. A cast alloy in accordance with claim 1 further comprising up to about 5 weight percent of an element selected from the group consisting of iron, titanium, zirconium, and vanadium.

8. A cast alloy in accordance with claim 1 further comprising up to about 12 weight percent magnesium.

9. A cast alloy in accordance with claim 1 further comprising up to about 8 weight percent of at least one element selected from the group consisting of copper and nickel.

10. A cast alloy in accordance with claim 1 wherein said alloy has a room-temperature ductility of at least 1%.

11. A cast alloy in accordance with claim 10 wherein said alloy has a room-temperature ductility of at least 5%.

12. A cast alloy in accordance with claim 11 wherein said alloy has a room-temperature ductility of at least 10%.

13. A cast alloy in accordance with claim 12 wherein said alloy has a room-temperature ductility of at least 20%.

14. A cast alloy in accordance with claim 1 wherein said alloy retains at least 60% of its room-temperature tensile yield strength and at least 60% of its ultimate tensile strength at about 200° C.

15. A cast alloy in accordance with claim 1 wherein said alloy retains at least 50% of its room-temperature tensile yield strength and at least 30% of its ultimate tensile strength at about 300° C.

16. A cast alloy in accordance with claim 1 wherein said alloy retains at least 80% of its room temperature tensile yield strength and at least 80% of its ultimate tensile strength at room temperature after being held at about 550° C. for 40 hours.

17. A cast alloy in accordance with claim 1 wherein said spacing and thickness do not increase by more than 20% after being held at about 550° C. for 40 hours.

18. A cast alloy in accordance with claim 1 wherein said spacing and thickness do not increase by more than 20% after being held at about 400° C. for 40 hours.

19. A cast alloy in accordance with claim 1 having a castability rating of at least 3.

20. A cast alloy in accordance with claim 1 wherein said alloy exhibits an anti-ferromagnetic transition at a temperature between 2K and 12K.

21. A cast alloy in accordance with claim 20 wherein said alloy exhibits an anti-ferromagnetic transition at a temperature between 4K and 10K.

22. A cast alloy in accordance with claim 1 further comprising a rare-earth containing surface oxide.

23. A cast alloy in accordance with claim 1 wherein said alloy exhibits a solid state transformation and associated exothermic thermal signature at a temperature between about 250 and about 500° C.

24. A cast alloy in accordance with claim 1 wherein said alloy exhibits a complex load sharing relationship between an Al face-centered-cubic phase and said strengthening $Al_{11}X_3$ inter-metallic phase, said complex load sharing relationship characterized by a three-stage deformation mechanism that includes load partitioning preference to said strengthening $Al_{11}X_3$ inter-metallic, and wherein, in a first stage, both of said Al face-centered-cubic phase and said strengthening $Al_{11}X_3$ inter-metallic phase deform elastically, in a second stage, said Al face-centered-cubic phase deforms plastically and said strengthening $Al_{11}X_3$ inter-metallic phase deforms elastically, and in a third stage, said Al face-centered-cubic phase and said strengthening $Al_{11}X_3$ inter-metallic phase deforming plastically, load sharing relationship characterized by a common tangent between said first stage and said second stage, a transition from said elastic to said plastic deformation in the Al face-centered-cubic phase having an onset at no less than about 0.025 lattice strain.

25. A cast alloy in accordance with claim 24 wherein said transition has an onset at no less than about 0.05 lattice strain.

26. A cast alloy in accordance with claim 1 further comprising up to about 0.1 weight percent Si, up to about 0.15 weight percent Fe, about 4.2-5.0 weight percent Cu, about 0.2-0.5 weight percent Mn, about 0.15-0.35 weight percent Mg, up to about 0.05 weight percent Ni, up to about 0.1 weight percent, about 0.15-0.30 weight percent Ti, from about 6 to about 30 wt weight percent of at least one material selected from the group consisting of cerium, lanthanum, and mischmetal, up to 0.15 weight percent total other impurities, and balance aluminum.

27. A cast alloy in accordance with claim 1 further comprising 6.5-7.5 weight percent Si, up to 0.6 weight percent Fe, up to 0.25 weight percent Cu, up to 0.35 weight percent Mn, 0.20-0.45 weight percent Mg, up to 0.35 weight percent Zn, up to 0.25 weight percent Ti, from about 6 to about 30 wt weight percent of at least one material selected from the group consisting of cerium, lanthanum, and mischmetal, up to about 0.15 weight percent total other impurities, and balance aluminum.

28. A cast alloy in accordance with claim 1 further comprising about 5.5-6.5 weight percent Si, 1 weight percent Fe, about 3.0-4.0 weight percent Cu, about 0.5 weight percent Mn, up to about 0.1 weight percent Mg, up to about 1 weight percent Zn, up to about 0.25 weight percent Ti, from about 6 to about 30 wt weight percent of either Cerium lanthanum Mischmetal or any mixture of the three, up to about 0.15 weight percent total other impurities, and balance aluminum.

29. A cast alloy in accordance with claim 1 further comprising up to about 0.15 weight percent Si, up to about 0.15 weight percent Fe, up to about 0.05 weight percent Cu, about 0.1-0.25 weight percent Mn, about 6.2-7.5 weight percent Mg, about 0.10-0.25 weight percent Ti, from about 6 to about 30 wt weight percent of at least one material selected from the group consisting of cerium, lanthanum, and mischmetal, up to about 0.15 weight percent total other impurities, and balance aluminum.

30. A cast alloy in accordance with claim 1 further comprising up to about 0.1 weight percent Si, up to about 0.15 weight percent Fe, about 4.2-5.0 weight percent Cu, about 0.2-0.5 weight percent Mn, about 0.15-0.35 weight percent Mg, up to about 0.05 weight percent Ni, up to about 0.1 weight percent, about 0.15-0.30 weight percent Ti, up to about 0.15 weight percent total other impurities, and balance aluminum, to which from about 6 to about 30 weight percent of at least one material selected from the group consisting of cerium, lanthanum, and mischmetal is added.

31. A cast alloy in accordance with claim 1 further comprising about 6.5-7.5 weight percent Si, up to about 0.6 weight percent Fe, up to about 0.25 weight percent Cu, up to about 0.35 weight percent Mn, about 0.20-0.45 weight percent Mg, up to about 0.35 weight percent Zn, up to about 0.25 weight percent Ti, up to about 0.15 weight percent total other impurities, and balance aluminum, to which from about 6 to about 30 weight percent of at least one material selected from the group consisting of cerium, lanthanum, and mischmetal is added.

32. A cast alloy in accordance with claim 1 further comprising about 5.5-6.5 weight percent Si, about 1 weight percent Fe, about 3.0-4.0 weight percent Cu, about 0.5 weight percent Mn, up to about 0.1 weight percent Mg, up to about 1 weight percent Zn, up to about 0.25 weight percent Ti, up to about 0.15 weight percent total other impurities, and balance aluminum, to which from about 6 to about 30 weight percent of at least one material selected from the group consisting of cerium, lanthanum, and mischmetal is added.

33. A cast alloy in accordance with claim 1 further comprising up to about 0.15 weight percent Si, up to about 0.15 weight percent Fe, up to about 0.05 weight percent Cu, about 0.1-0.25 weight percent Mn, about 6.2-7.5 weight percent Mg, about 0.10-0.25 weight percent Ti, up to about 0.15 weight percent total other impurities, and balance aluminum, to which from about 6 to about 30 weight percent of at least one material selected from the group consisting of cerium, lanthanum, and mischmetal is added.

34. A method of making a cast alloy comprising the steps of:

a. heating preselected amounts of aluminum and at least one additional alloying element selected from the group consisting of silicon, zinc, iron, titanium, zirconium, vanadium, magnesium, copper, and nickel to a molten state to form a melt;
b. degassing said melt with a reactive gas in order to purge said melt of undesirable dissolved materials and bring the melt to greater than 90% theoretical density;
c. further degassing said melt with a nonreactive gas to remove the reactive gas;
d. fluxing said melt with an alkaline based flux to remove dissolved gases and undesirable solids;
e. testing theoretical density of said melt, and if the theoretical density:
   i. does not exceed 70% theoretical density, repeat steps b, c, d, and e;
   ii. exceeds 70% theoretical density, but does not exceed 90% theoretical density, repeat steps c, d, and e;
   iii. exceeds 90% theoretical density, go to step f;
f. adding to said melt a preselected amount of at least one material selected from the group consisting of cerium, lanthanum, and mischmetal;
g. degassing said melt with a nonreactive gas;
h. fluxing said melt with an alkaline based flux to remove dissolved gases and undesirable solids;
j. testing theoretical density of said melt, and if the theoretical density:
   i. does not exceed 90% theoretical density, repeat steps g, h, and j;
   ii. exceeds 90% theoretical density, go to step k; and
k. transferring said melt into a casting mold to form a cast alloy comprising: aluminum and from about 5 to about 30 weight percent of at least one material selected from the group consisting of cerium, lanthanum, and mischmetal, said cast alloy having a strengthening $Al_{11}X_3$ intermetallic phase in an amount in the range of from about 5 to about 30 weight percent, wherein X is at least one material selected from the group consisting of cerium, lanthanum, and mischmetal, said $Al_{11}X_3$ intermetallic phase having a microstructure comprising at least one morphological feature selected from the group consisting of lath features and rod features, said features having an average thickness of no more than 700 um and an average lath spacing of no more than 10 um, said microstructure further comprising an eutectic microconstituent that comprises more than about 10 volume percent of said microstructure.

35. A method of making a cast alloy in accordance with claim 34 further comprising an additional step, preceding step k, of holding said melt under alkaline based flux or a cover gas.

36. A method of making a cast alloy in accordance with claim 34 further comprising an additional step, after step k, of heat-treating said cast alloy.

37. A method of making a cast alloy in accordance with claim 36 wherein said heat-treating step comprises ASTM T6 heat treatment.

38. A method of making a cast alloy comprising the steps of:

a. heating a predetermined amount of aluminum;
b. degassing said melt with a reactive gas in order to purge said melt of undesirable dissolved materials;
c. further degassing said melt with a nonreactive gas to remove the reactive gas;
d. testing theoretical density of said melt, and if the theoretical density:
  i. does not exceed 70% theoretical density, repeat steps c and d;
  ii. exceeds 70% theoretical density, but does not exceed 90% theoretical density, repeat steps b, c, and d;
  iii. exceeds 90% theoretical density, go to step f;
e. adding to said melt a predetermined amount of at least one material selected from the group consisting of cerium, lanthanum, and mischmetal;
f. degassing said melt with a nonreactive gas;
g. fluxing said melt with an alkaline based flux to remove dissolved gases and undesirable solids;
h. testing theoretical density of said melt, and if the theoretical density:
  i. does not exceed 90% theoretical density, repeat steps f, g, and h;
  ii. exceeds 90% theoretical density, go to step j;
j. adding a predetermined amount of at least one additional alloying element selected from the group consisting of silicon, zinc, iron, titanium, zirconium, vanadium, magnesium, copper, and nickel to said melt;
k. degassing said melt with a nonreactive gas;
l. fluxing said melt with an alkaline based flux to remove dissolved gases and undesirable solids;
m. testing theoretical density of said melt, and if the theoretical density:
  i. does not exceed 90% theoretical density, repeat steps k, l and m;
  ii. exceeds 90% theoretical density, go to step n; and
n. transferring said melt into a casting mold to form a cast alloy comprising: aluminum and from about 5 to about 30 weight percent of at least one material selected from the group consisting of cerium, lanthanum, and mischmetal, said cast alloy having a strengthening $Al_{11}X_3$ intermetallic phase in an amount in the range of from about 5 to about 30 weight percent, wherein X is at least one material selected from the group consisting of cerium, lanthanum, and mischmetal, said $Al_{11}X_3$ intermetallic phase having a microstructure comprising at least one morphological feature selected from the group consisting of lath features and rod features, said features having an average thickness of no more than 700 um and an average lath spacing of no more than 10 um, said microstructure further comprising an eutectic microconstituent that comprises more than about 10 volume percent of said microstructure.

39. A method of making a cast alloy in accordance with claim 38 further comprising an additional step, preceding step n, of holding said melt under alkaline based flux or a cover gas.

40. A method of making a cast alloy in accordance with claim 38 further comprising an additional step, after step n, of heat-treating said cast alloy.

41. A method of making a cast alloy in accordance with claim 40 wherein said heat-treating step comprises ASTM T6 heat treatment.

42. A method of making a cast alloy comprising the steps of:

a. heating predetermined amounts of aluminum and at least one additional alloying element selected from the group consisting of silicon, iron, titanium, zirconium, vanadium, copper, and nickel to a molten state to form a melt;
b. degassing said melt with a reactive gas in order to purge said melt of undesirable dissolved materials;
c. fluxing said melt with an alkaline based flux to remove dissolved gases and undesirable solids;
d. testing theoretical density of said melt, and if the theoretical density:
  i. does not exceed 90% theoretical density, repeat steps b, c, and d;
  ii. exceeds 90% theoretical density, go to step e;
e. adding to said melt a predetermined amount of at least one material selected from the group consisting of magnesium and zinc;
f. degassing said melt with a reactive gas in order to purge said melt of undesirable dissolved materials;
g. further degassing said melt with a nonreactive gas to remove the reactive gas;
h. fluxing said melt with an alkaline based flux to remove dissolved gases and undesirable solids;
j. testing theoretical density of said melt, and if the theoretical density:
  i. does not exceed 70% theoretical density, repeat steps f, g, h, and j;
  ii. exceeds 70% theoretical density, but does not exceed 90% theoretical density, repeat steps g, h, and j;
  iii. exceeds 90% theoretical density, go to step k;
k. adding to said melt a predetermined amount of at least one material selected from the group consisting of cerium, lanthanum, and mischmetal;
l. degassing said melt with a nonreactive gas;
m. fluxing said melt with an alkaline based flux to remove dissolved gases and undesirable solids;
n. testing theoretical density of said melt, and if the theoretical density:
  i. does not exceed 90% theoretical density, repeat steps l, m and n;
  ii. exceeds 90% theoretical density, go to step o; and
o. transferring said melt into a casting mold to form a cast alloy comprising: aluminum, up to about 12 weight percent magnesium, up to about 7 weight percent zinc, and from about 5 to about 30 weight percent of at least one material selected from the group consisting of cerium, lanthanum, and mischmetal, said cast alloy having a strengthening $Al_{11}X_3$ intermetallic phase in an amount in the range of from about 5 to about 30 weight percent, wherein X is at least one material selected from the group consisting of cerium, lanthanum, and mischmetal, said $Al_{11}X_3$ intermetallic phase having a microstructure comprising at least one morphological feature selected from the group consisting of lath features and rod features, said features having an average thickness of no more than 700 um and an average lath spacing of no more than 10 um, said microstructure further comprising an eutectic microconstituent that comprises more than about 10 volume percent of said microstructure.

43. A method of making a cast alloy in accordance with claim 42 further comprising an additional step, preceding step o, of holding said melt under alkaline based flux or a cover gas.

44. A method of making a cast alloy in accordance with claim 42 further comprising an additional step, after step o, of heat-treating said cast alloy.

45. A method of making a cast alloy in accordance with claim 44 wherein said heat-treating step comprises ASTM T6 heat treatment.

46. A method of making a cast alloy comprising the steps of:

a. heating predetermined amounts of aluminum and at least one additional alloying element selected from the group consisting of silicon, iron, titanium, zirconium, vanadium, copper, and nickel to a molten state to form a melt;

b. degassing said melt with a reactive gas in order to purge said melt of undesirable dissolved materials;

c. fluxing said melt with an alkaline based flux to remove dissolved gases and undesirable solids;

d. testing theoretical density of said melt, and if the theoretical density:

i. does not exceed 90% theoretical density, repeat steps b, c, and d;

ii. exceeds 90% theoretical density, go to step e;

e. adding to said melt a predetermined amount of at least one material selected from the group consisting of cerium, lanthanum, and mischmetal;

f. degassing said melt with a nonreactive gas;

g. fluxing said melt with an alkaline based flux to remove dissolved gases and undesirable solids;

h. testing theoretical density of said melt, and if the theoretical density:

i. does not exceed 90% theoretical density, repeat steps f, g, and h;

ii. exceeds 90% theoretical density, go to step j;

j. adding to said melt a predetermined amount of at least one material selected from the group consisting of magnesium and zinc;

k. degassing said melt with a nonreactive gas;

l. fluxing said melt with an alkaline based flux to remove dissolved gases and undesirable solids;

m. testing theoretical density of said melt, and if the theoretical density:

i. does not exceed 90% theoretical density, repeat steps k, l and m;

ii. exceeds 90% theoretical density, go to step n; and n. transferring said melt into a casting mold to form a cast alloy comprising: aluminum, up to about 12 weight percent magnesium, up to about 7 weight percent zinc, and from about 5 to about 30 weight percent of at least one material selected from the group consisting of cerium, lanthanum, and mischmetal, said cast alloy having a strengthening $Al_{11}X_3$ intermetallic phase in an amount in the range of from about 5 to about 30 weight percent, wherein X is at least one material selected from the group consisting of cerium, lanthanum, and mischmetal, said $Al_{11}X_3$ intermetallic phase having a microstructure comprising at least one morphological feature selected from the group consisting of lath features and rod features, said features having an average thickness of no more than 700 um and an average lath spacing of no more than 10 um, said microstructure further comprising an eutectic microconstituent that comprises more than about 10 volume percent of said microstructure.

47. A method of making a cast alloy in accordance with claim 46 further comprising an additional step, preceding step o, of holding said melt under alkaline based flux or a cover gas.

48. A method of making a cast alloy in accordance with claim 46 further comprising an additional step, after step o, of heat-treating said cast alloy.

49. A method of making a cast alloy in accordance with claim 48 wherein said heat-treating step comprises ASTM T6 heat treatment.

* * * * *